US006051359A

United States Patent [19]

Ohkawa et al.

[11] Patent Number: 6,051,359

[45] Date of Patent: Apr. 18, 2000

[54] HEAT DEVELOPABLE LIGHT-SENSITIVE MATERIAL AND METHOD OF FORMING COLOR IMAGES

[75] Inventors: Atsuhiro Ohkawa; Hiroo Takizawa; Shun-ichi Ishikawa; Takuya Yokokawa, all of Kanagawa, Japan

[73] Assignee: Fuji Photo Film Co., Ltd., Kanagawa, Japan

[21] Appl. No.: 08/978,631

[22] Filed: Nov. 25, 1997

[30] Foreign Application Priority Data

| | | | |
|---|---|---|---|
| Nov. 25, 1996 | [JP] | Japan | 8-329123 |
| Nov. 25, 1996 | [JP] | Japan | 8-329124 |
| Jan. 27, 1997 | [JP] | Japan | 9-027166 |
| Oct. 2, 1997 | [JP] | Japan | 9-286137 |

[51] Int. Cl.[7] ..... G03C 8/00; G03C 8/40

[52] U.S. Cl. ..... 430/203; 430/350; 430/510; 430/522; 430/546; 430/619

[58] Field of Search ..... 430/619, 567, 430/203, 350, 955, 510, 522, 546

[56] References Cited

U.S. PATENT DOCUMENTS

| | | | |
|---|---|---|---|
| 4,435,501 | 3/1984 | Maskasky | 430/434 |
| 4,439,520 | 3/1984 | Kofron et al. | 430/434 |
| 4,500,630 | 2/1985 | Sato et al. | 430/386 |
| 4,540,654 | 9/1985 | Sato et al. | 430/381 |
| 5,238,798 | 8/1993 | Usami | 430/522 |
| 5,250,403 | 10/1993 | Antoniades et al. | 430/505 |
| 5,264,337 | 11/1993 | Maskasky | 430/567 |
| 5,292,632 | 3/1994 | Maskasky | 430/567 |
| 5,310,635 | 5/1994 | Szajewski | 430/496 |

FOREIGN PATENT DOCUMENTS

| | | |
|---|---|---|
| 0 479 167A1 | 4/1992 | European Pat. Off. . |
| 0 502 508A1 | 9/1992 | European Pat. Off. . |
| 63-223643 | 9/1998 | Japan . |
| WO 94/22054 | 9/1994 | WIPO . |

*Primary Examiner*—Thorl Chea

*Attorney, Agent, or Firm*—Sughrue, Mion, Zinn Macpeak & Seas, PLLC

[57] ABSTRACT

The present invention provides a heat-developable light-sensitive material having a support and a light-sensitive layer provided on the support. The heat-developable light-sensitive material contains dyes which are decolorized through reaction with a decolorizing agent during a development process. The dyes are non-diffusible and at least a part of decolorized dyes resulting from the development process is non-diffusible. Also provided is an image forming method using the heat-developable light-sensitive material. The present method provides images having excellent sharpness within a short period of time.

15 Claims, No Drawings

HEAT DEVELOPABLE LIGHT-SENSITIVE MATERIAL AND METHOD OF FORMING COLOR IMAGES

BACKGROUND OF THE INVENTION

1. Field of the Invention

The present invention relates to a novel heat-developable light-sensitive material containing decolorizable dyes and having excellent decolorizeation performance and storability.

The present invention also relates to a method of forming color images which provides excellent color differentiation and sharpness.

The present invention further relates to a method of forming color images readily and quickly through a heat development process.

2. Description of the Related Art

A silver halide light-sensitive material is characterized by high light sensitivity and by providing high-definition images. However, because of use of processing solutions having a complex composition, a development process for this material involves adverse effect on the environment and complicated solution control. In recent years, there have been developed and sold heat-developable dye-transfer type light-sensitive materials which can readily and quickly form high-quality color images through use of a small amount of water and application of heat without use of development-processing solute well as image-forming apparatuses which make use of such light-sensitive materials (PICTROGRAPHY 2000 and 3000 and PICTROSTAT 100 and 200 manufactured by Fuji Photo Film Co., Ltd.). Also, heat-developable, silver-salt-diffusion-transfer type light-sensitive materials are described in Japanese Patent Application Laid-Open (JP-A) Nos. 62-283332 and 63-198050. However, it has been found that images formed from such diffusion-transferred dyes or silver do not have sufficiently satisfactory sharpness in certain uses such as color negatives and plate-making intermediate materials.

Meanwhile, colloidal silver or filter dyes have been used for the purpose of improving color differentiation and sharpness. However, since colloidal silver forms fog nuclei, it must be isolated from a silver halide emulsion layer, thus incurring an increase in overall layer thickness due to employment of an additional intermediate layer(s). Thus, the effect of use of colloidal silver is greatly reduced. Filter dyes which have conventionally been used are eluted into a processing solution or cause decolorizeation. When such filter dyes are applied to a heat-developable light-sensitive material, they, together with image-forming dyes, are transferred onto a dye-fixing material, or cause image contamination due to insufficient decolorizeation. Further, in a system in which a light-sensitive material is heat-developed with a small amount of water being applied thereto, water-soluble dyes, when used, are eluted into the water and contaminate the water. Accordingly, the water cannot be used repeatedly.

An image-forming method which solves the above problems is disclosed in JP-A No. 6-337511. In this method, water-insoluble organic pigments are dispersed in a light-sensitive material in the form of solid fine grains, and the light-sensitive material is heat-developed in the presence of water. Since no organic pigments are transferred to a dye-fixing material, dye images are not contaminated. However, when certain sharpness is to be achieved as described above, transferred images are not usable, and thus there is no choice but to use images formed on the light-sensitive material. This is not preferred, since water-insoluble organic pigments remain on the light-sensitive material.

To solve the above problem, a method of forming images through use of solid dispersion dyes is disclosed in JP-A No. 8-101487. However, this method has been found to involve the following problems: part of dyes are solubilized and move during storage of a light-sensitive material; and the reactivity between couplers and color developing agents deteriorates.

JP-A No. 9-146247 discloses a system in which substances color-developed by leuco dyes and color developers are decolorized by alkali during a development process. This system exhibits excellent decolorizeation, but requires a large amount of color developers. Thus, this system consumes alkali so that the reactivity between couplers and color developing agents deteriorates.

For simple, quick processing without use of processing solutions or with minimized use of processing solutions, the present inventors studied a method in which an exposed light-sensitive material is used while it is unfixed. As a result, this method has been found to involve the following problems: the color differentiation of green light and red light from blue light is insufficient due to the insufficient difference between the intrinsic sensitivity of silver halide contained in a blue-light-sensitive layer and that of green-light-sensitive and red-light-sensitive layers; sharpness is impaired due to halation during photographing; and image quality is impaired due to optical scattering caused by remaining silver halide. To solve these problems, the present inventors have found a method in which coloring dyes having a certain structure are introduced into a light-sensitive material, and in addition, a silver halide emulsion which contains tabular grains primarily having (100) and (111) major faces with high silver chloride content is used.

A photographic silver halide light-sensitive material must have high sensitivity. Sensitivity is effectively increased by increasing the sensitivity of silver halide grains or the amount of application of silver halide.

As a technique for applying the advantage of quick development of an emulsion with high silver chloride content to a photographic light-sensitive material, a technique for using in a photographic light-sensitive material an emulsion containing tabular grains having (100) major faces with high silver chloride content is disclosed in U.S. Pat. Nos. 5,264,337, 5,292,632, and 5,310,635 and WO 94/22,054. An emulsion with high silver chloride content was used to obtain a high developing speed, and the same processing solutions can be used for processing both photographic light-sensitive materials and printing light-sensitive materials. However, these publications do not mention the incorporation of certain coloring dyes into a light-sensitive material.

Also, according to Japanese Patent Application Publication (JP-B) No. 7-120014, a heat-developable light-sensitive material exhibits high sensitivity and less fogging through use of silver halide grains having (100) major faces and having such an aspect that the length of one side is at least two times or at most 0.5 times an arithmetic mean of lengths of two other sides. However, these methods do not provide improved picture quality, particularly improved sharpness.

Silver chloride tabular grains having (100) major faces are also described in various other publications; for example, U.S. Pat. No. 5,314,798, EP-534,395A, EP-617,321A, EP-617,317A, EP-617,318A, EP-617,325A, Wo 94/22,051, EP-616,255A, U.S. Pat. Nos. 5,356,764, 5,320,938, and 5,275,930.

Tabular grains having (111) major faces are described in various publications, for example, U.S. Pat. No. 4,439,520. U.S. Pat. No. 5,250,403 describes very thin tabular grains having an average equivalent circular diameter of at least 0.7 Mm and a thickness of not greater than 0.07 Mm. Further, U.S. Pat. No. 4,435,501 discloses a technique for epitaxially growing a silver salt on the surfaces of tabular grains. Also, techniques for the improvement of performance of tabular grains are disclosed in EP-0,699,947A, EP-0,699,951A, EP-0,699,945A, EP-0,701,164A, EP-0,699,944A, EP-0,701,165A, EP-0,699,948A, EP-0,699,946A, EP-0,699,949A, and EP-0,699,950A. These publications disclose techniques regarding silver bromide and silver iodobromide, but do not mention silver halide grains of silver chloride having (111) major faces. Also, no mention was made of actions and effects of coloring dyes having a certain structure in the case where these coloring dyes are used in light-sensitive materials.

Meanwhile, it is observed that for a light-sensitive material containing processing agents, coloring dyes, if contained, prolong the development time. This is because the coloring dyes consume alkali for their dissociation. Accordingly, it has been difficult in some cases to incorporate a sufficient amount of coloring dyes into a light-sensitive material.

SUMMARY OF THE INVENTION

A first object of the present invention is to provide a novel heat-developable light-sensitive material comprising decolorizable dyes and having excellent storability and decolorizeation, as well as to provide a method of forming color images through use of the decolorizable dyes. The first object is to further provide a method of forming color images having excellent sharpness in a short period of time.

A second object of the present invention is to provide a heat-developable light-sensitive material capable of producing images with high quality in a simple and quick manner with less burden being imposed on the environment.

The second object is to further provide a heat-developable light-sensitive material capable of providing good granularity and exposure latitude, particularly high image quality with excellent sharpness, even in simple, quick processing.

To achieve the above first and second objects, the present invention provides:

1) a heat-developable light-sensitive material comprising a support and a light-sensitive layer provided on the support, wherein the heat-developable light-sensitive material comprises dyes which are decolorized by reaction with a decolorizing agent at the time of a development process, the dyes being non-diffusible and at least a part of decolorized dyes resulting from the development process is non-diffusible.;

2) a heat-developable light-sensitive material as described in 1). wherein the dyes have neither a carboxyl group nor a sulfo group in molecules thereof;

3) a heat-developable light-sensitive material as described in 1) or 2), further comprising a decolorizable dye layer formed from a dispersion in which oil droplets formed by dissolving at least one of the dyes in oil and/or oil-soluble polymer are dispersed into a hydrophilic binder;

4) a heat-developable light-sensitive material as described in 1), 2), or 3), wherein the dyes are represented by the following formulas (I) to (IV): Formula (I):

$$A51{=}L51{-}(L52{=}L53)_{m51}{-}Q51;$$

Formula (II):

$$A51{=}L51{-}(L52{=}L53)_{n51}{-}A52;$$

Formula (III):

$$A51({=}L51{-}L52)_{p51}{=}B51;$$

Formula (IV):

$$(NC)_2{-}C{=}C(CN){-}Q51;$$

wherein "=" represents a double bond, "—" represents a single bond; each of A51 and A52 represents an acidic nucleus, and B51 represents a basic nucleus; Q51 represents an aryl group or a heterocyclic group; each of L51, L52, and L53 represents a methine group; m51 represents 0, 1, or 2; each of n51 and p51 represents 0, 1, 2, or 3; when a plurality of L51, a plurality of L52, or a plurality of L53 are present in the molecule, members of each of L51, L52, and L53 may be identical to or different from one another; compounds represented by formulas (I) to (IV) have neither carboxyl group nor sulfo group; compounds represented by formulas (I) to (IV) have a non-diffusion group, and resultant products after the development process (decolorizeation) are also non-diffusible and are substantially not eluted from the light-sensitive material; and compounds represented by Formulas (I) to (IV) do not have a group that initiates a redox reaction during the development process and subsequently undergoes bond cleavage to separate into a plurality of molecules;

5) a heat-developable light-sensitive material as described in any of 1) through 4), wherein the light-sensitive layer contains light-sensitive silver halide grains;

6) a heat-developable light-sensitive material as described in 5), wherein the light-sensitive layer contains a developing agent and a coupler;

7) a heat-developable light-sensitive material as described in any of 1) through 6), wherein the dyes are contained in an amount of 0.005 to 2 mmol per square meter of the heat-developable light-sensitive material;

8) a heat-developable light-sensitive material as described in any of 1) through 7), wherein a decolorizing agent or a precursor thereof is contained at 0.1 to 200 times the amount of the dyes contained;

9) a heat-developable light-sensitive material as described in 4), wherein each of the acidic nuclei A51 and A52 is a cyclic ketomethylene compound or a compound having a methylene group interposed between electrophilic groups;

10) a heat-developable light-sensitive material as described in 9), wherein the cyclic ketomethylene compound is 2-pyrazolin-5-one, rhodanine, hydantoin, thiohydantoin, 2,4-oxazolidinedione, isoxazolone, barbituric acid, thiobarbituric acid, indandione, dioxopyrazolopyridine, hydroxypyridine, pyrazolidinedione, 2,5-dihydrofuran-2-one, or pyrrolin-2-one; and wherein the compound having a methylene group interposed between electrophilic groups is a group represented by $Z51{-}CH_2{-}Z52$, wherein each of Z51 and Z52 independently represents —CN, $-SO_2R51$, —COR51, —COOR51, $CON(R52)_2$, $-SO_2N(R52)_2$, $-C[{=}C(CN)_2]R51$, or $-C[C(CN)_2]N(R51)_2$; R51 represents an alkyl group, a cycloalkyl group, an arkyl group, or a heterocyclic group; R52 represents a hydrogen atom or groups listed for R51; each of R51 and R52 may have a substituent, and when there exist a plurality of R51 or a plurality of R52, they may be identical to or different from each other.

11) a heat-developable light-sensitive material as described in any of 1) through 6), wherein the basic nucleus B51 is pyridine, quinoline, indolenine, oxazole, imidazole, thiazole, benzoxazole, benzoimidazole, benzothiazole, oxazoline, naphthoxazole, or pyrrole;

12) a heat-developable light-sensitive material as described in 4), wherein the dye is represented by formula (I);

13) a heat-developable light-sensitive material as described in any of 1) through 4), wherein at least one light-sensitive layer contains a binder, and a compound which undergo a coupling reaction with light-sensitive silver halide grains and an oxidized product of a developing agent to thereby form a dye and wherein after exposure, the light-sensitive layer surface of the heat-developable light-sensitive material is adhered to the processing layer surface of a processing material containing a decolorizing agent or a precursor thereof, followed by heat development to form color images, the heat-developable light-sensitive material being further characterized in that at least one light-sensitive layer contains:

i) an emulsion containing silver halide grains comprised of at least 50 mol % silver chloride, wherein tabular grains having (100) major faces account for at least 50% of the projected area, each grain having a rectangular projected area of an adjacent edge ratio of 1:1 to 1:2 and an aspect ratio of at least 2, or ii) an emulsion containing silver halide grains comprised of at least 50 mol% silver chloride, wherein tabular grains having (111) major faces account for at least 50% of the projected area, each grain having a hexagonal projected area of an adjacent edge ratio of 1:1 to 1:10 and an aspect ratio of at least 2;

14) a heat-developable light-sensitive material as described in any of 1) through 3), wherein a dye is a yellow or magenta dye represented by the following formula (V):

(V)

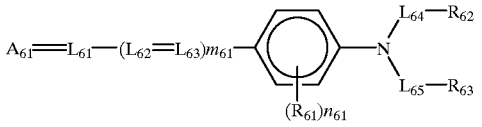

wherein "═" represents a double bond; "—" represents a single bond; A61 represents an acidic nucleus; each of L61, L62, and L63 represents a methine group; each of L64 and L65 represents a C1–C4 alkylene group; each of R62 and R63 represents a cyano group, —COOR64, —CONR65R66, —COR64, —$SO_2$R64, or —$SO_2$NR65R66; R64 represents an alkyl group, an alkenyl group, a cycloalkyl group, or an aryl group; each of R65 and R66 represents a hydrogen atom, an alkyl group, an alkenyl group, a cycloalkyl group, or an aryl group; R61 represents a substituent; m61 represents 0 or 1; n61 represents an integer between 0 and 4 inclusive, and R65 and R66 may link to each other to form a ring.

15) a heat-developable light-sensitive material as described in 6), wherein the light-sensitive layer contains a developing agent, and the processing layer of a processing material contains a base and/or base precursor (may be identical to or different from a decolorizing agent or a precursor thereof), and wherein the light-sensitive layer surface of the heat-developable light-sensitive material is adhered to the processing layer surface of the processing material with water being applied to the light-sensitive layer surface and/or the processing layer surface, followed by heat development; and 16) a method of forming color images, comprising the steps of: making face-to-face adhesion between the heat-developable light-sensitive material described in any of 1) through 15) and a processing material containing a decolorizing agent or a precursor thereof in the presence of water after or at the same time that the heat-developable light-sensitive material is given an image-forming exposure; applying heat to the adhered heat-developable light-sensitive material and processing material; and separating the heat-developable light-sensitive material from the processing material, thereby obtaining images on the heat-developable light-sensitive material and effecting decolorizeation of dyes.

DESCRIPTION OF THE PREFERRED EMBODIMENTS

First will be described dyes of the present invention, which are decolorized through reaction with a decolorizing agent at the time of a development process.

The dyes of the present invention are characterized by decolorizeation effected by reaction with a decolorizing agent at the time of a development process as well as characterized by non-diffusion. The dyes are further characterized in that even after they are decolorized in a development process, at least a part of the dyes remains non-diffusible. Through use of such dyes, the invention provides a light-sensitive material having excellent storability, providing images having excellent sharpness and granularity, and capable of being processed in a simple and quick manner. Also, the light-sensitive material of the invention does not discharge any substance which would otherwise impose a burden on the environment.

Specific examples of such dyes may include cyanins, merocyanines, oxonols, allylidenes (including heteroallylidenes), anthraquinones, triphenylmethanes, azo dyes, and azomethine dyes.

Preferably, dyes used in the present invention have neither a carboxyl group nor a sulfo group in molecules thereof. The presence of these groups impairs the storability and sensitivity of the light-sensitive material and the granularity and sharpness of images, and causes an impaired surface state of the light-sensitive material and a hardware trouble due to dyes or decomposed products thereof emerging on the surface of a light-sensitive material during a development process.

Dyes of the present invention will now be described in detail.

When a substituent in a dye compound used in the present invention includes an alkyl moiety, an alkenyl moiety, an alkylene moiety, or a cycloalkyl moiety, these moieties may be either straight or branched and may be either unsubstituted or substituted.

When a substituent in a dye compound used in the present invention includes an aryl moiety, the aryl moiety may be either unsubstituted or substituted and may be of either a monocyclic ring or condensed ring unless otherwise specified.

When a substituent in a dye compound used in the present invention includes a heterocyclic moiety, the heterocyclic moiety may be either unsubstituted or substituted and may be either of a monocyclic ring or condensed ring unless otherwise specified.

In the present invention, a heterocyclic ring is preferably a 3- to 8-membered ring constituted by non-metallic elements, more preferably a 5- to 6-membered ring constituted by non-metallic elements.

Preferred non-metallic elements are carbon, oxygen, nitrogen, and hydrogen, and more preferred non-metallic elements are carbon, hydrogen, and nitrogen.

Examples of preferred substituents in the aforementioned moieties may include a halogen atom, an alkyl group, an alkylene group, an alkenyl group, a cycloalkyl group, an aryl group, a heterocyclic group, an aliphatic oxy group, an aryloxy group, an acyl group, an aliphatic oxycarbonyl group, an aryloxycarbonyl group, a carbamoyl group, an acylamino group, a sulfonamide group, an aliphatic sulfonyl group, and an arylsulfonyl group.

Examples of preferable dyes which may be used in the present invention include compounds represented by the following formulas (I) through (IV):

Formula (I)

$$A51{=}L51{-}(L52{=}L53)_{m51}{-}Q51$$

Formula (II)

$$A51{=}L51{-}(L52{=}L53)_{n51}{-}A52$$

Formula (III)

$$A51({=}L51{-}L52)_{p51}{=}B51$$

Formula (IV)

$$(NC)_2C{=}C(CN){-}Q51$$

wherein "═" represents a double bond and "—" represents a single bond; each of A51 and A52 represents an acidic nucleus; B51 represents a basic nucleus; Q51 represents an aryl group or a heterocyclic group; each of L51, L52, and L53 represents a methine group; m51 represents 0, 1, or 2; each of n51 and p51 represents 0, 1, 2, or 3; wherein if there exist a plurality of L51, L52, or L53, the members of each of L51, L52, and L53 may be identical to or different from one another. The compounds represented by formulas (I)–(IV) have no carboxyl group or no sulfo group but have a non-diffusion group. Compounds formed after a development process (decolorizeation) also possess non-diffusion property and substantially do not elute from the light-sensitive material. The compounds represented by formulas (I)–(IV) do not have such a group that causes a redox reaction during the development process and subsequently undergoes bond scission to fragment into a plurality of molecules.

Of the acidic nuclei represented by A51 or A52, a cyclic ketomethylene compound or a compound having a methylene group sandwiched by electrophilic groups is preferable. Examples of cyclic ketomethylene compounds may include 2-pyrazolin-5-one, 1,2,3,6-tetrahydropyridine-2,6 -dione, rhodanine, hydantoin, thiohydantoin, 2,4-oxazolidinedione, isoxazolone, barbituric acid, thiobarbituric acid, indanedione, dioxopyrazolopyridine, hydroxypyridine, pyrazolinedione, 2,5-dihydrofuran-2-one, and pyrrolin-2-one. Each of them may have a substituent. Of these, preferable compounds are 2-pyrazolin-5-one, 1,2,3,6-tetrahydropyridine-2,6-dione, isoxazolone, dioxopyrazolopyridine, hydroxypyridine, pyrazolidinedione, and barbituric acid; with 2-pyrazolin-5-one, 1,2,3,6tetrahydropyridine-2,6-dione, isoxazolone, hydroxypyridine, pyrazolidinedione, and barbituric acid being particularly preferred.

The compound having a methylene group sandwiched by electrophilic groups is represented by $Z51{-}CH_2{-}Z52$, wherein each of Z51 and Z52 represents —CN, $-SO_2R51$, —COR51, —COOR51, $CON(R52)_2$, $-SO_2N(R52)_2$, $-C[{=}C(CN)_2]R51$, or $-C[{=}C(CN)_2]N(R51)_2$; R51 represents an alkyl group, an alkenyl group, a cycloalkyl group, an aryl group, or a heterocyclic group; R52 represents a hydrogen atom or groups listed for R51; each of R51 and R52 may have a substituent, and when there exist a plurality of R51 or a plurality of R52, they may be identical to or different from each other. Z51 and z52 may be identical to or different from each other.

Examples of the basic nuclei represented by B51 may include pyridine, quinoline, indolenine, oxazole, imidazole, thiazole, benzoxazole, benzoimidazole, benzothiazole, oxazoline, naphthoxazole, and pyrrole. Each of them may have a substituent. Preferable compounds among them are indolenine, benzoxazole, benzoimidazole, benzothiazole, and pyrrole, with indolenine and benzoxazole being particularly preferred.

Examples of the aryl groups represented by Q51 may include a phenyl group and a naphthyl group. Each of them may possess a substituent, which is preferably an electrophilic group. Of these, preferable groups are dialkylamino, hydroxyl, alkoxy, and alkyl-substituted phenyl, with dialkylamino-substituted phenyl being particularly preferred.

Examples of the heterocyclic groups represented by Q51 may include a group originating from pyrrole, indole, furan, thiophene, imidazole, pyrazole, indolidine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin, and coumarone. Each of them may have a substituent. Of the listed groups, pyrrole and indole are preferred.

Each of the methine groups represented by L51, L52, and L53 may possess a substituent. The substituents may be linked together to form a 5- or 6-membered ring (e.g., cyclopentene and cyclohexene).

Examples of the substituents on the above methine groups may include a sulfonamido group (e.g., methanesulfonamido, benzenesulfonamido, and octanesulfonamido), a sulfamoyl group (e.g., sulfamoyl, methylsulfamoyl, phenylsulfamoyl, and butylsulfamoyl), a sulfonylcarbamoyl group (e.g., methanesulfonylcarbamoyl and benzenesulfonylcarbamoyl), an acylsulfamoyl group (e.g., acetylsulfamoyl, pivaloylsulfamoyl, and benzoylsulfamoyl), a linear or cyclic alkyl group (e.g., methyl, isopropyl, cyclopropyl, cyclohexyl, 2-ethylhexyl, dodecyl, octadecyl, 2-phenethyl, and benzyl), an alkenyl group (e.g., vinyl and allyl), an alkoxy group (e.g., methoxy, octyloxy, dodecyloxy, and 2-methoxyethoxy), an aryloxy group (e.g., phenoxy), a halogen atom (e.g., F, Cl, and Br), an amino group (e.g., amino, diethylamino, and ethyldodecylamino), an ester group (e.g., ethoxycarbonyl, octyloxycarbonyl, and 2-hexyldecyloxycarbonyl), an acylamino group (e.g., acetylamino, pivaloylamino, and benzoylamino), a carbamoyl group (e.g, non-substituted carbamoyl, ethylcarbamoyl, diethylcarbamoyl, and phenylethylcarbamoyl), an aryl group (e.g., phenyl and naphthyl), an alkylthio group (e.g., methylthio and octylthio), an arylthio group (e.g., phenylthio, and naphthylthio), an acyl group (e.g., acetyl, benzoyl, and pivaloyl), a sulfonyl group (e.g., methanesulfonyl and benzenesulfonyl), an ureido group (e.g., 3-propylureido and 3,3-dimethylureido), an urethane group (e.g., methoxycarbonylamino and butoxycarbonylamino), a cyano group, a hydroxyl group, a nitro group, a heterocyclic group (e.g., a benzoxazole ring, a pyridine ring, a sulforane ring, a furan ring, a pyrrole ring, a morpholine ring, a piperazine ring, and a pyrimidine ring).

The dye used in the present invention may preferably be a compound represented by formula (I), (II), or (III), more preferably a compound of formula (I) or a compound of formula (III).

The dye represented by formula (I) is generally called an allylidene dye. When the dye represented by formula (I) is a yellow or a magenta dye, the dye is preferably a compound of formula (V):

(V)

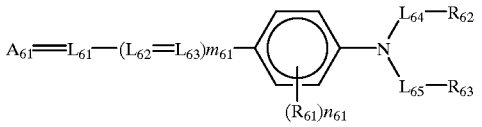

wherein represents a double bond; represents a single bond; A61 represents an acidic nucleus; each of L61, L62, and L63 represents a methine group; each of L64 and L65 represents a C1–C4 alkylene group; each of R62 and R63 represents a cyano group, —COOR64, —CONR65R66, —COR64, $SO_2$R64, or —$SO_2$NR65R66; R64 represents an alkyl group, an alkenyl group, a cycloalkyl group, or an aryl group; each of R65 and R66 represents a hydrogen atom, an alkyl group, an alkenyl group, a cycloalkyl group, or an aryl group; R61 represents a substituent; m61 represents 0 or 1; n61 represents an integer between 0 and 4 inclusive, and R65 and R66 may be linked to each other to form a ring. When there exist a plurality of L62 or a plurality of L63, the members of each of L62 and L63 may be identical to or different from each other.

The dye represented by formula (V) will next be described in detail.

In a compound (dye) represented by formula (V), m6l is 0 or 1. When m61 is 0, the dye is called a benzylidene dye which often serves as an yellow dye. When m61 is 1, the dye is called a cynnamylidene dye which often serves as a magenta dye.

In the present invention, m61 in formula (V) is preferably 0 and a compound of formula (V) preferably serves as a yellow dye.

In formula (V), A61 represents an acidic nucleus which is identical to a nucleus defined for A51 and A52 in formulas (I) to (III). A61 is preferably 2-pyrazolin-5-one, isoxazolone, hydroxypyridine, pyrazolidinedione, or barbituric acid, most preferably pyrazolidinedione.

Examples of the methine groups represented by L61, L62, and L63 may include those groups defined for L51, L52, and L53 in formulas (I) to (III). The methine groups are preferably ═CR67—, wherein R67 is an alkyl group having 1–10 carbon atoms or a hydrogen atom.

A preferable combination of L61, L62, and L63 is such that R67 in each of L61, L62, and L63 is a hydrogen atom; or R67 in each of L61 and L63 is a hydrogen atom and R67 in L62 is a methyl group. Most preferably, R67 in each of L61, L62, and L63 is a hydrogen.

In formula (V), each of L64 and L65 independently represents a C1–C4 alkylene group, preferably a methylene group or an ethylene group. L64 and L65 may preferably be identical to each other.

In formula (V), each of R62 and R63 represents a cyano group, —COOR64, —CONR65R66, —COR64, —$SO_2$R64, or —$SO_2$NR65R66. R64 represents an alkyl group (e.g., methyl, ethyl, i-propyl, t-butyl, benzyl, trifluoromethyl, 2-chloroethyl, and 2-ethoxyethyl), an alkenyl group (e.g., vinyl, allyl, oleyl), or an aryl group (phenyl, 2-naphthyl, 4-chlorophenyl, 2-methoxyphenyl, and 3-dimethylaminophenyl), preferably an alkyl group or an alkenyl group, with a linear non-substituted alkyl group being most preferred.

Each of R65 and R66 independently represents a group defined for R64, or a hydrogen atom, preferably an alkyl group, an aryl group, or a hydrogen atom, with a chained non-substituted alkyl group or a hydrogen atom being more preferred. When each of R65 and R66 is a group other than hydrogen, the carbon number thereof is preferably 1–20, more preferably 6–20, and particularly preferably 8–16.

Each of R62 and R63 represents more preferably a cyano group, —COOR64, or —CONR65R66, particularly preferably a cyano group or —COOR64, and most preferably —COOR64. When each of R62 and R63 is a cyano group, each of L64 and L65 is preferably an ethylene group. When each of R62 and R63 is —COOR64, each of L64 and L65 is preferably a methylene group.

Although R62 and R63 may be identical to or different from each other, they may preferably be identical to each other.

In formula (V), R61 represents a substituent; preferably a group defined for substituents of a methine group represented by L61, L62, or L63; more preferably an alkyl group, an alkoxy group, a dialkylamino group, or an alkoxycarbonyl group; particularly preferably an alkyl group or an alkoxy group; and most preferably a methyl group or a methoxy group.

In formula (V), n6l represents an integer between 0 to 4 inclusive, preferably 0 or 1, and more preferably 0. When n61 is 1, R61 may preferably be substituted at the m-position to the amino group.

Next will be described specific examples of dyes, which should not be construed as limiting the invention.

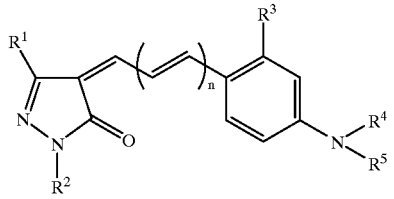
| Compound No. | $R^1$ | $R^2$ | $R^3$ | $R^4$ | $R^5$ | n |
|---|---|---|---|---|---|---|
| A1 | —CN | 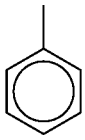 | —H | $—C_2H_5$ | $—C_{12}H_{25}$ | 1 |
| A2 | $—CO_2C_2H_5$ | 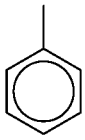 | —H | $—C_2H_5$ | $—C_{12}H_{25}$ | 1 |
| A3 | $—CO_2C_2H_5$ | 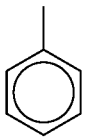 | —H | $—C_2H_5$ | $—C_{12}H_{25}$ | 0 |
| A4 | —CN | 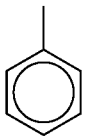 | $—CH_3$ | $—C_8H_{17}$ | $—C_8H_{17}$ | 0 |
| A5 | $—CONHC_2H_5$ | $—CH_3$ | $—CH_3$ | $—C_8H_{17}$ | $—C_8H_{17}$ | 1 |
| A6 | 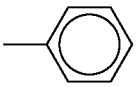 | $—CH_3$ | —H | $—C_2H_5$ | $—C_{12}H_{25}$ | 0 |
| A7 | 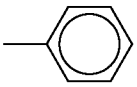 | $—CH_3$ | —H | $—C_2H_5$ | $—C_{12}H_{25}$ | 1 |
| A8 | —CN | 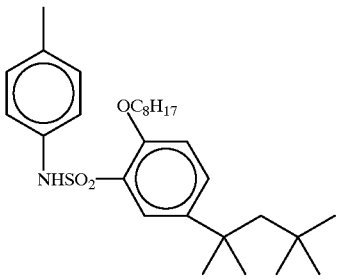 | —H | $—C_2H_5$ | $—C_2H_5$ | 0 |

-continued
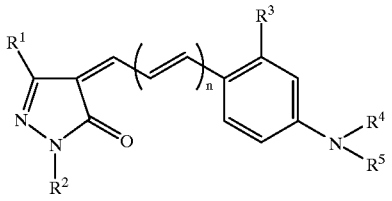
| Compound No. | $R^1$ | $R^2$ | $R^3$ | $R^4$ | $R^5$ | n |
|---|---|---|---|---|---|---|
| A9 | —CN | 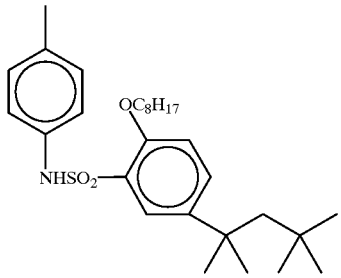 | —H | $—C_2H_5$ | $—C_2H_5$ | 1 |
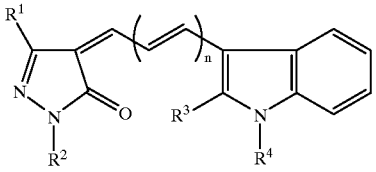
| Compound No. | $R^1$ | $R^2$ | $R^3$ | $R^4$ | n |
|---|---|---|---|---|---|
| A10 | —CN | 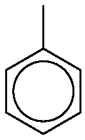 | $—CH_3$ | *1 | 1 |
| A11 | $—CO_2C_2H_5$ | 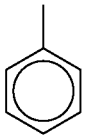 | $—CH_3$ | *1 | 1 |
| A12 | $—CH_3$ | $—CH_2CH_3$ | $—CH_3$ | *1 | 1 |
| A13 | —CN | 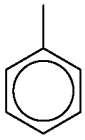 | —H | *1 | 0 |
| A14 | $—CO_2C_2H_5$ | 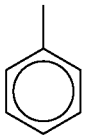 | —H | *1 | 0 |

-continued
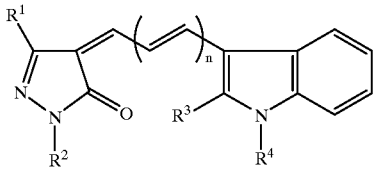
| Compound No. | $R^1$ | $R^2$ | $R^3$ | $R^4$ | n |
|---|---|---|---|---|---|
| A15 | 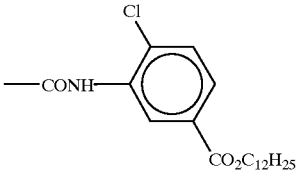 | 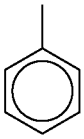 | $-CH_3$ | $CH_3$ | 0 |
| A16 | 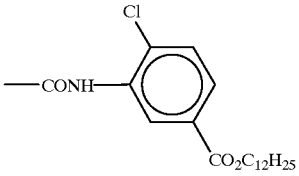 | 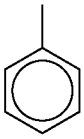 | $-CH_3$ | $CH_3$ | 1 |
| A17 | $-CO_2C_2H_5$ | 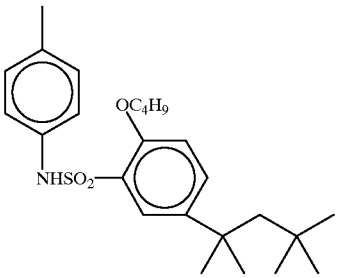 | $-CH_3$ | 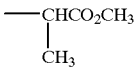 | 1 |
*1
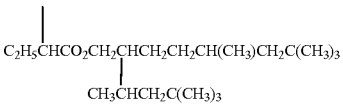
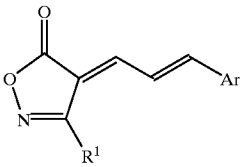
| Compound No. | $R^1$ | Ar |
|---|---|---|
| A18 | 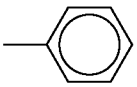 | 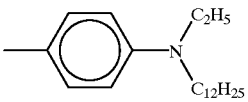 |

-continued
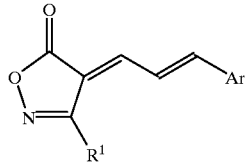
| Compound No. | $R^1$ | Ar |
|---|---|---|
| A19 | 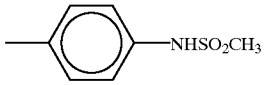 | 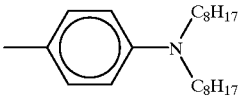 |
| A20 | $—CH_3$ | 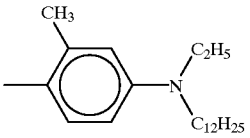 |
| A21 | 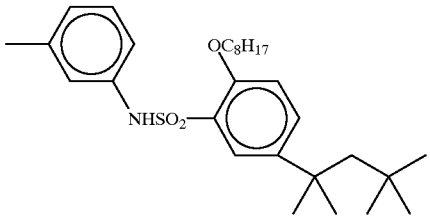 | 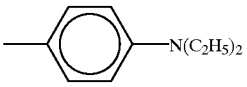 |
| A22 | 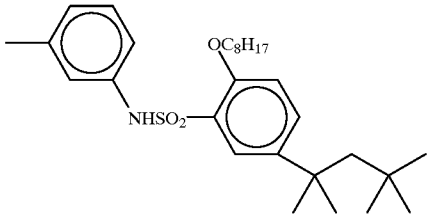 | 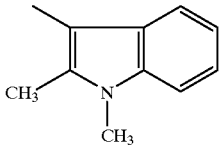 |
| A23 | 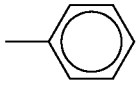 | 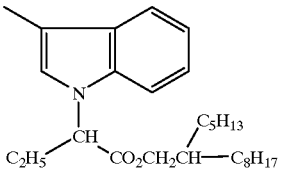 |
| A24 | $—CO_2C_2H_5$ | 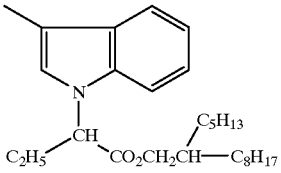 |

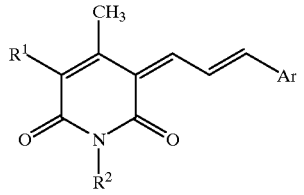
| Compound No. | $R^1$ | $R^2$ | $Ar^1$ |
|---|---|---|---|
| A25 | —CN | $—CH(C_2H_5)CO_2C_2H_5$ | 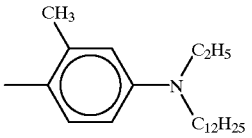 |
| A26 | —CN | 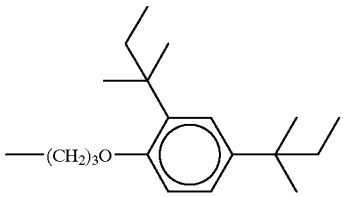 | 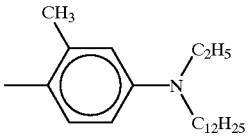 |
| A27 | —CN | 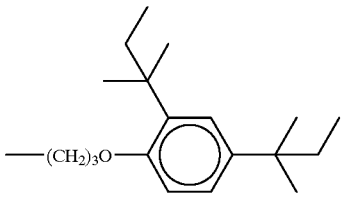 | 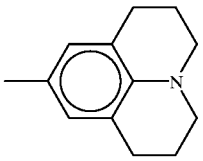 |
| A28 | $—CONH_2$ | 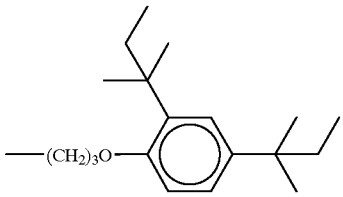 | 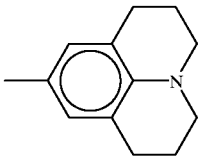 |
| A29 | —CN | 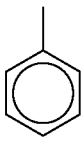 | 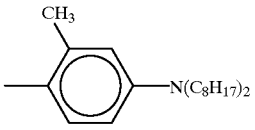 |
| A30 | —CN | $—C_2H_5$ | 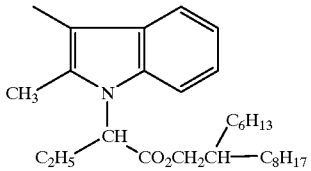 |

-continued
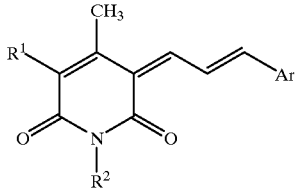
| Compound No. | $R^1$ | $R^2$ | $Ar^t$ |
|---|---|---|---|
| A31 | —CN | $—(CH_2)_3OC_{12}H_{25}$ | 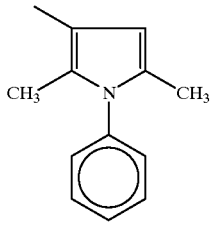 |
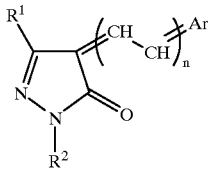
| Compound No. | $R^1$ | $R^2$ | =Ar | n |
|---|---|---|---|---|
| A32 | —CN | 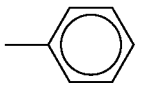 | 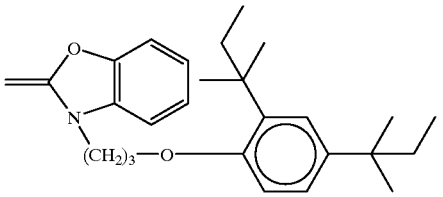 | 1 |
| A33 | —CN | 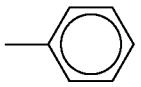 | 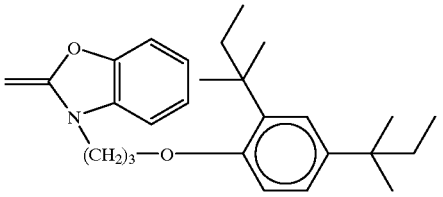 | 2 |
| A34 | —CN | $—CH_3$ | 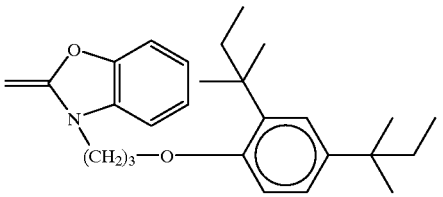 | 1 |

-continued
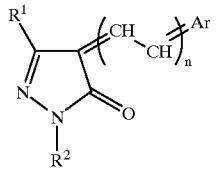
| Compound No. | $R^1$ | $R^2$ | =Ar | n |
|---|---|---|---|---|
| A35 | *2 | 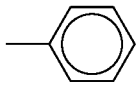 | 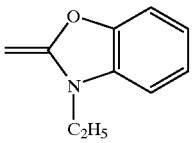 | 1 |
| A36 | *2 | 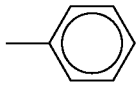 | 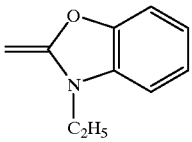 | 2 |
| A37 | *2 | 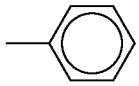 | 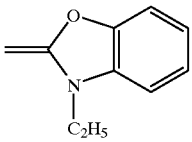 | 3 |
| A38 | —$CONHC_4H_9$ | 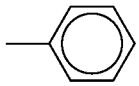 | 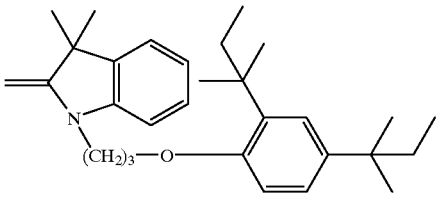 | 2 |
| A39 | —$CONHC_4H_9$ | 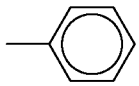 | 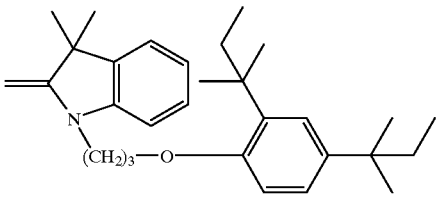 | 3 |
| A40 | 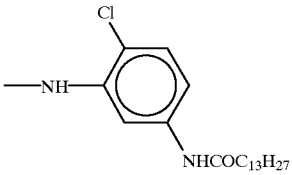 | 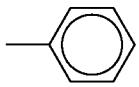 | 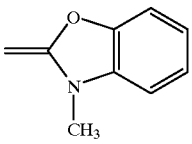 | 1 |
*2
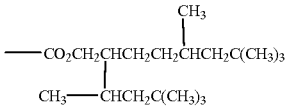

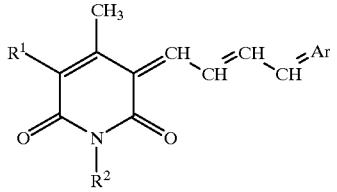
| Compound No. | $R^1$ | $R^2$ | =Ar |
|---|---|---|---|
| A41 | —CN | $—C_2H_5$ | 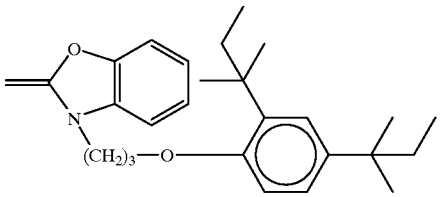 |
| A42 | $—CONH_2$ | $—C_2H_5$ | 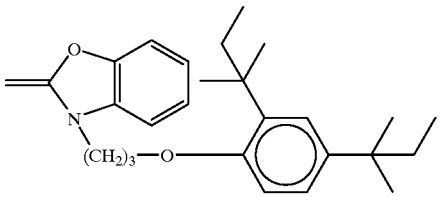 |
| A43 | —CN | $—CH(C_2H_5)CO_2C_2H_5$ | 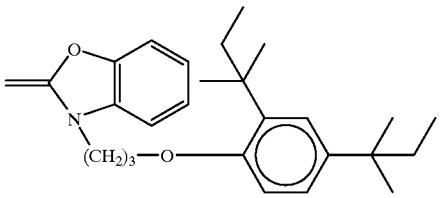 |
| A44 | —CN | 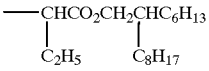 | 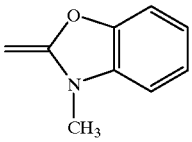 |
| A45 | —CN | 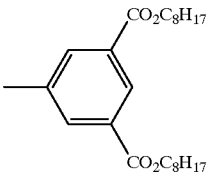 | 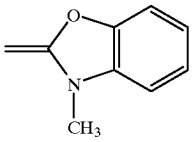 |
| A46 | —CN | 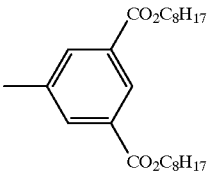 | 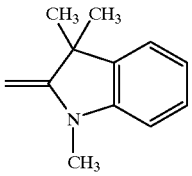 |

-continued
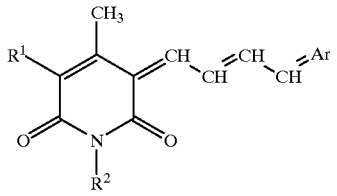
| Compound No. | $R^1$ | $R^2$ | =Ar |
|---|---|---|---|
| A47 | —CN | $—C_2H_5$ | 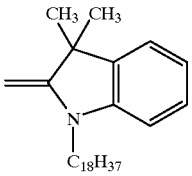 |
| A48 | —CN | $—CH_2CHC_6H_{13}$ (with $C_8H_{17}$) | 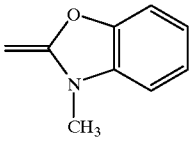 |
| A49 | —CN | $—CH_2CHC_6H_{13}$ (with $C_8H_{17}$) | 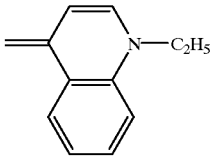 |
| A50 | —CN | $—CH_2CHC_6H_{13}$ (with $C_8H_{17}$) | 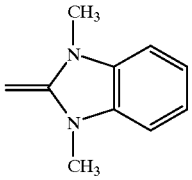 |
| A51 | —CN | $—CH_2CHC_6H_{13}$ (with $C_8H_{17}$) | 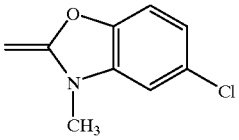 |
| A52 | —CN | $—CH_2CHC_6H_{13}$ (with $C_8H_{17}$) | 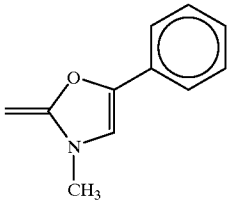 |

-continued
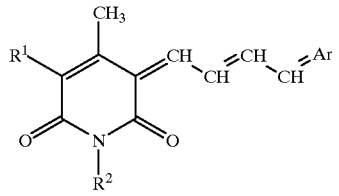
| Compound No. | $R^1$ | $R^2$ | =Ar |
|---|---|---|---|
| (A53) | 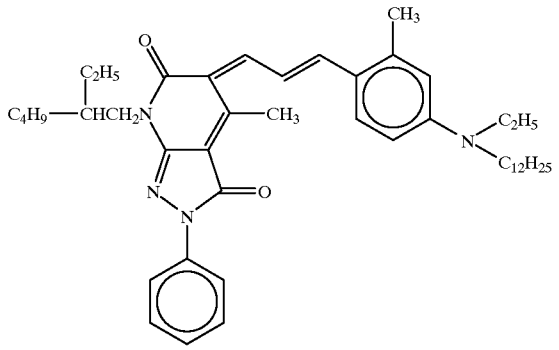 | | |
| (A54) | 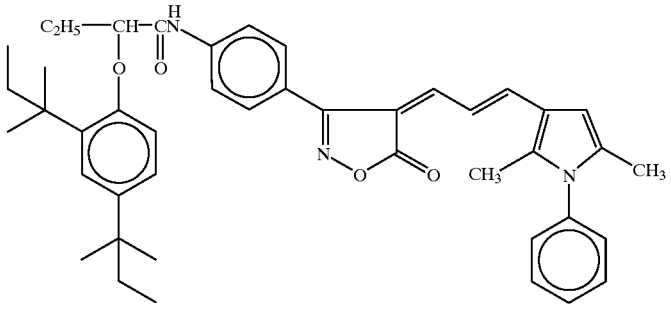 | | |
| (A55) | 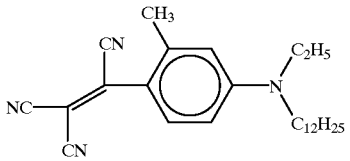 | | |

-continued
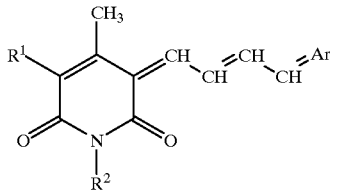
| Compound No. | $R^1$ | $R^2$ | =Ar |
|---|---|---|---|
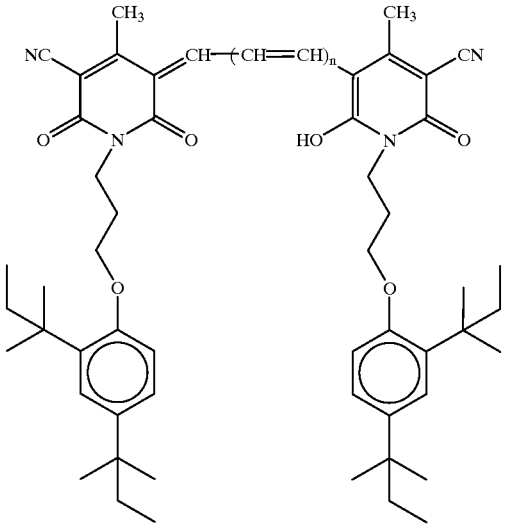
(A56) n = 1
(A57) n = 2
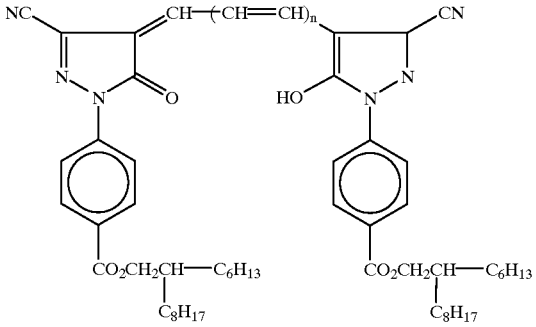
(A58) n = 0
(A59) n = 1
(A60) n = 2

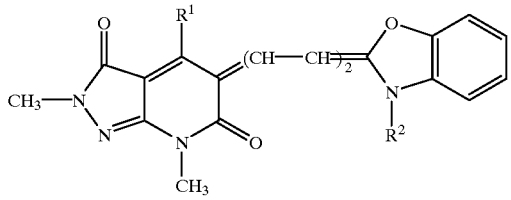
| | $R^1$ | $R^2$ |
|---|---|---|
| A61 | $-CH_3$ | $-(CH_2)_3OC_{12}H_{25}$ |
| A62 | $-CH_2CHC_8H_17$ (with $C_6H_{13}$) | $-CH_3$ |
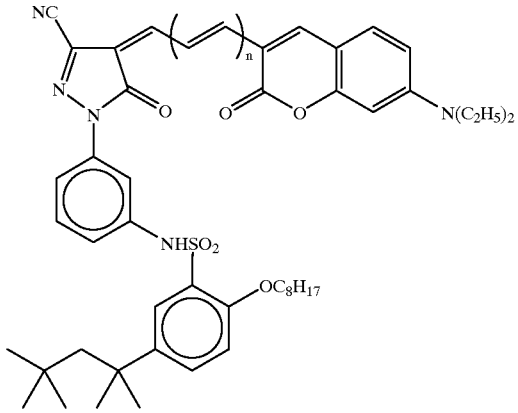
(A63) n = 0
(A64) n = 1
(A65)
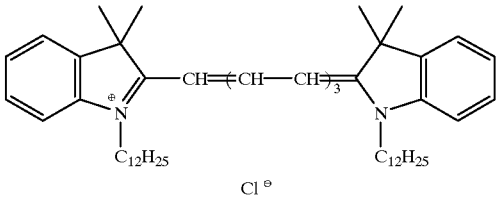
(A66)
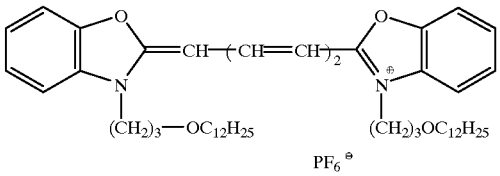
(A67)
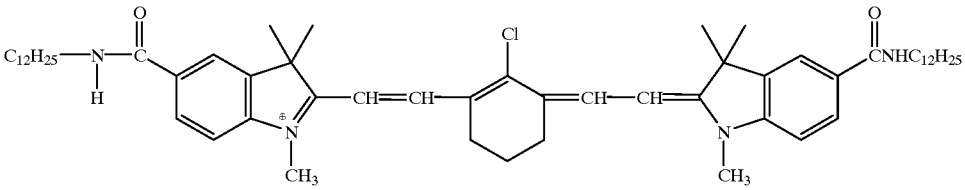

-continued
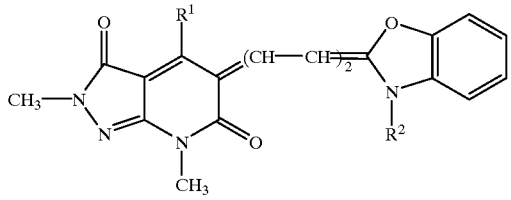
| $R^1$ | $R^2$ |
|---|---|
(A68)
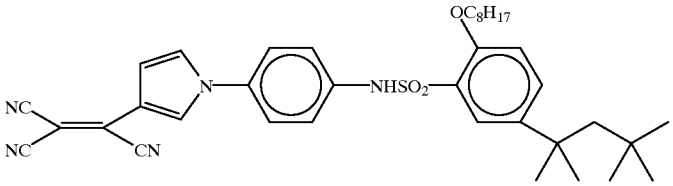
(A69)
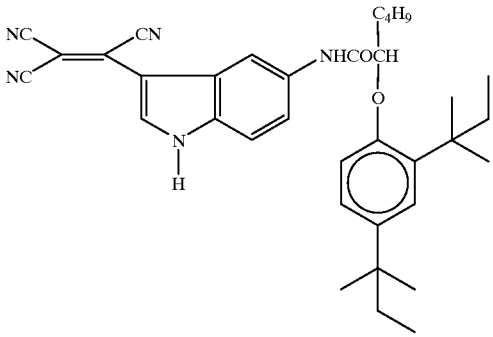
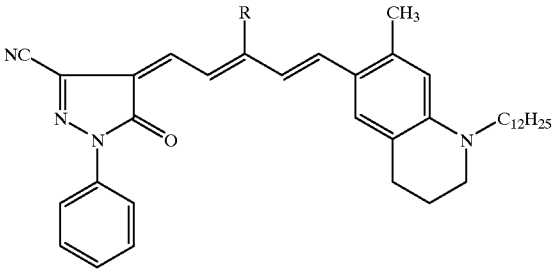
(A70) R = Cl
(A71) R = —$SCH_3$
(A72) R = —$OC_2H_5$
(A73) R = $CH_3$
(A74)
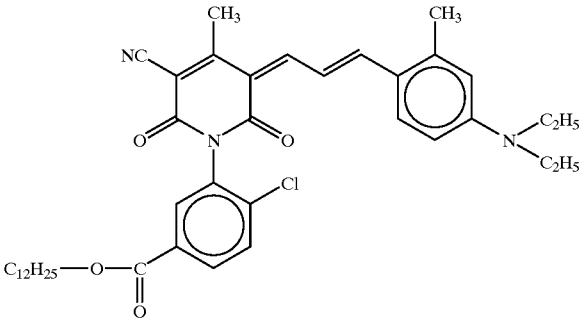

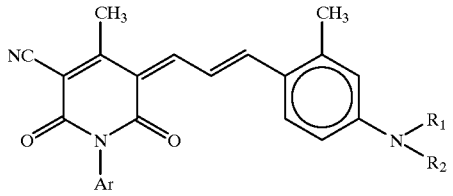
| | Ar | $R_1$ | $R_2$ |
|---|---|---|---|
| A-75 | 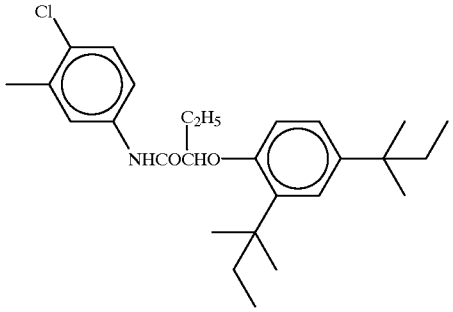 | $CH_3$ | $CH_3$ |
| A-76 | 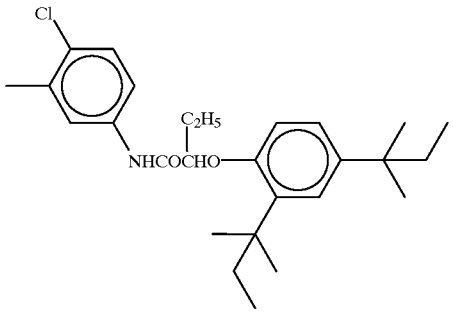 | $C_2H_5$ | $C_{12}H_{25}$ |
| A-77 | 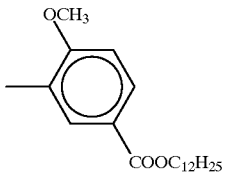 | $CH_3$ | $CH_3$ |
| A-78 | 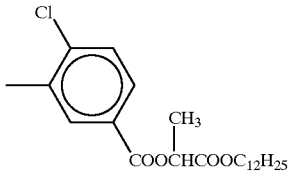 | $C_2H_5$ | $C_2H_5$ |
| A-79 | 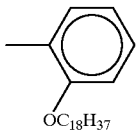 | $CH_3$ | $CH_3$ |

-continued
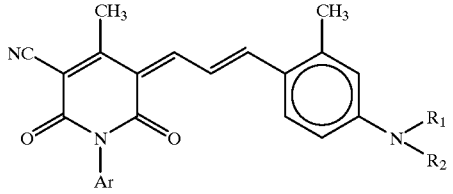
| | Ar | $R_1$ | $R_2$ |
|---|---|---|---|
| A-80 | 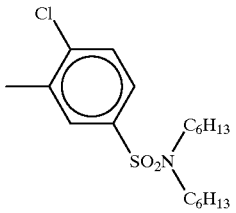 | $-(CH_2)_2-OC_2H_5$ | 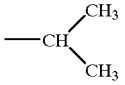 |
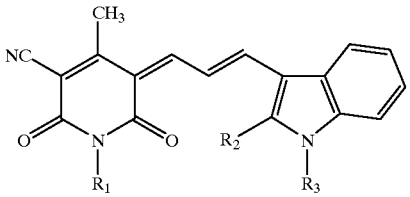
| | $R_1$ | $R_2$ | $R_3$ |
|---|---|---|---|
| A-81 | $C_2H_5$ | H | $-CH_2COOC_{16}H_{33}$ |
| A-82 | 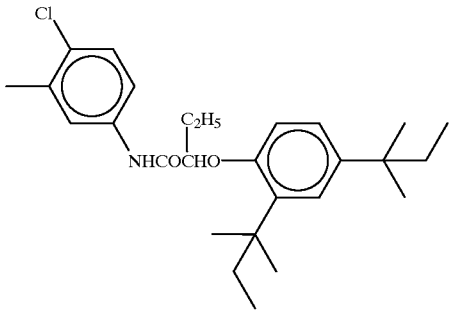 | $CH_3$ | 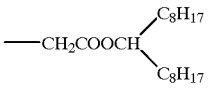 |
| A-83 | 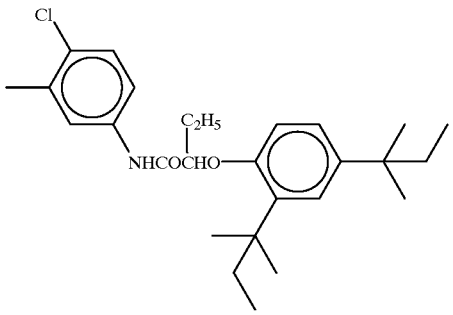 | H | $CH_3$ |

-continued
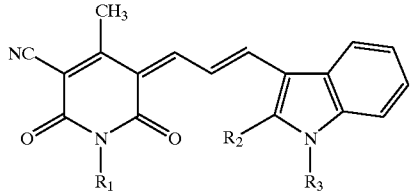
| | $R_1$ | $R_2$ | $R_3$ |
|---|---|---|---|
| A-84 | 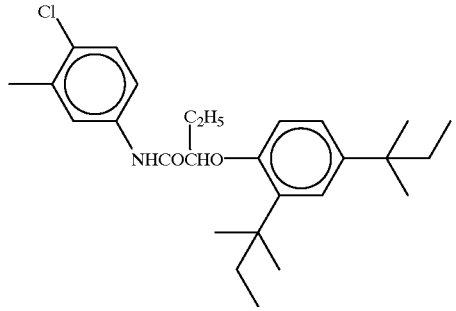 | $CH_3$ | 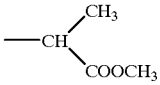 |
| A-85 | 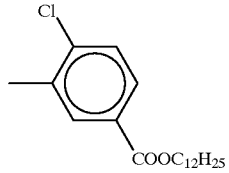 | H | $—CH_2COOC_2H_5$ |
| A-86 | $C_2H_5$ | H | 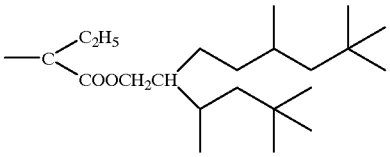 |
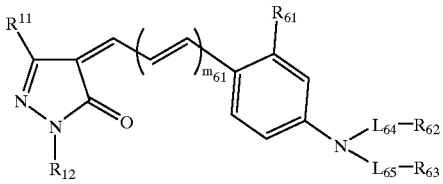
| Compound No. | $R_{11}$ | $R_{12}$ | $m_{61}$ | $R_{61}$ | $—L_{64}—R_{62}$ | $—L_{65}—R_{63}$ |
|---|---|---|---|---|---|---|
| A-87 | $—CH_3$ | 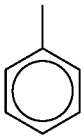 | 0 | —H | $—CH_2COOC_{12}H_{25}$ | $—CH_2COOC_{12}H_{25}$ |

-continued
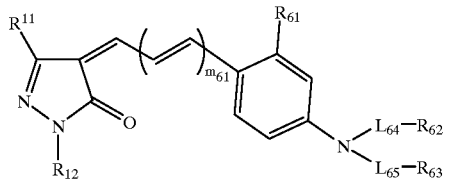
| Compound No. | $R_{11}$ | $R_{12}$ | $m_{61}$ | $R_{61}$ | $—L_{64}—R_{62}$ | $—L_{65}—R_{63}$ |
|---|---|---|---|---|---|---|
| A-88 | $—COOC_{12}H_{25}$ | 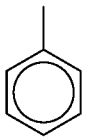 | 0 | —H | $—CH_2CH_2CN$ | $—CH_2CH_2CN$ |
| A-89 | —CN | 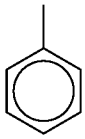 | 0 | —H | 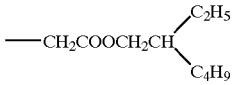 | 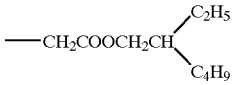 |
| A-90 | $—OC_2H_5$ | 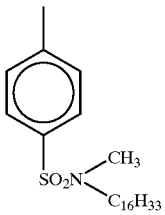 | 0 | $—CH_3$ | $—CH_2COOCH_3$ | $—CH_2COOCH_3$ |
| A-91 | 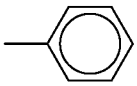 | $—CH_3$ | 0 | $—OCH_3$ | 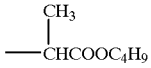 | $—CH_2COOC_{12}H_{25}$ |
| A-92 | $—CH_3$ | 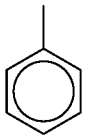 | 1 | $—CH_3$ | $—CH_2COOC_{10}H_{21}$ | $—CH_2COOC_{10}H_{21}$ |
| A-93 | —CN | 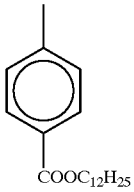 | 1 | —H | $—CH_2CH_2CN$ | $—CH_2CH_2CN$ |

-continued
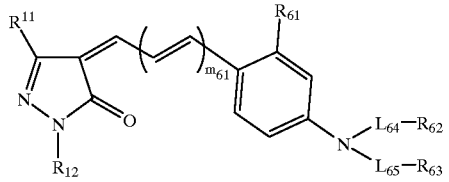
| Compound No. | $R_{11}$ | $R_{12}$ | $m_{61}$ | $R_{61}$ | $—L_{64}—R_{62}$ | $—L_{65}—R_{63}$ |
|---|---|---|---|---|---|---|
| A-94 | $—CONHC_{12}H_{25}$ | 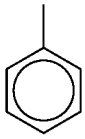 | 1 | $—OCH_3$ | $—CH_2CH_2COOC_4H_9$-i | $—CH_2CN$ |
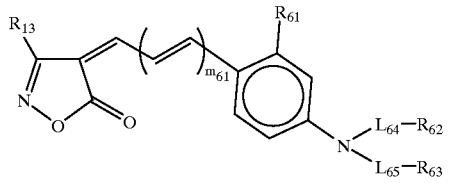
| Compound No. | $R_{13}$ | $m_{61}$ | $R_{61}$ | $—L_{64}—R_{62}$ | $—L_{65}—R_{63}$ |
|---|---|---|---|---|---|
| A-95 | 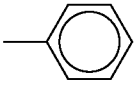 | 0 | —H | $—CH_2COOC_{12}H_{25}$ | $—CH_2COOC_{12}H_{25}$ |
| A-96 | 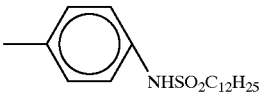 $NHSO_2C_{12}H_{25}$ | 0 | —H | $—CH_2CH_2CN$ | $—CH_2CH_2CN$ |
| A-97 | $—C_4H_9$-t | 0 | $—CH_3$ | $—CH_2CONHC_{10}H_{21}$ | $—CH_2CONHC_{10}H_{21}$ |
| A-98 | 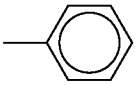 | 1 | $—CH_3$ | $—CH_2COOC_{12}H_{25}$ | $—CH_2COOC_{12}H_{25}$ |
| A-99 | $—CH_3$ | 1 | $—OCH_3$ | 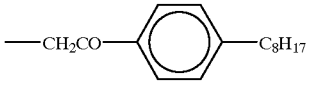 | 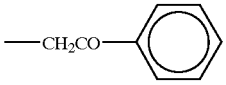 |

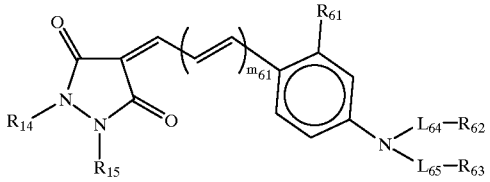
| Compound No. | $R_{14}$ | $R_{15}$ | $m_{61}$ | $R_{61}$ | $—L_{64}—R_{62}$ | $—L_{65}—R_{63}$ |
|---|---|---|---|---|---|---|
| A-100 | 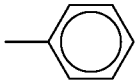 | 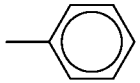 | 0 | —H | $—CH_2COOC_{12}H_{25}$ | $—CH_2COOC_{12}H_{25}$ |
| -101 | 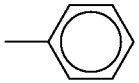 | 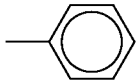 | 0 | $—OCH_3$ | $—CH_2COOC_{18}H_{37}$ | $—CH_2COOC_{18}H_{37}$ |
| A-102 | 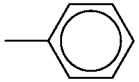 | 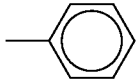 | 0 | —H | 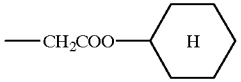 | 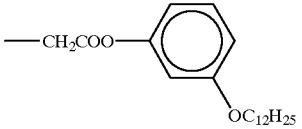 |
| A-103 | 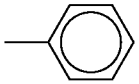 | 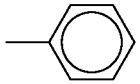 | 0 | $—O^nC_{12}H_{25}$ | $—CH_2CH_2CN$ | $—CH_2CH_2CN$ |
| A-104 | 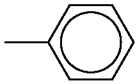 | 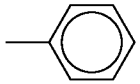 | 0 | —H | 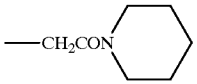 | 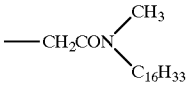 |
| A-105 | 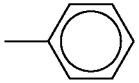 | 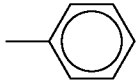 | 0 | —H | $—CH_2CH_2SO_2C_{12}H_{25}$ | 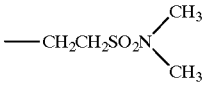 |
| A-106 | 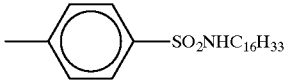 | 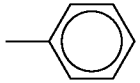 | 0 | —H | $—CH_2CH_2CN$ | $—CH_2CH_2CN$ |

-continued
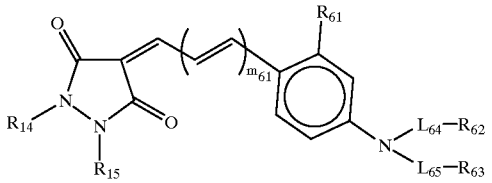
| Compound No. | $R_{14}$ | $R_{15}$ | $m_{61}$ | $R_{61}$ | $—L_{64}—R_{62}$ | $—L_{65}—R_{63}$ |
|---|---|---|---|---|---|---|
| A-107 | 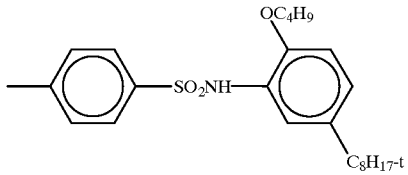 | 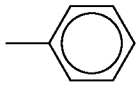 | 0 | —H | $—CH_2COOCH_3$ | $—CH_2COOCH_3$ |
| A-108 | $—CH_3$ | $—CH_3$ | 0 | —H | 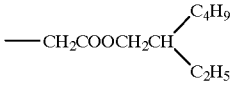 | 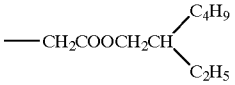 |
| A-109 | 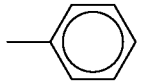 | 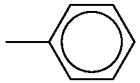 | 0 | $—CH_3$ | $—CH_2COO—(CH_2)_3—OC_{12}H_{25}$ | $—CH_2COO—(CH_2)_3—OC_{12}H_{25}$ |
| A-110 | 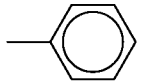 | 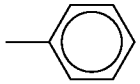 | 1 | —H | $—CH_2COOC_{12}H_{25}$ | $—CH_2COOC_{12}H_{25}$ |
| A-111 | 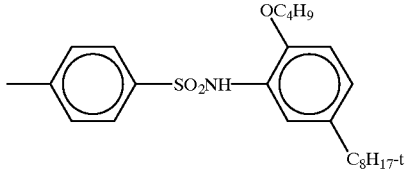 | 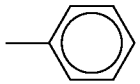 | 1 | —H | $—CH_2CH_2CN$ | $—CH_2CH_2CN$ |
| A-112 | 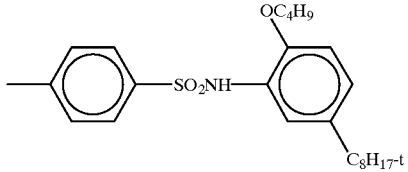 | 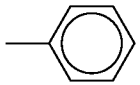 | 1 | —H | $—CH_2COOC_{12}H_{25}$ | $—CH_2COOC_{12}H_{25}$ |

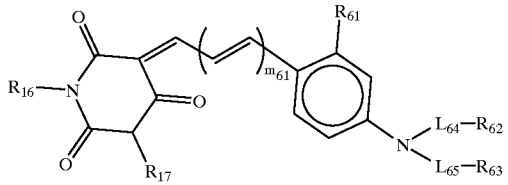
| Compound No. | $R_{16}$ | $R_{17}$ | $m_{61}$ | $R_{61}$ | $—L_{64}—R_{62}$ | $—L_{65}—R_{63}$ |
|---|---|---|---|---|---|---|
| A-113 | $—CH_3$ | $—CH_3$ | 0 | —H | $—CH_2COOC_{10}H_{21}$ | $—CH_2COOC_{10}H_{21}$ |
| A-114 | $—CH_3$ | $—CH_3$ | 0 | $—CH_3$ | 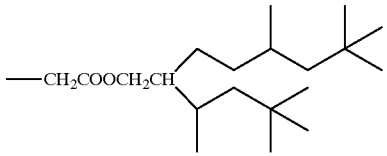 | 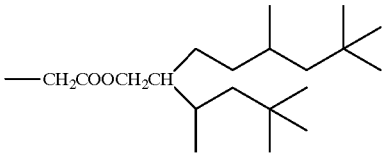 |
| A-115 | $—C_8H_{17}$ | $—C_8H_{17}$ | 0 | —H | $—CH_2CH_2CN$ | $—CH_2CH_2CN$ |
| A-116 | $—CH_3$ | $—CH_3$ | 0 | $—OC_{12}H_{25}$ | $—CH_2CH_2CN$ | $—CH_2CH_2CN$ |
| A-117 | $—CH_3$ | $—CH_3$ | 0 | —H | $—(CH_2)_4COOC_6H_{13}$ | $—(CH_2)_3COCH_3$ |
| A-118 | $—CH_3$ | $—CH_3$ | 1 | —H | 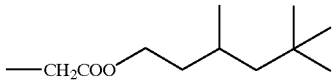 | 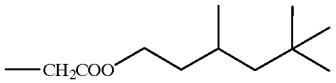 |
| A-119 | 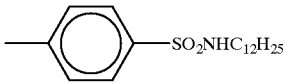 | $—CH_3$ | 0 | —H | $—CH_2COOC_2H_5$ | $—CH_2COOC_2H_5$ |
| A-120 | $—CH_3$ | $—CH_3$ | 1 | $—COOCH_3$ | $—CH_2CH_2COOC_8H_{17}$ | $—CH_2CH_2CN$ |

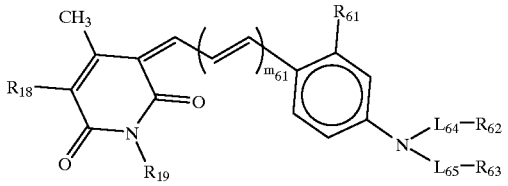
| Compound No. | $R_{18}$ | $R_{19}$ | $m_{61}$ | $R_{61}$ | $—L_{64}—R_{62}$ | $—L_{65}—R_{63}$ |
|---|---|---|---|---|---|---|
| A-121 | —CN | $—C_2H_5$ | 0 | H | $—CH_2COOC_{12}H_{25}$ | $—CH_2COOC_{12}H_{25}$ |
| A-122 | —CN | 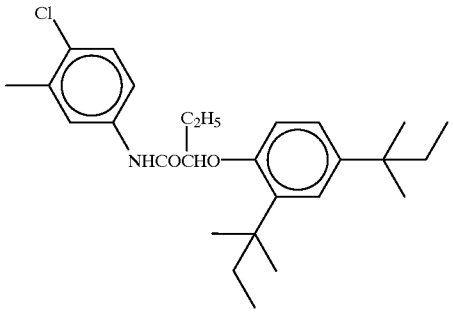 | 0 | H | $—CH_2CH_2CN$ | $—CH_2CH_2CN$ |
| A-123 | $—CONH_2$ | $—C_2H_5$ | 0 | H | $—CH_2COOC_{10}H_{21}$ | $—CH_2COOC_{10}H_{21}$ |
| A-124 | —CN | $—C_{12}H_{25}$ | 1 | H | $—CH_2CH_2CN$ | $—CH_2COOC_{16}H_{33}$ |
| A-125 | —CN | 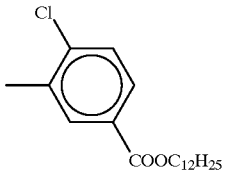 | 1 | H | $—CH_2COOCH_3$ | $—CH_2COOCH_3$ |
| A-126 | $—CONH_2$ | 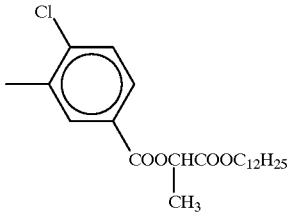 | 1 | $CH_3$ | $—CH_2COOC_2H_5$ | $—CH_2COOC_2H_5$ |
| A-127 | | 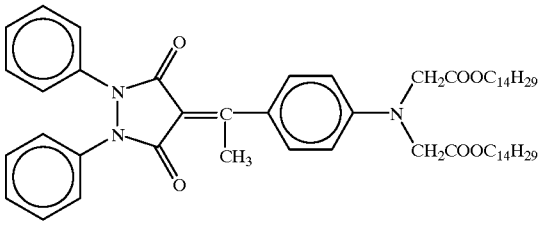 | | | | |
| A-128 | | 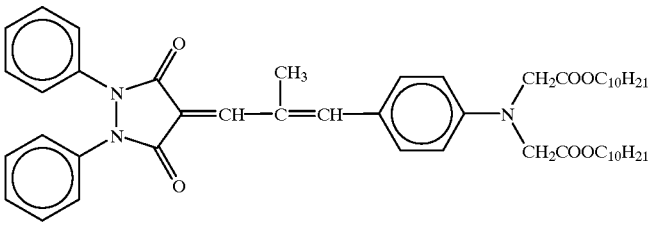 | | | | |

-continued
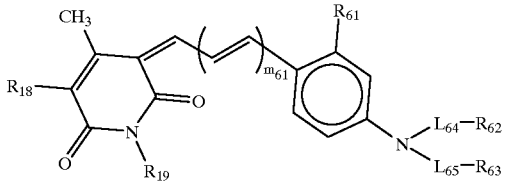
| Compound No. | $R_{18}$ | $R_{19}$ | $m_{61}$ | $R_{61}$ | $—L_{64}—R_{62}$ | $—L_{65}—R_{63}$ |
|---|---|---|---|---|---|---|
| A-129 | | | | | | |
| A-130 | | | | | | |
| A-131 | | | | | | |
| A-132 | | | | | | |
| A-133 | | | n = 1 | | | |
| A-134 | | | n = 2 | | | |
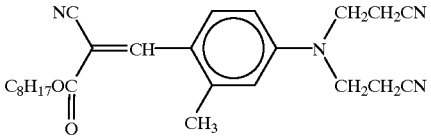
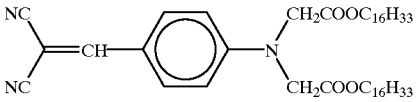
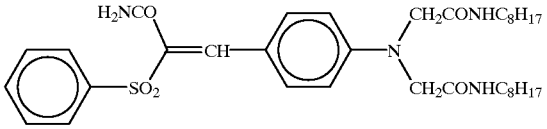
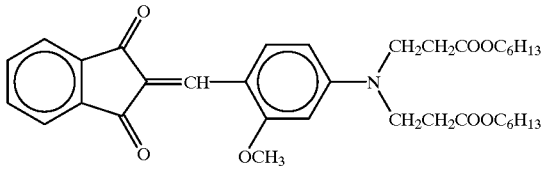
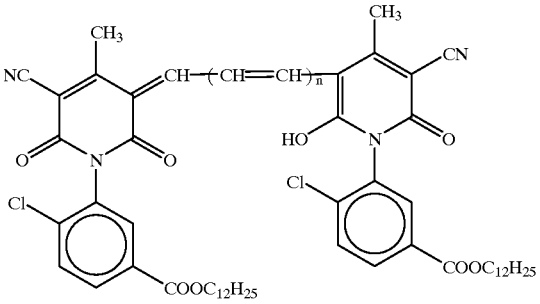

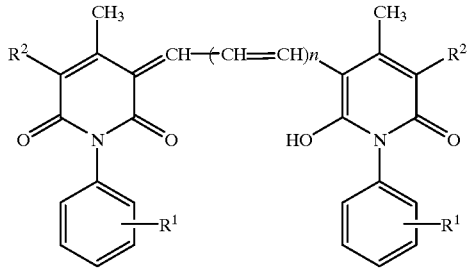

| Compound No. | $R^1$ | $R^2$ | n |
|---|---|---|---|
| A-135 | 2-O$^n$C$_{18}$H$_{37}$ | CN | 2 |
| A-136 | 3-O$^n$C$_{18}$H$_{37}$ | CN | 2 |
| A-137 | 2-O$^n$C$_{18}$H$_{37}$ | CN | 2 |
| A-138 | 3-O$^n$C$_{18}$H$_{37}$ | CN | 2 |
| A-139 | 4-CO$_2$CH$_2$CH(C$_8$H$_{17}$)—C$_6$H$_{13}$ | CN | 2 |
| A-140 | 3,5-di-O$^n$C$_{12}$H$_{25}$ | CN | 2 |
| A-141 | 3-O—CH$_2$CH$_2$—O—C(=O)-n-C$_{14}$H$_{29}$ | CN | 2 |
| A-142 | 3-CH$_3$,4-O-n-C$_{12}$H$_{25}$ | CN | 2 |
| A-143 | 2-O-n-C$_{18}$H$_{37}$ | —C(=O)NH$_2$ | 2 |
| A-144 | 3-O-n-C$_{18}$H$_{37}$ | —C(=O)—NH$_2$ | 2 |
| A-145 | 2-Cl,5-CO$_2$-n-C$_{12}$H$_{25}$ | —C(=O)NH$_2$ | 2 |
| A-146 | 3-O-n-C$_{18}$H$_{37}$ | CN | 1 |
| A-147 | 4-CO$_2$CH$_2$CH(C$_8$H$_{17}$)—C$_6$H$_{13}$ | —C(=O)NH$_2$ | 1 |

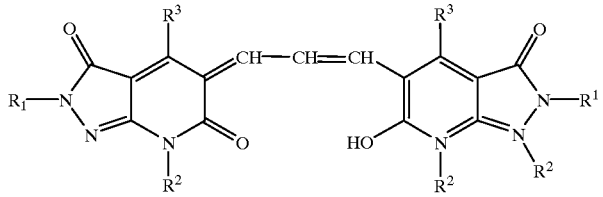

| Compound No. | $R^1$ | $R^2$ | $R^3$ |
|---|---|---|---|
| A-148 | 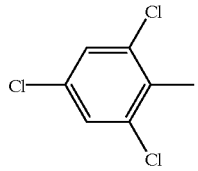 | 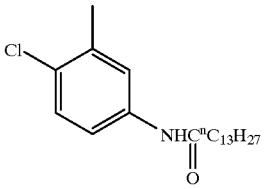 | $CH_3$ |
| A-149 | 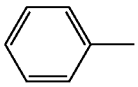 | n-C$_8$H$_{17}$ | $CH_3$ |
| A-150 | 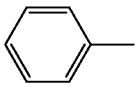 | n-C$_{18}$H$_{37}$ | $CH_3$ |
| A-151 | 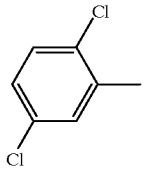 | n-C$_{16}$H$_{33}$ | $CH_3$ |

-continued
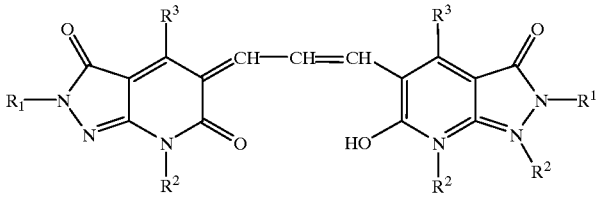
| Compound No. | $R^1$ | $R^2$ | $R^3$ |
|---|---|---|---|
| A-152 | 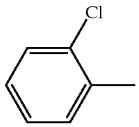 | n-$C_{14}H_{29}$ | $CH_3$ |
| A-153 | 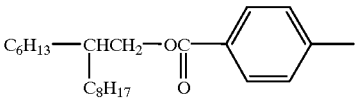 | n-$C_8H_{17}$ | $CH_3$ |
25
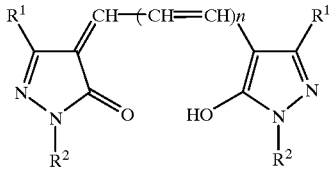
| Compound No. | $R^1$ | $R^2$ | n |
|---|---|---|---|
| A-154 | $CH_3$ | 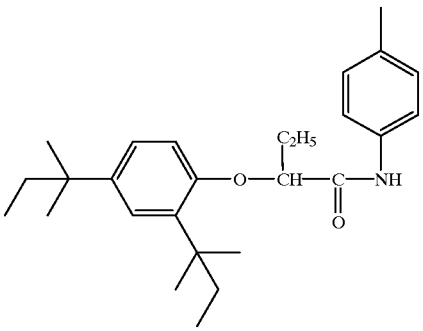 | 0 |
| A-155 | $CH_3$ | 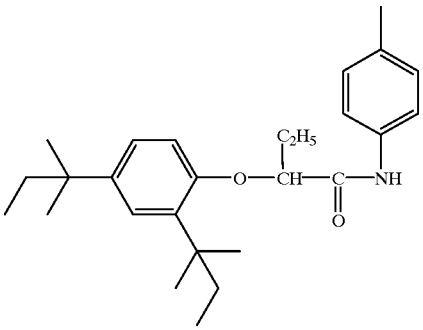 | 1 |

-continued
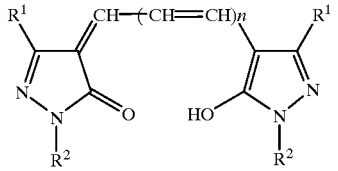
| Compound No. | $R^1$ | $R^2$ | n |
|---|---|---|---|
| A-156 | $CH_3$ | 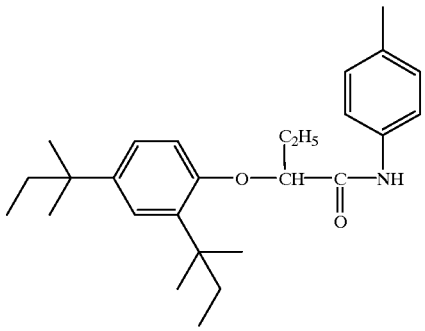 | 2 |
| A-157 | 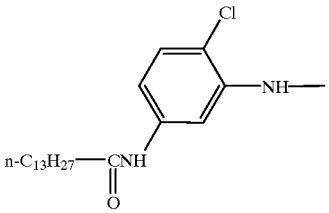 | 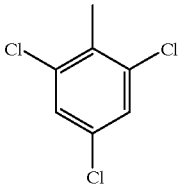 | 0 |
| A-158 | 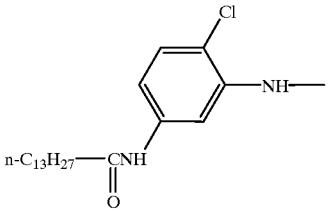 | 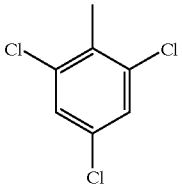 | 1 |
| A-159 | 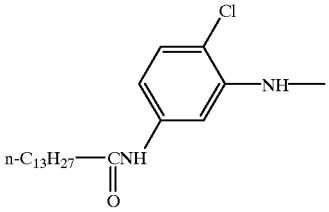 | 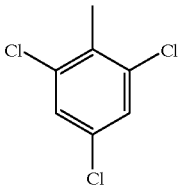 | 2 |
| A-160 | NC | 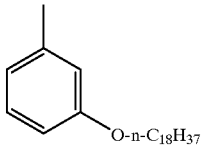 | 0 |
| A-161 | NC | 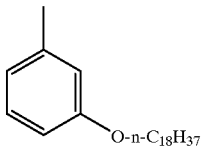 | 1 |

-continued
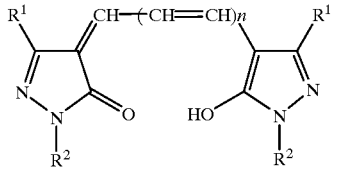
| Compound No. | $R^1$ | $R^2$ | n |
|---|---|---|---|
| A-162 | NC | 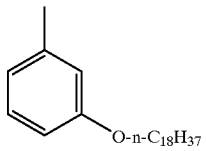 | 2 |
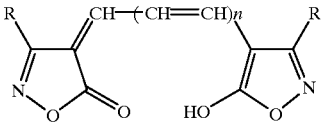
| Compound No. | R | n |
|---|---|---|
| A-163 | 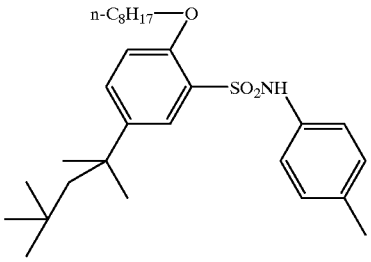 | 0 |
| A-164 | 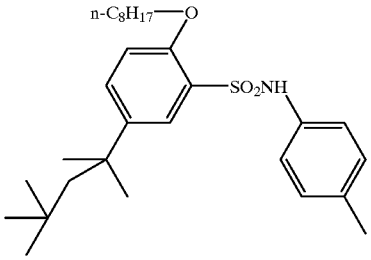 | 1 |
| A-165 | 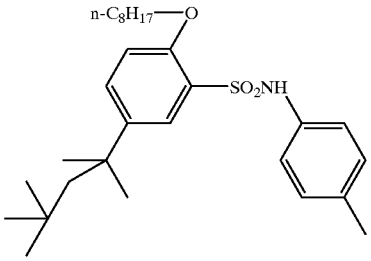 | 2 |

-continued
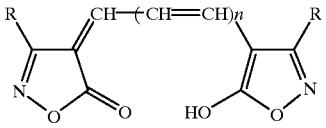
| Compound No. | R | n |
|---|---|---|
| A-166 | 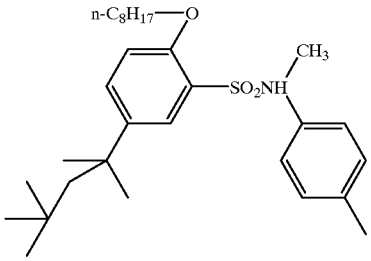 | 0 |
| A-167 | 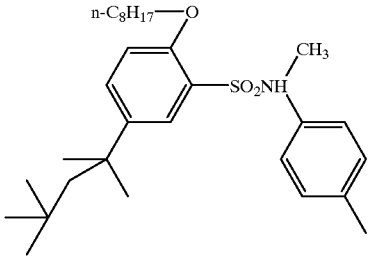 | 1 |
| A-168 | 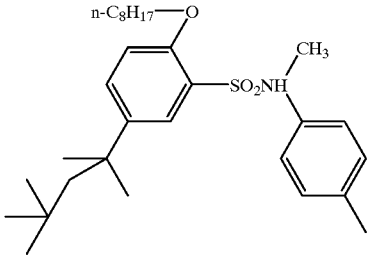 | 2 |
| A-169 | 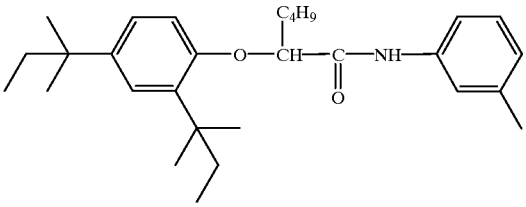 | 0 |
| A-170 | 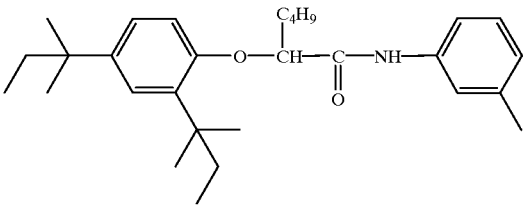 | 1 |

-continued
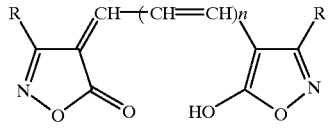
| Compound No. | R | n |
|---|---|---|
| A-171 | 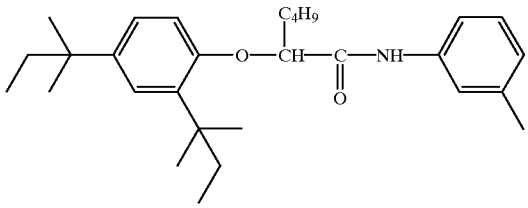 | 2 |
| A-172 | 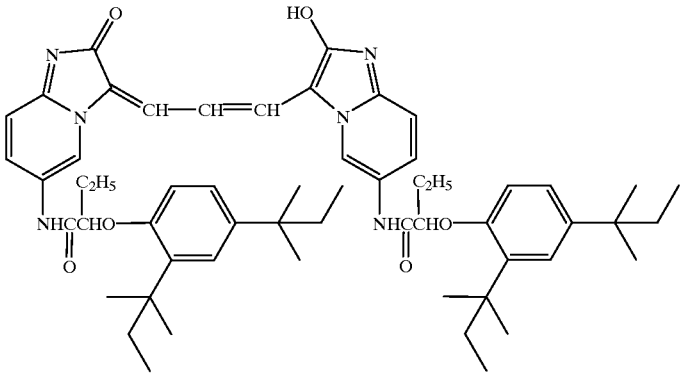 | |
| A-173 | 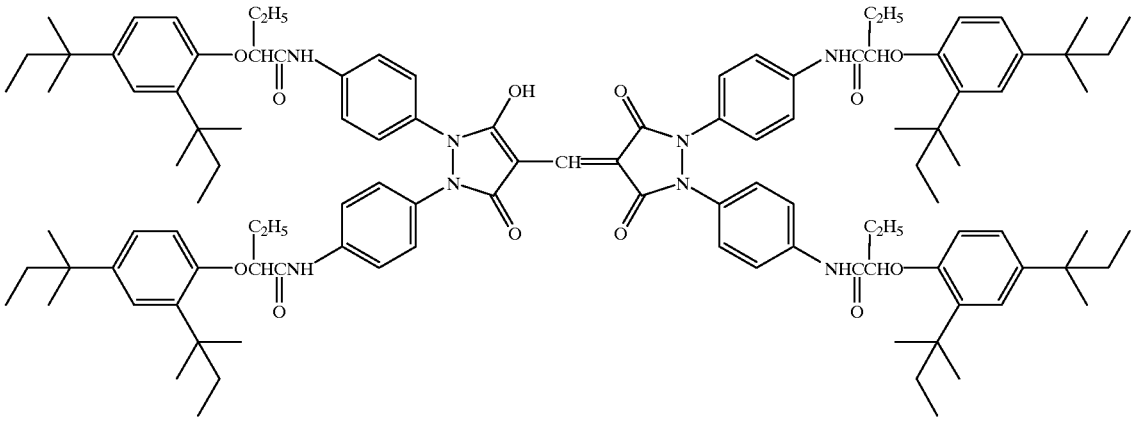 | |
| A-174 | 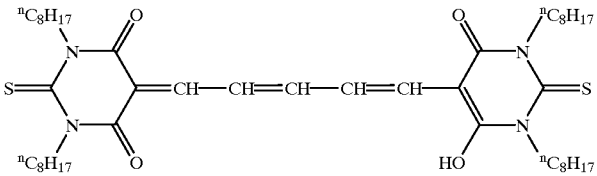 | |
| A-175 | | |

-continued

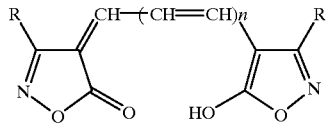

| Compound No. | R | n |
|---|---|---|
| | | |

Dyes which may be used in the present invention are prepared by use of or according to methods described, for example, in WO88/04794, EP-274,723, EP-276,556, EP-299,435, U.S. Pat. Nos. 2,572,583, 3,486,897, 3,746,539, 3,933,798, 4,130,429, and 4,040,841, JP-A Nos. 48-68623, 52-92716, 55-155350, 55-155351, 61-205934, 2-173630, 2-230135, 2-277044, 2-282244, 3-7931, 3-167546, 3-13937, 3-206443, 3-208047, 3-192157, 3-216645, 3-274043, 4-37841, 4-45436, 4-138449, and 5-197077, and JP-A Nos. 6-332112, 7-206824, and 8-20582.

Specific synthesis examples of Compound Nos. A10, A100, and A134, which are typical compounds of the present invention, will be described below.

An acetonitrile (250 ml) solution of Compound No. A10-2 (0.52 mol) was cooled to −7° C. in an ice-methanol bath, and phosphorus oxychloride (0.55 mol) was added to the solution while the temperature of the reaction mixture being maintained at 15° C. or less. Subsequently, an acetonitrile (150 ml) solution of Compound No. A10-1 (0.5 mol) was added dropwise to the resultant solution while the interior temperature being maintained at 5° C. or less. The cooling bath was removed, and the mixture was stirred for an additional 1 hour. The reaction mixture was poured into ice-water (1 liter), and an aqueous solution (water: 500 ml) of sodium hydroxide (100 g) was added thereto. The reaction mixture was subjected to extraction twice with ethyl acetate (500 ml). The organic layer was washed with brine Example of Synthetic route for compound No. A10

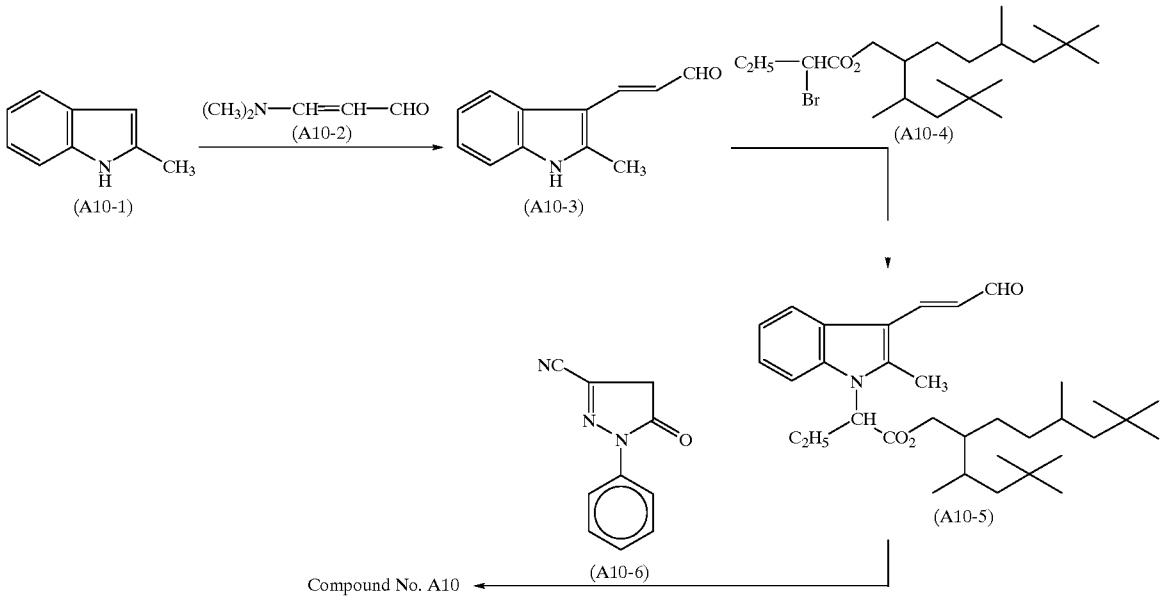

and concentrated. Recrystallization of the residue from methanol afforded Compound No. A10-3 (yield 49%).

Compound No. A10-3 (0.05 mol), Compound No. A10-4 (0.05 mol), and potassium carbonate (0.10 mol) were reacted in N,N-dimethylacetamide (200 ml) at 100° C. for 3 hours. The reaction mixture was cooled to room temperature, mixed with ethyl acetate (200 ml), and filtered to remove insoluble components. The filtrate was washed with 2N hydrochloric acid, water, and brine and concentrated to quantitatively obtain Compound No. A10-5.

Compound No. A10-5 (0.03 mol) and Compound No. A10-6 (0.03 mol) were refluxed in ethanol (80 ml) for 5 hours. After the solvent was removed by distillation, the residue was purified by silica gel chromatography (gradient eluent: methylene chloride/hexane=4/1 to 1/0) to obtain Compound No. A10 (yield 76%).

Synthesis of Compound A-100

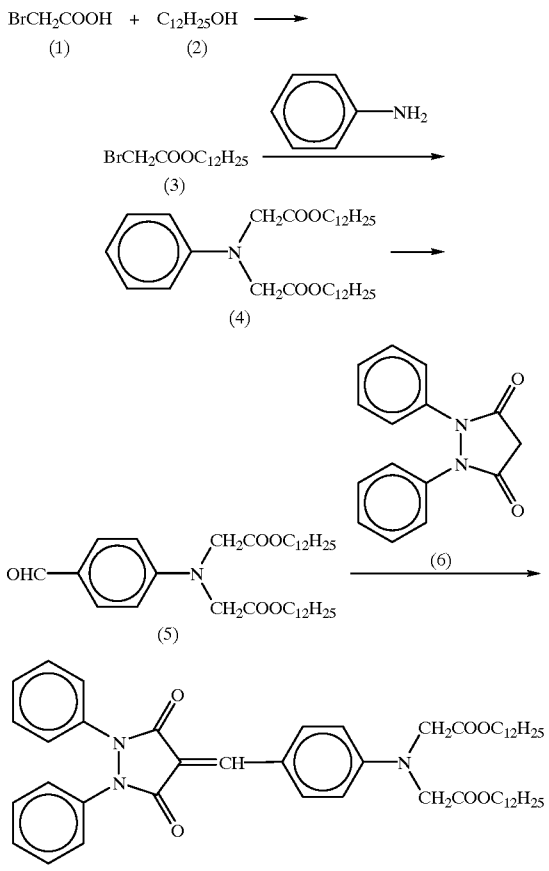

Bromoacetic acid (a) (76.4 g, 0.55 mol), dodecanol (b) (93.2 g, 0.5 mol), and p-toluenesulfonic acid monohydrate (1.4 g) were dissolved in toluene (200 ml). The mixture was refluxed for 1 hour while the formed water was azeotropically removed, followed by washing 3 times with 2% aqueous solution of sodium carbonate, dehydrating with magnesium sulfate, and concentrating to thereby obtain a transparent ester (c) (yield 100%).

Aniline (21.1 g, 0.227 mol), the above ester (c) (0.5 mol), potassium carbonate (105 g, 0.75 mol) and sodium iodide (11.2 g, 0.075 mol) were dissolved in dimethylacetamide (300 ml) and the resultant mixture was stirred with heat at 80° C. in an nitrogen atmosphere for 4 hours. After cooling, the mixture was mixed with water and ethyl acetate to separate the organic phase and the water phase. The organic phase was washed twice with water, dehydrated over magnesium sulfate, and concentrated, to thereby obtain a solution containing aniline (d) as a main component.

Dimethylformamide (300 ml) was stirred under cooling conditions to 10° C. or less. Phosphorus oxychloride (69.6 g, 0.454 mol) was added dropwise thereto so that the temperature did not exceed 20° C. The mixture was continuously stirred for 30 minutes at 20° C., to which a solution containing aniline (d) was added. The mixture was stirred at 60° C. for 1 hour. After the mixture was cooled, water (1 liter) and potassium hydroxide (110 g) were successively added carefully so as to adjust the pH to 8. The resultant solution was extracted with ethyl acetate. The oil phase was washed twice with water, dehydrated over magnesium sulfate, and concentrated. The residue was cooled through addition of acetonitrile to form benzaldehyde (e) with pale brown crystals, which were isolated by filtration and washed with cold acetonitrile. The yield of benzaldehyde (e) was 74.2 g (57% based on aniline).

Pyrazolidinedione (f) (6.31 g, 0.025 mol), the above-mentioned benzaldehyde (e) (15.8 g, 0.0275 mol), and acetic anhydride (7.7 g, 0.075 mol) were dissolved in ethanol (50 ml) and the mixture was refluxed for 2 hours. The solution was cooled to precipitate crystals, which were isolated by filtration and washed with cold ethanol to thereby obtain Compound No. A-100 as pale yellow crystals. The yield of Compound No. A-100 was 16.4 g (81.2% based on pyrazolidinedione (f)).

Synthesis of Compound No. A-134

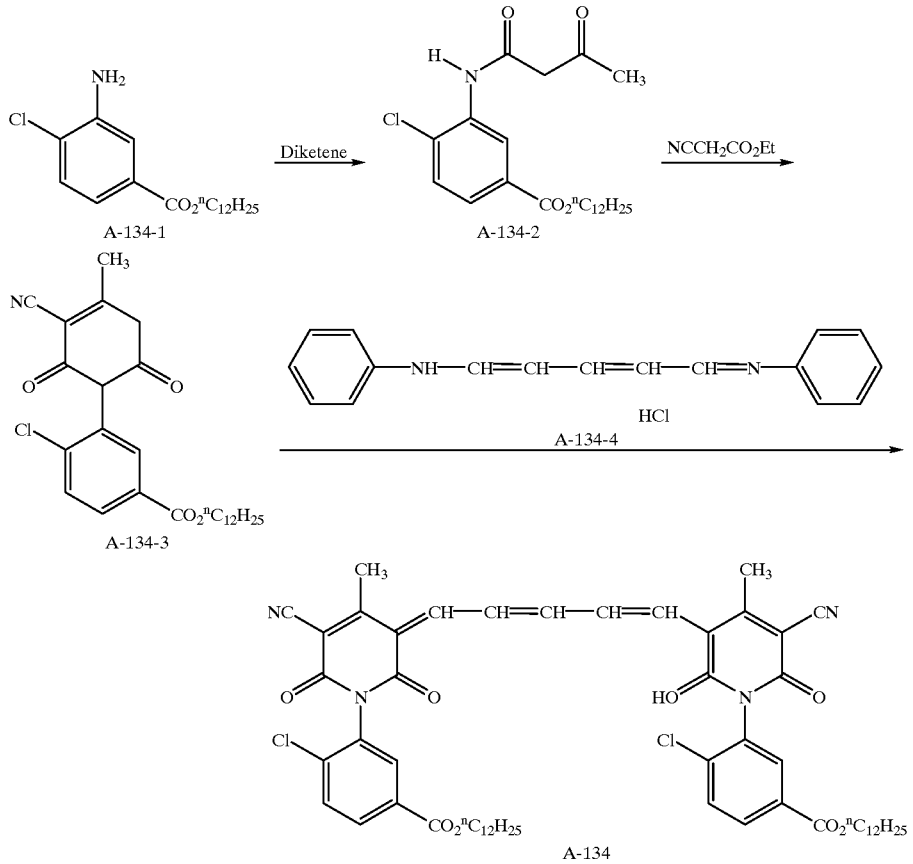

Diketene (347 ml) was added dropwise over 30 minutes to a mixture of Compound No. A134-1 (1020 g), pyridine (24.3 ml), and N,N-dimethylacetamide (2 liters) placed in a three-necked flask while the mixture was stirred with the application of heat (interior temperature: 85° C). The resultant solution was stirred for an additional 3 hours with heat, followed by cooling to room temperature and extracting with ethyl acetate (4 liters) and water (4 liters). The ethyl acetate phase was washed 5 times with a mixture of saturated brine (500 ml) and water (2 liters) and dehydrated over sodium sulfate anhydrate. The solution was concentrated in a rotary evaporator and the resultant residue was mixed with isopropyl alcohol (2.5 liters) to form crystals, which were isolated by filtration to thereby obtain Compound No. A134-2 (yield 944 g, 74%).

Piperidine (119 ml) was added dropwise over 5 minutes to a mixture of the above-mentioned Compound No. A134-2 (424 g) and isopropyl alcohol (900 ml) in a three-necked flask while stirring at room temperature. After completion of addition, ethyl cyanoacetate (128 ml) was added dropwise for 10 minutes to the resultant mixture under reflux with heat. The resultant solution was further stirred for 3 hours under reflux with heat, followed by cooling to room temperature and extracting with ethyl acetate (2 liters) and water (2 liters). The obtained ethyl acetate phase was washed 5 times with a mixture of saturated brine (300 ml) and water (1 liter) and dehydrated with sodium sulfate anhydrate. The solution was concentrated in a rotary evaporator and the residue was mixed with acetonitrile (1.2 liters). Concentrated hydrochloric acid (129 ml) was added dropwise over 20 minutes to the resultant acetonitrile solution with stirring in ice bath. The crystals that precipitated were isolated by filtration to thereby obtain Compound No. A134-3 (yield 393 g, 83%).

Piperidine (202 ml) was added dropwise over 25 minutes to a mixture of the above-mentioned Compound No. A134-4 (142 g) and acetonitrile (1.5 liters) in a three-necked flask while stirring at a room temperature. Subsequently, acetic anhydride (94 ml) was added dropwise over 10 minutes to the resultant mixture. After completion of addition, the resultant solution was stirred for 10 minutes. Compound No. A134-3 (473 g) was added thereto over 20 minutes to the resultant solution, followed by stirring for 3 hours and an additional 1 hour stirring in ice bath. The crystals that precipitated were isolated by filtration to thereby obtain Compound No. A134 (yield 388 g, 77%).

The structure of each of these compounds was confirmed by NMR, MS spectrum, and elementary analysis.

The above-mentioned dyes in the present invention are used in a yellow filter layer, a magenta filter layer, or an anti-halation layer, each layer serving as a decolorizing dye layer. Consequently, in case in which the light-sensitive layers comprising a red-sensitive layer, a green-sensitive layer, and a blue-sensitive layer in this order from the most vicinity of the support, a yellow filter layer may be provided between the blue-sentitive layer and the green-sensitive layer; a magenta filter layer may be provided between the green-sensitive layer and the red-sensitive layer; and a cyan filter layer (anti-halation layer) may be provided between the red-sensitive layer and the support. The amounts of dyes are such that transmission densities of the yellow filter layer, magenta filter layer, and the antihalation filter layer for blue light, green light, and red light, respectively, may come to be 0.03 to 3.0, more preferably 0.1 to 2.0. Specifically, the amount may be 0.005 to 2 mmol/$m^2$, more preferably 0.05 to 1 mmol/$m^2$, depending on $\epsilon$ and the molecular weight of the dye.

The light-sensitive material in the present invention may contain two or more dyes in a single layer. Thus, the above-mentioned anti-halation layer may contain a mixture of an yellow dye, a magenta dye, and a cyan dye.

The light-sensitive material of the present invention contains a decolorizing dye. Before the dye is incorporated into the light-sensitive material, the dye is preferably dissolved in oil and/or an oil-soluble polymer, and then the thus-formed oil droplets are dispersed in a hydrophilic binder. Preferable methods for preparing dye dispersions include an emulsion dispersion method described, for example, U.S. Pat. No. 2,322,027. When this method is used, there may be employed an oil having high boiling point described, for example, in U.S. Pat. Nos. 4,555,470, 4,536,466, 4,587,206, 4,555,476, and 4,599,296 and JP-B No. 3-62256, optionally in combination with an organic solvent having a boiling point of 50° C.–160° C. An oil-soluble polymer may be used instead of the oil or in combination with the oil. Some examples thereof are described in PCT Wo 88/00723. The oil having high boiling point and/or the polymer are used in an amount of 0.01 to 10 g, preferably 0.1 to 5 g per gram of the dye used.

Alternatively, the dye may be dissolved in a polymer through a latex dispersion method. Specific examples of latex used for impregnation in the process are described, for example, in U.S. Pat. No. 4,199,363, German Patent Application Laid-Open (OLS) Nos. 2,541,274, 2,541,230, JP-B No. 53-41091, and EP-029,104.

To disperse oil droplets in a hydrophilic binder, a variety of surfactants may be used. Such surfactants are described, for example, in JP-A No. 59-157636 (p37-p38) and Kochi Gijutsu Vol. 5 (published in Mar. 22, 1991 by As-tech Company Ltd., p136–p138). Alternatively, phosphate ester-type surfactants described in JP-A Nos. 7-56267 and 7-228589 and German Patent Application Laid-Open No. 932,299A may be used.

The hydrophilic binder may preferably be a water-soluble polymer. Examples of water-soluble polymers may include natural compounds such as proteins (e.g., gelatin and gelatin derivatives); polysaccharides such as cellulose derivatives, starch, acacia, dextrin, and pullulan; and synthetic polymer compounds such as polyvinyl alcohol, polyvinylpyrrolidone, and acrylamide polymers. These water-soluble polymers may be used in combination of two or more species. A combination with gelatin is particularly preferred. Gelatin may be selected from among lime-treated gelatin, acid-treated gelatin, and so-called delimed gelatin having a reduced calcium content, which may be used singly or in combination according to the purposes.

In the present invention, the dyes may decolorizeize through the reaction with a decolorizing agent in the processing stage.

The decolorizing agent or a precursor thereof in the present invention is preferably a nucleophilic agent or a precursor thereof, more preferably a base or a precursor thereof.

Examples of the decolorizing agent may include alcohols or phenols (R51OH), amines or anilines ($(R52)_3N$), hydroxylamines ($(R52)_2NOR52$), sulfinic acids ($R51SO_2H$) or their salts, sulfurous acid or their salts, thiosulfuric acid or their salts, carboxylic acids ($R51CO_2H$) or their salts, hydrazines ($(R52)_2NN(R52)_2$), guanidines ($[(R52)_2N]_2C{=}NH$), aminoguanidines ($(R52)_2NR52N(R52N)C{=}NH$), amidines, thiols (R51SH), cyclic or linear active methylene compounds ($Z53{-}CH_2{-}Z54$, wherein Z53 and Z54 are equivalent to Z51 and Z52 and may be linked to each other to form a ring), and anionic species derived from these compounds.

Of these, preferred ones are hydroxylamines, sulfinic acids, sulfurous acids, guanidines, aminoguanidines, heterocyclic thiols, cyclic or linear active methylene compounds, and active methine compounds, with guanidines and aminoguanidines being particularly preferred.

These decolorizing agents may be added incorporated into light-sensitive materials in advance or incorporated into the materials in processing stages through appropriate methods. Alternatively, the decolorizing agents may be transformed into precursors before being incorporated into the light-sensitive materials.

The above-mentioned decolorizing agents may decolorizeize the dyes through nucleophilic addition to the dye molecules induced by interaction thereof in processing stages. Preferably, the below-described steps are employed for forming a color image on a silver halide light-sensitive material and for decolorizing the dyes in a simultaneous fashion: image-forming exposing a silver halide light-sensitive material containing dyes; laminating a processing material containing a decolorizing agent or its precursor thereto subsequent to or simultaneous with the exposure so that their film surfaces are affixed to each other; heating; and separating the materials by peeling. In this case, the density of the dye after being decolorized is ⅓ or less, preferably ⅕ or less, the initial density. The amount of the decolorizing agent used is 0.1 to 200 times, preferably 0.5 to 100 times, that of the dye in mol.

The dyes of the present invention are usable in a variety of systems. Preferably, they are used in a system containing a self-contained color developing agent and a coupler. Detailed description of the developing agent and the coupler will be provided hereinlater.

The silver halides which may be used in the present invention are silver chloride, silver bromide, silver iodobromide, silver chlorobromide, silver chloroiodide, or silver chloroiodobromide.

The silver halide emulsions used in the present invention may be of the surface latent image type or of the internal latent image type. Internal latent image type emulsions, being used in combination with nucleating agents or fogging agents, serve as direct reversal emulsions. The internal latent image type emulsions may be of the core/shell type in which the inside portion and the surface portion of an emulsion particle have different phases. Alternatively, silver halides having different compositions may be joined together through epitaxial junction. The silver halide emulsions may be monodispersed emulsions or multidispersed emulsions. Preferably, as described in JP-A No. 1-167,743 and 4-223,463, monodispersed emulsions are mixed to thereby adjust gradation. The grain size is preferably within the range of 0.1 to 2 micrometers, particularly preferably 0.2 to 1.5 micrometers. The crystal habit of the silver halide grains may be of a regular crystal shape such as cubic, octahedral, and tetradecahedral; an irregular crystal shape such as spherical and high-aspect-ratio tabular; or of a crystal shape having crystal defect such as twinned crystal planes; or their combined shapes .

Preferred silver halide grains in the present invention will next be described.

In the present invention, at least one light-sensitive layer contains:

i) an emulsion containing silver halide grains comprised of at least 50 mol % silver chloride, wherein tabular grains having (100) major faces account for at least 50% of the projected area, each grain having a rectangular projected area of an adjacent edge ratio of 1:1 to 1:2 and an aspect ratio of at least 2; or ii) an emulsion containing silver halide grains comprised of at least 50 mol % silver chloride, wherein tabular grains having (111) major faces account for at least 50% of the projected area, each grain having a hexagonal projected area of an adjacent edge ratio of 1:1 to 1:10 and an aspect ratio of at least 2. In the context of the present invention, it suffices if 50% or more of the projected area of the silver halide grains contained in the emulsion satisfies the above-mentioned requirement. Preferably, not less than 70% of the projection area satisfies the above-mentioned requirement.

As used herein, the term "aspect ratio" refers to a value obtained by dividing the diameter of a circle that defines an area equivalent to the projected area by the grain thickness.

In a first mode of the present invention, the silver halide grain has (100) major outer surfaces. Therefore, the projected area of the grain provides a rectangular shape. It is necessary that the ratio of adjacent sides of the rectangular projected area fall within the range of 1:1 to 1:2. If an emulsion formed of rod-shaped grains or quasi-cubic rectangular parallelpiped grains is used, the effect of the present invention cannot be obtained. In the present invention, tabular grains each providing a substantially square-shaped projected area having an adjacent side ratio of 1:1 to 1:1.5 are preferred.

In a second mode of the present invention, the silver halide grain has (111) major outer surfaces. Therefore, the projected area of the grain provides a hexagonal shape. It is necessary that the ratio of two adjacent sides of the hexagonal projected area fall within the range of 1:1 to 1:10. If an emulsion formed of triangular-shaped grains is used, the effect of the present invention cannot be obtained. In the present invention, tabular grains each providing a substantially regular hexagonal projected area having an adjacent side ratio of 1:1 to 1:5 are preferred.

The shape of the silver halide grains may be determined by electromicroscopy through a carbon replica method in which silver halide grains and latex particles which serve as references for standard sizes are simultaneously subjected to shadowing with heavy metals.

Regarding the halogen composition of the silver halide grains of the present invention, the silver chloride based on content of silver chlorobromide, silver chloroiodide, or silver chloroiodobromide is 50 mol % or more. Needless to say, silver chloride itself may be used. Although the emulsions of the present invention may contain silver iodide, the silver iodide content is preferably not less than 2 mol %, more preferably not less than 1 mol %. It is also preferable that the silver halide emulsion is constituted by grains each having a layer structure having a plurality of intra-grain layers of different halogen compositions. When expressed by circle-equivalent projected area, the size of the silver halide grains used in the present invention is preferably 0.1 to 10 micrometers, more preferably 0.3 to 5 micrometers, and most preferably 0.5 to 4 micrometers.

In order to prepare an emulsion used in the present invention, i.e., an emulsion containing a silver halide grains comprised of at least 50 mol % silver chloride, wherein tabular grains having (100) major faces account for at least 50% of the projected area, each grain having a rectangular projected area of an adjacent edge ratio of 1:1 to 1:2 and an aspect ratio of at least 2, or an emulsion containing silver halide grains comprised of at least 50 mol % silver chloride, wherein tabular grains having (111) major faces account for at least 50% of the projected area, each grain having a hexagonal projected area of an adjacent edge ratio of 1:1 to 1:10 and an aspect ratio of at least 2, a variety of methods including conventionally known ones may be used.

When emulsions of tabular grains having (100) major outer surfaces with high AgCl content are prepared, methods described, for example, in JP-A Nos. 5-204,073, 51-88,017, 63-24,238, and 7-146,522 may arbitrarily be used.

Methods for preparing emulsions of tabular grains having (111) major outer surfaces with high AgCl content are described, for example, in U.S. Pat. Nos. 4,399,215, 4,404,463, and 5,217,858, and JP-A No. 2-32. In the case of emulsions with high AgCl content, under conditions in which no adsorptive substances are present, (100) faces generally come to be outer surfaces. Therefore, by use of an adsorptive substance that favors the (111) face, and through elimination of nuclei of regular crystals, single twinned crystal nuclei, and non-parallel twinned crystal nuclei during a physical ripening process after twin crystal nuclei are formed, nuclei of parallel multi-twinned crystals can be selectively obtained. The thus-obtained nuclei are allowed to grow, to thereby obtain a light-sensitive silver halide emulsion containing tabular grains. The rule of thumb regarding formation of silver chloride tabular grains showing (111) faces is reported in "Journal of Photographic Science," Vol. 36, page 182 (1988).

The critical point in the preparation of tabular grains used in the present invention is how to make nuclei that grow to have a tabular shape. In this regard, as described in the aforementioned literature in connection with preparation methods, addition of iodide ions or bromide ions during the initial stage of grain formation or addition of a compound that exhibits preferred adsorption on a specific face is effective.

The mean grain thickness of the tabular grains used in the present invention is from 0.01 to 0.5 micrometers, preferably from 0.01 to 0.4 micrometers, most preferably from 0.05 to 0.4 micrometers.

The mean grain thickness is an arithmetic average of the thickness of all the tabular grains contained in the emulsion.

In order to form tabular grains having a high aspect ratio, it is important that twin crystal nuclei of a small size be formed. To this end, a variety of measures are taken, including low temperature, high pBr content, low pH, use of a reduced amount of a specific type of gelatin with low methionine content or a low molecular weight, or use of a phthalated gelatin derivative, or nuclei formation in a reduced nuclei formation time.

After formation of nuclei, tabular grains (parallel multi-twinned crystal nuclei) alone are formed through physical ripening, to thereby eliminate nuclei of other regular crystals, single twinned crystal nuclei, and non-parallel twinned crystal nuclei so as to selectively form nuclei of parallel multi-twinned crystals. Thereafter, soluble silver salts and soluble halogen salts are added to induce growth of grains, yielding an emulsion formed of tabular grains.

The emulsion used in the present invention is preferably monodisperse.

The coefficient of variance of the circle-equivalent diameter of the projected area of all the silver halide grains contained in the emulsion used in the present invention is preferably 30% to 3%, more preferably 25% to 3%, most preferably 20% to 3%. The range over 30% is not preferred in terms of homogeneity of grains. However, the present invention is not limited by this numerical figure.

The coefficient of variance of circle-equivalent diameter represents a value obtained by dividing the standard deviation of the circle-equivalent diameters of respective silver halide grains by the mean circle-equivalent diameter.

When the grains have phases containing iodides or chlorides, these phases may be uniformly distributed within grains or may be localized.

Other silver salts, for example, silver rhodanide, silver sulfide, silver selenide, silver carbonate, silver phosphate, and organic acid salts of silver may be contained as separate grains or part of silver halide grains.

The tabular grains of the present invention may have dislocation lines.

A dislocation line is a linear lattice defect occurring along the boundary between a region which has already slid and a region which has not slid yet.

References regarding dislocation lines of a silver halide crystal include: 1) C. R. Berry, J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Phot. Sci. Jap., 34, 16 (1971); 5) T. Shiozawa, J. Soc. Phot. Sci. Jap., 35, 213 (1972). Dislocation lines can be analyzed by the X-ray diffraction method or the direct observation method through use of a low-temperature transmission electron microscope.

When dislocation lines are to be directly observed through a transmission electron microscope, silver halide grains are sampled from an emulsion while exercising care not to apply so large a pressure as to generate a dislocation line in grains, and the thus-sampled gains are placed on a mesh for observation through an electron microscope and are then observed by the transmission method while being cooled to prevent an electron beam-induced damage (such as printout).

In this case, since thicker grains are less likely to transmit an electron beam, it is desirable to use a high-voltage (200 kV or higher for a thickness of 0.25 $\mu$m) electron microscope in order to obtain a clear view.

JP-A No. 63-220,238 discloses a technique related to controlled introduction of dislocation lines into respective silver halide grains.

This publication demonstrates that tabular grains in which dislocation lines have been introduced are superior in photographic characteristics such as sensitivity and reciprocity to tabular grains having no dislocation lines.

In the case of tabular grains, the position and number of dislocation lines as viewed in a direction perpendicular to the main plane thereof can be obtained for each grain through study of the above-described electron-microphotograph of the grains.

Emulsions used in the present invention and other photographic emulsions to be used therewith will next be described.

Specifically, the present invention can use any of silver halide emulsions prepared using various methods as described, for example, in U.S. Pat. No. 4,500,626 (column 50), U.S. Pat. No. 4,628,021, *Research Disclosure* (abbreviated as IM, hereinafter) No. 17,029 (1978), RD No. 17,643, pp. (Dec. 22–23, 1978), RD No. 18,716, p.648 (Nov., 1979), EZ No. 307,105, pp. 863-865 (November, 1989), JP-A Nos. 62-253,159, 64-13,546, 2-236,546, 3-110, 555; and further, P. Grafkides, *Chemie et Phisque Photographique*, Paul Montel, Paris (1967); G. F. Duffin, *Photographic Emulsion Chemistry*, Focal Press, (1966); V. L. Zelikman et al., *Making and Coating Photographic Emulsion*, Focal Press, (1964); and so on.

In a process of preparing the light-sensitive silver halide emulsions used in the present invention, it is prferable to carry out the so-called desalting operation, that is, removal of excess salts from the silver halide emulsions. The removal can be effected using the noodle washing method which comprises gelling the gelatin, or using a flocculation method which takes advantage of a polyvalent anion-containing inorganic salt (such as sodium sulfate), an anionic surfactant, an anionic polymer (such as sodium polystyrenesulfonate), or a gelatin derivative (such as an aliphatic acylated gelatin, an aromatic acylated gelatin or an aromatic carbamoylated gelatin). Preferably, a flocculation method is employed in the present invention.

The light-sensitive silver halide emulsions used in the present invention may contain heavy metals such as iridium, rhodium, platinum, cadmium, zinc, thallium, lead, iron and osmium for various purposes. These compounds may be used alone, or as combination of two or more thereof. The amount of heavy metals added, though it depends on their intended purpose, is generally of the order of $10^{-9}$ to $10^{-3}$ mole per mole of silver halide. Those metals may be introduced into emulsion grains so that the distribution thereof is uniform throughout the grains or localized in the inner or surface part of the grains. Specifically, the emulsions described in e.g., JP-A Nos. 2-236,542, 1-116,637 and 4-126,629 are preferably used.

In the step for the formation of silver halide grains in the light-sensitive silver halide emulsions of the present invention, a rhodanate, ammonia, a tetra-substituted thiourea compound, an organic thioether derivative as described in JP-B No. 47-11,386, a sulfur-containing compound as described in JP-A No. 53-144,319 or so on can be used as a solvent for silver halides.

For details of other conditions descriptions in the above-cited books, namely P. Grafkides, *Chemie et Phisque Photographique*, Paul Montel, (1967); G. F. Duffin, *Photographic Emulsion Chemistry*, Focal Press, (1966); and V. L. Zelikman et al., *Making and Coating Photographic Emulsion*, Focal Press, (1964); may be referred to. Specifically, the present silver halide emulsions can be prepared by any of an acid process, a neutral process and an ammonia process. Further, a method suitably employed for reacting a soluble silver salt with a soluble halide may be any of a single jet method, a double jet method and a combination thereof. In order to obtain a monodisperse emulsion, a double jet method is preferably adopted.

Also, a reverse mixing method in which silver halide grains are produced in the presence of excessive silver ions may be employed. In addition, as a type of a double jet method the so-called controlled double jet method may also be used, in which the pAg of the liquid phase from which silver halide grains are to be precipitated is maintained constant.

Moreover, for the purpose of increasing the speed of grain growth, the concentration, the amount, and the incorporation rate of a silver salt or a halide may be increased (as described in JP-A Nos. 55-142,329, 55-158,124 and U.S. Pat. No. 3,650,757).

Further, the agitation of a reaction solution may be carried out by any of known methods. On the other hand, the temperature and the pH of a reaction solution during the formation of silver halide grains may be chosen properly in accordance with the intended purpose. An appropriate pH range is from 2.2 to 8.5, more preferably from 2.5 to 6.0.

Light-sensitive silver halide emulsions are, in general, chemically sensitized silver halide emulsions. In chemically sensitizing light-sensitive silver halide emulsions used in the present invention, there may be used known chemical sensitization processes for emulsions of conventional light-sensitive materials. Examples of these processes include a chalcogen sensitization process (e.g., a sulfur sensitization process, a selenium sensitization process and a tellurium sensitization process), a noble metal sensitization process (using gold, platinum, palladium or the like), and a reduction sensitization process. These processes may be employed alone or in combination of two or more (as described, e.g. in JP-A Nos. 3-110,555 and 5-241,267). Such chemical sensitization may also be carried out in the presence of a nitrogen-containing heterocyclic compound (as described in JP-A No. 62-253,159). Further, an anti-fogging agent recited hereinafter may be added after the completion of chemical sensitization. Specifically the addition of an anti-fogging agent can be performed in the ways as described in JP-A Nos. 5-45,833 and 62-40,446.

The pH during the chemical sensitization is preferably from 5.3 to 10.5, and more preferably from 5.5 to 8.5; while the pAg is preferably from 6.0 to 10.5, and more preferably from 6.8 to 9.0.

The amount of coating of light-sensitive silver halide used in the present invention is within the range of 1 mg to 10 g, preferably 0.1 g to 10 g, on a silver basis per square meter of a light-sensitive material.

In order to impart color sensitivities, including green sensitivity, red sensitivity, and infrared sensitivity, upon light-sensitive silver halide used in the present invention, light-sensitive silver halide emulsions are spectrally sensitized with methine dyes or other dyes. Further, if necessary, a blue-sensitive emulsion may be spectrally sensitized in the blue color region.

Suitable dyes which can be used for the foregoing purpose include cyanine dyes, merocyanine dyes, complex cyanine dyes, complex merocyanine dyes, holopolar cyanine dyes, hemicyanine dyes, styryl dyes and hemioxonol dyes.

Specific examples of such sensitizing dyes are disclosed in U.S. Pat. No. 4,617,257, JP-A Nos. 59-180,550, 64-13, 546, 5-45,828, 5-45,834, and so on.

These sensitizing dyes may be employed individually or in combination. In particular, combinations of sensitizing dyes are often used for supersensitization or for wavelength adjustment of spectral sensitization.

In addition to sensitizing dyes, there may be incorporated, into silver halide emulsions, other dyes which themselves do not spectrally sensitize silver halide emulsions, or compounds which do not substantially absorb light in the visible region but can exhibit supersensitizing effect (see, for example, U.S. Pat. No. 3,615,641 and JP-A No. 63-23,145).

These sensitizing dyes may be added to silver halide emulsions during, before, or after the chemical ripening, or before or after the formation of the nuclei of silver halide grains according to the descriptions of U.S. Pat. Nos. 4,183,756 and 4,225,666. These sensitizing dyes and supersensitizers may be added to the emulsion as a solution in an organic solvent, such as methanol, dispersion in gelatin or solution containing a surfactant. A suitable amount of each of such ingredients added is generally in the range of from $10^{-8}$ to $10^{-2}$ mole per mole of silver halide.

Additives used in the aforementioned steps and known photographic additives which can be used in the present invention are described in the aforementioned RD Nos. 17,643, 18,716 and 307,105, and the portions where relevant descriptions are given are shown below.

| Additives: | RD 17,643 | RD 18,716 | RD 307,105 |
|---|---|---|---|
| 1. Chemical sensitizer | pp. 23 | pp. 648, RC | pp. 866 |
| 2. Sensitivity enhancer | | pp. 648, RC | |
| 3. Spectral sensitizer/ Supersensitizer | pp. 23–24 | pp. 648, RC – pp. 649, RC | pp. 866–868 |
| 4. Brightening agent | pp. 24 | pp. 648, RC | pp. 868 |
| 5. Anti-fogging agent/Stabilizer | pp. 24–26 | pp. 649, RC | pp. 868–870 |
| 6. Light absorber/ Filter bye/ Ultraviolet ray absorber | pp. 25–26 | pp. 649, RC – pp. 650, LC | pp. 873 |
| 7. Dye image stabilizer | pp. 25 | pp. 650, LC | pp. 872 |
| 8. Film hardener | pp. 26 | pp. 651, LC | pp. 874–875 |
| 9. Binder | pp. 26 | pp. 651, LC | pp. 873–874 |
| 10. plasticizer/ Lubricant | pp. 27 | pp. 650, RC | pp. 876 |
| 11. Coating aid/ Surfactant | pp. 26–27 | pp. 650, RC | pp. 875–876 |
| 12. Anti-static agent | pp. 27 | pp. 650, RC | pp. 876–877 |
| 13. Matting agent | | | pp. 878–879 |

(RC: right column, LC: left column)

In the first and second embodiments of the light-sensitive material according to the second aspect of the present invention, the light-sensitive material is constructed such that a photographic constituent layer placed on a support therefor, the photographic constituent layer including at least one photographic light-sensitive layer formed of light-sensitive silver halide, a compound that forms a dye through a coupling reaction with an oxidized product of a developing agent (the compound will hereafter may be referred to as a coupler), and a binder.

In the present invention, there may basically be employed color reproduction through a subtractive color process in order to prepare a light-sensitive material used for recording original scenes and reproducing recorded scenes in the form of color images. That is, there are provided at least three light-sensitive layers which have individual photosensitivities in blue, green, and red regions, each of which layers contains a color coupler capable of forming dyes of yellow, magenta, or cyan having the relation of a complementary color to its own light-sensitive wavelength region, thereby recording color information regarding original scenes. Color photographic printing paper having the relationship between light-sensitive wavelengths and hues to be developed similar to that of the light-sensitive material is exposed to light which has passed through the thus-obtained dye images, to thereby reproduce original scenes. Alternatively, information regarding dye images obtained through the photographing of original scenes may be read by a scanner or the like, and based on the thus-read information, images may be reproduced for viewing.

The light-sensitive material of the present invention may comprise a light-sensitive layer sensitive to light of three or more wavelength regions.

Also, light-sensitive wavelength regions and hues to be developed may have relationship other than the above-mentioned relationship of a complementary color and light sensitive. In such a case, read image information may undergo image processing such as hue conversion so as to reproduce original color information.

According to the present invention, it is preferable that at least two kinds of silver halide emulsions sensitive to light of the same wavelength region and having different mean grain projected areas be contained. The expression "sensitive to light of the same wavelength region" as used in the present invention refers to "effectively sensitive to light of the same wavelength region." Accordingly, even when emulsions are somewhat different in spectral sensitivity, the emulsions are considered as sensitive to light of the same wavelength region if their major light-sensitive regions overlap each other.

In this case, difference in mean grain projected area between the emulsions is preferably 1.25 times, more preferably 1.4 times or greater, most preferably 1.6 times or greater. When three kinds or more of emulsions are used, this relationship is preferably satisfied between emulsions having a smallest mean grain projected area and a largest mean grain projected area.

According to the present invention, in order to incorporate in a light-sensitive material a plurality of emulsions sensitive to light of the same wavelength region and having different mean grain projected areas, separate light-sensitive layers may be provided for respective emulsions, or alternatively a single light-sensitive layer may mixedly contain these emulsions.

When these emulsions are contained separately in respective layers, an emulsion having a greater mean grain projected area is preferably contained in an upper layer (positioned closer to an incident light source).

When these emulsions are contained separately in respective layers, color couplers to be combined preferably have the same hue. However, light-sensitive layers may have different hues to be developed through the mixing of couplers which develop into different hues. Alternatively, couplers having different hue-absorbing profiles may be contained in respective light-sensitive layers.

In the present invention, emulsions sensitive to light of the same wavelength region are preferably applied such that the ratio of the number of silver halide grains per unit area of a light-sensitive material contained in these emulsions comes to be greater than the ratio of a value obtained by dividing the amount of silver of an applied emulsion by the mean grain projected area of silver halide grains contained in the emulsion to the 3/2 power and such that this tendency is more remarkable for an emulsion having a greater mean grain projected area. This provides images having good granularity even when development is performed at high temperatures. Also, high developing performance and wide exposure latitude are both attained.

Conventionally, in order to attain a desired granularity value of a color negative for photographing use, not only has a silver halide emulsion been improved, but also there has been used a so-called DIR coupler which releases a development-inhibiting compound upon coupling reaction with an oxidized product of a developing agent. A light-sensitive material of the present invention provides an excellent granularity value even when no DIR coupler is used, and will provide a more improved granularity value when a DIR compound is used in combination.

In the present invention, organometal salts may be used as oxidizer together with light-sensitive silver halide. Among these organometal salts, an organic silver salts are particularly preferable.

Examples of the organic compounds which may be used for the preparation of the above-mentioned organic silver salts serving as an oxidant include benzotriazoles, fatty acids and other compounds described in U. S. Pat. No. 4,500,626, columns 52–53. The silver acetylide, which is described in U. S. Pat. No. 4,775,613, is also useful. These organic silver salts may be used alone or in a combination of two or more of them.

The organic silver salts may be used in an amount of from 0.01 to 10 moles, preferably from 0.01 to 1 mole, per mole of light-sensitive silver halide. The total weight of the light-sensitive silver halide and the organic silver salts used for coating is in the range of 0.05 to 10 g/m$^2$, preferably 0.1 to 4 g/m$^2$, in terms of the weight of silver.

The binder for a constituent layer of the light-sensitive material is preferably hydrophilic material, examples of which include those described in the aforementioned RD, and those described at pages 71-75 of JP-A No. 64-13546. Specifically, the binder is preferably a transparent or translucent hydrophilic binders, exemplified by a naturally occurring compound, such as a protein including gelatin and a gelatin derivative; and polysaccharides including a cellulose derivative, starch, gum arabic, dextran and pullulane, as well as a synthetic polymer such as polyvinyl alcohol, polyvinyl pyrrolidone and acrylamide polymer. Also usable as the binder is a highly water-absorbent polymer described in U.S. Pat. No. 4,960,681 and JP-A No. 62-245,260. More specifically, those polymers are homo- or copolymers of vinyl monomers having —COOM or —$SO_3$M (wherein M stands for a hydrogen atom or an alkali metal), and copolymers of a vinyl monomer having the foregoing group and other vinyl monomers (e.g., such as sodium methacrylate and ammonium methacrylate, Sumikagel L-5H, trade name, a product of Sumitomo Chemical Co., Ltd.). The binders recited above may be used in combination of two or more thereof. In particular, it is preferable to use gelatin in combination with some of the foregoing binders. As for the gelatin, lime-processed gelatin, acid-processed gelatin or delimed gelatin having reduced contents of calcium and the like may be properly chosen depending on the intended purpose. Also, it is preferable that those gelatins be used in combination.

In the present invention, the weight of the binder used for coating is preferably not more than 30 g/m$^2$, more preferably 1 g/m$^2$ to 20 g/m$^2$, most preferably 2 g/m$^2$ to 15 g/m$^2$.

Four-equivalent couplers and two-equivalent couplers may both be used in the present invention. Their non-diffusion groups may form a polymer chain. Specific examples of such couplers are described in detail in T.H. James, "The Theory of the Photographic Process," 4th edition, pages 291-334 and 354-361, and JP-A Nos. 58-123,533, 58-149,046, 58-149,047, 59-111,148, 59-124,399, 59-174,835, 59-231,539, 59-231,540, 60-2,950, 60-2,951, 60-14,242, 60-23,474, 60-66,249, 8-110,608, 8-146,552 and 8-146,578.

In addition, the following couplers are preferably used in the present invention.

Yellow couplers: couplers represented by formulas (I) and (II) described in EP-A-502424, the couplers represented by formulas (1) and (2) described in EP-A-513496, the coupler represented by formula (1) in claim 1 of Japanese Patent Application No. 4-134,523, the coupler represented by formula D in column 1, lines 45–55, of U.S. Pat. No. 5,066,576, the coupler represented by formula D in paragraph [0008] of JP-A No. 4-274,425, the coupler described in claim 1 (at page 40) of EP-Al-498,381, the coupler represented by formula (Y) at page 4 of EP-A1-447,969, and the couplers represented by formulas (I) to (IV) in column 7, lines 36 and 58, of U.S. Pat. No. 4,476,219.

Magenta couplers: couplers described in JP-A Nos. 3-39,737, 6-43,611, 5-204,106 and 4-3,626.

Cyan couplers: couplers described in JP-A Nos. 4-204, 843, 4-43,345 and Japanese Patent Application No. 4-23, 633.

Polymeric couplers: couplers described in JP-A No. 2-43, 345.

Examples of preferred couplers that allow color-developing dyes to exhibit suitable diffusion property include those described in U.S. Pat. Nos. 4,366,237, GB-2, 125,570, EP-096570, and DE-3,234,533.

Examples of the couplers which may be used in the present invention may include those described in the aforementioned literature related to color-generating developing agents, as well as those described in the citations referred to in such literature. Typical examples of couplers are listed below.

Four-equivalent couplers

C-1

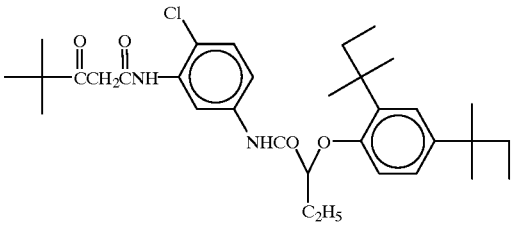

C-2

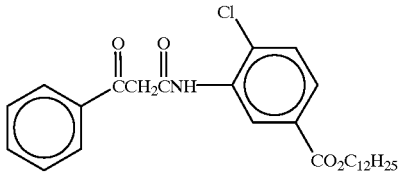

C-3

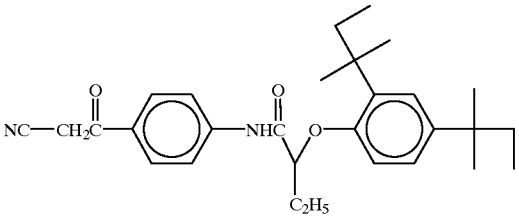

C-4

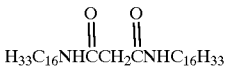

C-5

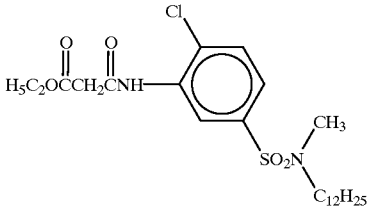

C-6

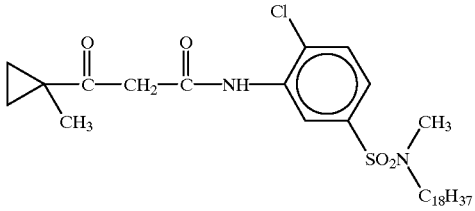

C-7

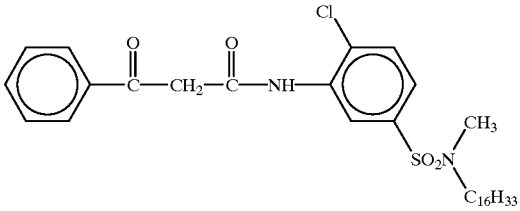

C-8

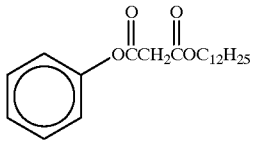

C-9

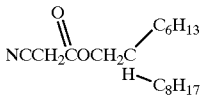

C-10

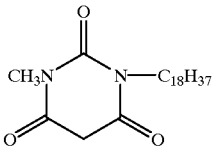

C-11

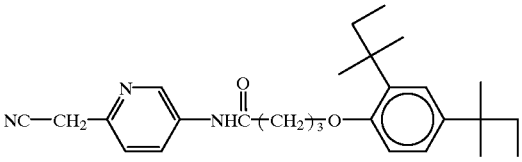

C-12

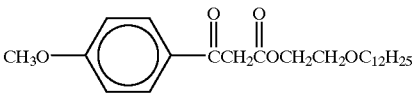

-continued
C-13
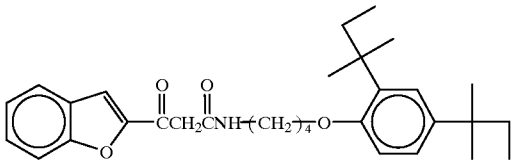
C-14
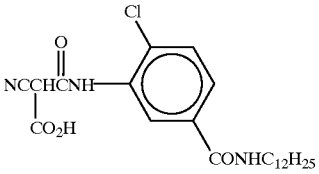
C-15
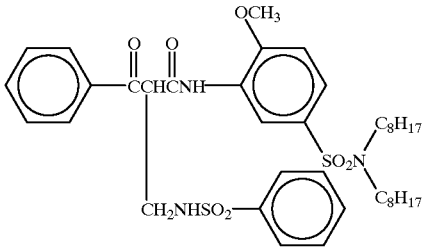
C-16
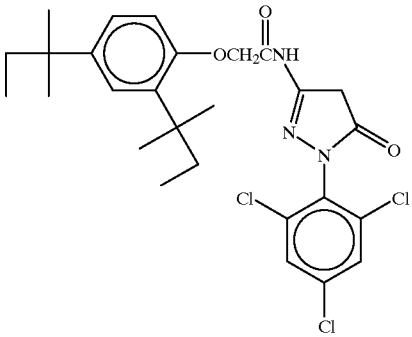
C-17
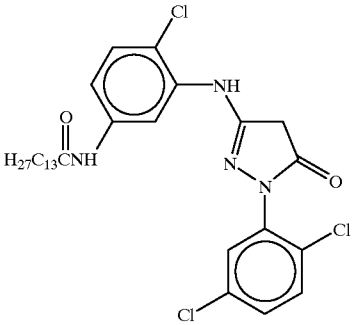
C-18
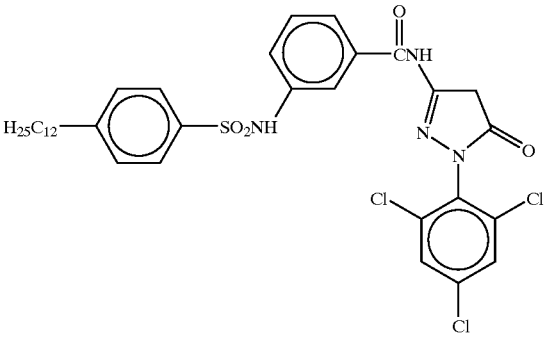
C-19
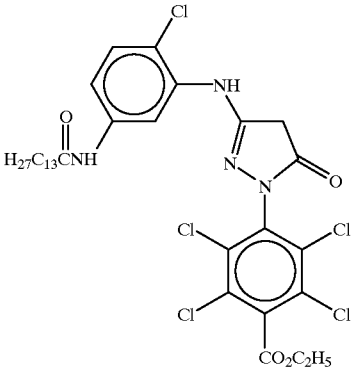
C-20
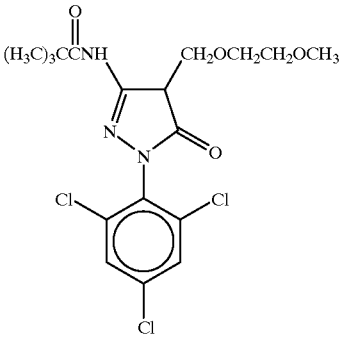

-continued
C-21
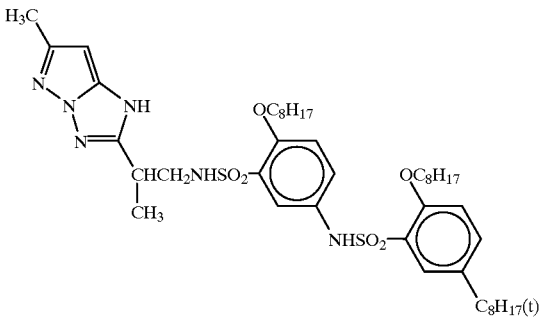
C-22
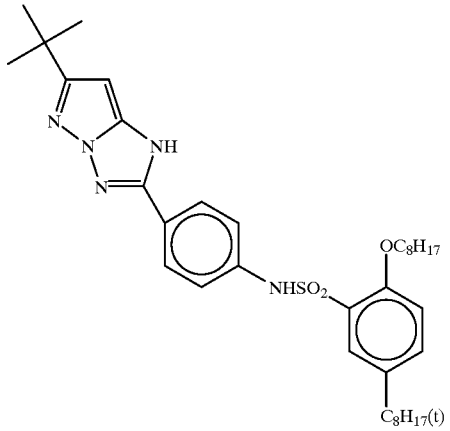
C-23
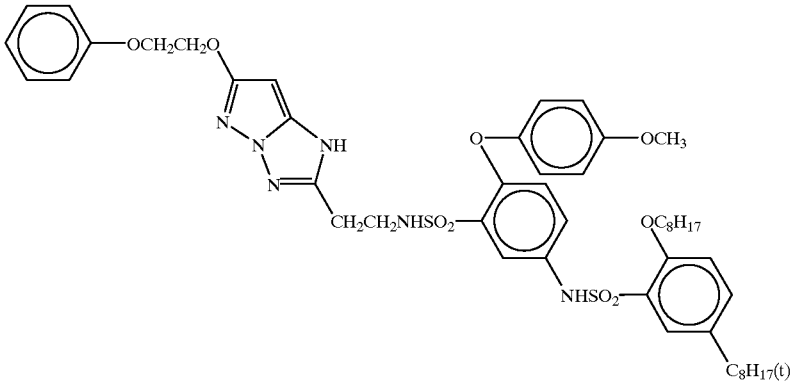
C-24
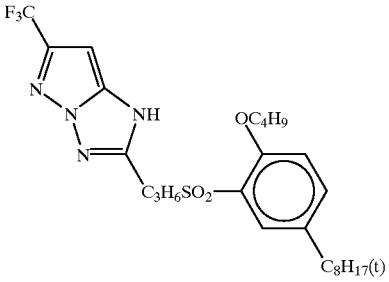
C-25
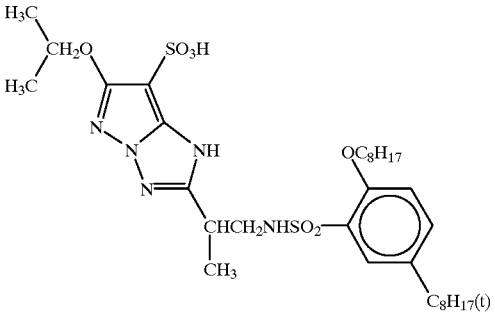
C-26
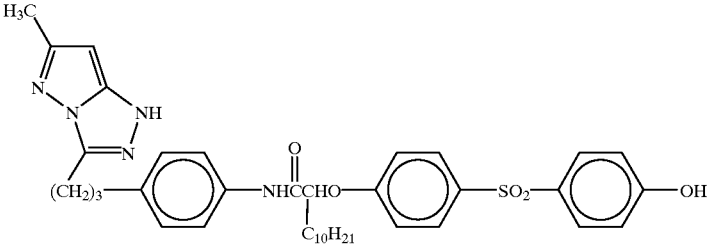

-continued
C-27
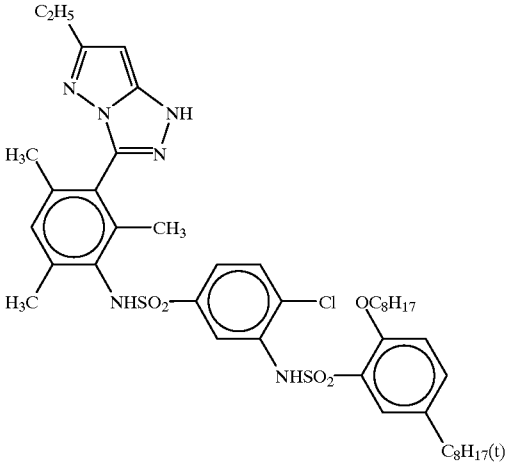
C-28
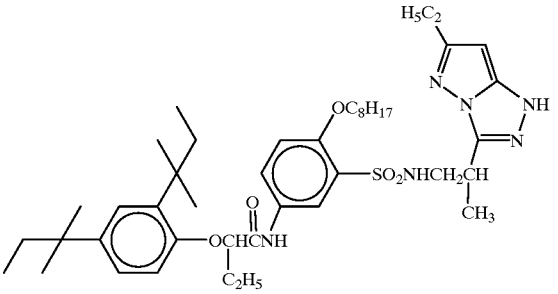
C-29
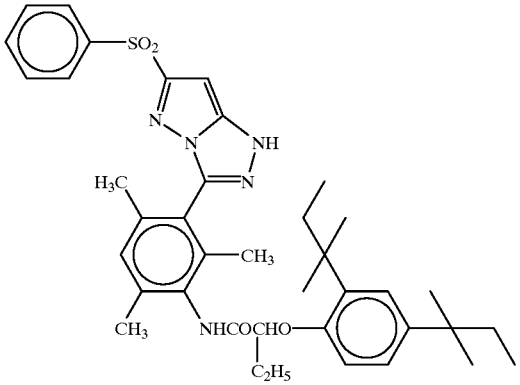
C-30
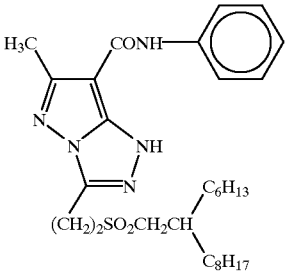
C-31
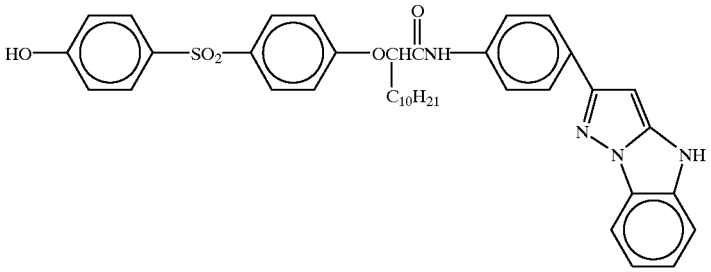
C-32
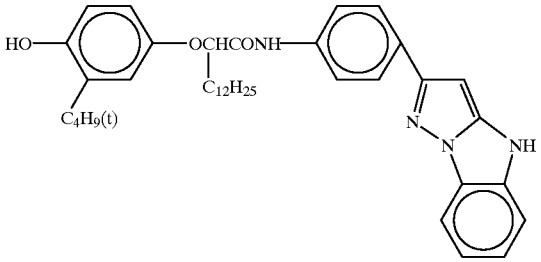

-continued
C-33
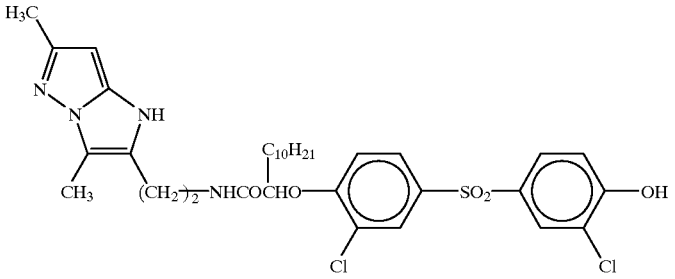
C-34
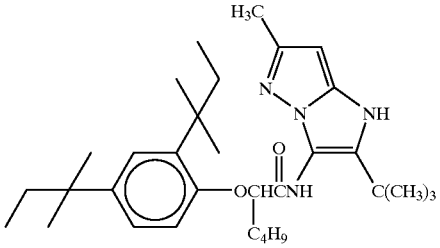
C-35
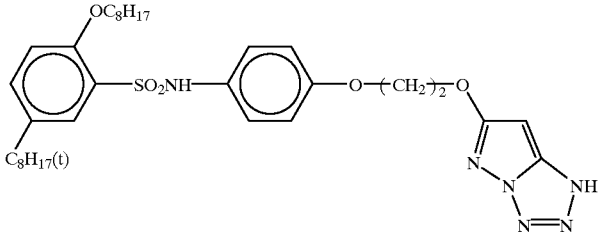
C-36
C-37
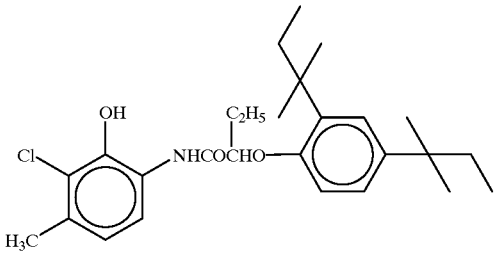
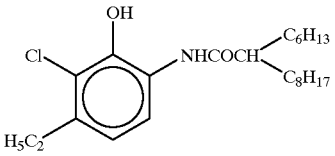
C-38
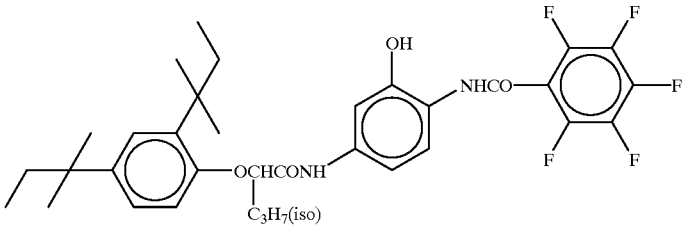
C-39
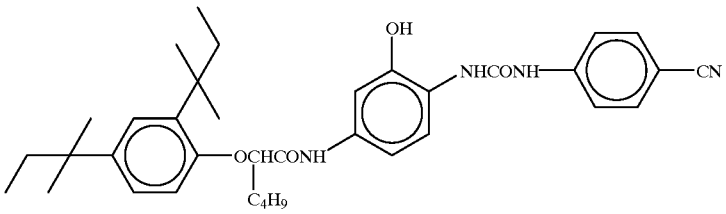

-continued
C-40
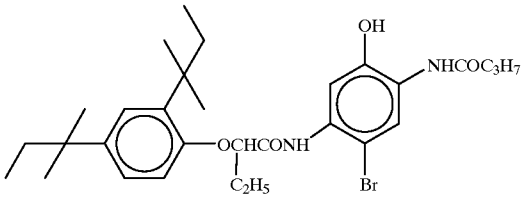
C-41
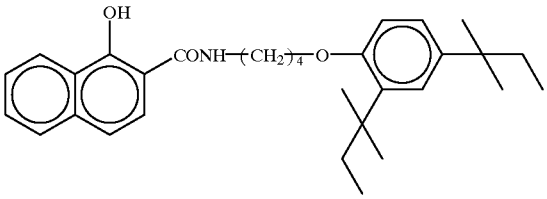
C-42
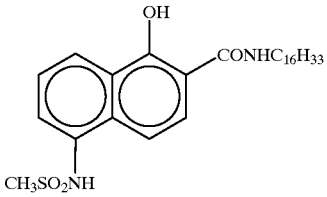
C-43
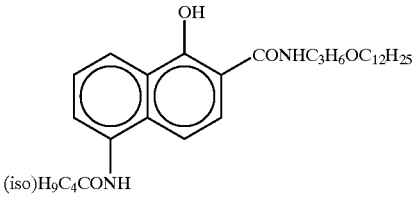
C-44
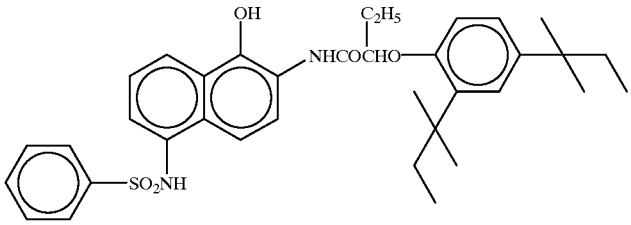
C-45
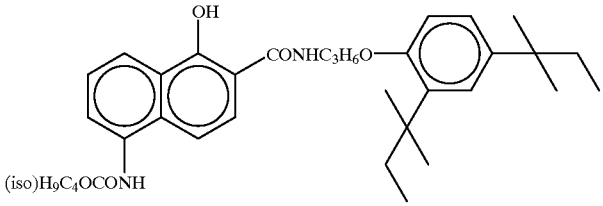
C-46
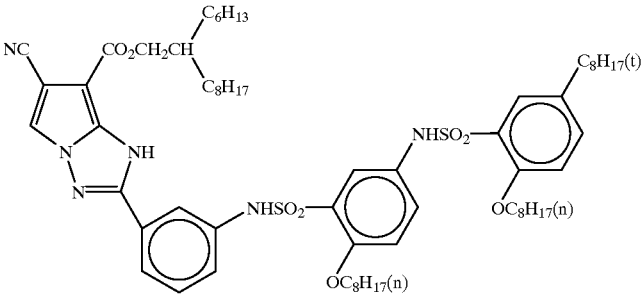

-continued
C-47
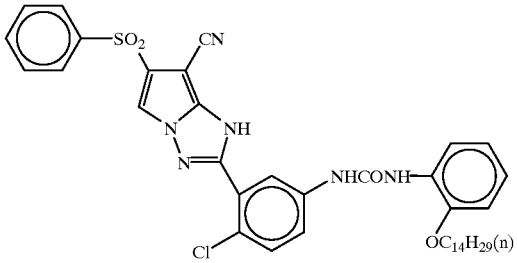
C-48
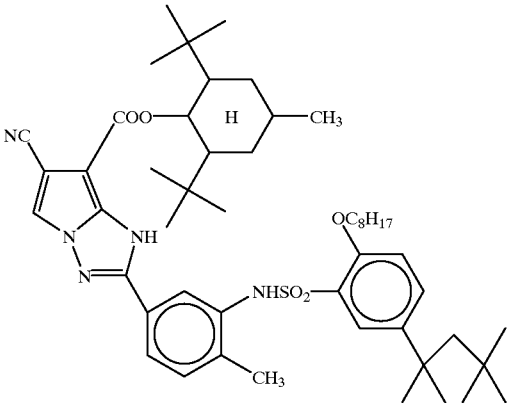
C-49
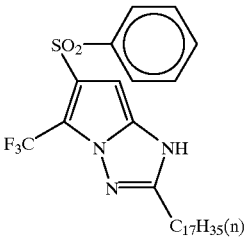
C-50
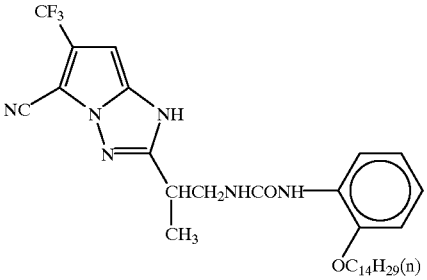
C-51
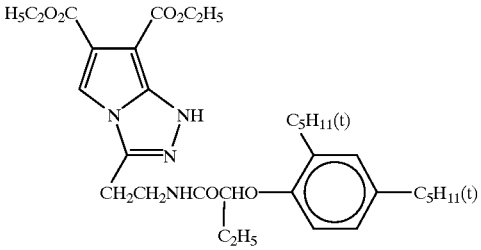
C-52
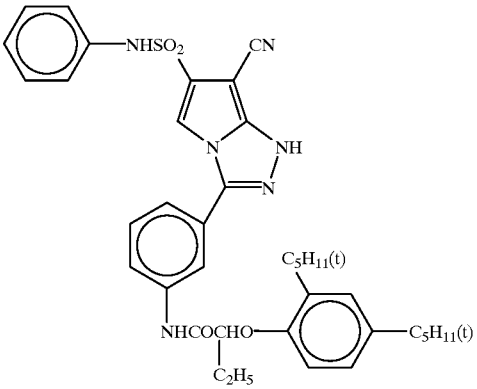
C-53
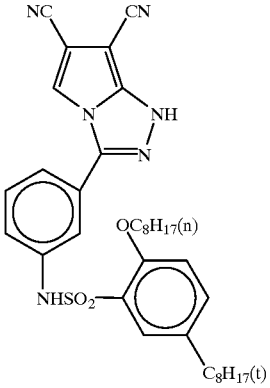
C-54
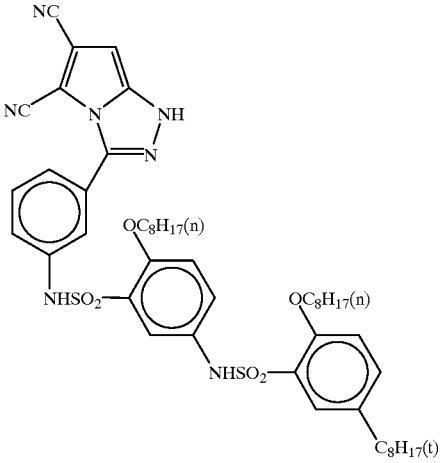

-continued
C-55
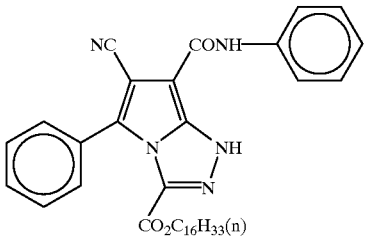
C-56
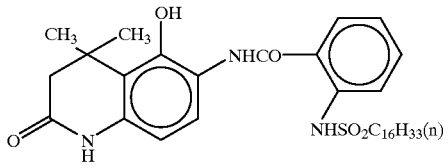
C-57
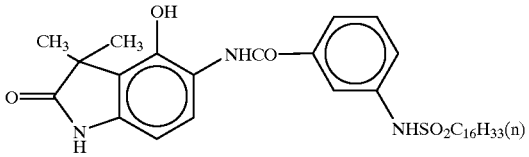
C-58
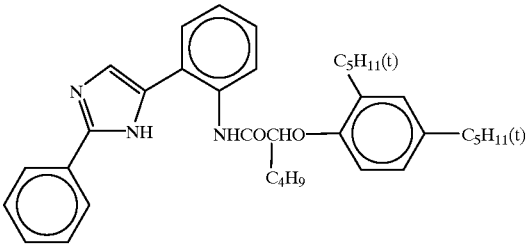
C-59
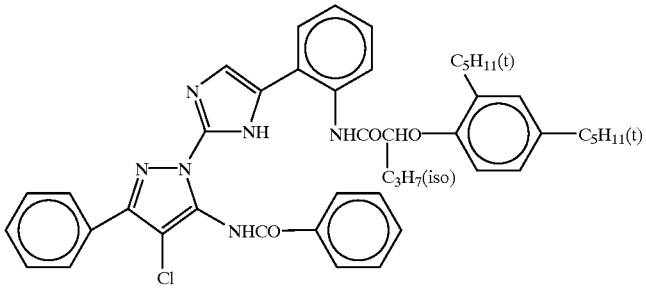
C-60
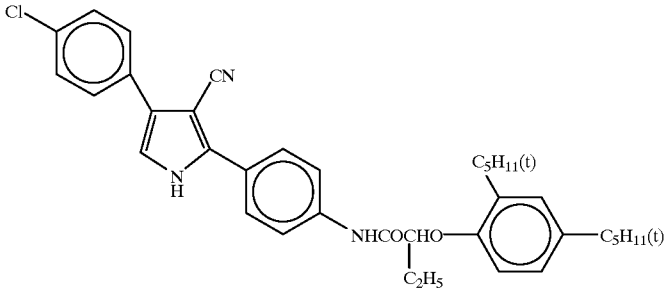
C-61
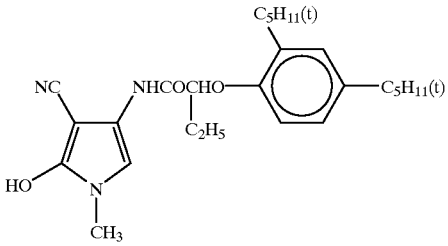
C-62
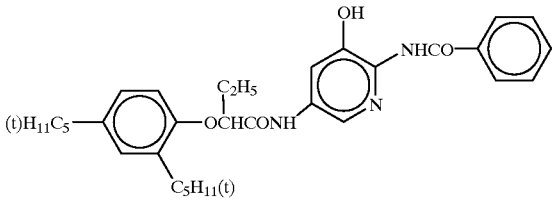

-continued
C-63
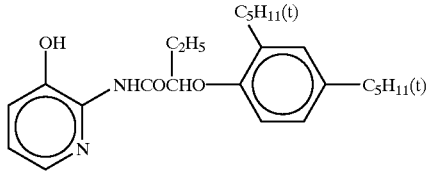
C-64
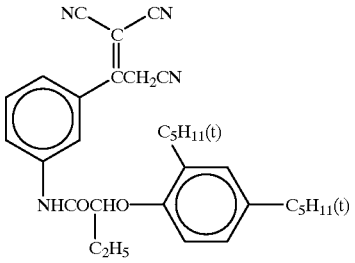
C-65
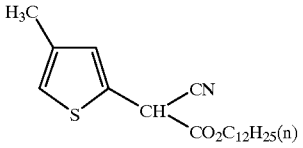
C-66
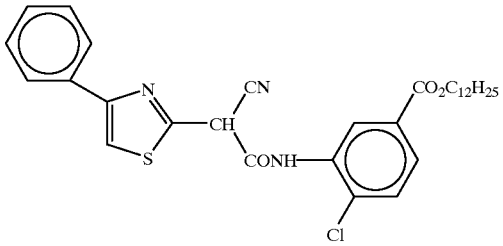
C-67
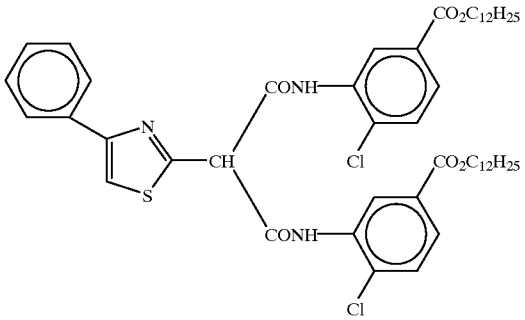
C-68
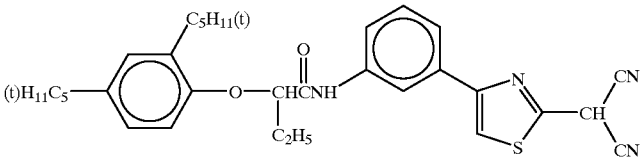
C-69
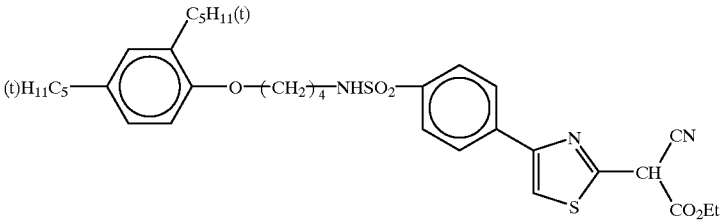

-continued
C-70
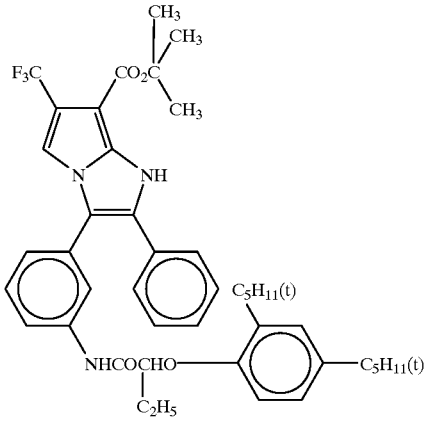
C-71
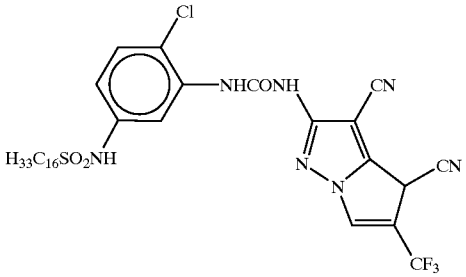
C-72
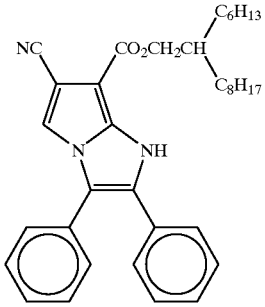
C-73
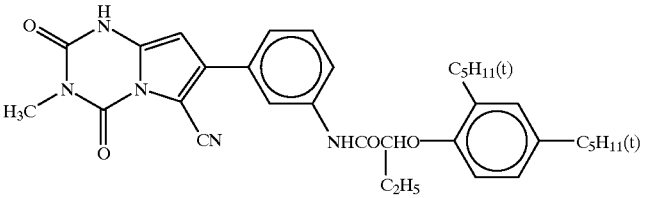
C-74
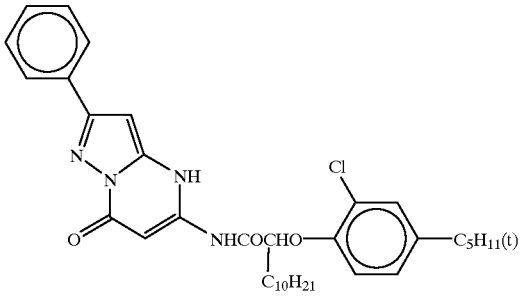
C-75
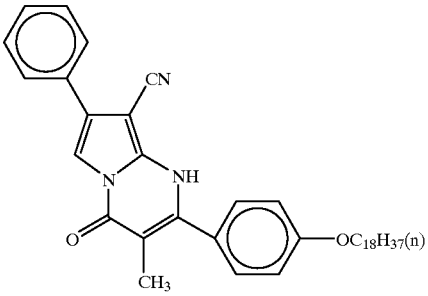

Two-equivalent couplers
C-76
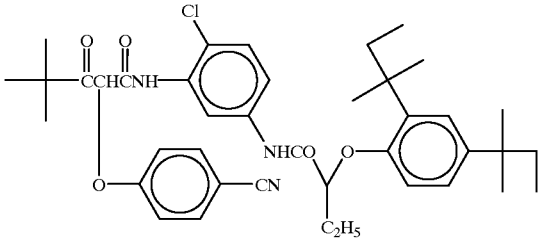
C-77
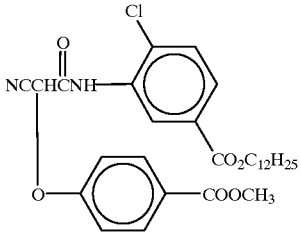
C-78
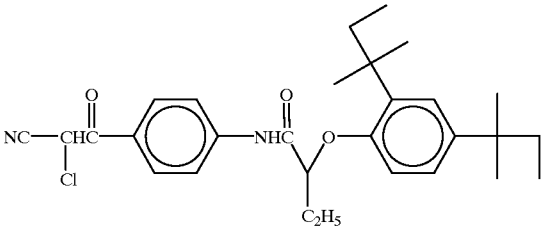
C-79
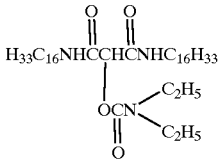
C-80
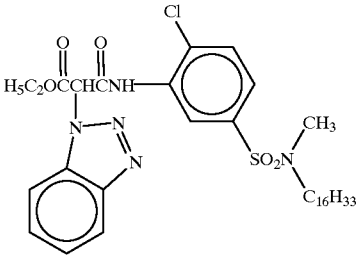
C-81
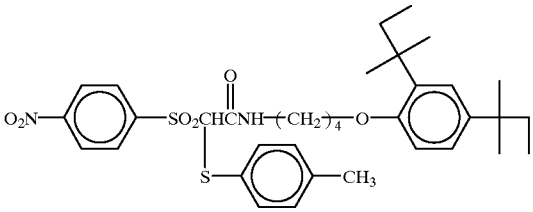
C-82
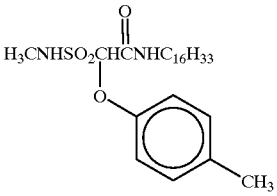
C-83
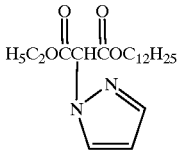
C-84
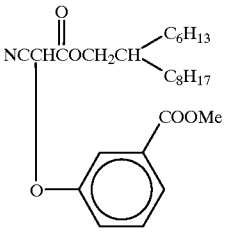
C-85
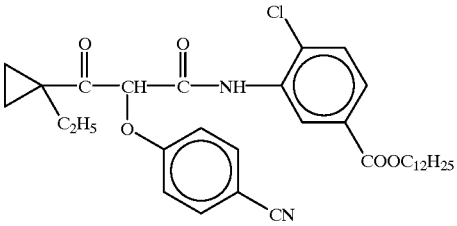
C-86
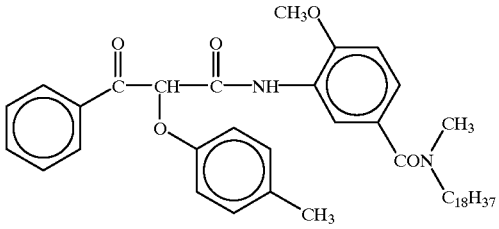
C-87
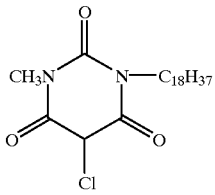

-continued
C-88
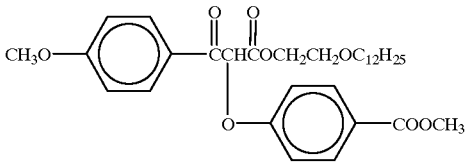
C-89
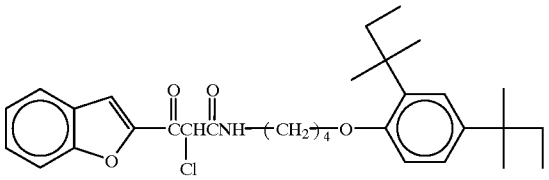
C-90
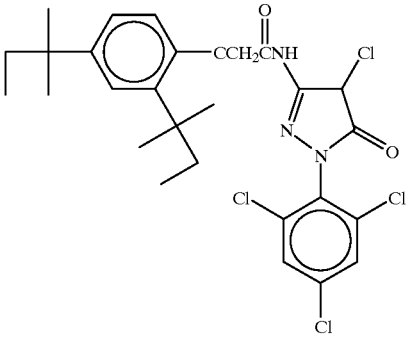
C-91
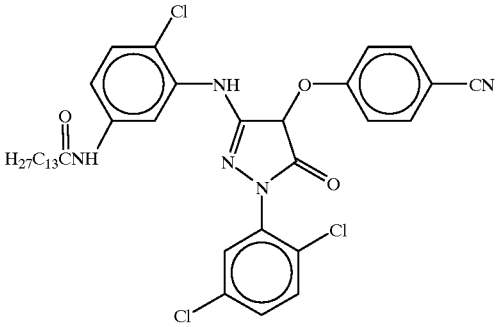
C-92
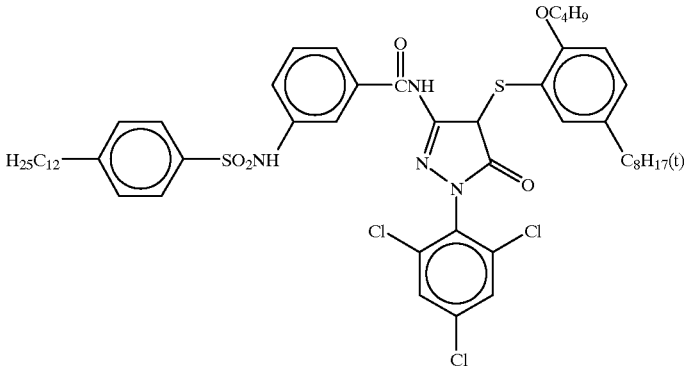
C-93
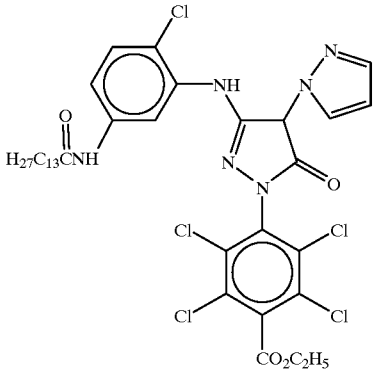
C-94
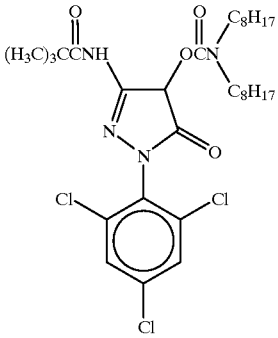

-continued
C-95
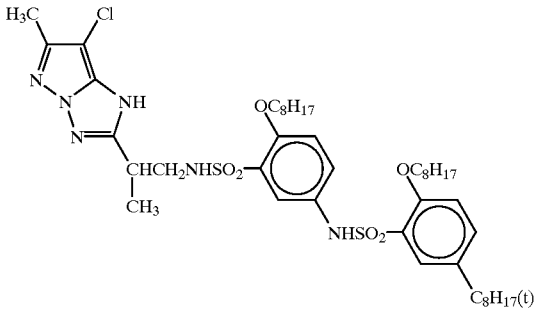
C-96
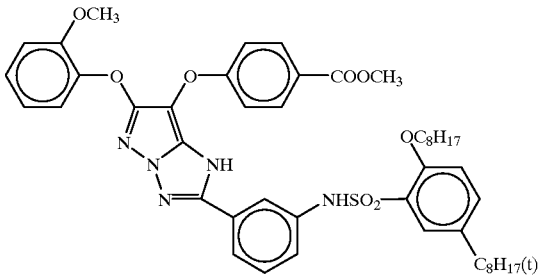
C-97
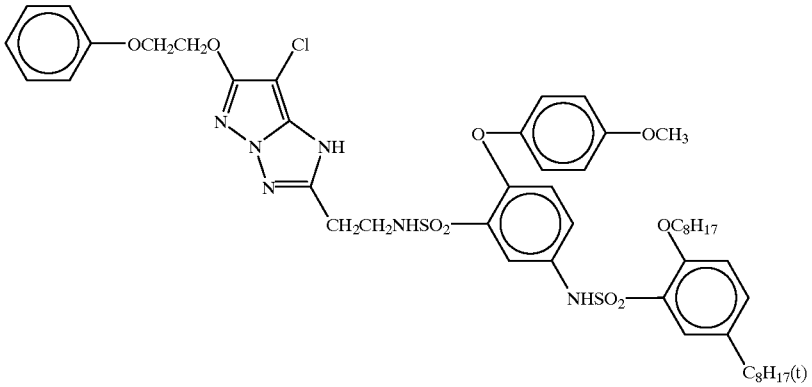
C-98
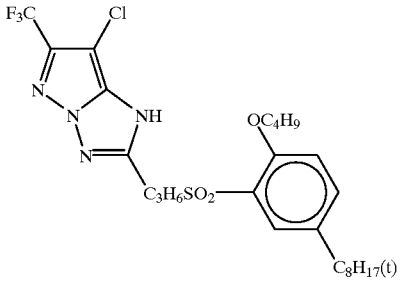
C-99
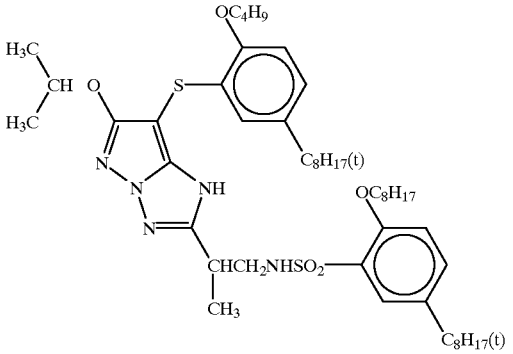
C-100
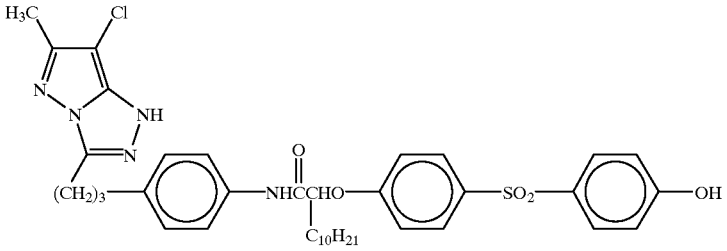

-continued
C-101
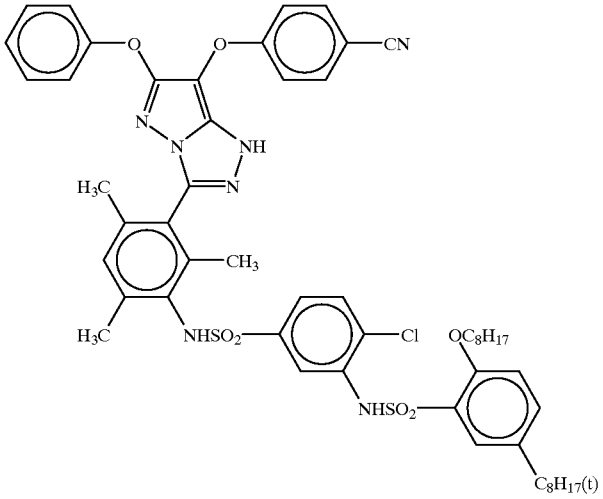
C-102
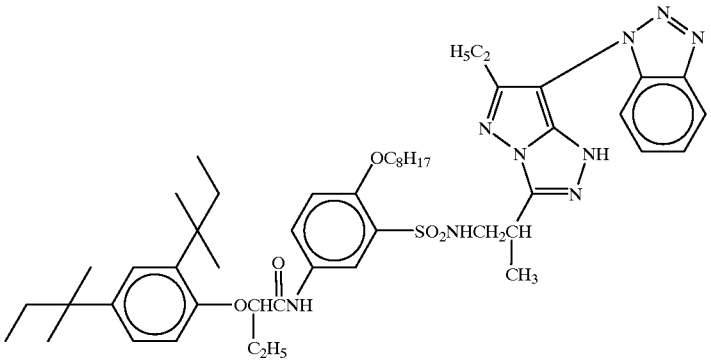
C-103
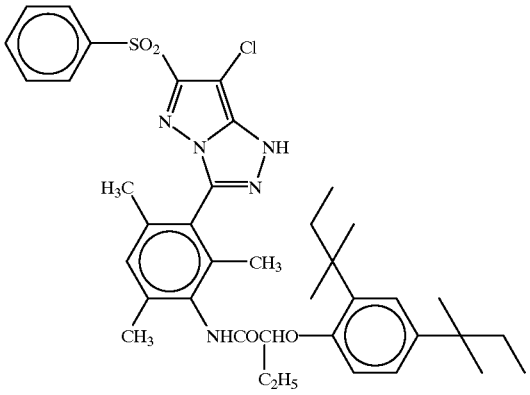
C-104
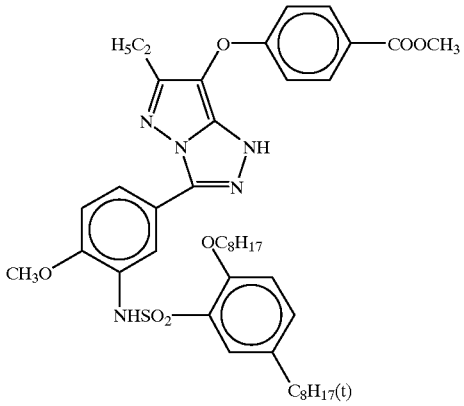
C-105
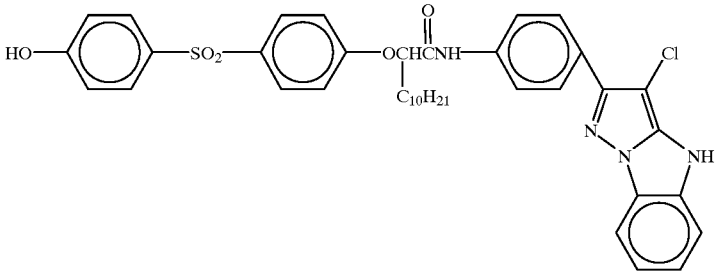

-continued
C-106
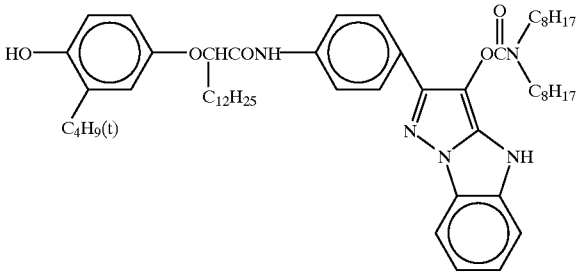
C-107
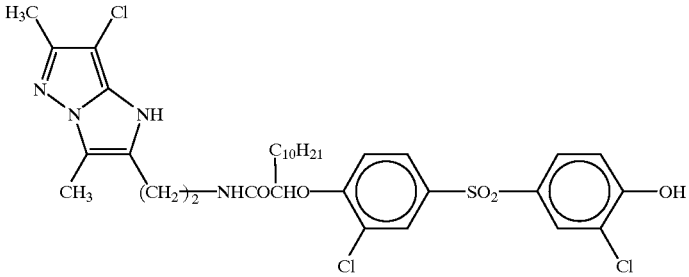
C-108
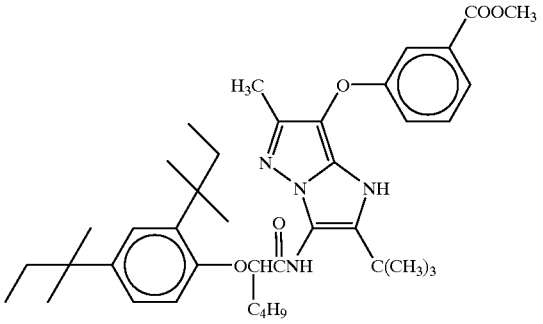
C-109
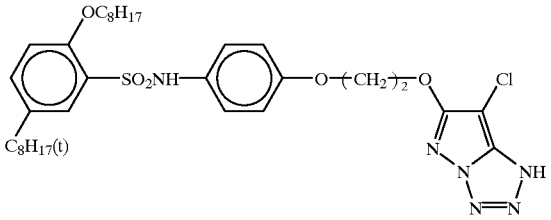
C-110
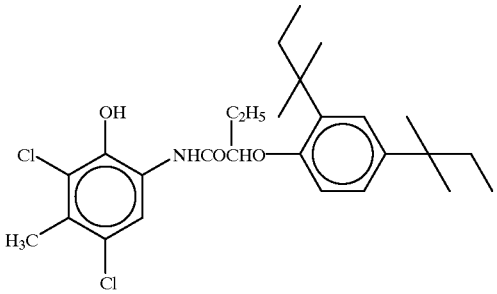
C-111
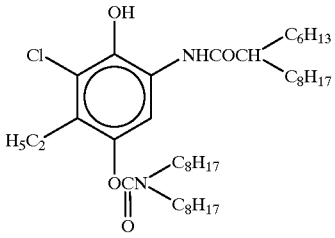
C-112
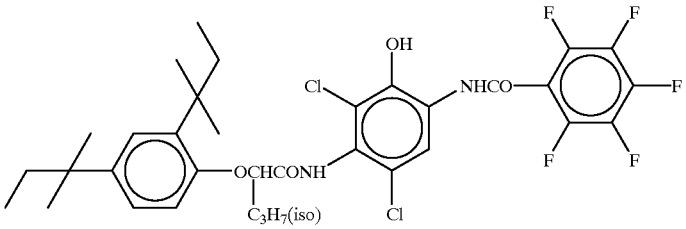

-continued
C-113
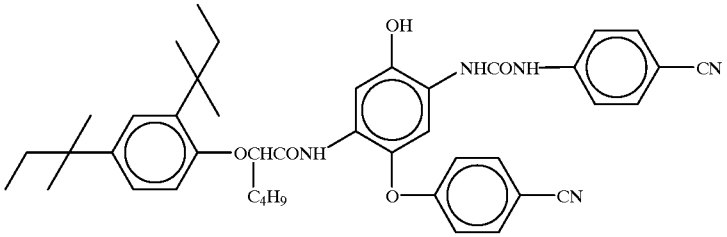
C-114
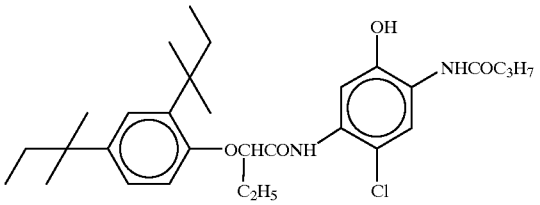
C-115
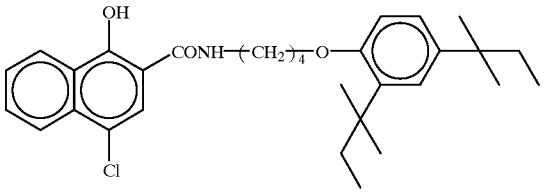
C-116
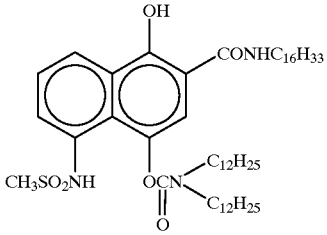
C-117
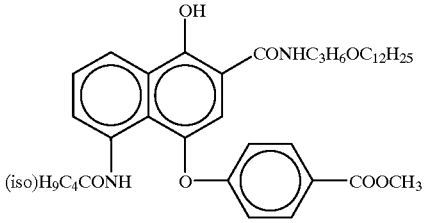
C-118
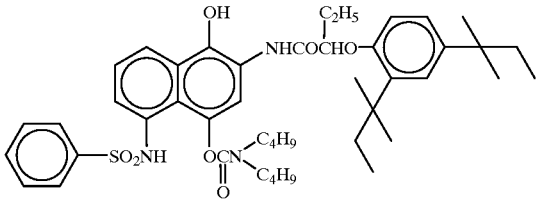
C-119
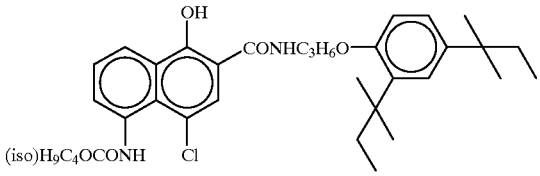
C-120
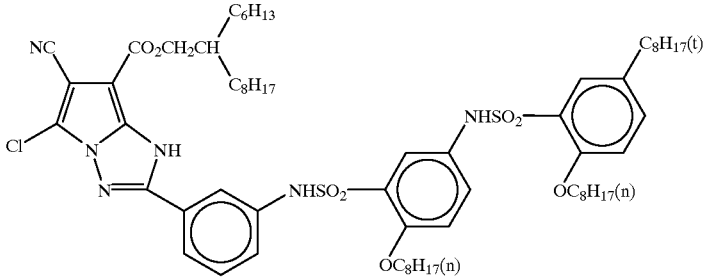
C-121
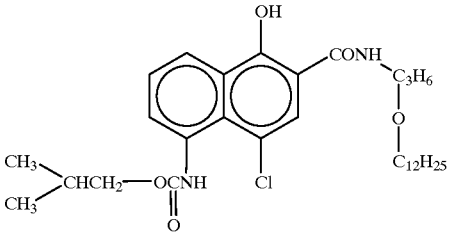
C-122
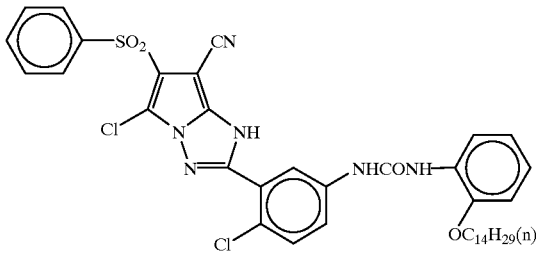

-continued
C-123
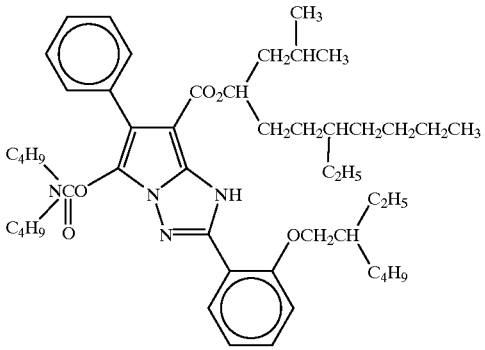
C-124
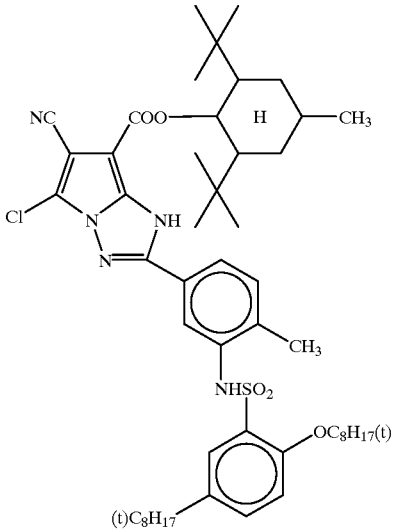
C-125
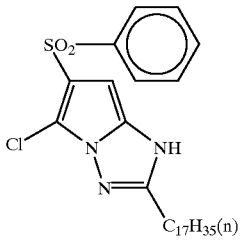
C-126
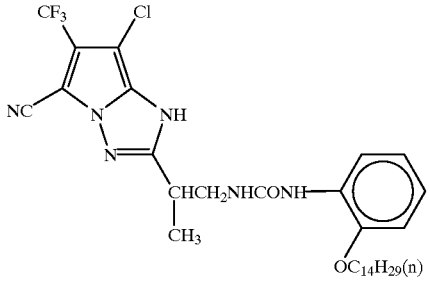
C-127
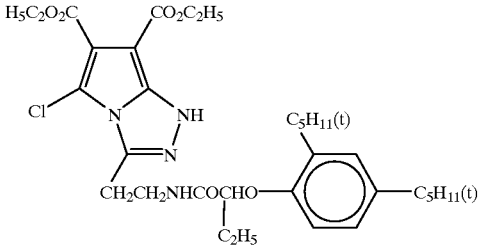
C-128
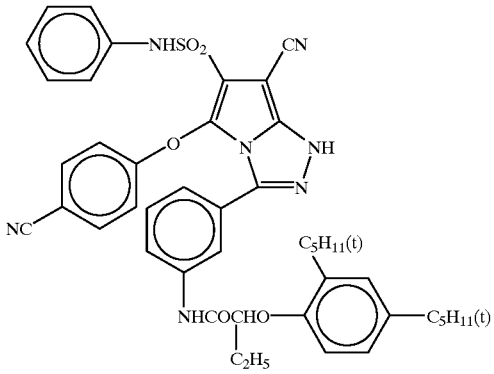
C-129
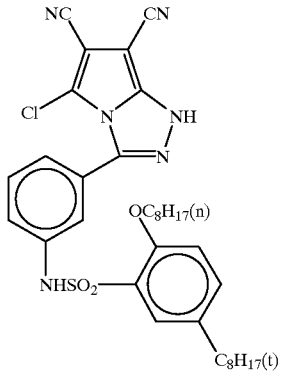
C-130
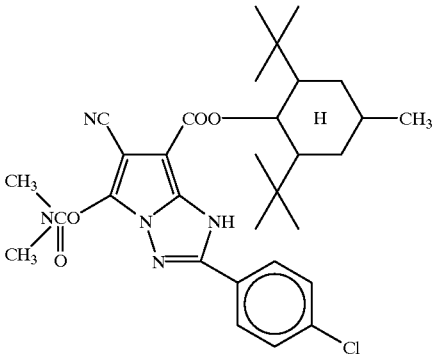

-continued
C-131
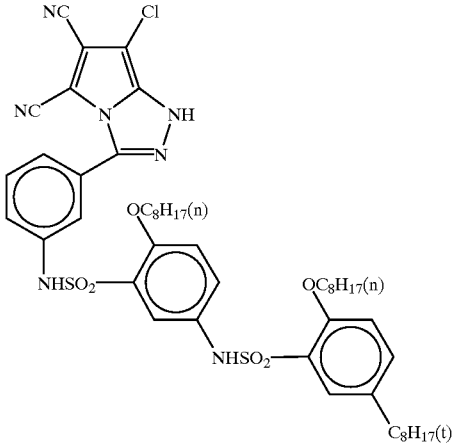
C-132
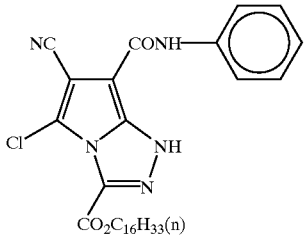
C-133
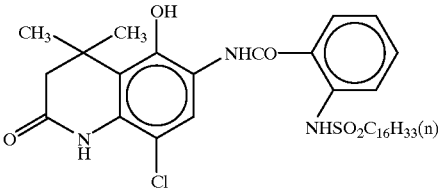
C-134
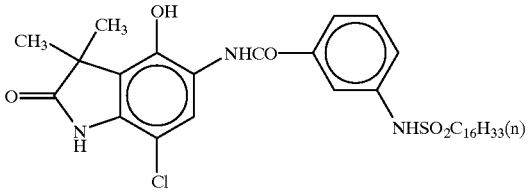
C-135
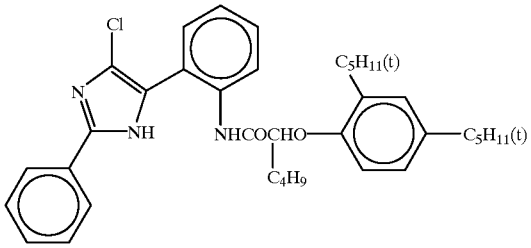
C-136
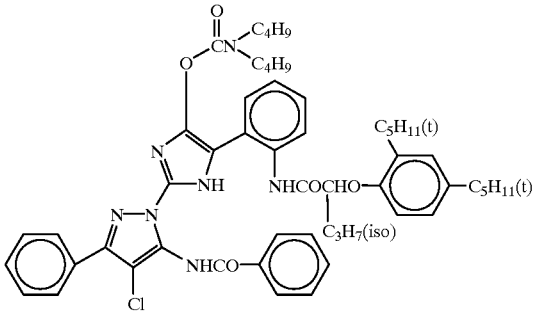
C-137
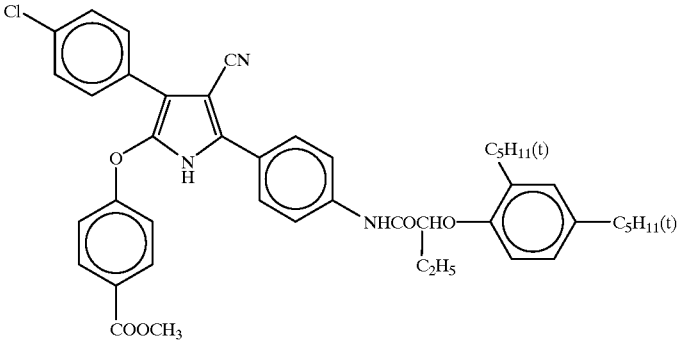

-continued
C-138
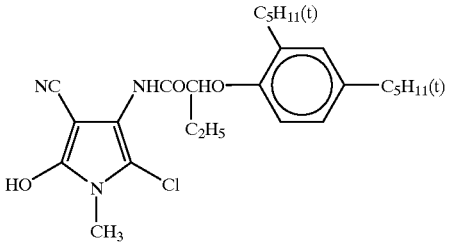
C-139
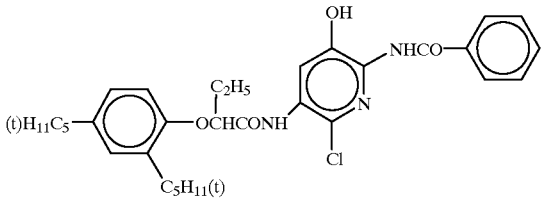
C-140
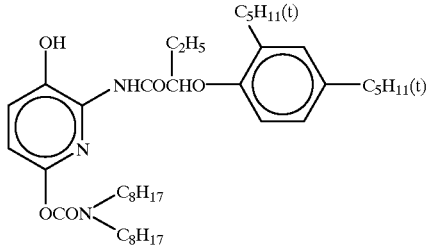
C-141
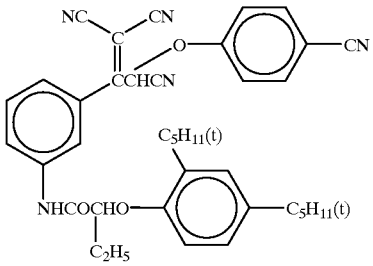
C-142
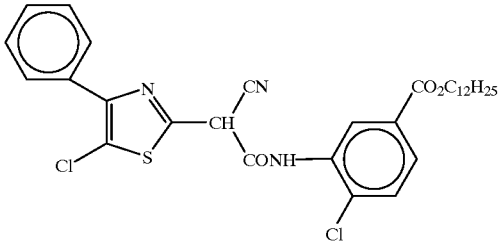
C-143
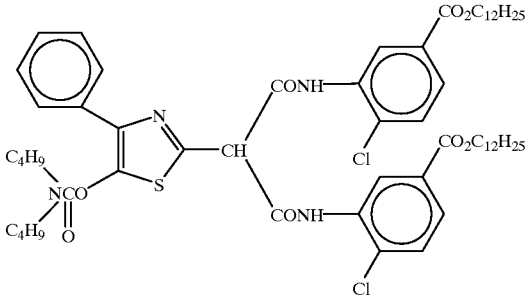
C-144
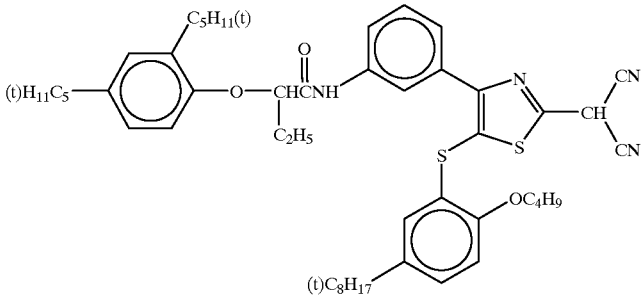
C-145
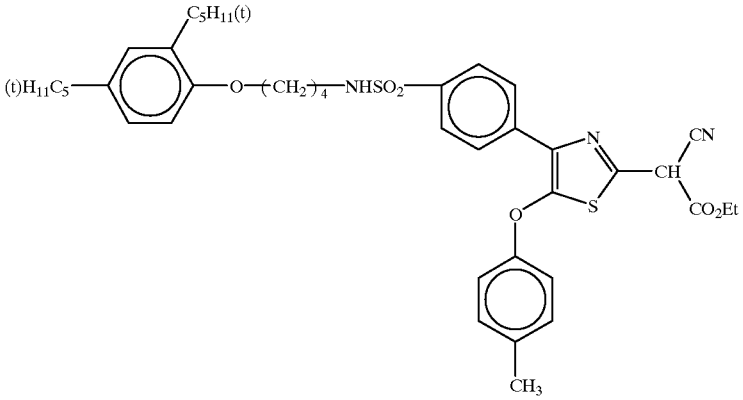

-continued
C-146
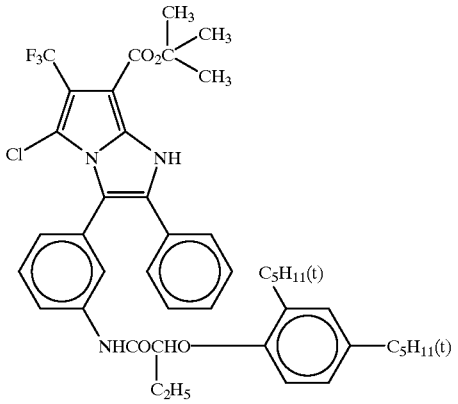
C-147
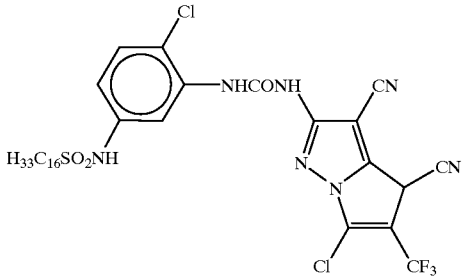
C-148
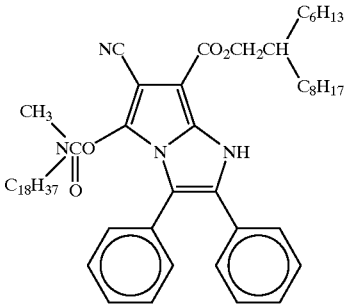
C-149
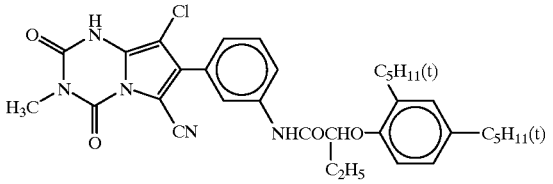
C-150
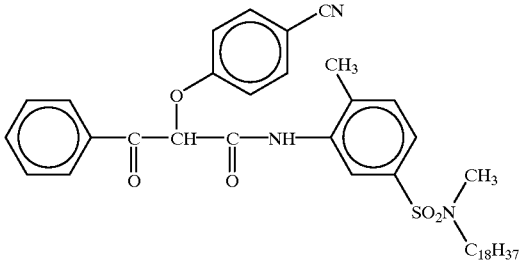
C-151
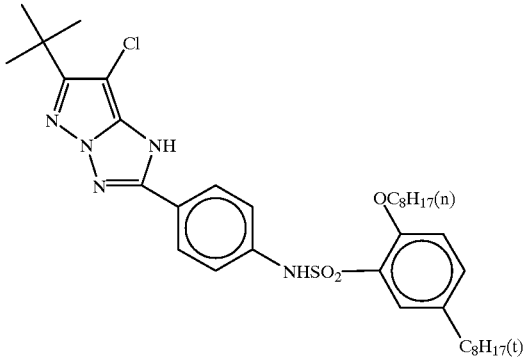
C-152
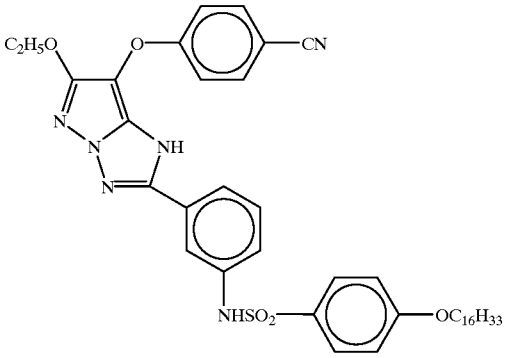
C-153
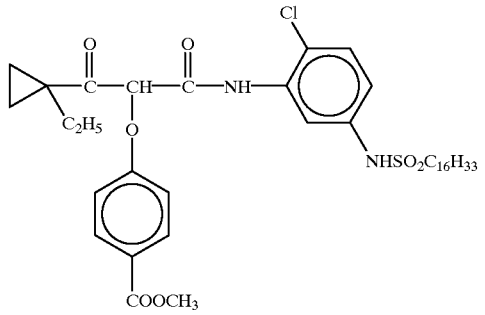

-continued
C-154
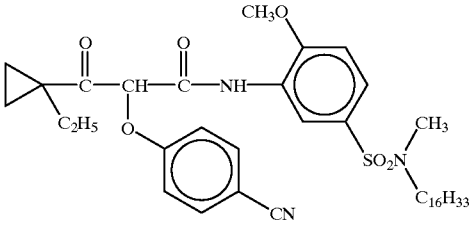
C-155
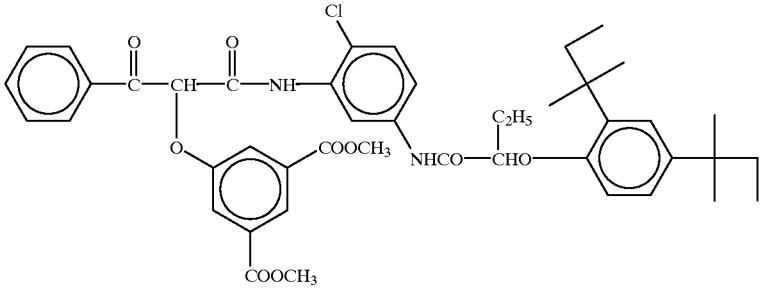
C-156
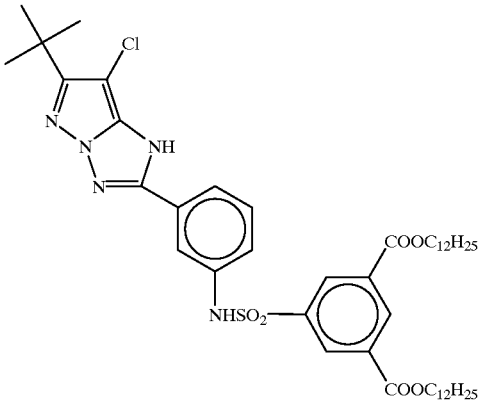
C-157
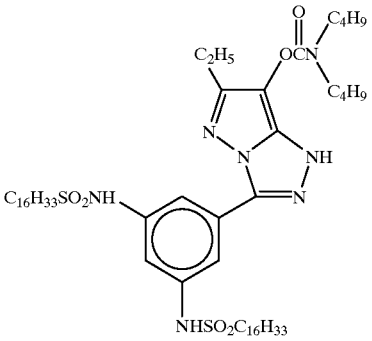
C-158
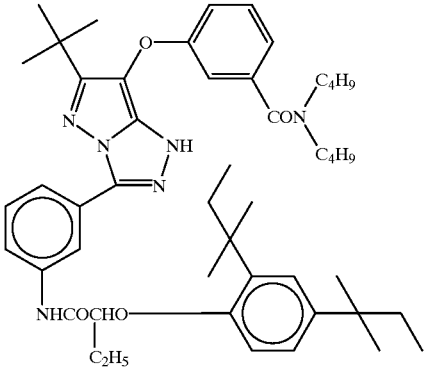
C-159
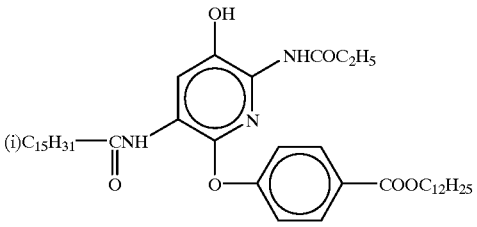

-continued
C-160
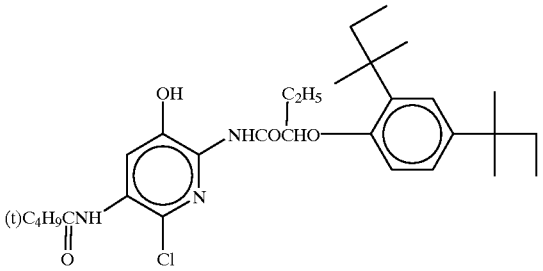
C-161
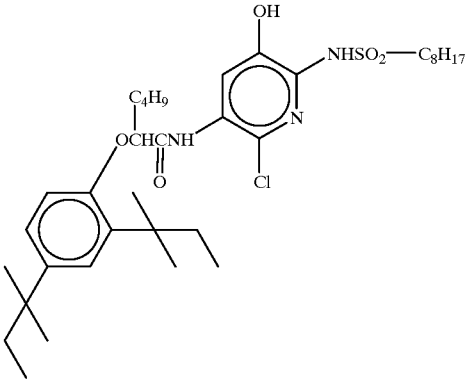
C-162
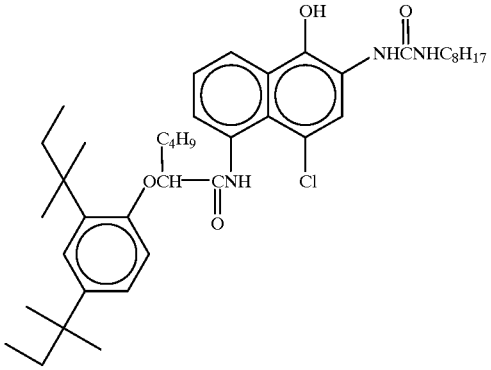
C-163
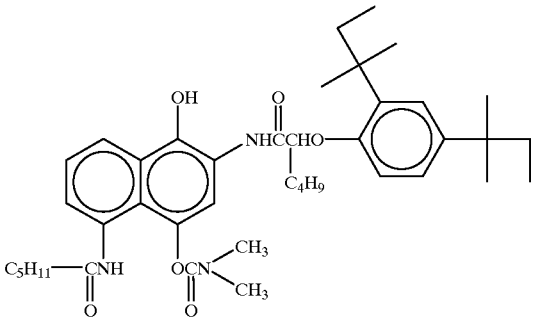
C-164
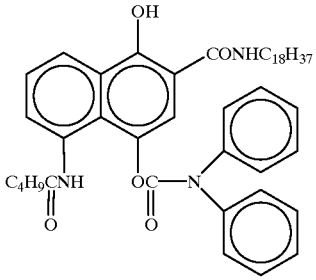
C-165
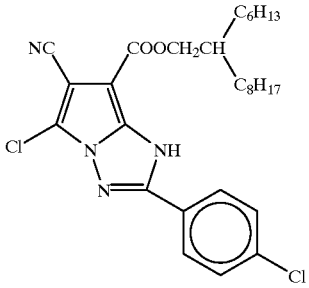
C-166
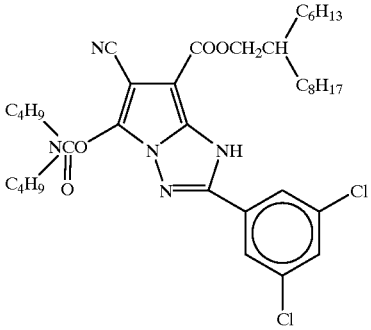
C-167
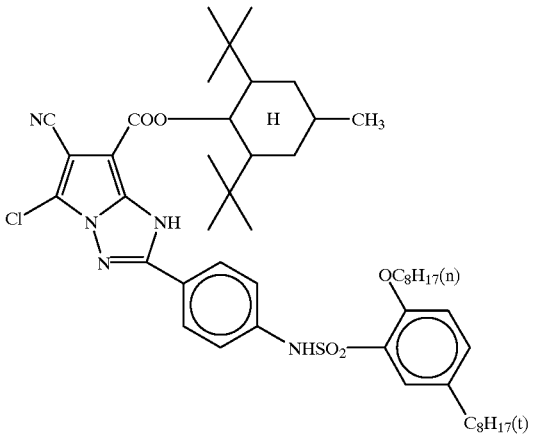

-continued

C-168

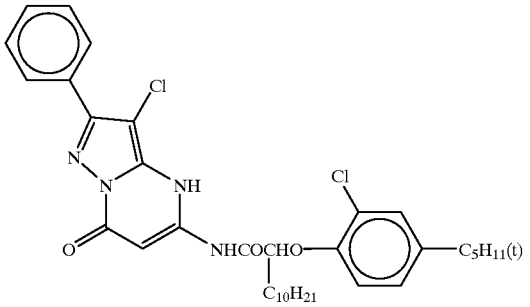

C-169

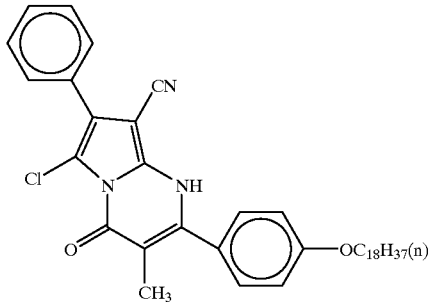

Further, the light-sensitive material used in the present invention may contain a functional coupler, for example, a coupler which is designed to correct the unnecessary absorption of coloring dyes, such as the yellow colored cyan couplers described in EP-A1-456,257, the yellow colored magenta couplers described in EP, supra, the magenta colored cyan couplers described in U.S. Pat. No. 4,833,069, and the colorless masking couplers represented by (2) of U.S. Pat. No. 4,837,136 and formula (A) in claim 1 of WO 92/11575 (especially, the compounds on pages 36-45) are examples thereof.

Examples of the compounds (including couplers) which react with the oxidation product of a developing agent to release photographically important compound residues include the following compounds: development-inhibitor-releasing compounds such as those represented by formulas (I) to (IV) in EP-A1-378,236 (page 11), compounds represented by formula (I) in EP-A2-436,938 (page 7), compounds represented by formula (1) in JP-A No. 5-307248, compounds represented by formulas (I), (II) and (III) in EP-A2-440,195 (pages 5–6), compounds (ligand releasing compound) represented by formula (I) in claim 1 of JP-A No. 6-59411, and compounds represented by LIG-X in claim 1 of U.S. Pat. No. 4,555,478.

In the present invention, it is preferable to use a coupler or other compounds which react with the oxidation product of a developing agent to release a photographically important compound.

In the present invention, the amount of the coupler to be incorporated is preferably 1/1,000 to 1 mole, more preferably 1/500 to 1/5 moles per mole of silver halide.

The light-sensitive material of the present invention preferably contains a developing agent which generates, in the course of silver development, an oxide capable of coupling with the aforementioned coupler to form a dye.

Examples of compounds of a containable developing agent to form a hue may include an aromatic primary amine developing agent or a precursor thereof described in U.S. Pat. Nos. 803,783, 3,342,597, 3,719,492, 4,060,418, British Patent No. 1,069,061, German Patent No. 1,159,758, JP-B Nos. 58-14,671, 58-14,672, JP-A Nos. 57-76,543, and 59-81,643. Examples of compounds of a hydrazine-type developing agent may be described in U.S. Pat. No. 4,481,268, EP-545,491, 565,165, JP-A Nos. 7-219,180, 8-286,340, 8-227,131, and 8-234,388. Further, examples of compounds of sulfonamide phenol-type developing agent are described in U. S. Patent No. 4,021,240, JP-A Nos. 8-110,608, 8-146,552, 8-122,994, 9-15806,and 9-146,248.

P-phenylene diamine (which is a developing agent) and a phenol coupler or an active methylene coupler may be used in combination, as described in U.S. Pat. No. 3,531,256. Similarly, p-aminophenol (which is a developing agent) and an active methylene coupler may be used in combination, as described in U.S. Pat. No. 3,761,270.

Further, combination use of a sulfonamide phenol and a four-equivalent coupler described in U.S. Pat. No. 4,021,240 and JP-A No. 60-128,438, is preferable, because this combination assures excellent raw storage stability when a developing agent is contained in a light-sensitive material.

When a developing agent is contained, there may be used a precursor of a color-generating developing agent, examples of which include an indoaniline compound described in U.S. Pat. No. 3,342,597, a Schiff base-type compound described in U.S. Pat. No. 3,342,599 and in Research Disclosure Nos. 14,850 and 15,159, an aldol compound described in Research Disclosure No. 13,924, a metal salt complex described in U.S. Pat. No. 3,719,492 and a urethane compound described in JP-A No. 53-135,628.

In the present invention, it is preferable to use a compound represented by one of the formulas I D, II D, III D or IV D as a developing agent. Of these compounds, the compounds represented by formula I D or II D are particularly preferred. These developing agents will next be described in detail.

Formulas ID

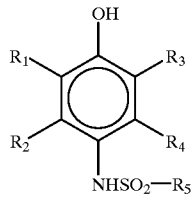

Formulas IID

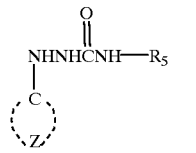

Formulas IIID

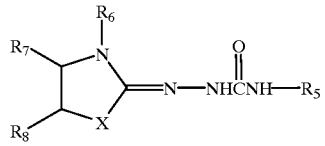

-continued

Formulas IVD

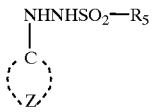

wherein each of $R_1$ to $R_4$ represents a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; Z represents a group of atoms that form a (hetero) aromatic ring, and when Z is a benzene ring, preferably the sum of Hammett's constants ($\sigma$) of the substitutes is not less than 1; $R_6$ represents an alkyl group; X represents an oxygen atom, a sulfur atom, a selenium atom, or an alkyl-substituted or aryl-substituted tertiary nitrogen atom; $R_7$ and $R_8$ may be joined each other so as to form a double bond or a ring. The compounds represented by formulas I D to IV D respectively have at least one ballast group having 8 or more carbon atoms so as to make the molecule oil-soluble.

The compounds represented by formula I D are generally called sulfonamide phenols, which are known in this technical field. When they are used in the present invention, it is preferred that at least one of the substituents $R_1$ to $R_5$ have a ballast group having 8 or more carbon atoms.

In the above formulas, each of $R_1$ to $R_4$ represents a hydrogen atom, a halogen atom (e.g., Cl or Br), an alkyl group (e.g., methyl, ethyl, isopropyl, n-butyl, or t-butyl), an aryl group (e.g., phenyl, tolyl, or xylyl), an alkylcarbonamide group (e.g., acetylamino, propionylamino, butyroylamino), an arylcarbonamide group (e.g., benzoylamino), an alkylsulfonamide group (e.g., methanesulfonylamino or ethanesulfonylamino), an arylsulfonamide group (e.g., benzenesulfonylamino or toluenesulfonylamino), an alkoxy group (e.g., methoxy, ethoxy, or butoxy), an aryloxy group (e.g., phenoxy), an alkylthio group (e.g., methylthio, ethylthio, or buthylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, or morpholylcarbamoyl), an arylcarbamoyl group (e.g., phenylcarbamoyl, methylphenylcarbamoyl, ethylphenylcarbamoyl, benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, or morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4 -chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, or butyroyl), an arylcarbonyl group (e.g., benzoyl or alkylbenzoyl), or an acyloxy group (e.g., acetyloxy, propionyloxy, or butyroyloxy). Of groups $R_1$ to $R_4$, $R_2$ and $R_4$ are preferably hydrogen atoms. A sum of Hammett's substituent constant ($\sigma_p$) values of $R_1$ to $R_4$ is preferably not less than 0. $R_5$ represents an alkyl group (e.g., methyl, ethyl, butyl, octyl, lauryl, cetyl, or stearyl), an aryl group (e.g., =phenyl, tolyl, xylyl, 4-methoxyphenyl, dodecylphenyl, chlorophenyl, trichlorophenyl, nitrochlorophenyl, triisopropylphenyl, 4-dodecyloxyphenyl, or 3,5-di-(methoxycarbonyl)), or a heterocycle (e.g., pyridyl).

The compounds represented by formula II D are generally called carbamoylhydrazines. The above two groups of compounds are known in this technical field. When they are used in the present invention, it is preferred that the substituents on the ring or $R_5$ have a ballast group having 8 or more carbon atoms.

In formula II D, Z represents a group of the atoms forming a (hetero) aromatic ring. The (hetero) aromatic ring represented by Z should be sufficiently electron-attractive in order to inpart the compound with silver developing activity. From this standpoint, aromatic rings which form a nitrogen-containing aromatic ring or which are prepared by introducing an electon-attractive group into a benzene ring are preferably used. Examples of such aromatic rings include a pyridine ring, a pyrazine ring, a pyrimidine ring, a quinoline ring, and a quinoxaline ring. Examples of substituents on the benzene ring include an alkylsulfonyl group (e.g., methanesulfonyl or ethanesulfonyl), a halogen atom (e.g., chlorine or bromine), an alkylcarbamoyl group (e.g., methylcarbamoyl, dimethylcarbamoyl, ethylcarbamoyl, diethylcarbamoyl, dibutylcarbamoyl, piperidinecarbamoyl, or morpholinocarbamoyl), an arylcarbamoyl group (e.g., phenylcarbamoyl, methylphenylcarbamoyl, ethylphenylcarbamoyl, or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, or morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, or butyroyl), or an arylcarbonyl group (e.g., benzoyl or alkylbenzoyl). Preferably, the sum of the Hammett's constants 9 of the above-described substituents is not less than 1.

The compounds represented by formula III D are generally called carbamoylhydrazones. The compounds represented by formula IV D are generally called sulfonylhydrazines. These two groups of compounds are known in the art. When they are used in the present invention, preferably at least one of $R_5$ to $R_8$ has a ballast group having 8 or more carbon atoms.

In the above formulas, $R_6$ represents an alkyl group (e.g., methyl or ethyl). X represents an oxygen atom, a sulfur atom, a selenium atom, or an alkyl-substituted or aryl-substituted tertiary nitrogen atom, with alkyl-substituted tertiary nitrogen atom being preferred. Each of $R_7$ and $R_8$ represents a hydrogen atom or a substituent (such as one listed above as a substituent for the benzene ring of Z), and $R_7$ and $R_8$ may be joined each other so as to form a double bond or a ring.

Of the compounds of formulas I D to IV D, those of I D and II D are particularly preferred from the viewpoint of superior raw storage stability.

In the above compounds, the substituents $R_1$ to $R_8$ may respectively have a substituent, examples of which include those listed for the substituents on the above-described benzene ring Z.

Specific examples of the compounds represented by formulas I D through IV D are given below, but the developing agents which may be used in the present invention are not limited only to such examples.

I-1

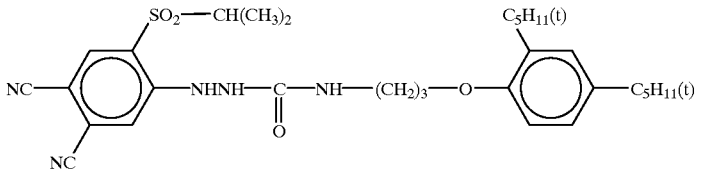

I-2

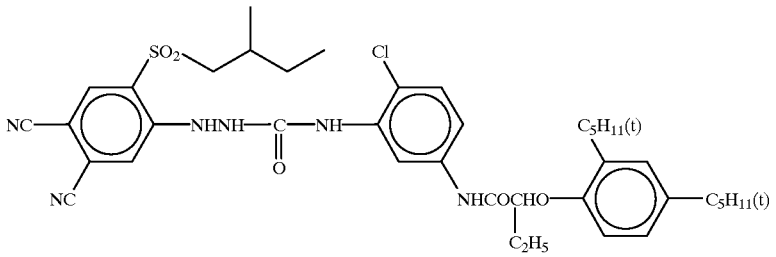

I-3

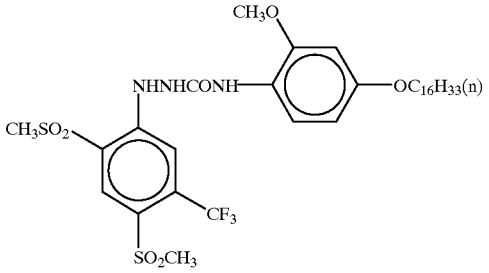

I-4

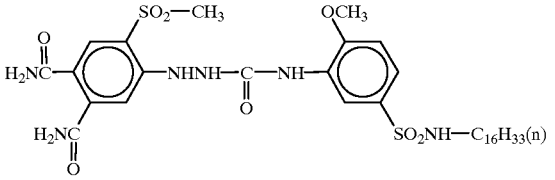

I-5

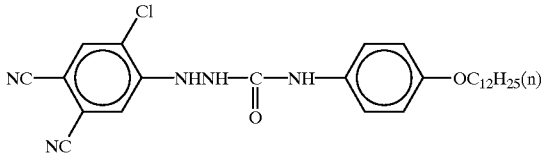

I-6

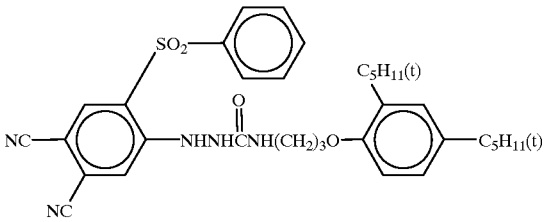

I-7

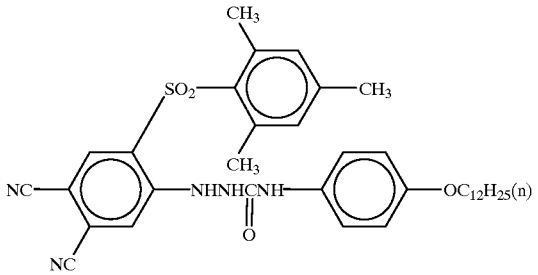

I-8

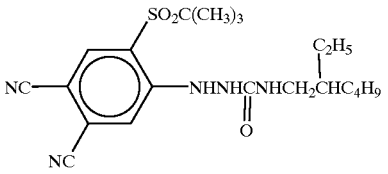

I-9

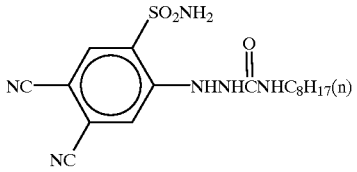

I-10

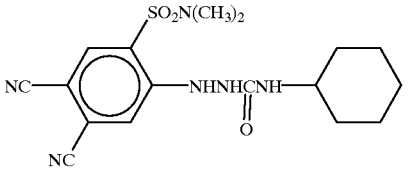

-continued
I-11
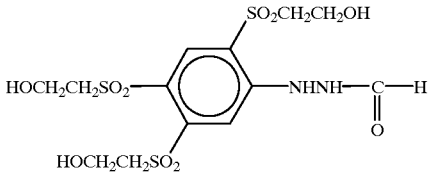
I-12
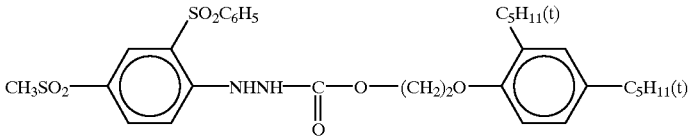
I-13
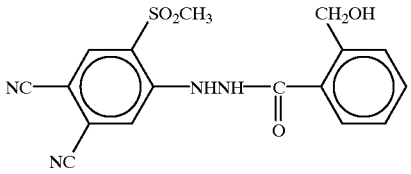
I-14
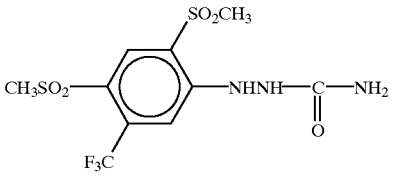
I-15
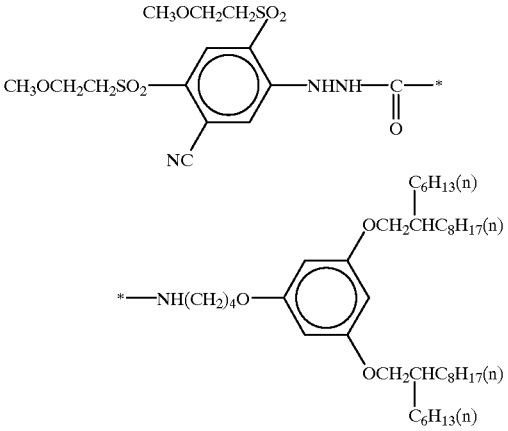
I-16
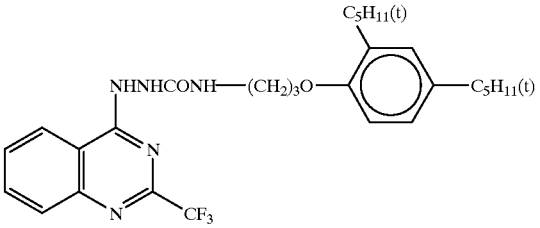
I-17
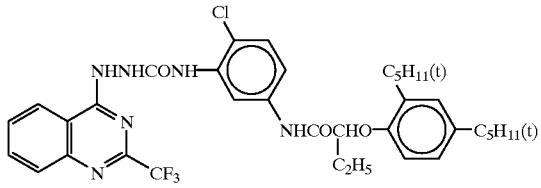
I-18
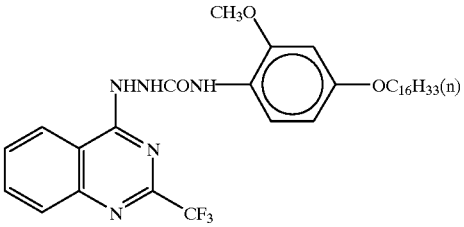
I-19
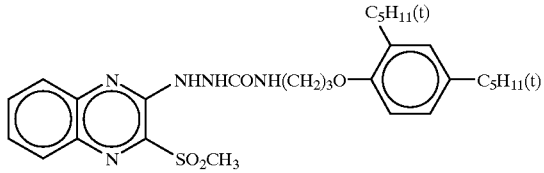
I-20
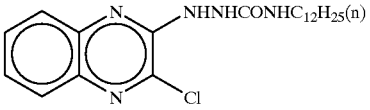

-continued
I-21
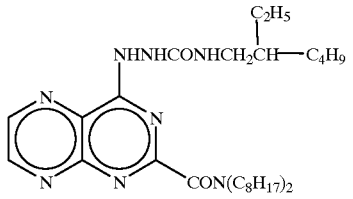
I-22
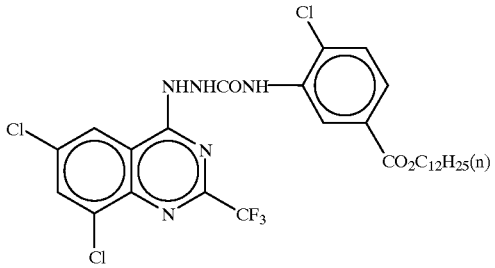
I-23
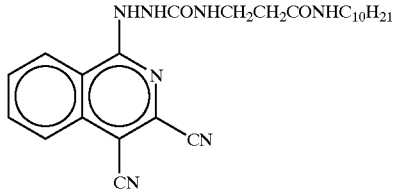
I-24
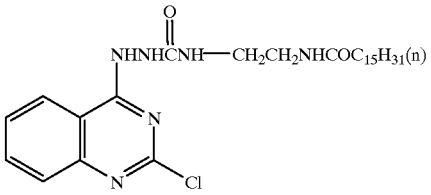
I-25
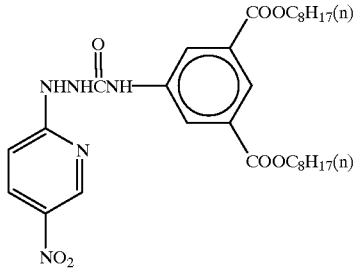
I-26
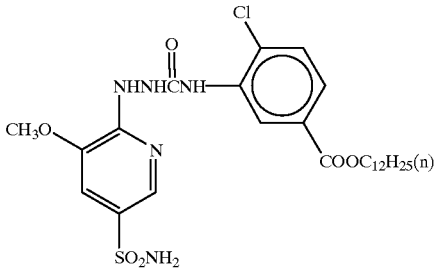
I-27
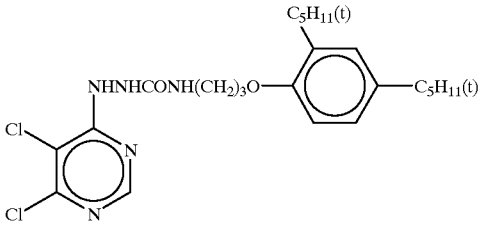
I-28
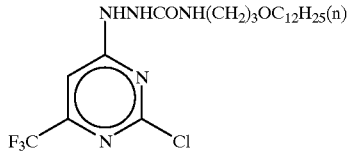
I-29
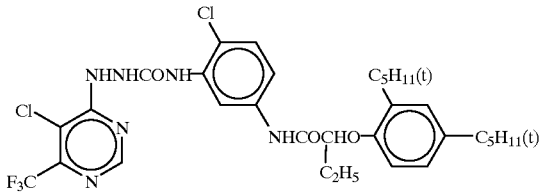
I-30
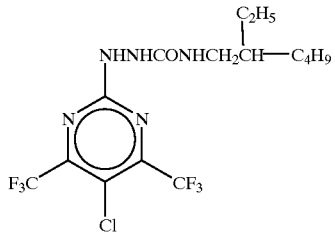
I-31
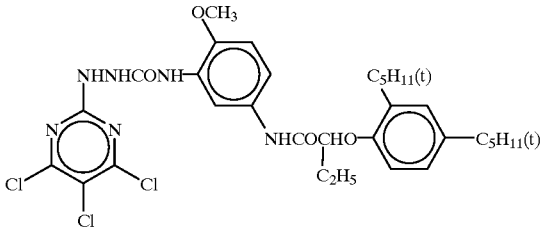
I-32
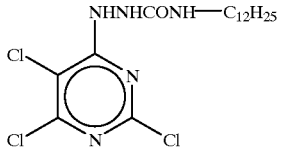

-continued
I-33
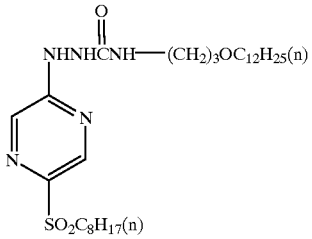
I-34
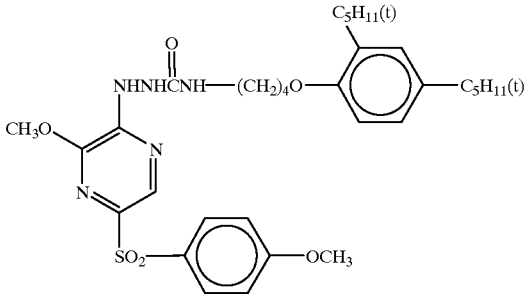
I-35
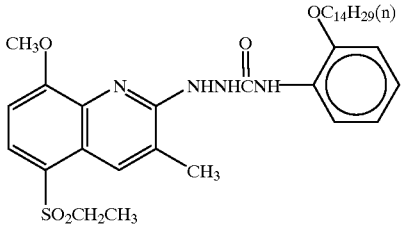
I-36
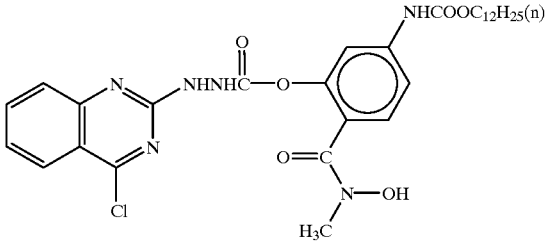
I-37
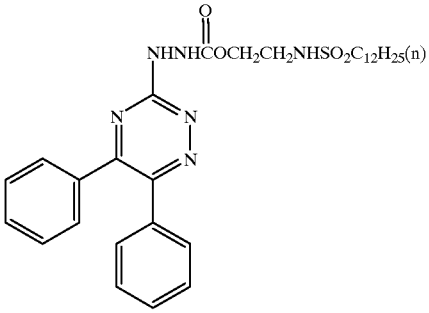
I-38
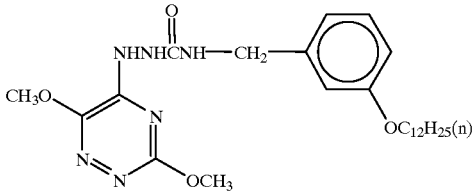
I-39
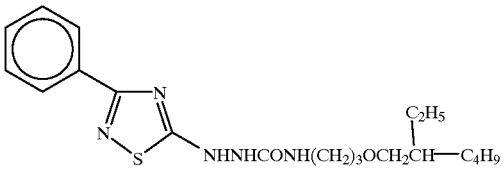
I-40
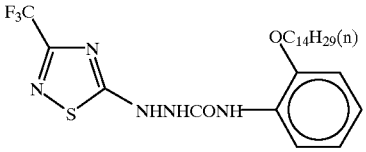
I-41
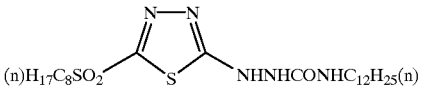
I-42
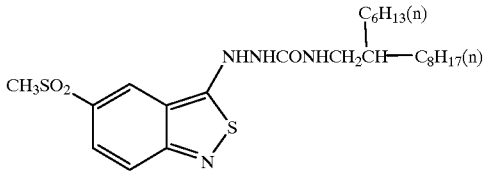
I-43
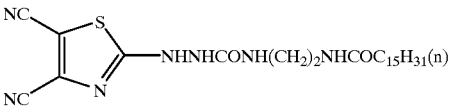
I-44
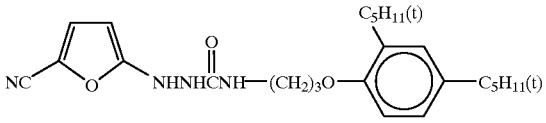

-continued
I-45
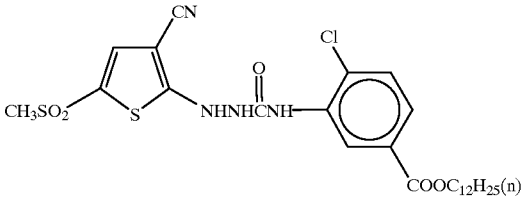
I-46
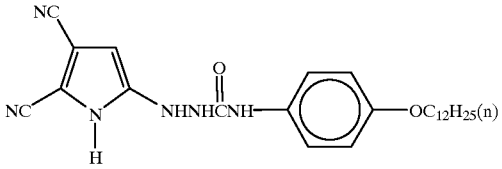
I-47
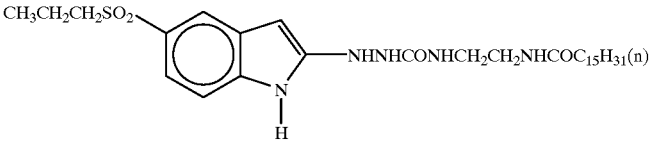
I-48
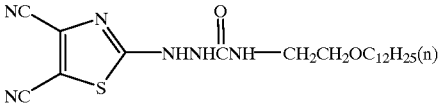
I-49
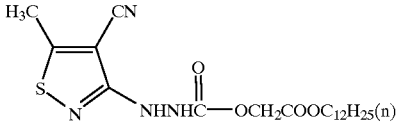
I-50
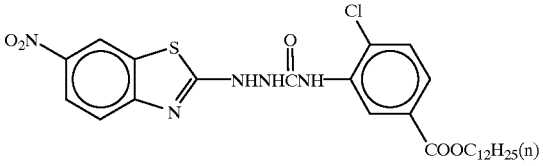
I-51
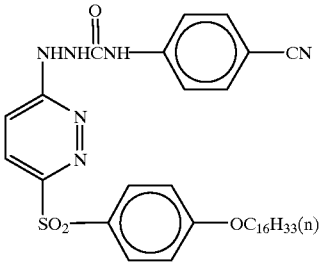
I-52
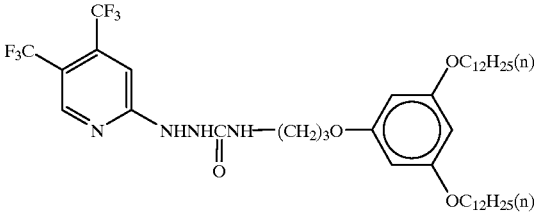
I-53
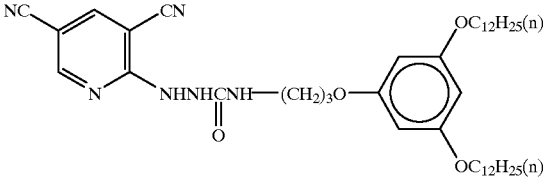
I-54
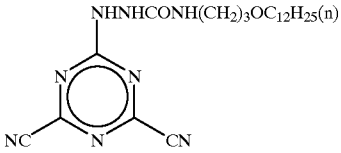
I-55
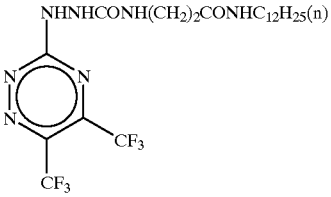
I-56
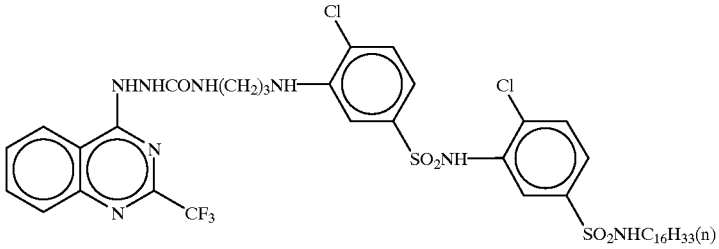

-continued
I-57
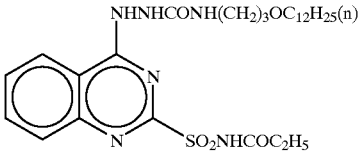
I-58
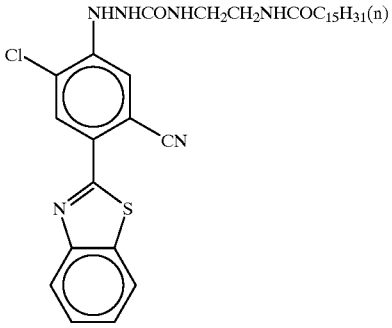
I-59
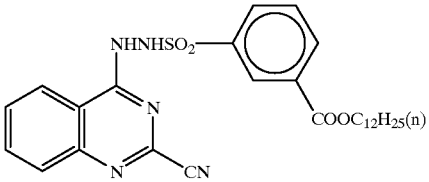
I-60
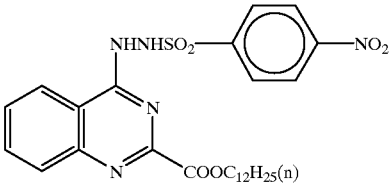
I-61
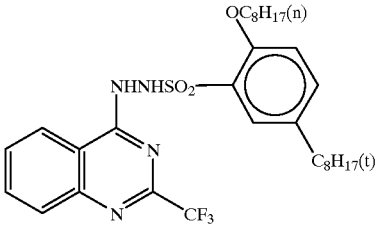
I-62
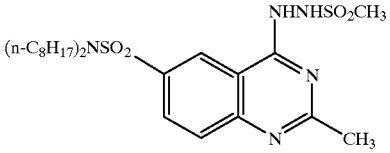
I-63
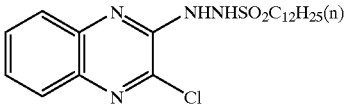
I-64
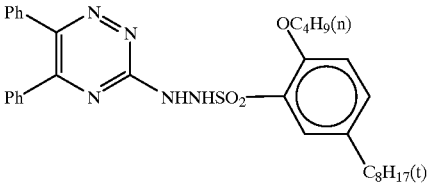
I-65
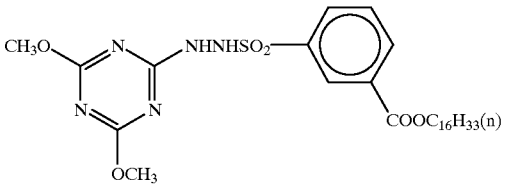
I-66
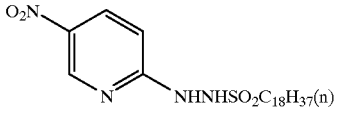
I-67
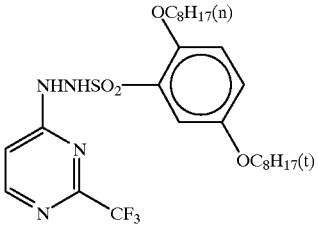
I-68
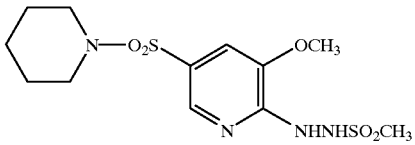

-continued
I-69
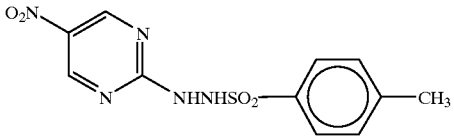
I-70
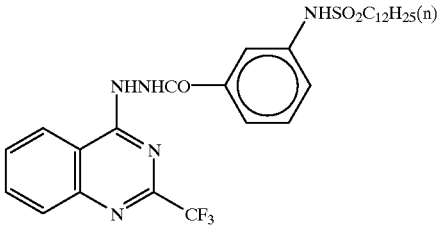
I-71
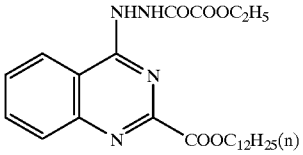
I-72
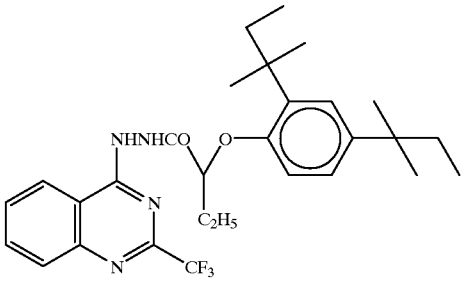
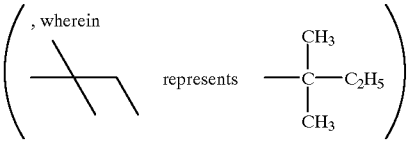
I-73
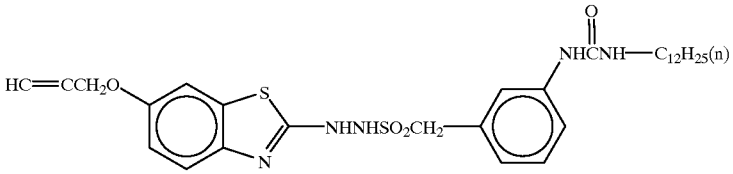
I-74
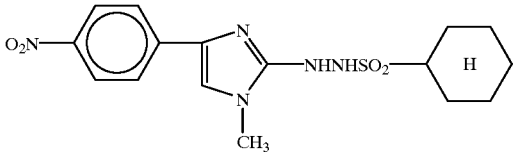
I-75
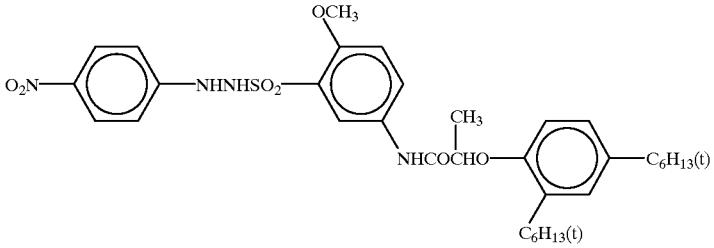
I-76
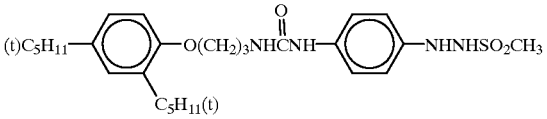
I-77
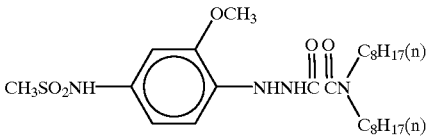

-continued
I-78
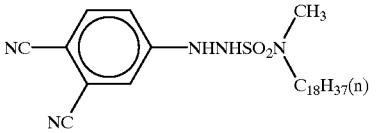
I-79
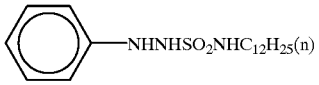
I-80
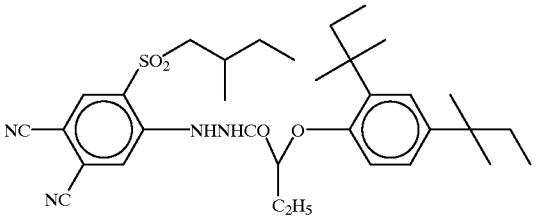
I-81
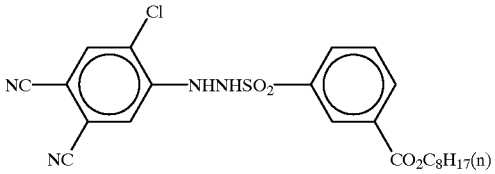
I-82
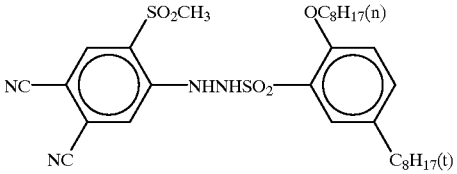
I-83
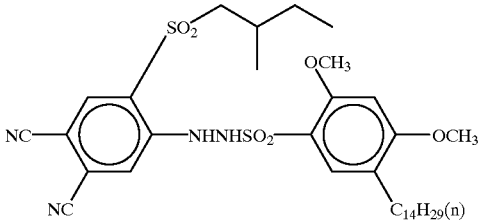
I-84
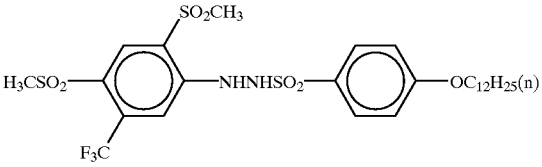
D-1
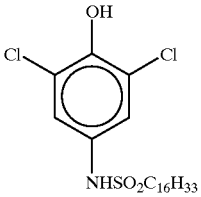
D-2
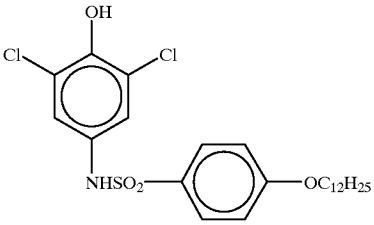
D-3
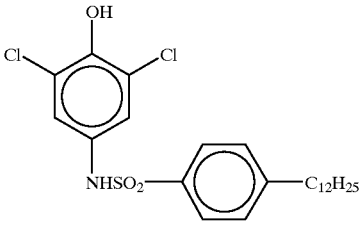
D-4
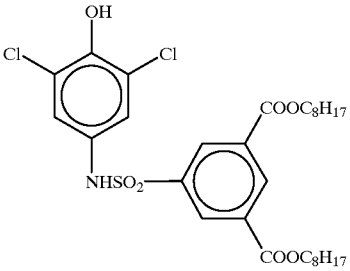
D-5
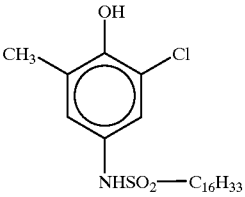

-continued
D-6
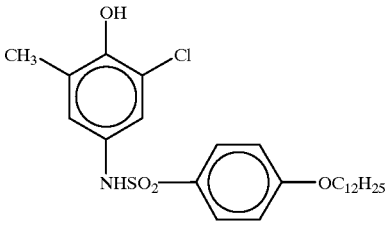
D-7
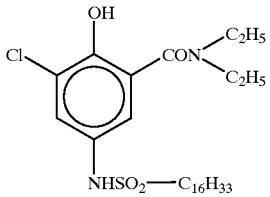
D-8
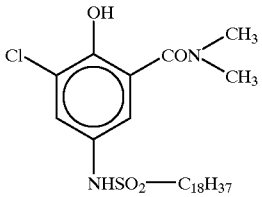
D-9
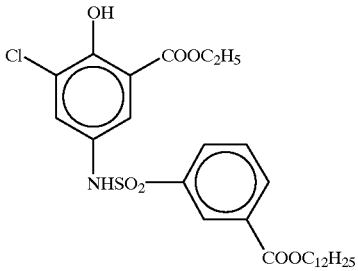
D-10
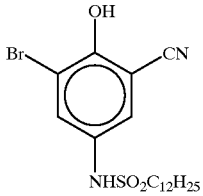
D-11
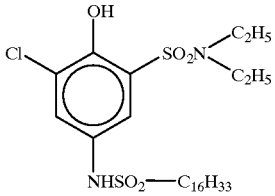
D-12
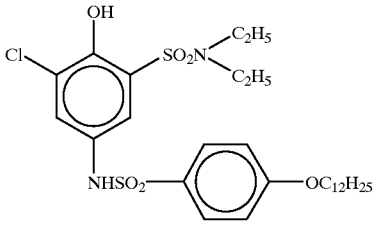
D-13
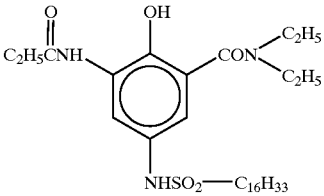
D-14
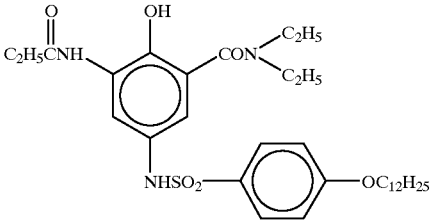
D-15
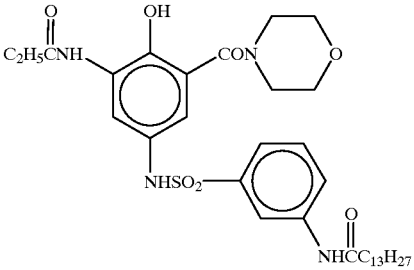
D-16
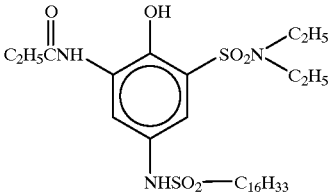
D-17
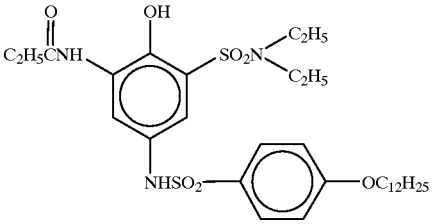

-continued
D-18
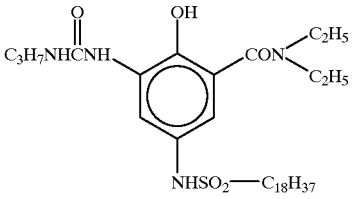
D-19
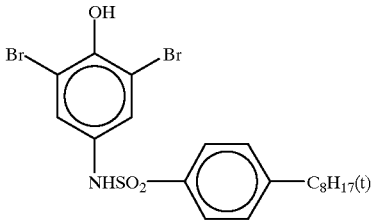
D-20
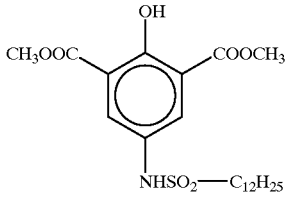
D-21
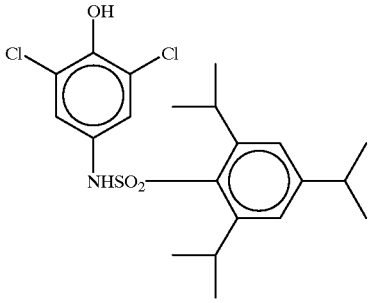
D-22
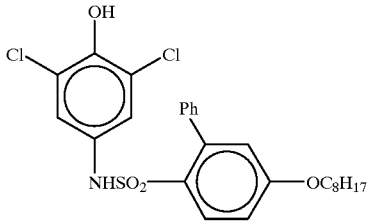
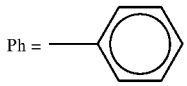
D-23
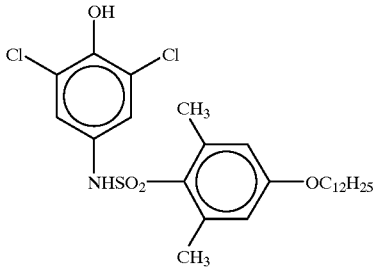
D-24
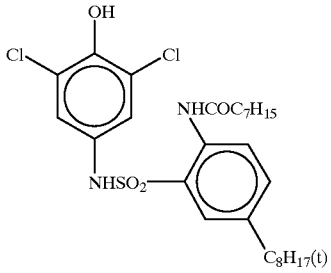
D-25
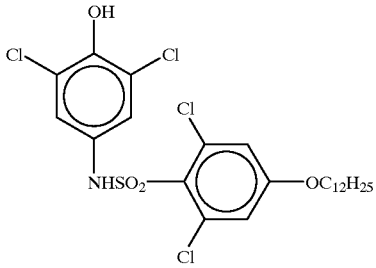
D-26
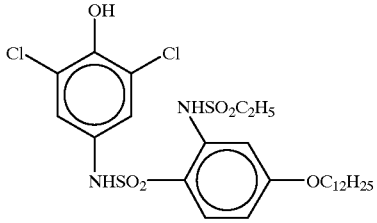
D-27
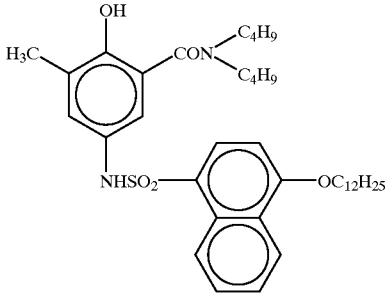

-continued
D-28
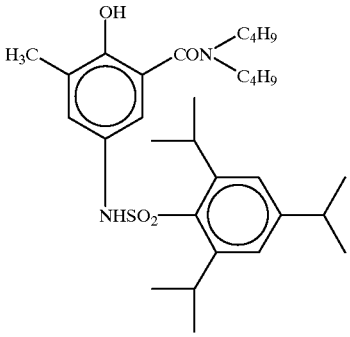
D-29
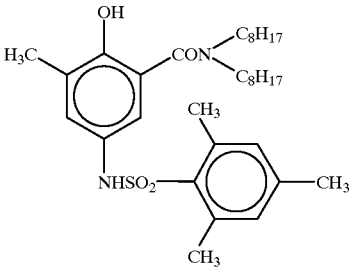
D-30
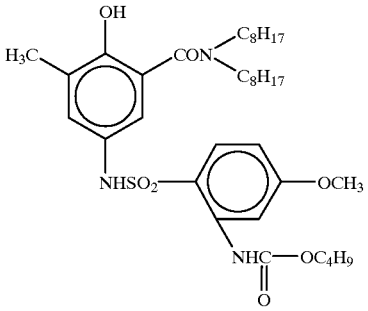
D-31
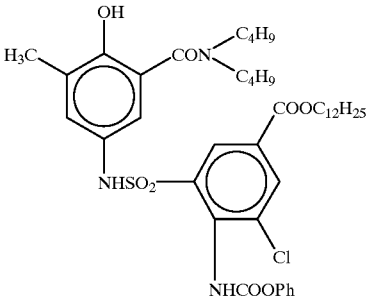
D-32
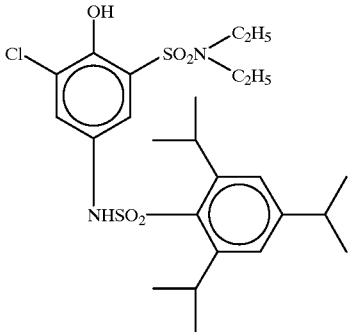
D-33
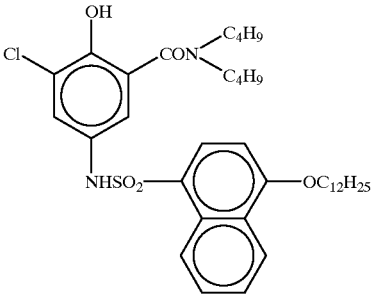
D-34
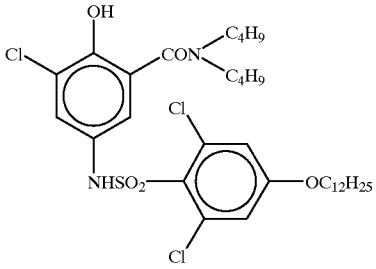
D-35
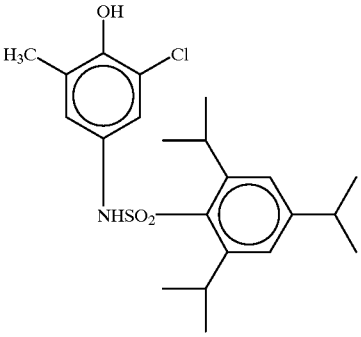

-continued
D-36
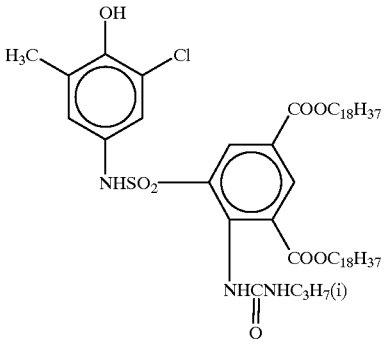
D-37
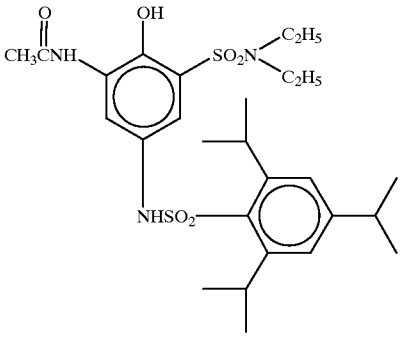
D-38
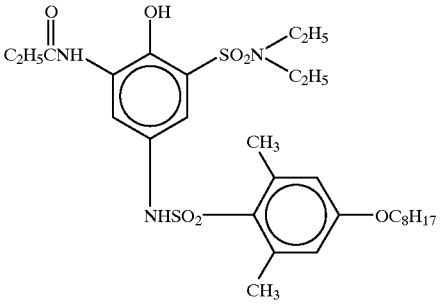
D-39
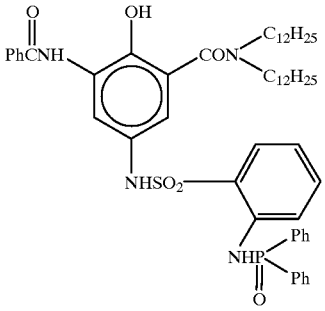
D-40
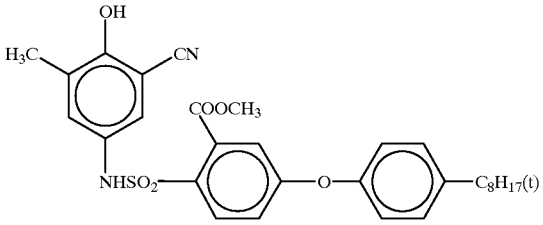
D-41
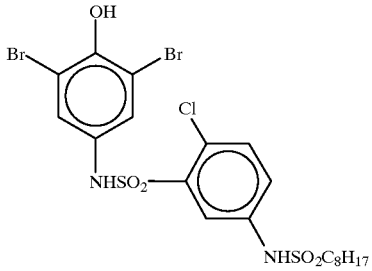
D-42
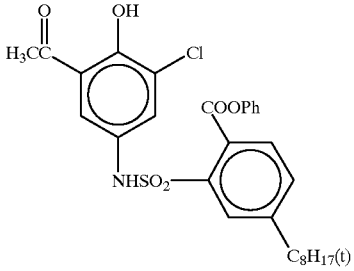
D-43
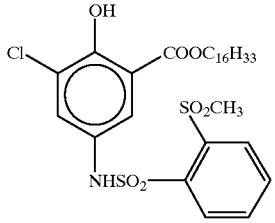
D-44
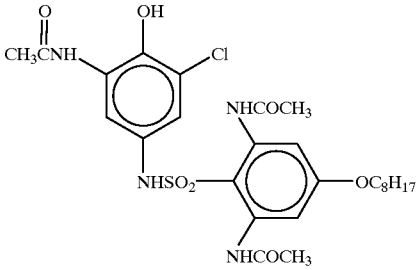
D-45
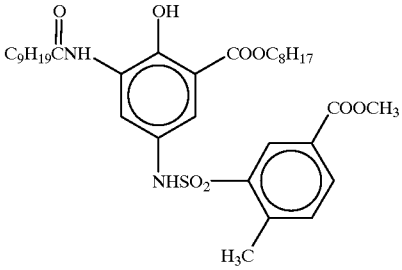

-continued
D-46
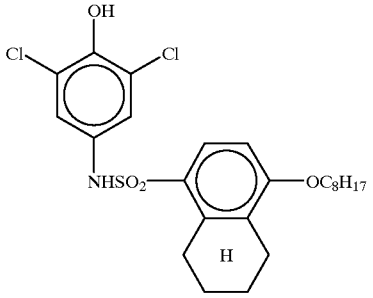
D-47
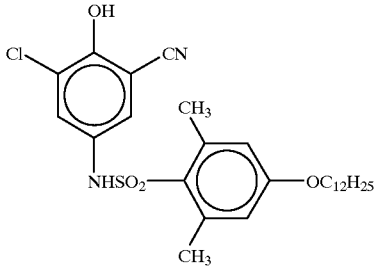
D-48
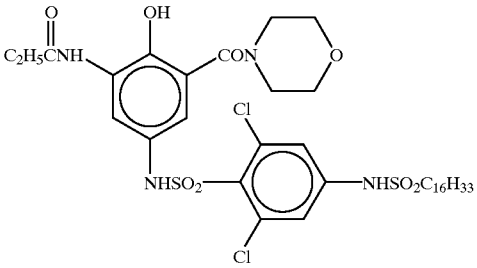
D-49
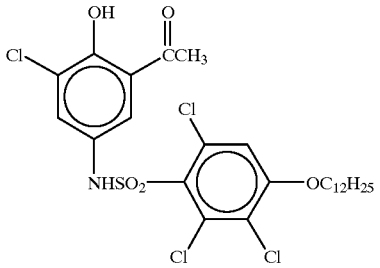
D-50
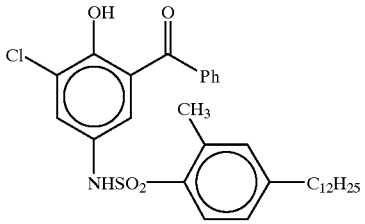
D-51
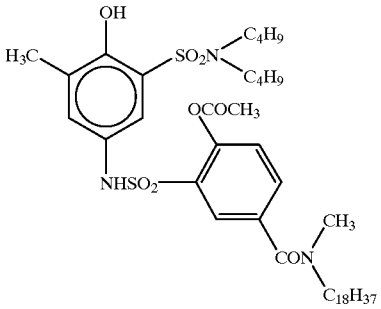
D-52
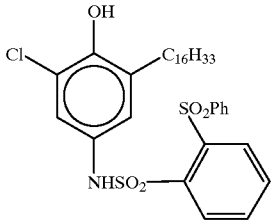
D-53
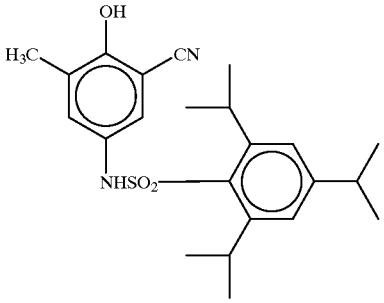
D-54
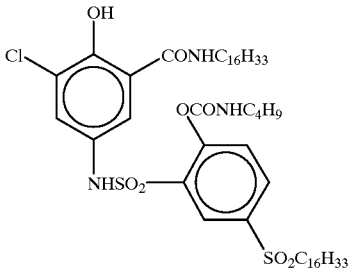
D-55
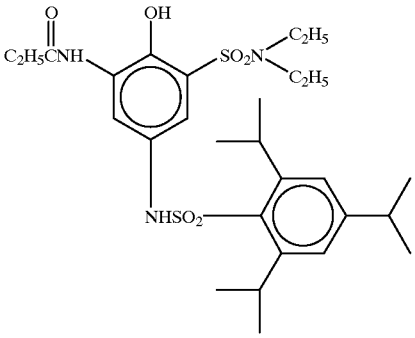

-continued
D-56
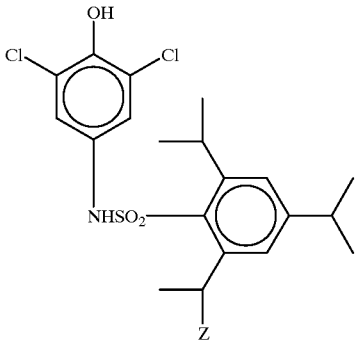
D-57
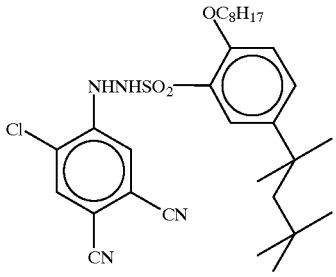
D-58
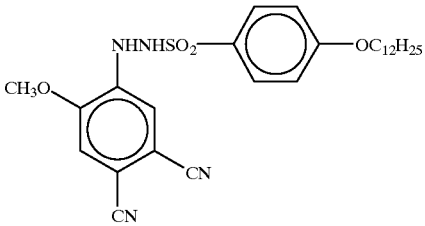
D-59
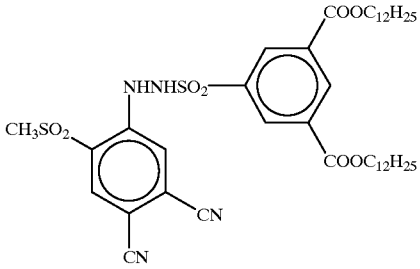
D-60
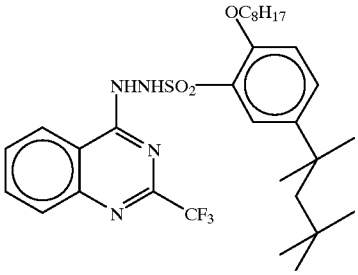
D-61
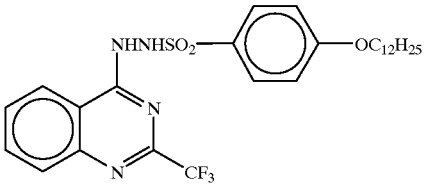
D-62
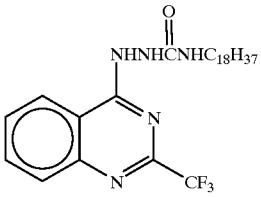
D-63
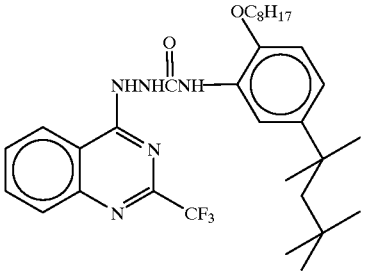
D-64
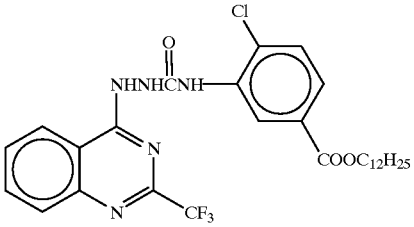
D-65
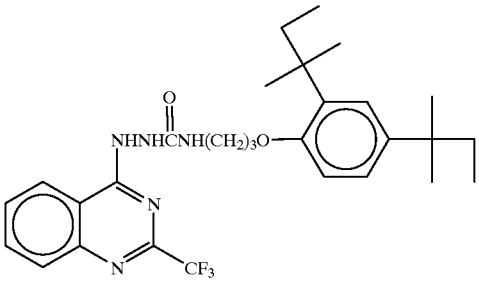

-continued
D-66
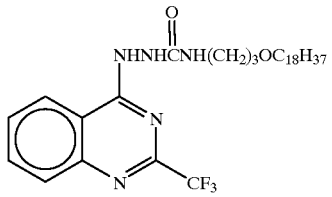
D-67
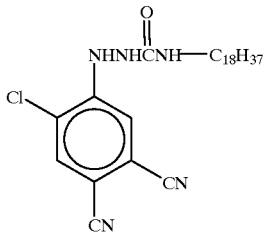
D-68
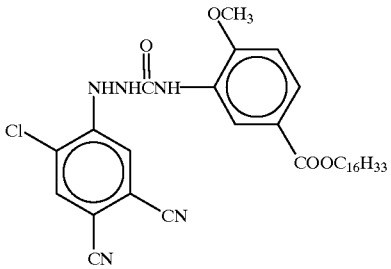
D-69
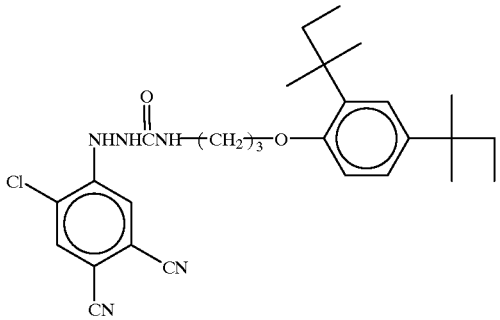
D-70
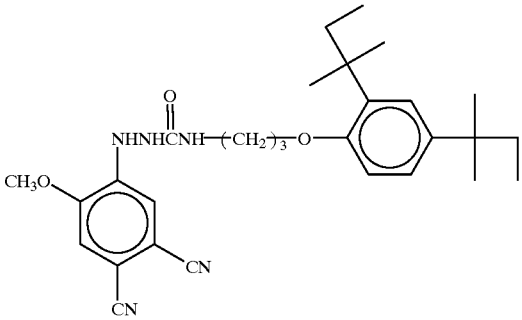
D-71
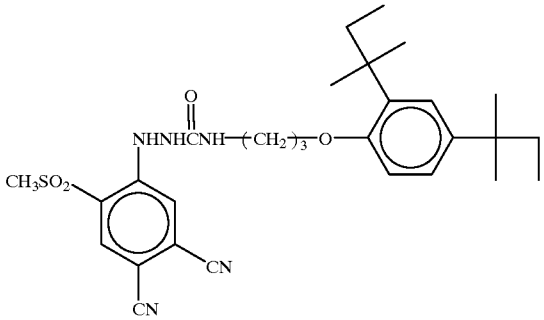
D-72
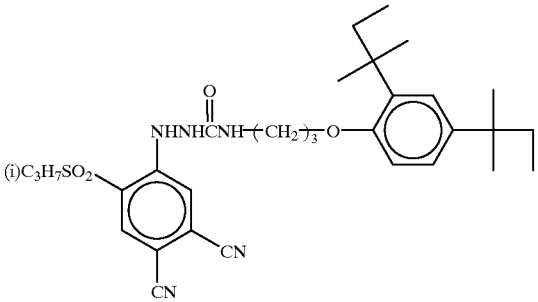
D-73
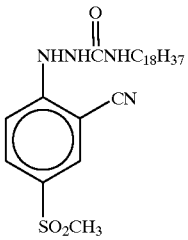
D-74
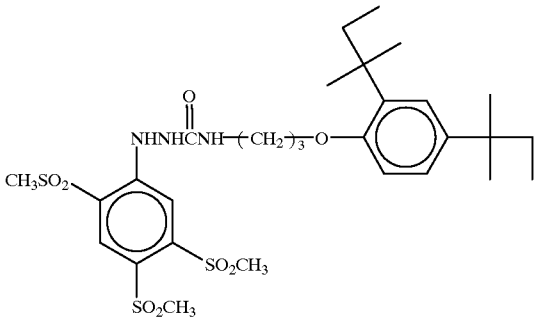
D-75
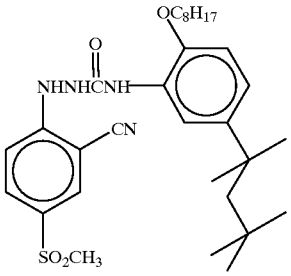

-continued
D-76
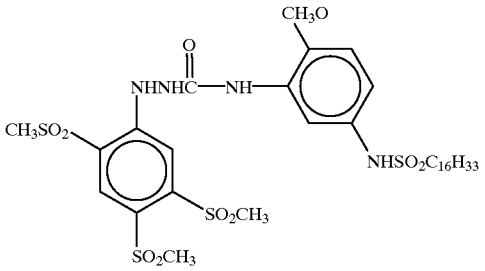
D-77
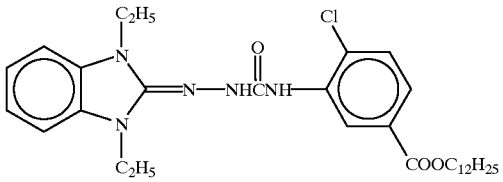
D-78
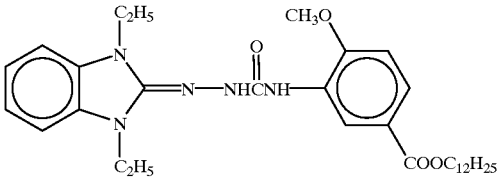
D-79
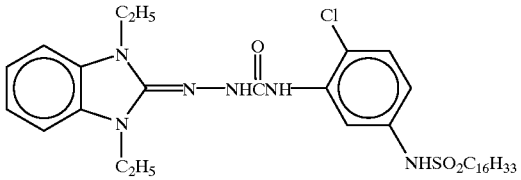
D-80
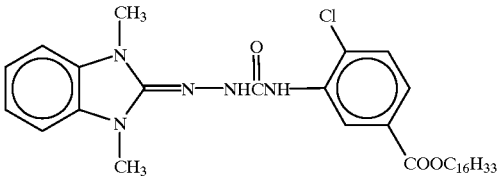
D-81
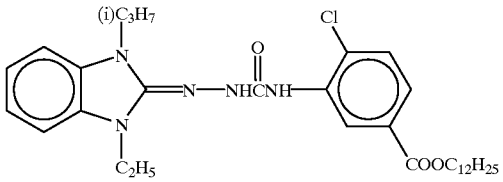
D-82
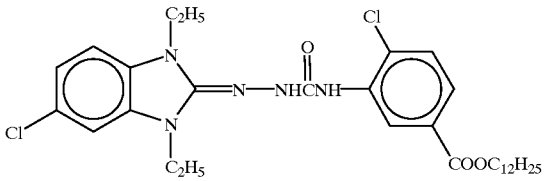
D-83
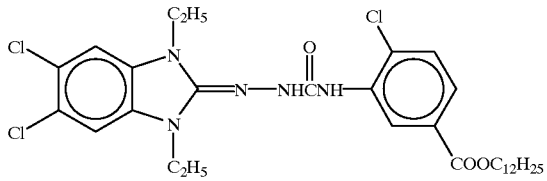
D-84
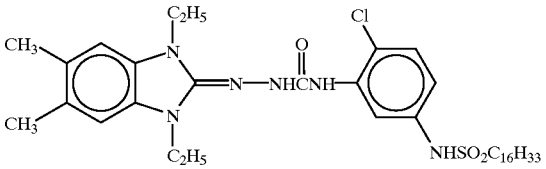
D-85
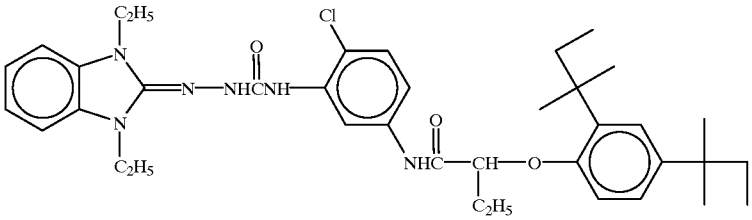
D-86
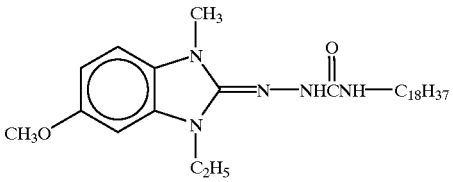
D-87
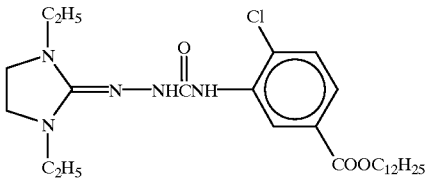

-continued
D-88
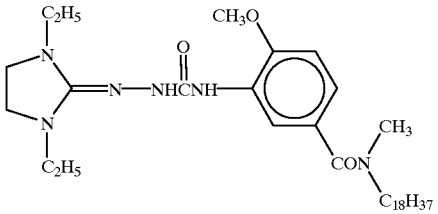
D-89
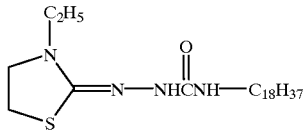
D-90
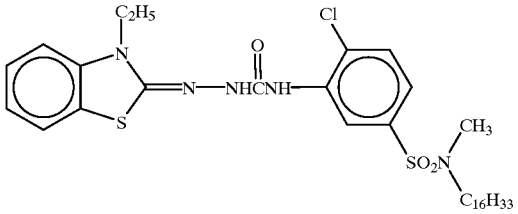
D-91
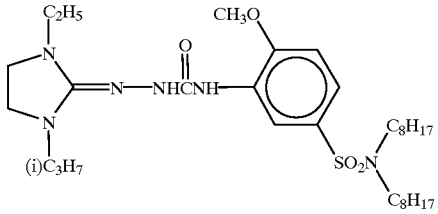
The above-illustrated compounds may generally be synthesized by use of known methods. Some simple synthesis routes will next be shown below.
Synthesis of Developing Agent D-2
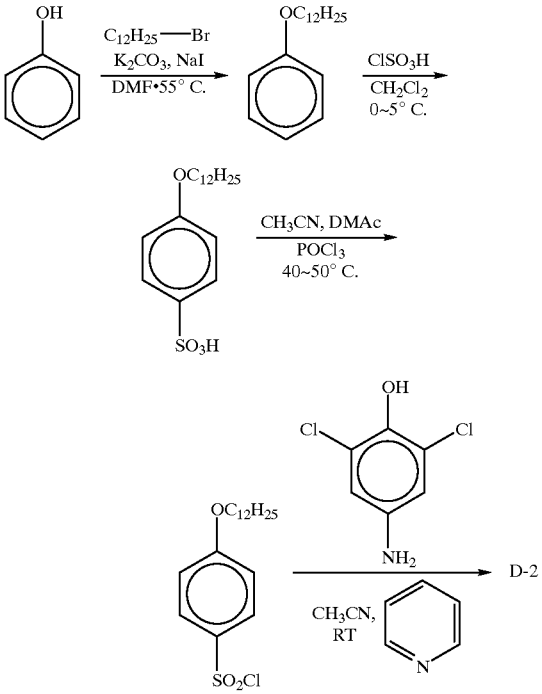
Synthesis of Developing Agent D-62
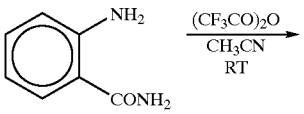
-continued
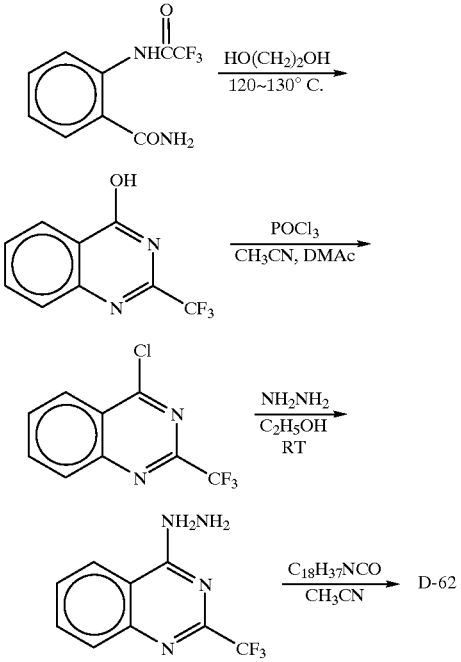
Synthesis of Developing Agent D-77
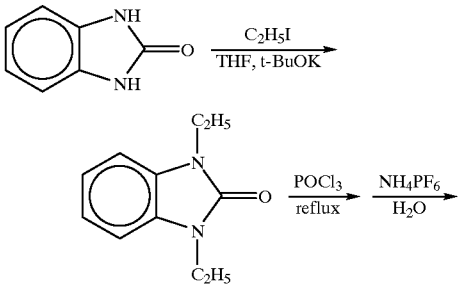

-continued

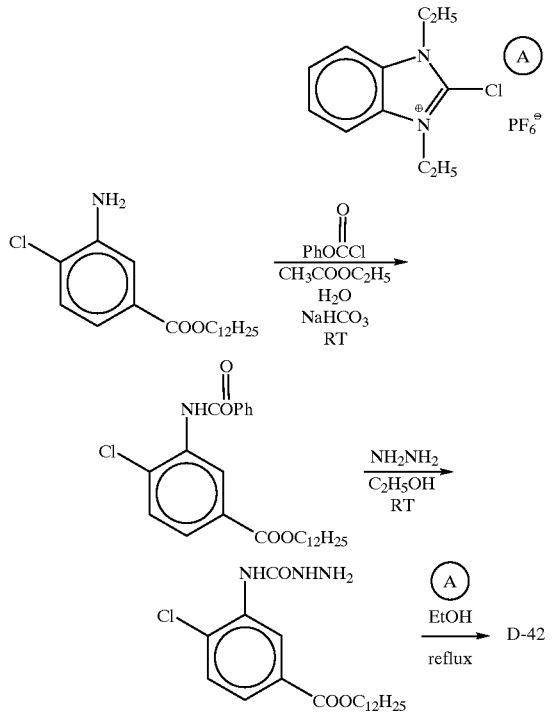

In the case in which a nondiffusive developing agent is used, an electron transport agent and/or a precursor thereof may optionally be used therewith in order to accelerate the electron transfer between the nondiffusive developing agent and the silver halide to be developed. Use of electron transport agents and precursor thereof described in U.S. Pat. No. 5,139,919 and EP-A 418,743 is particularly preferred in the present invention. Use of a method for introducing the electron transport agent and/or precursor thereof into a layer in a stable manner described in JP-A Nos. 2-230,143 and 2-235,044 is also preferred in the present invention.

The electron transport agent and the precursor thereof can be selected from the above-mentioned developing agents and their precursors. The mobility of the electron transport agent or a precursor thereof is preferably greater than that of a nondiffusive developing agent (electron donor). Especially useful electron transport agents are 1-phenyl-3-pyrazolidones or aminophenols.

In addition, the electron donor precursors as described in JP-A No. 3-160,443 are preferable for use in the light-sensitive material of the present invention.

For such purposes as prevention of color mixing, improvement in the color reproduction and the like, a reducing agent may be used in an intermediate layer or in a protective layer. The reducing agents described in EP-A Nos. 524,649 and 357,040 and in JP-A Nos. 4-249,245, 2-46,450 and 63-186,240, are particularly preferable for use in the present invention. Also usable are development inhibitor releasing reducers which are described in JP-B No. 3-63,733, JP-A Nos. 1-150,135, 2-46,450, 2-64,634, and 3-43,735 and EP-A No. 451,833.

Further, a precursor of a developing agent, which does not have reducing properties per se but which exhibits reducing properties under the influence of a nucleophilic reagent or heat in the process of development, may be used in the light-sensitive material of the present invention.

Moreover, the following reducing agents may be incorporated in the light-sensitive material.

Examples of the reducing agents used in the present invention includes reducing agents and precursors thereof as described in U.S. Pat. No. 4,500,626 (columns 49–50), U.S. Pat. Nos. 4,839,272, 4,330,617, 4,590,152, 5,017,454 and 5,139,919, JP-A Nos. 60-140,335 (pages 17–18), 57-40,245, 56-138,736, 59-178,458, 59-53,831, 59-182,449, 59-182,450, 60-119,555, 60-128,436, 60-128,439, 60-198,540, 60-181,742, 61-259,253, 62-244,044, 62-131,253, 62-131,256, 64-13,546 (pages 40–57), 1-120,553, and EP-A2-220,746 (pages 78–96).

Also, combinations of various reducing agents as disclosed in U.S. Pat. No. 3,039,869 may be used.

A developing agent or a reducer may be incorporated into a processing sheet mentioned hereinafter or a light-sensitive material.

In the present invention, the total amounts of the developing agent and the reducing agent is 0.01–20 moles, preferably 0.01–10 moles, per mole of silver.

In the present invention, four-equivalent couplers or two-equivalent couplers may be suitably selected in accordance with the species of the developing agent. Proper selection of couplers prevents production of dull colors attributed to interlayer transfer of oxides of the developing agent. Specific examples of both types of couplers, i.e., four-equivalent couplers and two-equivalent couplers, are described in detail in "The Theory of the Photographic Process," 4th edition, edited by T. H. James, at pages 291–334, 354–361, JP-A No. 58-12,353, 58-149,046, 58-149,047, 59-11,114, 59-124,399, 59-174,835, 59-231,539, 59-231,540, 60-2,951, 60-14,242, 60-23,474, 60-66,249, and other patents and literature listed hereinabove.

Hydrophobic additives such as couplers, and developing agents to form a hue may be introduced into layers of a light-sensitive material by known methods described in U.S. Pat. No. 2,322,027. In this case, an organic solvent having a high boiling point described in, for example, U.S. Pat. Nos. 4,555,470, 4,536,466, 4,536,467, 4,587,206, 4,555,476, 4,599,296, or JP-B No. 3-62,256 may be used, if necessary, in combination with an organic solvent having a low boiling point in the range of 50° to 160° C. These dye-donating compounds, and high-boiling-point organic solvents may be used in combinations of two or more species.

The amount of the organic solvent having a high boiling point is not more than 10 g, preferably not more than 5 g, more preferably in the range of 1 g to 0.1 g based on 1 g of hydrophobic additive; or not more than 1 cc, preferably not more than 0.5 cc, particularly preferably not more than 0.3 cc based on 1 g of the binder.

A dispersion method utilizing a polymer as described in JP-B No. 51-39,853 and JP-A No. 51-59,943 and a method wherein a hydrophobic additive converted into a dispersion of fine grains is added to a light-sensitive material as described in JP-A No. 62-30,242 may be used.

In addition to the above methods, in the case where the hydrophobic additive is a compound substantially insoluble in water, the hydrophobic compound may be converted into a dispersion of fine grains and included in a binder.

When dispersing a hydrophobic compound to form a hydrophilic colloidal dispersion, a variety of surfactants may be used. For example, surfactants described in JP-A No. 59-157,636, pp. 37–38 and in the aforesaid Research Disclosure may be used. In addition, a phosphoric ester-type surfactant described in JP-A Nos. 7-56,267 and 7-228,589 and in German Patent Application Laid-Open No. 1,932,299A may also be used in the light-sensitive material of the present invention.

The light-sensitive material of the present invention may contain a compound which activates the development and stabilizes the image. Preferred examples of these compounds are described in U.S. Pat. No. 4,500,626, columns 51–52.

The light-sensitive material used in the present invention may include at least three types of light-sensitive layers having different spectral sensitivities and different hues of dyes with one another. Each of the layers may be separated into a plurality of silver halide emulsion layers which have substantially same color sensitivity, but different light sensitivity. Each of the aforementioned three types of layers are preferably sensitive to one of blue light, green light, or red light. The arrangement is generally in order of a red-sensitive layer, a green-sensitive layer, and a blue-sensitive layer from the support. Other arrangements may be employed according to purposes. For example, an arrangement described in JP-A No. 7-152,129 may be employed. Silver halides, dye-donating couplers, and color developing agents of the present invention may be included in the same layer, or may be added different layers so long as they can react. For example, when a layer containing a color developing agent and a layer containing a silver halide are disposed separately, the raw storage stability of a light-sensitive material can be enhanced.

The relationship of each layer's spectral sesitivity and a coupler's hue is arbitrary. When a light-sensitive material is constructed such that it incorporates a cyan coupler into a red-sensitive layer, a magenta coupler into a green-sensitive layer, and a yellow coupler into a blue-sensitive layer, conventional color papers may be used for direct exposure.

Other than the aforementioned yellow filter layer, magenta filter layer, and cyan filter layer, a variety of non-light-sensitive layers such as a protective layer, an undercoat layer, or an intermediate layer may be formed between the silver halide emulsion layers of the light-sensitive material, on the top emulsion layer, or on the bottom emulsion layer thereof. Further, a variety of supplementary layers, such as a back layer, may be formed on the reverse side of the support. More specifically, it is possible to form various layers including the above-mentioned construction layer, an undercoat layer described in U.S. Pat. No. 5,051,335, an intermediate layer containing a solid pigment described in JP-A Nos. 1-167,838 and 61-20,943, an intermediate layer containing a reducing agent or a DIR compound described in JP-A Nos. 1-120,553, 5-34,884 and 2-64,634, an intermediate layer containing an electron transport layer described in U.S. Pat. No. 5,017,454 and 5,139,919 and in JP-A No. 2-235,044 and a protective layer containing a reducing agent described in JP-A No. 4-249,245 as well as a combination of two or more of these layers.

A dye which may be used in a yellow filter layer or in an antihalation layer is preferably a dye which loses its color or which is eliminated at the time of development so that it exerts no influence on the density of image after the process.

The dye which is present in the yellow filter layer or in the antihalation layer loses its color or is eliminated at the time of development when the amount of the dye remaining after processing is less than one third, preferably less than one tenth, of the amount of the dye present before processing. This may be attained by a phenomenon wherein the component of the dye is leached out of the light-sensitive material or is transferred into the processing material at the time of development, or by a phenomenon wherein the component of the dye undergoes a reaction and becomes a colorless compound at the time of development.

The light-sensitive material of the present invention is preferably hardened with a hardener.

Examples of the hardener include those described in U.S. Pat. No. 4,678,739, column 41 and U.S. Pat. No. 4,791,042, and in JP-A Nos. 59-116,655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis (vinylsulfonylacetamide)ethane), a N-methylol compound (e.g., dimethylolurea), boric acid, metaboric acid and a polymeric compound (e.g., a compound described in JP-A No. 62-234,157).

These hardeners are used in an amount of 0.001 to 1 g, preferably, 0.005 to 0.5 g, per gram of a hydrophilic binder.

The light-sensitive material may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, JP-A No. 64-13,564, pp. 7–9, pp. 57–71 and pp. 81–97, U.S. Pat. Nos. 4,775,610, 4,626,500 and 4,983,494, JP-A Nos. 62-174,747, 62-239,148, 1-150,135, 2-110,557, 2-178,650 and RD 17,643 (1978) pp. 24–25.

The amount of these compounds is preferably in the range of $5\times10^{-6}$ to $1\times10^{-1}$ mole, more preferably $1\times10^{-5}$ to $1\times10^{-2}$ mole, per mole of silver.

After the light-sensitive material of the present invention has undergone image-forming exposure, images are formed by first bonding the post-exposure light-sensitive material to a processing material having a support and a base and/or a base precursor provided thereon so that the light-sensitive layer surface and the processing layer surface of the processing material are bonded to each other, and subsequently subjecting to a heat development. It is preferable that water in an amount of 10% to 100% that required for the maximum swelling of the entirety of the coating films which constitute the light-sensitive material and the processing material is supplied to the light-sensitive material or the processing material during heat development, and thereafter the two materials are attached to each other and heated for color generation and development. However, the present invention is not limited by such a mode. Also, the developing agent may preferably be incorporated into the light-sensitive material or the processing material according to needs. Again, the present invention is not limited to this mode.

The light-sensitive material of the present invention may be processed under conditions where unreacted silver halide remains unfixed. In this case, a color image is formed on the light-sensitive material, where silver halide remains. In other words, in the case in which a light-sensitive material is used while retaining the residual silver halide thereon, the present light-sensitive material containing an emulsion of tabular, high-AgCl-content grains having (100) or (111) major faces provides images having excellent sharpness as compared with when other types of silver halide are used, and when the coloring dye of the present invention having a specific structure is used in combination, even enhanced sharpness can be obtained.

The present invention was made in an attempt to attain excellent granularity and exposure latitude as well as improved sharpness when the aforementioned heat development is performed, and further to mitigate the load imposed on the environment which may otherwise be incurred by solution development. However, the present invention may be applied to an activator method through use of an alkaline processing solution, or a method in which images are developed through use of a processing solution containing a development agent and a base.

A thermal process of a light-sensitive material is well known in the art. For example, a light-sensitive material for heat development and a heat development process are described in "Shashinkogaku no kiso (Fundamentals of Photographic Engineering)", pp. 553–555, Corona Co., Ltd. (1970), "Eizojoho (Image Information)" (April, 1978), pp. 40, "Nablett's Handbook of Photography and Reprography", 7th Ed. (Vna Nostrand and Reinhold Company), pp. 32–pp. 33, U.S. Pat. Nos. 3,152,904, 3,301, 678, 3,392,020 and 3,457,075, U. K. Pat. Nos. 1,131,108 and 1,167,777 and Research Disclosure (June, 1978), pp. 9–15 (RD-17,029).

The term "activator process" refers to a developing process in which a light-sensitive material containing a color developing agent is treated with a processing solution containing no color developing agent. The characteristic feature of the activator process is that the processing solution for the process does not contain a color developing agent which is contained in an ordinary developing solution. The processing solution for the activator process may contain other components, such as an alkali and an auxiliary developing agent. Examples of the activator processes are described in literature such as EP-A Nos. 545,491A1 and 565,165A1.

Methods for developing a light-sensitive material by means of a processing solution containing a developing agent and a base are described in RD Nos. 17,643, pp. 28–29, 18,716, pp. 651, left column to right column, and 307,105, pp. 880–881.

Details of the processing material and processing method to be employed in the heat developing process in the present invention are described hereinbelow.

The light-sensitive material of the present invention preferably contains a base or a base precursor in order to accelerate the development of silver and the dye forming reaction. Examples of the base precursor include a salt of an organic acid and a base capable of decarboxylation by means of heat and a compound capable of releasing an amine by means of an intramolecular neucleophilic substitution reaction, a Lossen rearrangement or a Beckmann rearrangement. Examples of these compounds are described in U.S. Pat. Nos. 4,514,493 and 4,657,848 as well as in "Known Technologies" No. 5 (issued on Mar. 22, 1991, AZTEC Co., Ltd.), pp. 55–86. In addition, also usable in the present invention is a base generating method in which a combination of a slightly water-soluble basic metal compound and a compound capable of reacting with the metal contained in the foregoing basic metal compound by use of water as a medium to form a complex compound (hereinafter referred to as a complex forming compound) is used, as described in and EP-A No. 210,660 and U.S. Pat. No. 4,740,445.

The amount of the base or the base precursor to be used in the present invention is in the range of 0.1 to 20 g/m$^2$, preferably 1 to 10 g/m$^2$.

The light-sensitive material of the present invention may contain a thermal solvent so as to accelerate heat development. Examples of the thermal solvent include polar organic compounds described in U.S. Pat. Nos. 3,347,675 and 3,667,959. Examples of such compounds include amide derivatives (e.g., benzamide), urea derivatives (e.g., methylurea and ethyleneurea), sulfonamide derivatives (e.g., compounds described in JP-B Nos. 1-40,974 and 4-13,701), polyol compounds (e.g., sorbitols) and polyethylene glycol.

If the thermal solvent is insoluble in water, preferably the thermal solvent is used as a solid dispersion. Depending on the purposes, the thermal solvent may be contained in any of a light-sensitive layer and non-light-sensitive layer.

The temperature of the heat development process is approximately 50° C. to 250° C., preferably 60° C. to 150° C.

The amount of the thermal solvent is in the range of 10 to 500% by weight, preferably 20 to 300% by weight, based on the weight of the binder present in the layer to which the thermal solvent is to be added.

In order to supply a base, which is needed for the heat development process, to the light-sensitive material of the present invention, a processing material is used which has a processing layer containing a base or a base precursor. The processing material may have other functions, for example, a function to shut out the air at the time of heat development, a function to prevent the vaporization of the components of the light-sensitive material, a function to supply a material other than the base to the light-sensitive material and a function to remove a component of the light-sensitive material which becomes unnecessary after the development process (e.g., YF dye and AH dye) or an unnecessary component which is formed during the development process. The support and binder for the processing material can be the same as those for the light-sensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in JP-A No. 61-88,256, pp. 32–41, 62-244,043 and 62-244,036. Further, the processing material can contain a dye acceptor polymeric compound described in U.S. Pat. No. 4,463,079, or the above-mentioned thermal solvent.

When the processing material is subjected to heat development, a small amount of water is used for such purposes for acceleration of development, acceleration of the transfer of the processing material, or acceleration of the diffusion of unnecessary substances as described in U.S. Pat. Nos. 4,704,245 and 4,470,445 and in JP-A No. 61-238,056. Water may optionally contain compounds such as an inorganic salt of an alkali metal, an organic base, a solvent having a low boiling point, a surfactant, an anti-fogging agent, a compound forming a complex with a slightly water-soluble metal salt, an anti-mold agent and an antibacterial agent.

The water is not particularly limited, and examples of the water include distilled water, tap water, well water and mineral water. In the heat developing apparatus utilizing the light-sensitive material of the present invention and the processing material, the waste water may be discarded without being reused or may be recycled for repeated use. When using recycled water, the water used accumulates the components leached out of the materials over repeated use. Further, the apparatus and water described in JP-A Nos. 63-144,354, 63-144,355, 62-38,460 and 3-210,555 may be used in the present invention.

Water may be applied to the light-sensitive material, the processing material, or to both these materials.

The amount of the water to be added ranges from 1/10 to 1 time that required for the maximum swelling of the entire coating layers (excepting the back layer) that constitute the light-sensitive material and the processing material.

Water may be applied to the light-sensitive material or the processing material in such a manner that the material is immersed into water and then taken up to remove water by use of a squeeze roller. Preferably, a predetermined amount of water is applied to the light-sensitive material or processing material at a single coating operation. Particularly preferably, a specific water application device is used to apply water in the form of jet, the device including a nozzle and an actuator, the nozzle having a plurality of nozzle holes for jetting water arranged with certain intervals in straight line along a direction intersecting the direction of conveyance of the light-sensitive material or the processing material, and the actuator displacing the nozzle towards the light-sensitive material or the processing material on the conveyance path.

Preferred examples of methods for supplying water to the two materials include the methods described in JP-A Nos. 62-253,159, pp. 5, and 63-85,544. Further, water contained in microcapsules or in the form of hydrates may be incorporated in advance into the light-sensitive material or the processing material or into both of them.

The temperature of the water to be applied falls within the range of 30 to 60° C. as disclosed in JP-A No. 63-85,544.

When the light-sensitive material is heat-developed in the presence of a small amount of water, it is effective to generate a base as described in EP-A No. 210,660 and in U.S. Pat. No. 4,740,445, wherein a combination of a slightly water-soluble basic metal compound and a compound which forms a complex by the mediation of water and metal ion that constitutes the basic metal (the compound is referred to as a complex forming compound). In this case, it is desirable to incorporate the sparingly water-soluble basic metal compound in the light-sensitive material and to incorporate the complex forming compound in the processing material, from the viewpoint of the storage stability of the raw materials.

Examples of the heating method in the developing process include a method in which the light-sensitive material is brought into contact with a heated block or plate, a method in which the light-sensitive material is brought into contact with such an object as a hot plate, a hot presser, a hot roller, a hot drum, a halogen lamp heater and an infrared or a far infrared lamp heater, and a method in which the light-sensitive material is passed through a hot atmosphere.

As for the method for placing the light-sensitive material and the processing material face to face so that the light-sensitive layer and the processing layer face each other, the methods described in JP-A Nos. 62-253,159 and 61-147,244, page 27 may be employed. Preferably, the material is heated at 70 to 100° C.

For the purpose of processing the light-sensitive material and the processing material of the present invention, any known apparatus for heat development can be used. Preferred examples of the apparatus include the apparatus described in JP-A Nos. 59-75,247, 59-177,547, 59-181,353 and 60-18,951, Japanese Utility Model Application Laid-Open (JP-U) No. 62-25,944 and Japanese patent application Nos. 4-277,517, 4-243,072, 4-244,693, 6-164,421, and 6-164,422.

In addition, commercially available apparatus such as "Pictrostat" 100, 200, 300, 330 and 50 and "Pictrography" 3000 and 2000 manufactured by Fuji Photo Film Co., Ltd. may be used in the present invention.

The light-sensitive material and/or the processing material of the present invention may have an electroconductive heat generator layer as a heating means for heat development. For example, a heat generator layer described in JP-A No. 61-145,544 may be used.

The light-sensitive material of the present invention may contain a silver oxidizing agent for removing developed silver contained in the light-sensitive material simultaneously with development, and for serving as a bleaching agent to the processing material, to thereby induce these reactions during the process of development.

Developed silver may alternatively removed by affixing a second material containing a silver oxidizing agent to the light-sensitive material after completion of development of formed images.

However, preferably, for the sake of simplicity of processing, developed silver is not bleached during development.

As regards the bleaching agent which may be used in the processing material, silver bleaching agents routinely employed may be arbitrarily used. Examples of such silver bleaching agents are described in U.S. Pat. Nos. 1,315,464 and 1,946,640 and in "Photographic Chemistry", vol. 2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are water-soluble compounds, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron III salt of cyclohexyldialkylaminetetraacetic acid, an iron III salt of ethylenediaminetetraacetic acid and an iron III salt of citric acid. Materials of the binder, support, and other additives which may be used to prepare the second processing material may be the same as those usable for preparing the previously described processing material (first processing material) for developing the light-sensitive material.

The amount of the bleaching agent to be added should be determined in accordance with the amount of silver contained in the light-sensitive material to be bonded, and is in the range of 0.01 to 10 moles, preferably 0.1 to 3 moles, more preferably 0.1 to 2 moles, per mols of silver coated on the unit area of the light-sensitive material.

Both the first processing material and the second processing material may have at least a single polymerizable timing layer. The polymerizable timing layer can temporarily retard the bleaching reaction during the period until the desired reaction among the silver halide, a dye forming compound, or a developing agent substantially terminates. The timing layer may comprise gelatin, polyvinyl alcohol or polyvinyl alcohol—polyvinyl acetate. This layer may be a barrier timing layer as described in U.S. Pat. Nos. 4,056,394, 4,061,496 and 4,229,516.

When the timing layer is provided by coating, the film thickness of the timing layer is in the range of 5 to 50 $\mu$m, preferably 10 to 30 $\mu$m.

In the present invention, in order to bleach the light-sensitive material after being developed by use of the second processing material, a specific amount of water (0.1 to 1 time that required for attaining the maximum swelling of all the applied films excepting the back layers on the light-sensitive material and the processing material) is applied to the light-sensitive material or the second processing material, and subsequently, the light-sensitive material and the second processing material are affixed so that the light-sensitive layer and processing layer face each other, and thereafter heat (40° C.–100°) is applied for 5 to 60 seconds.

As for the amount of water, type of water, method of supplying water and method of placing the light-sensitive material and the second processing material face to face, the same conditions as those in the case of the first processing material may be employed.

More specifically, the bleaching sheets described in JP-A No. 59-136,733, U.S. Pat. No. 4,124,398 and JP-A No. 55-28,098 may be used in the present invention.

After being subjected to heat development, the light-sensitive material of the present invention is used as a negative original with unreacted silver halide being retained unfixed and thus substantially retaining the unreacted silver halide on the light-sensitive material, to thereby form images on paper, etc.

In the present invention, by the phrase "with unreacted silver halide being retained unfixed" is intended to mean that no fixing step is performed as an additional post heat development step.

In the present invention, by the phrase "substantially retaining the unreacted silver halide" is intended to mean that not less than 50 mol %, preferably not less than 70 mol %, more preferably not less than 80 mol %, of unreacted silver halide is retained.

In the present invention, it is preferred that the processing time from the point where the film surfaces of the processing sheet and the light-sensitive material are brought to be in contact each other in the presence of water to the point where the two are separated from each other be within 30 seconds.

In order to improve coatability, releasability, or lubricity, to secure antistaticity, and to accelerate development reaction, a variety of surfactants may be incorporated into the light-sensitive material. Examples of the surfactants include those described in "Known Technologies" No. 5 (issued on Mar. 22, 1991, AZTEC Co., Ltd.), pp. 136–138 and in JP-A Nos. 62-173,463 and 62-183,457.

For such purposes as prevention of excessive lubricity, prevention of electrostatic charge and improvement of releasability, organic fluorine-containing compounds may be added to the light-sensitive material. Typical examples of the organic fluorine-containing compounds include fluorine-containing surfactants and hydrophobic fluorine-containing compounds, such as an oily fluorine-containing compound, e.g., fluorocarbon oil, and a solid fluorine-containing resin, e.g., tetrafluoroethylene, described in JP-B No. 57-9,053, columns 8–17, JP-A Nos. 61-20,944 and 62-135,826.

Preferably, the light-sensitive material has a certain level of lubricity. For this purpose, it is preferable that a lubricant is contained both in the light-sensitive layer and in the back layer. A preferred level of lubricity is indicated by a coefficient of dynamic friction in the range between 0.01 and 0.25 inclusive, which is determined in a test comprising sliding the light-sensitive material at a rate of 60 cm/min against stainless steel balls having a diameter of 5 mm (25° C., 60% RH). In this test, a value of nearly the same level is obtained even if the stainless steel balls are replaced with a light-sensitive layer.

Examples of usable lubricants include polyorganosiloxanes, higher aliphatic acid amides, metal salts of higher fatty acids and esters made up of higher fatty acids and higher alcohols. Examples of the polyorganosiloxanes include polydimethylsiloxane, polydiethylsiloxane, polystyrylmethylsiloxane and polymethylphenylsiloxane. The layer to which the lubricant is added is preferably the outermost emulsion layer or the back layer. Polydimethylsiloxane and an ester having a long alkyl chain are particularly preferred.

It is preferable to use an anti-static agent in the present invention. Polymers which contain carboxylic acid, a carboxylic acid salt, or a sulfonic acid salt, cationic polymers, and ionic surfactants may be used as the anti-static agent.

The most preferred anti-static agent is grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, $MoO_3$ and $V_2O_5$ and having a volume resistivity of $10^7$ Ω·cm or less, preferably $10^5$ Ω·cm or less, or grains of a complex oxide thereof, for example, a complex of an element such as Sb, P, B, In, S, Si, C and the like and the foregoing metal oxide. Metal oxides in the form of sol and fine particles of a complex oxide of such metal oxides are also preferred. The amount of an anti-static agent present in the light-sensitive material is preferably in the range of 5 to 500 mg/m$^2$, more preferably in the range of 10 to 350 mg/m$^2$. The ratio of an electroconductive crystalline oxide or a complex oxide thereof to a binder is preferably in the range of 1/300 to 100/1, more preferably 1/100 to 100/5.

Constituent layers (including a back layer) of the light-sensitive material or below-described processing material may contain a polymer latex in order to improve film properties such as dimensional stability, prevention of curling, prevention of adhering, prevention of film cracking, and prevention of pressure-induced sensitization or desensitization. Any polymer latex described in JP-A Nos. 62-245,258, 62-136,648 and 62-110,066 may be used in the present invention. Particularly, use of a polymer latex having a low glass transition point (40° C. or less) in a processing layer prevents generation of cracks in the layer, while use of a polymer latex having a high glass transition point in the back layer prevents curling.

Preferably, the light-sensitive material of the present invention contains a matting agent. Although the matting agent may be added to either the light-sensitive layer or the back layer, it is particularly preferable that the matting agent be added to the outermost layer on the emulsion side. Although the matting agent may be soluble or insoluble during processing, it is preferable to use a combination of a soluble matting agent and an insoluble matting agent in the present invention. An example of such a combination of matting agents comprises grains of polymethyl methacrylate, poly(methyl methacrylate/methacrylic acid) (in a molar ratio of 9/1 or 5/5) and polystyrene. Preferably, the matting agent has grain diameters in the range of 0.8 to 10 $\mu$m. Also, the matting agent preferably has a narrow grain diameter distribution range. It is preferable that 90% or more of the total number of the grains have a diameter falling in the range of 0.9 to 1.1 times the average grain diameter. Meanwhile, in order to enhance the matting effect, it is also preferable to use fine grains having a grain diameter of 0.8 $\mu$m or less, together with the matting agent having the above-mentioned grain diameter. Examples of fine grains include grains of polymethyl methacrylate (0.2 $\mu$m), grains of poly(methyl methacrylate/methacrylic acid) (in a molar ratio of 9/1, 0.3 $\mu$m ), grains of polystyrene (0.25 $\mu$m) and grains of colloidal silica (0.03 $\mu$m).

Specific examples of the matting agent are described in JP-A No. 61-88,256, page 29. Other examples of the matting agent are benzoguanamine resin beads, polycarbonate beads and AS resin beads, all of which are described in JP-A Nos. 63-274,944 and 63-274,952. Further, the compounds described in the aforesaid Research Disclosure may be employed as the matting agent.

In the present invention, a support for the light-sensitive material may be transparent and able to withstand the processing temperature. Generally, examples of the support are paper, a synthetic polymer (film) and the like, as described in "Shashinkogaku no kiso—Gin'en Shashin Hen (Fundamentals of Photographic Engineering—Silver Salt Photography Section)," pp. 223–240, edited by Photographic Society of Japan, Corona Co., Ltd., 1979. Specific examples of the support include polyethylene terephthalate, polyethylene naphthalate, polycarbonate, polyvinyl chloride, polystyrene, polypropylene, polyimide, and cellulose (e.g., triacetylcellulose).

Other supports which may be used in the present invention include those described in JP-A Nos. 62-253,159, pp. 29–31, 1-161,236, pp. 14–17, 63-316,848, 2-22,651 and 3-56,955 and U.S. Pat. No. 5,001,033.

In the case where high levels of resistance to heat and curling are required, the supports described in the following publications may be preferably used: JP-A Nos. 6-41,281, 6-43,581, 6-51,426, 6-51,437, 6-51,442, 6-82,961, 6-82,960, 6-123,937, 6-82,959, 6-67,346, 6-118,561, 6-266,050, 6-202,277, 6-175,282, 6-118,561, 7-219,129 and 7-219,144.

Also preferable is a support mainly made from a styrene-based polymer having a syndiotactic structure.

In order to bond the photographic layer to the support, it is preferable that the support be surface-treated. Examples of the surface treatment include a chemical process, a mechanical process, a corona discharge process, a flame process, an ultraviolet ray process, a high frequency wave process, a glow discharge process, an activated plasma process, a laser process, a mixed acid process and an ozone-oxidation process. Among these surface processes, an ultraviolet irradiation process, a flame process, a corona discharge process and glow discharge process are particularly preferred.

An undercoat layer may comprise a single layer or two or more layers. A typical example of the binder for the undercoat layer may be copolymer made up of a monomer selected from the group consisting of vinyl chloride, vinylidene chloride, butadiene, methacrylic acid, acrylic acid, itaconic acid, maleic anydride and the like. Othe examples of the binder may be polyethylene imine, an epoxy resin, grafted gelatin, nitrocellulose, and gelatin. Examples of the compound that swells the support include resorcin and p-chlorophenol. The undercoat layer may contain a gelatin-hardening agent such as chromates (e.g., chromium alum), aldehydes (e.g., formaldehyde and glutaric aldehyde), isocyanates, active halogen compounds (e.g., 2,4-dichloro-6-hydroxy-s-triazine), an epichlorohydrin resin and active vinylsulfonic compounds. Further, the undercoat layer may contain $SiO_2$, $TiO_2$, grains of an inorganic material or grains of a copolymer of polymethyl methacrylate (0.01 to 10 $\mu$m) as a matting agent.

It is preferable to record photographic information and the like by use of a support provided with a magnetic recording layer described in JP-A Nos. 4-124,645, 5-40,321, 6-35,092 5-58,221, and 6-317,875.

The magnetic recording layer is formed by coating onto a support an aqueous or organic solvent-based coating solution comprising a binder and magnetic grains dispersed therein.

Examples of usable magnetic grains include ferromagnetic iron oxide such as Y-$Fe_2O_3$, Co-coated y-$Fe_2O_3$, Co-coated magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-coated ferromagnetic iron oxide such as Co-coated $\gamma$-$Fe_2O_3$ is preferable. The magnetic grains may have the form of needles, rice grains, spheres, cubes, or plates. The specific surface area in SBET is preferably 20 $m^2/g$ or greater, more preferably 30 $m^2/g$ or greater. The saturation magnetization ($\sigma s$) of the ferromagnetics is preferably in the range of $3.0\times10^4$ to $3.0\times10^5$ A/m, more preferably $4.0\times10^4$ to $2.5\times10^5$ A/m. The ferromagnetic grains may be surface-treated with silica and/or alumina or with an organic substance. Further, as described in JP-A No. 6-161,032, the ferromagnetic grains may be surface-treated with a silane coupling agent or with a titanium coupling agent. Magnetic grains covered with an inorganic or organic substance and described in JP-A Nos. 4-259,911 and 5-81, 652 may also be used in the present invention.

As described in JP-A No. 4-219,569, the binders usable together with the magnetic grains are thermoplastic resins, thermosetting resins, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 300° C. and a weight-average molecular weight in the range of 2,000 to 1,000,000. Preferred examples of the binder include vinyl-based copolymers, cellulose derivatives (e.g., cellulose diacetate, cellulose triacetate, cellulose acetatepropionate, cellulose acetatebutylate and cellulose tripropionate), acrylic resins, and polyvinyl acetal resins. Cellulose di(tri)acetate is particularly preferred. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate, xylylenediisocyanate, a reaction product of any of these isocyanates and polyalcohol (e.g., a reaction produc of tolylenediisocyanate (3 mol) and trimethylol propane (1 mol), and a polyisocyanate produced by a condensation reaction of these isocyanates, all of which are described, for example, in JP-A No. 6-59,357.

As described in JP-A No. 6-35,092, the aforementioned magnetic grains are dispersed in a binder preferably by means of a kneader, a pin-type mill or an annular mill. Use of these dispersing means in combination is also preferable. iThe dispersants described in JP-A No. 5-88,283 and other known dispersants may be used in order to disperse the magnetic grains in the binder. The thickness of the magnetic recording layer is in the range of 0.1 to 10 $\mu$m, preferably 0.2 to 5 $\mu$m, and more preferably 0.3 to 3 pm. The ratio of the weight of the magnetic grains to the weight of the binder is preferably in the range of 0.5:100 to 60:100, more preferably 1:100 to 30:100. The amount of the magnetic grains used for coating is in the range of 0.005 to 3 $g/m^2$, preferably 0.01 to 2 $g/m^2$, and more preferably 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in stripes on the reverse side of a photographic support by coating or printing. In forming the magnetic recording layer, there may be employed an air doctor method, a blade method, an air knife method, squeezing, impregnation, reverse roll coating, transfer roll coating, gravure coating, kissing, casting, spraying, dipping, bar coating and extrusion. The coating solution described, for example, in JP-A No. 5-341,436, is preferably used.

The magnetic recording layer may also function to enhance lubrication, control curling, prevent charging of electrostaticity, prevent adhering, and to polish the head. Also, another functional layer exerting any of these functions may be formed. The abrasive grains which impart a head polishing function to the magnetic recording layer or to another functional layer preferably contain at least one type of grain having a Mohs' hardness of 5 or greater and are non-spherically shaped inorganic grains. Examples of non-spherical inorganic grains include oxides (such as aluminum oxide, chromium oxide, silicon dioxide and titanium dioxide), carbides (such as silicon carbide and titanium carbide), and fine powder of diamond. The surfaces of abrasive grains may be treated with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder for the overcoat, the same binders as those mentioned above may be used, and preferably the same as that listed for the magnetic recording layer. The light-sensitive materials having a magnetic recording layer are described in U.S. Pat. Nos. 5,336,589, 5,250,404, 5,229,259 and 5,215,874 and in EP 466,130.

Polyester supports which are preferably used in the light-sensitive material having the above-described magnetic recording layer are described below. Details of the polyester supports including light-sensitive material, processing procedure, cartridges and examples of use are shown in JIII Journal of Technical Disclosure No. 94-6,023 (issued on Mar. 15, 1994, The Japan Institution of Invention and Innovation). The polyester is made up of a diol and an aromatic dicarboxylic acid. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethylene glycol, triethylene glycol, cyclohexanedimethanol, bisphenol A and bisphenol. Examples of polymers formed from theses monomers include homopolymers such as polyethylene terephthalate, polyethylene naphthalate and polycyclohexanedimethanol terephthalate. A polyester containing 2,6-naphthalenedicarboxylic acid in an amount of 50 to 100 mol % is preferred, and polyethylene 2,6-naphthalate is particularly preferred. The average molecular weight of the polyester is in the range of about 5,000 to 200,000. Tg of the polyester is 50° C. or greater, preferably 90° C. or greater.

Next, in order to make the polyester support resistive to curling, the polyester support is subjected to a heat process within a specified temperature range (preferably not lower than 40° C. but below Tg, more preferably not lower than (Tg—20)° C. but below Tg). The heat process may be carried out at a constant temperature within the above-mentioned range, or it may be carried out while being cooled. The duration of the heat process is preferably in the range of 0.1 to 1,500 hours, more preferably 0.5 to 200 hours. The heat process may be effected while the support is held in the shape of a roll, or the heat process may be effected while the support is in the shape of a web while being carried. Electroconductive inorganic particles, such as $SnO_2$ and $Sb_2O_5$, may be provided onto the surface of the support to impart surface roughness so that the surface condition is improved. Further, it is preferable that the support is designed in such a way that the tips of the roll are slightly elevated relative to other parts so that transfer of the cut end mark in the roll core is prevented. Although the heat process may be carried out after film forming, after surface process, after application of back layer (e.g., antistatic agent, lubricating agent or the like) and after application of undercoatr, the heat process is carried out preferably after the application of an anti-static agent.

An ultraviolet absorber may be blended into the polyester. Further, in order to prevent light piping, a dye or pigment, commercialized for polyester use under the names of "Diaresin" (from Mitsubishi Chemical Industries, Co., Ltd.) or "Kayaset" (from Nihon Kayaku Co., Ltd.) may be blended into the polyester.

A film magazine, into which the light-sensitive material of the present invention may be encased, is explained below. The main material of the film magazine may be a metal or a synthetic plastic.

Preferred examples of the plastic material include polystyrene, polyethylene, polypropylene and polyphenyl ether. The film magazine may contain an anti-static agent, examples of which include carbon black, metal oxide particles, surfactants (nonionic, anionic, cationic and betaine surfactants), and polymers. Examples of the magazines which have been rendered antistatic are described in JP-A Nos. 1-312,537 and 1-312,538. The resistivity of the magazine is preferably $10^{12}$ Ω·cm or less in a condition of 25° C. and 25% RH. Generally, carbon black or a pigment is incorporated into the plastic magazine in order to afford light-shielding. The size of the magazine may be the 135 size which is currently employed (the diameter of cartridge of the 135 size is 25 mm). For use in a small-sized camera, a film magazine having a diameter of 22 mm or less may be used. The case volume of the magazine is 30 $cm^3$ or less, preferably 25 cm or less. The weight of the plastics for a film magazine is preferably in the range of 5 g to 15 g.

A film magazine which feeds out film by the rotation of a spool may be used for the light-sensitive material of the present invention. A film magazine wherein the end of the film is fed from the port of the film magazine to the outside by rotating the spool axis in the direction of the feed of the film can also be used. These magazines are described in U.S. Pat. Nos. 4,834,306 and 5,226,613.

The above-described light-sensitive materials may also be advantageously adapted to lens-equipped film units described in JP-B No. 2-32,615 and JUM-B No. 39,784.

The processing layer of the processing material of the present invention preferably contains a base and/or a base precursor.

The base and/or the base precursor of the present invention may be identical to or different from the decolorizing agent or a precursor thereof. In other words, the base (or base precursor) (e.g., a guanidine ring) necessary for the imagewise formation of dye may or may not serve as a decolorizing agent (or decolorizing agent precursor).

As regards the base, inorganic bases and organic bases may be used. Examples of inorganic bases may include those described in JP-A No. 62-209448 such as alkali metal or alkaline earth metal hydroxides (e.g., potassium hydroxide, sodium hydroxide, lithium hydroxide, calcium hydroxide, and magnesium hydroxide); alkali metal or alkaline earth metal phosphates (e.g., secondary or tertiary phosphate such as dipotassium hydrogenphosphate, disodium hydrogenphosphate, ammonium sodium hydrogenphosphate, and calcium hydrogenphosphate); alkali metal or alkaline earth metal carbonates (e.g., potassium carbonate, sodium carbonate, sodium hydrogencarbonate, and magnesium carbonate); alkali metal or alkaline earth metal borates (e.g., potassium borate, sodium borate, and sodium metaborate); and organic acid salts of alkali metals or alkaline earth metals (e.g., potassium acetate, sodium acetate, potassium oxalate, sodium oxalate, potassium tartarate, sodium tartarate, sodium malate, sodium palmitate, and sodium stearate); as well as acetylides of alkali metals or alkaline earth metals which are described in JP-A No. 63-25208.

Examples of organic bases may include ammonia or aliphatic or aromatic amines such as primary amines (e.g., methylamine, ethylamine, butylamine, n-hexylamine, cyclohexylamine, 2-ethylhexylamine, allylamine, ethylenediamine, 1,4-diaminobutane, hexamethylenediamine, aniline, anisidine, p-toluidine, α-naphthylamine, m-phenylenediamine, 1,8-diaminonaphthalene, benzylamine, phenethylamine, ethanolamine, and thallium); secondary amines (e.g., dimethylamine, diethylamine, dibutylamine, diallylamine, N-methylaniline, N-methylbenzylamine, N-methylethanolamine, and diethanolamine); tertiary amines (e.g., N-methylmorpholine, N-hydroxyethylmorpholine, N-methylpyridine, N-hydroxyethylpiperidine, N,N'-dimethylpiperazine, N,N'-dihydroxyethylpiperazine, diazabicyclo[2.2.2]octane, N,N-dimethylethanolamine, N,N-dimethylpropanolamine, N-methyldiethanolamine, N-methyldipropanolamine, triethanolamine, N,N,N',N'-tetramethylethylenediamine, N,N,N',N'-tetrahydroxyethylethylenediamine, N,N,N',N'-tetramethyltrimethylenediamine, and N-methylpyrrolidine; all features described in JP-A No. 62-170954); polyamines (e.g., diethylenetriamines, triethylenetetramine, polyethyleneimine, polyallylamine, polyvinylbenzylamine, poly(N,N-diethylaminoethyl methacrylate), and poly(N,N-dimethylvinylbenzylamine)); hydroxylamines (e.g., hydroxylamine and N-hydroxy-N-methylaniline); heterocyclic amines (pyridine, lutidine, imidazole, aminopyridine, N,N-dimethylaminopyridine, indole, quinoline, isoquinoline, poly(4-vinylpyridine), and poly(2-vinylpyridine)); amidines (e.g., monoamidines such as acetoamidine, imidazoline, 2-methylimidazole, 1,4,5,6-tetrahydropyrimidine, 2-methyl-1,4,5,6-tetrahydropyrimidine, 2-phenyl-1,4,5,6-tetrahydropyrimidine, iminopiperidine, diazabicyclononene, and diazabicycloundecene (DBU); and bis, tris, or tetramidines); guanidines (e.g, water-soluble monoguanidines such as guanidine, dimethylguanidine, tetramethylguanidine, 2-aminoimidazoline, and 2-amino-1,4,5-tetrahydropyrimidine; water-insoluble mono or bisguanidines described in JP-A No. 63-70845; and bis, tris, or tetraguanidines); and tertiary ammonium hydroxides (e.g., tetramethylammonium hydroxide, tetraethylammonium hydroxide, tetrabutylammnoium hydroxide, trimethylbenzylammonium hydroxide, trioctylmethylammonium hydroxide, and methylpyridinium hydroxide).

As regards the base precursors, those of the decarbonation type, decomposition type, reaction type, complex-formation type, etc. may be used.

In the present invention, as described in EP-210,660 and U.S. Pat. No. 4,740,445, combination use of a slightly water-soluble basic metal compound and a compound which is capable of forming a complex compound with metal ions in the basic metal compound mediated by water (called a complexing compound) may be advantageously employed for forming a base. In this case, the slightly water-soluble basic metal compound is preferably incorporated in the light-sensitive material and the complexing compound is preferably incorporated in the processing material or vice versa. Particularly, a method for forming guanidines may be advantageously employed in that the formed guanidines may also serve as an effective dye-decolorizing agent.

The amount of the base or the precursor thereof may be 0.1 to 20 g/m$^2$, preferably 1 to 10 g/m$^2$.

Hydrophilic polymers used in the light-sensitive material may also be used as binders in the processing layer.

The processing material may preferably be hardened with a hardener as is the case with the light-sensitive material. A hardener used in the light-sensitive material may also be used.

The processing material may contain a mordant. A polymer mordant may preferably used as the mordant. Examples of the mordant may include polymers having a secondary or tertiary amino group, polymers having an azo-heterocyclic moiety, and polymers having quaternary cationic group thereof. These polymers have a molecular weight of 5,000 to 20,000, particularly 10,000 to 50,000.

More specifically, examples of the mordant may include vinylpyridine polymers and vinylpyridinium cationic polymers disclosed in, for example, U.S. Pat. Nos. 2,548,564, 2,484,430, 3,148,061, and 6,756,814; polymer mordants cross-linkable with gelatin, etc. disclosed in, for example, U.S. Pat. Nos. 3,625,694, 3,859,096, and 4,128,538, and British Patent No. 1,277,453; aqueous sol-type mordants disclosed in, for example, U.S. Pat. Nos. 3,958,995, 2,721,852, and 2,798,063 and JP-A Nos. 54-115228, 54-145529, and 54-126027; water-insoluble mordants disclosed in U.S. Pat. No. 3,898,088; reactive mordants which can form covalent bonds with dyes disclosed in, for example, U.S. Pat. No. 4,168,976 (JP-A No. 54-137333); and mordants disclosed in U.S. Pat. Nos. 3,709,690, 3,788,855, 3,624,482, 3,488,706, 3,557,066, 3,271,147, and 3,271,148, and JP-A Nos. 50-71332, 53-30328, 52-155528, 53-125, and 53-1024.

Other mordants described in U.S. Pat. Nos. 2,675,316 and 2,882,156 may also be used.

In the present invention, a development stop agent may be incorporated in the processing material, so that the agent acts simultaneously with development.

As used herein, the development stop agent is a compound that immediately neutralizes or reacts with base to reduce the concentration of the base contained in the film to thereby stop development, or a compound that interacts with silver or silver salts to inhibit development. Specific examples of the development stop agent may include acid precursors that release acid by the application of heat, electrophilic compounds that causes substitution reaction with co-existing base, nitrogen-containing heterocyclic compounds, and mercapto compounds and their precursors. More specific examples are described in JP-A No. 62-253,159 on pp. 31–32.

Also, the following is an advantageous combination: a zinc salt of mercaptocarboxylic acid described in JP-A No. 8-54,705 is incorporated into the light-sensitive material, and one of the aforementioned complex-forming compounds is incorporated into the processing material.

Similarly, a printout preventive agent that acts on silver halide may be contained in the processing material so that the agent acts during development. Examples of the printout preventive agent may include monohalogen compounds described in JP-B No. 54-164, trihalogen compounds described in JP-A No. 53-46,020, compounds described in JP-A 48-45,228 which are constituted by a halogen and aliphatic carbon atoms bonded to the halogen, and polyhalogen compounds typified by tetrabromoxylene described in JP-B 57-8,454. Development inhibitors, for example, 1-Phenyl-5-mercaptotetrazole described in British Patent No. 1,005,144 are also effective.

The amount of the printout preventive agent may be preferably $10^{-4}$ to 1 mole, particularly preferably $10^{-3}$ to $10^{-1}$ mole, per mole of silver.

Alternatively, the processing material may contain a physical development nucleus and the solvent for silver halide, so that the solvent for silver halide solubilizes the silver halide contained in the light-sensitive material concurrently with development and fixes the silver halide to the processing layer.

The physical development nucleus reduces the soluble silver salt diffused from the light-sensitive material to convert it to physically developed silver which is to be fixed to the processing layer. Any physical development nucleus known as such may be used in the present invention. Examples of the physical development nucleus include colloidal particales of a heavy metal (such as zinc, mercury, lead, cadmium, iron, chromium, nickel, tin, cobalt, copper, and ruthenium), a noble metal (such as palladium, platinum, silver, and gold), a chalcogen compound composed of the foregoing and a substance, for example, sulfur, selenium or tellurium. These physical development nucleus substances are obtained by reducing a corresponding metal ion utilizing a reducing agent such as ascorbic acid, sodium borohydride or hydroquinone to produce a colloidal dispersion of metal or by mixing the corresponding metal ion with a solution of soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a desalting process may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/m$^2$, preferably from $10^{-2}$ to 10 mg/m$^2$, in the processing layer.

Although the physical development nuclei may be prepared separately from a coating solution and thereafter the physical development nuclei may be added to the coating solution, the physical development nuclei may be prepared, for example, through the reaction between silver nitrate and sodium sulfide or between silver chloride and a reducing agent in a coating solution containing a hydrophilic binder.

Silver, silver sulfide, palladium sulfide or the like is preferably employed as a physical development nucleus. When using as an image the physically developed silver, which has been transferred to a processing material, it is preferable to use palladium sulfide, silver sulfide and the like, because they have small Dmin and high Dmax values.

The solvent for silver halide may be a known compound, examples of which include thiosulfates (such as sodium thiosulfate and ammonium thiosulfate), sulfites (such as sodium sulfite and sodium hydrogen sulfite), thiocyanates (such as potassium thiocyanate and ammonium thiocyanate), thioethers (such as 1,8-di-3,6-dithiaoctane, 2,2'-thiodiethanol, 6,9-dioxa-3,12-dithiatetradecane-1,14-diol as described in JP-B No. 47-11,386), a compound having a 5- or 6-membered imido ring (such as urasil and hydantoin as described in Japanese patent application No. 6-325,350), and a compound represented by the following general formula (VI) as described in JP-A No. 53-144,319. A mesoion thiolate compound of trimethyltriazolium thiolate described in "Analytica Chemica Acta", vol. 248, pp. 604 to 614 (1991), is also a preferred compound. A compound which is described in Japanese patent application No. 6-206,331 and which is capable of fixing and stabilizing silver halide may also be used as a solvent for silver halide.

$$N(R^1)(R^2)—C(=S)—X—R^3 \quad (VI)$$

wherein X represents a sulfur atom or an oxygen atom, each of $R^1$ and $R^2$, which may be the same or different, represents an aliphatic group, an aryl group, a heterocyclic residue or an amino group, $R^3$ represents an aliphatic group or an aryl group, wherein $R^1$ and $R^2$ or $R^2$ and $R^3$ may join together to form a 5-membered or a 6-membered heterocyclic ring. The above-described solvents for silver halide may be used in combination.

Among the above-described compounds, a compound having a 5-membered or 6-membered imido ring, such as sulfite, urasil or hydantoin, is particularly preferred. The addition of urasil or hydantoin in the form of potassium salt is preferable, because the salt can suppress gloss reduction during the storage of the processing material.

The content of the total amount of the solvent for silver halide in the processing layer is in the range of 0.01 to 50 mmol/m$^2$, preferably 0.1 to 30 mmol/m$^2$, and more preferably 1 to 20 mmol/m$^2$. The total amount of the solvent for the silver halide in the light-sensitive material is in the range of 1/20 to 20 times, preferably 1/10 to 10 times, and more preferably 1/3 to 3 times the amount (mol) of silver coated on the light-sensitive material. When using the solvent for silver halide, it may be added to a solvent, such as water, methanol, ethanol, acetone, dimethylformamide or methylpropyl gycol, or to an alkaline or acidic aqueous solution, or otherwise a dispersion comprising fine solid grains of the solvent for the silver halide may be added to a coating solution.

The processing material, similar to the light-sensitive material, may contain a variety of auxiliary layers such as a protective layer, undercoat layer, a back layer, etc.

The processing material is preferably constructed such that a processing layer is provided on a continuous web.

As used herein, the term "the continuous web of the processing material" refers to the mode in which the length of the processing material is sufficiently longer than the major side of the corresponding light-sensitive material when processing is performed, so that the processing material can be used without being cut at a portion thereof, and long enough so as to enable processing of a plurality of light-sensitive materials. Generally, the length of the processing material is 5 times or more the width but 1,000 times or less the width. Although the width of the processing material is arbitrarily determined, it is preferably not shorter than the width of the corresponding light-sensitive material.

According to another preferable mode, a plurality of light-sensitive materials are processed in parallel. In this case, the width of the processing material is preferably equal to or more than the "width of the light-sensitive material"× "number of light-sensitive materials that are processed in parallel."

Such a continuous-web-type processing material is particularly advantageous when the light-sensitive material has a length of 50 cm or more, or when a plurality of light-sensitive materials are continuously processed.

Also, when such a continuous web processing material is used, the light-sensitive material can be easily peeled off the processing material.

The continuous-web-type processing material is preferably fed from a feeding roll, and disposed of by being wound on a take-up roll. Particularly in the case in which the light-sensitive material has a large size, this makes disposal of the waste material quite easy.

As described above, the continuous-web-type processing material considerably improves handling thereof as compared with conventional sheet materials.

Although the thickness of the support used in the processing material of the present invention is arbitrarily determined, the thinner may be preferable. Particularly preferably, the thickness is between 4 $\mu$m to 40 $\mu$m, inclusive. When the thickness falls within this range, the amount of the processing material per unit area increases, to thereby make the processing material roll compact.

The material of support is not particularly limited, and any material that withstands temperature during processing may be used. Generally, there may be employed a photographic support such as paper, a synthetic polymer (film), and the like, as described in "Shashinkogaku no kiso—Gin'en Shashin Hen (Fundamentals of Photographic Engineering—Silver Salt Photography Section)," pp. 223– 240, edited by Photographic Society of Japan and published by Corona Co., Ltd., 1979. Specific examples of the support include polyethylene terephthalate, polyethylene naphthalate, polycarbonate, polyvinyl chloride, polystyrene, polypropylene, polyimide, and cellulose (e.g., triacetylcellulose). Alternatively, there may be used these films in which pigments such as titanium dioxide are incorporated, synthetic paper made from polypropylene, mixed paper made from synthetic resin pulp and natural pulp, Yankee paper, baryta paper (photographic base paper), and coated paper (especially cast-coat paper).

These may be used singly or in combination therewith. Alternatively, synthetic polymer may be laminated onto either face or both faces of the paper to construct a support.

Other supports which may be used in the present invention may include those described in JP-A Nos. 62-253,159, pp. 29–31, 1-161,236, pp. 14–17, 63-316,848, 2-22,651 and 3-56,955 and U.S. Pat. No. 5,001,033.

Also preferable is a support mainly made from a styrene-based polymer having a syndiotactic structure.

The surfaces of these supports may be coated with a hydrophilic binder and an antistatic agent such as carbon black and semiconductive metal oxides such as alumina sol and tin oxide. Aluminum-deposited supports may also be advantageously used.

In the present invention, a preferable method of developing a light-sensitive material that has been used in photographing with a camera, etc. may include applying a specific amount of water (10% to 100% that required for the maximum swelling of the entirety of the coating films excepting back layers of both the light-sensitive material and the processing material) to the light-sensitive material or the processing material, superposing the light-sensitive material and the processing material one on another, and then heating at a temperature between 60° C. and 100° C. for 5 to 60 seconds.

In the present invention, the light-sensitive material and/or the processing material are attached to each other in a state swollen with water. Since the swollen film is unstable, it is critical that the amount of water be limited to the above range so as to prevent local unevenness of color development.

The amount of water required for achieving the maximum swelling can be obtained by immersing in water the light-sensitive material having a coating film thereon to be measured, and when sufficiently swollen, measuring the film thickness, and subtracting the weight of the coating film from the computed maximum swelling volume. An example of measuring the swelling degree is also described in Photographic Science Engineering, vol. 16, page 449 (1972).

In the present invention, it is primarily attempted that image information is acquired in the form of digital data by use of a scanner or a similar device with developed silver that has been produced from the development process and undeveloped silver halide not being removed. However, the conventional approach of analog-mode optically exposure on a print material such as color paper may also be used.

In the present invention, after photographing and subsequent image forming, other methods for preventing obstacles against perfect reading of images may also be used in combination. Particularly, since undeveloped silver halide produces high haze in gelatin film to elevate the density of the background of an image, silver halide used in the present is considered to be advantageous in reduction of such an effect. However, the detailed mechanism will be elucidated by future research.

In order to make prints on color paper or heat development light-sensitive materials by use of such color photographic materials, there may be used methods described in JP-A No. 5-241,251, 5-19,364, and 5-19,363.

EXAMPLES

The present invention will be described in detail by way of examples.

Example 1

Preparation of tabular silver iodobromide emulsion (Step A): An aqueous solution (1,600 cc) containing gelatin (7.5 g) and KBr (4.3 g) was stirred while the temperature of the solution was maintained at 40° C. Aqueous 1.2 M $AgNO_3$ solution (41 cc) and aqueous 1.4 M KBr/KI solution (41 cc) containing KI (12 mol%) were simultaneously added thereto in double jets for 40 seconds. Gelatin (36 g) was added. Subsequently, the temperature of the mixture was raised to 58° C. Aqueous 0.4 M $AgNO_3$ solution (36 cc) and subsequently ammonia were added. The mixture was aged for 15 minutes and neutralized with acetic acid. Aqueous 1.9 M $AgNO_3$ solution (782 cc) and aqueous 1.9 M KBr solution (700 cc) were added for 17 minutes while pAg being maintained at 8.4 and the flow rate being accelerated (the flow at the point of completion of addition was 4.2 times that at the point of starting addition). Thereafter, the resultant emulsion was cooled to 35° C. and washed by use of the customary flocculation method. Gelatin (49 g) was added so as to adjust pH to 5.5 and pAg to 8.8. The thus-obtained emulsion contained 1.2 mol of silver and 65 g of gelatin per kg. The grains in the emulsion were tabular grains having a size of 0.27 microns.

(Step B) An aqueous solution (1,150 cc) containing the thus-obtained emulsion (30 g, which served as a seed emulsion), gelatin (33 g), and KBr (1.2 g) was stirred while the temperature of the mixture was maintained at 75° C. Aqueous 1.8 M $AgNO_3$ solution (387 cc) and aqueous 1.6 M KBr/KI solution (427 cc) containing KI (10 mol %) were added thereto for 38 minutes in double jets with the flow rate being accelerated (the flow at the point of completion of addition was 3.3 times that at the point of starting addition).

(Step C) Subsequently, the mixture was cooled to 55° C. Aqueous 1 M $AgNO_3$ solution (30 cc) and aqueous 0.3 M KI solution (100 cc) were quantitatively added over 3 minutes, and then aqueous KBr solution was added to adjust pAg 9.1. Thereafter, an aqueous 2 M $AgNO_3$ solution (194 cc) and aqueous 2.2 M KBr solution (165 cc) were added.

Subsequently, the resultant emulsion was cooled to 35° C. and washed by use of the customary flocculation method. Gelatin (75 g) was added so as to adjust pH to 5.8 and pAg to 8.9.

Tabular grains having a mean equivalent spherical diameter of 0.86 microns were obtained.

The thus-obtained emulsion was subjected to spectral and chemical sensitization by the addition of the below-described spectral sensitizing dyes (blue-sensitive, green-sensitive, and red-sensitive), Compound I, potassium thiocyanate, chloroauric acid, and sodium thiosulfate at 60° C., pH=6.2, and pAg=8.4. The amount of chemical sensitizing agent was adjusted so as to maximize the sensitivity for exposure of 1/100 sec.

Sensitizing dye IV for blue-sensitive emulsion

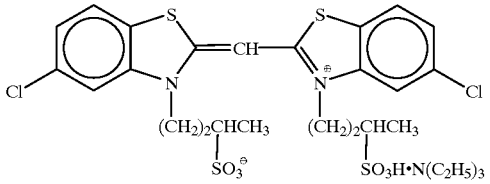

$6.0\times10^{-4}$ mole per mole of silver contained in emulsion

Sensitizing dye I for green-sensitive emulsion

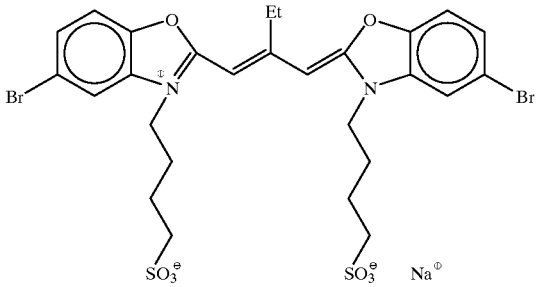

$5.3\times10^{-4}$ mole per mole of silver contained in emulsion

Sensitizing dye II for green-sensitive emulsion

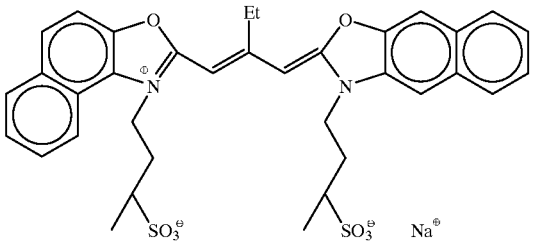

$1.2\times10^{-4}$mole per mole of silver contained in emulsion

Sensitizing dye III for green-sensitive emulsion

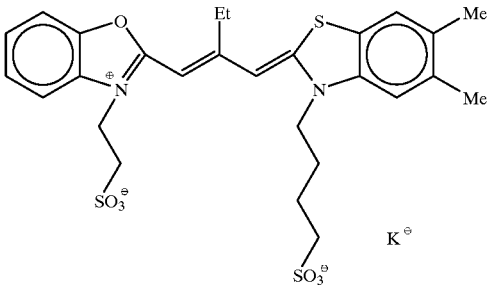

$4.5\times10^{-5}$ mole per mole of silver contained in emulsion

Sensitizing dye V for red-sensitive emulsion

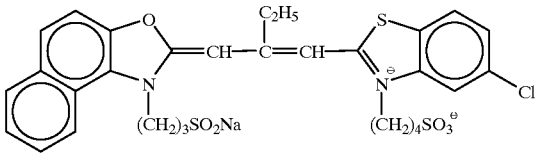

$2.4\times10^{-4}$ mole per mole of silver contained in emulsion

Sensitizing dye VI for red-sensitive emulsion

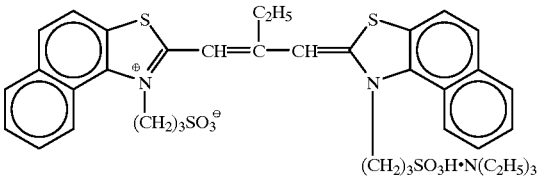

$1.1\times10^{-5}$ mole per mole of silver contained in emulsion

Sensitizing dye VII for red-sensitive emulsion

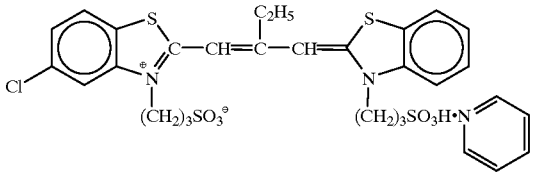

$3.4\times10^{-4}$ mole per mole of silver contained in emulsion

Compound I

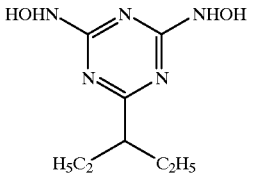

Preparation of a zinc hydroxide dispersion

Zinc hydroxide powder (31 g) with a primary grain size of 0.2 $\mu$m was mixed with dispersing agents, namely, carboxymethylcellulose (1.6 g) and sodium polyacrylate (0.4 g), lime-treated ossein gelatin (8.5 g), and water (158.5 ml). The mixture was dispersed for one hour in a mill employing glass beads. After the powder was dispersed, the glass beads were removed by filtration, whereby a dispersion (188 g) of zinc hydroxide was obtained.

Preparation of emulsions containing a color developing agent and a coupler

The oil phase components and the aqueous phase components shown in Table 1 were respectively dissolved to prepare uniform solutions at 60° C. The oil phase solution and the aqueous phase solution were combined and placed in a 1-liter stainless vessel. By use of a dissolver equipped with a disperser having a diameter of 5 cm, the mixture was stirred at 10,000 rpm for 20 minutes so as to obtain a dispersion. Subsequently, warm water shown in Table 1 was added, followed by mixing at 2,000 rpm for 10 minutes. In this manner, emulsions containing a cyan, magenta, or yellow coupler and a color developing agent were prepared.

TABLE 1

| | | Cyan | Magenta | Yellow |
|---|---|---|---|---|
| Oil phase | cyan coupler (1) | 5.63 g | — | — |
| | Magenta coupler (2) | — | 6.87 g | — |
| | Yellow coupler (3) | — | — | 7.86 g |
| | Developing agent (4) | 5.11 g | 5.11 g | 5.11 g |
| | Anti-fogging agent (5) | 3.0 mg | 1.0 mg | 10.0 mg |
| | High b.p. solvent (6) | 5.37 g | 5.99 g | 6.49 g |
| | Ethyl acetate | 24.0 ml | 24.0 ml | 24.0 ml |

TABLE 1-continued

| | | Cyan | Magenta | Yellow |
|---|---|---|---|---|
| Aqueous phase | Lime-treated gelatin | 12.0 g | 12.0 g | 12.0 g |
| | Surfactant (7) | 0.60 g | 0.60 g | 0.60 g |
| | Water | 138.0 ml | 138.0 ml | 138.0 ml |
| | Subsequent addition of water | 180.0 ml | 180.0 ml | 180.0 ml |

Cyan coupler (1)

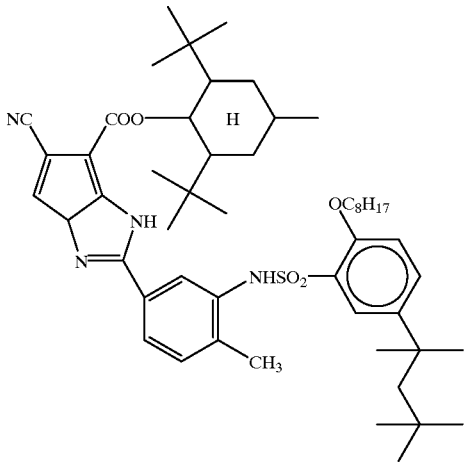

Magenta coupler (2)

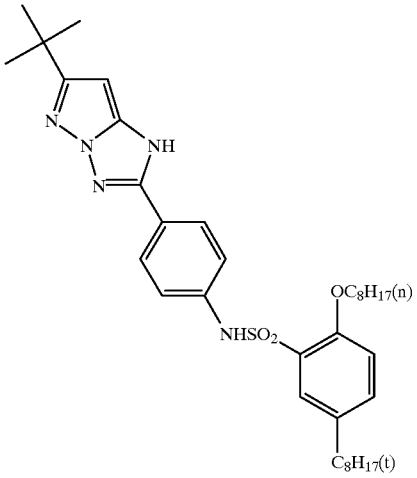

Yellow coupler (3)

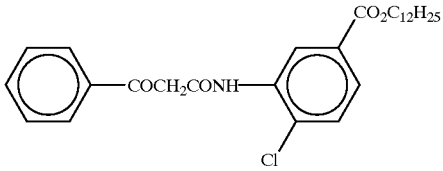

-continued

Developing agent (4)

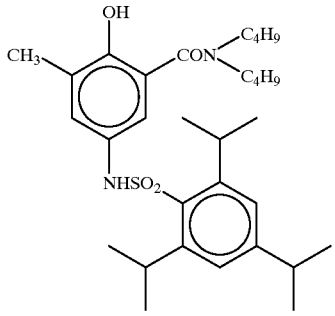

Anti-fogging agent (5)

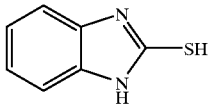

High-b.p. solvent (6)

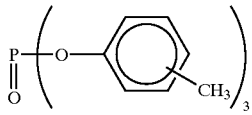

Surfactant (7)

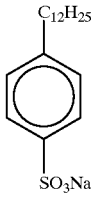

Preparation of dye compositions for filter layers

Dye compositions to be incorporated into yellow, magenta, and cyan filter layers were respectively processed into emulsions and then added.

Briefly, the oil phase components and the aqueous phase components shown in Table 2 were respectively dissolved to prepare uniform solutions of 4° C. The oil phase solution and the aqueous phase solution were combined and homogenized in a homogenizer at 10,000 rpm for 5 minutes. Subsequently, warm water shown in Table 2 was added, followed by mixing at 2,000 rpm for 5 minutes.

TABLE 2

| | | Cyan | Magenta | Yellow |
|---|---|---|---|---|
| Oil phase | Cyan dye A26 | 2.25 g | — | — |
| | Magenta dye A10 | — | 2 g | — |
| | Yellow dye A13 | — | — | 1.92 g |
| | Tricresyl phosphate | 2 g | 2 g | 2 g |
| | Cyclohexanone | 22 cc | 22 cc | 22 cc |
| Aqueous phase | Lime-treated gelatin | 3.5 g | 3.5 g | 3.5 g |
| | Surfactant (7) | 0.26 | 0.26 g | 0.26 g |
| | Water | 37 cc | 37 cc | 37 cc |
| | Subsequent addition of water | 44 cc | 44 cc | 44 cc |

By use of the thus-obtained materials, a light-sensitive material I-101 having a multi-layer structure as shown in Table 3 was prepared.

Also, a processing material I-R-1 as shown in Table 4 was prepared.

TABLE 3-1

Structure of Light-Sensitive Material I-101

| Structure of layers | Materials incorporated | Amounts (mg/m$^2$) |
|---|---|---|
| The 8th layer: Protective layer | Lime-treated gelatin | 1000 |
| | Matting agent (silica) | 100 |
| | Surfactant (8) | 100 |
| | Surfactant (9) | 300 |
| | Water-soluble polymer (10) | 20 |
| The 7th layer: Intermediate layer | Lime-treated gelatin | 400 |
| | Surfactant (9) | 15 |
| | Zinc hydroxide | 1200 |
| | water-soluble polymer (10) | 15 |
| The 6th layer: Yellow dye forming layer | Lime-treated gelatin | 1450 |
| | Blue-sensitive silver halide emulsion | 800 (silver) |
| | Yellow coupler (3) | 629 |
| | Developing agent (4) | 409 |
| | Anti-fogging agent (5) | 0.8 |
| | High b.p. solvent (6) | 519 |
| | Surfactant (7) | 48 |
| | Water-soluble polymer (10) | 20 |
| The 5th layer: Intermediate layer (Yellow filter) | Lime-treated gelatin | 475 |
| | Yellow dye A13 | 260 |
| | Tricresyl phosphate | 270 |
| | Sutfactant (7) | 35 |
| | Water-soluble polymer (10) | 5 |
| | Hardenirig agent (11) | 65 |
| The 4th layer: Magenta dye forming layer | Lime-treated gelatin | 1800 |
| | Green-sensitive silver halide emulsion | 500 (silver) |
| | Magenta coupler (2) | 423 |
| | Developing agent (4) | 281 |
| | Anti-fogging agent (5) | 0.06 |
| | High b.p. solvent (6) | 330 |
| | Surfactant (7) | 33 |
| | Water-soluble polymer (10) | 14 |
| The 3rd layer: Intermediate layer (Magenta filter) | Lime-treated gelatin | 1000 |
| | Magenta dye A10 | 240 |
| | Surfactant (9) | 8 |
| | Tricresyl phosphate | 270 |
| | Zinc hydroxide | 1200 |
| | Surfactant (7) | 35 |
| | Water-soluble polymer (10) | 5 |

TABLE 3-2

Structure of Light-Sensitive Material I-101

| Structure of layers | Materials incorporated | Amounts (mg/m$^2$) |
|---|---|---|
| The 2nd layer: Cyan dye forming layer | Lime-treated gelatin | 720 |
| | Red-sensitive silver halide emulsion | 350 (silver) |
| | Cyan coupler (1) | 250 |
| | Developing agent (4) | 204 |
| | Anti-fogging agent (5) | 0.12 |
| | High b.p. solvent (6) | 215 |
| | Surfactant (7) | 24 |
| | Water-soluble polymer (10) | 10 |
| The 1st layer: Antihalation layer (Cyan filter) | Lime-treated gelatin | 240 |
| | Cyan dye A26 | 150 |
| | Tricresyl phosphate | 130 |
| | Water-soluble polymer (10) | 10 |
| | Surfactant (7) | 35 |
| | Transparent PET base (100 μm) | |

Surfactant (8)

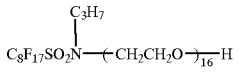

Surfactant (9)

TABLE 3-2-continued

Structure of Light-Sensitive Material I-101

| Structure of layers | Materials incorporated | Amounts (mg/m$^2$) |
|---|---|---|

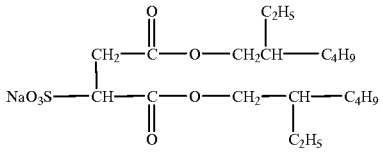

Water-soluble polymer (10)

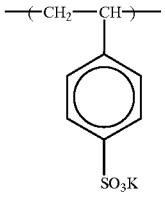

Hardening agent (11)

$CH_2{=}CH{-}SO_2{-}CH_2{-}SO_2{-}CH{=}CH_2$

TABLE 4

Processing Material I-R-1

| Structure of layers | Materials incorporated | Amounts (mg/m$^2$) |
|---|---|---|
| The 4th layer: Protective layer | Gelatin | 34 |
| | κ-carageenan | 60 |
| | Water-soluble polymer (20) | 160 |
| | Matting agent (22) | 60 |
| | Potassiuin nitrate | 10 |
| | Surfactant (9) | 7 |
| | Surfactant (23) | 7 |
| | Surfactant (24) | 10 |
| The 3rd layer: Intermediate layer | Gelatin | 240 |
| | Water-soluble polymer (20) | 25 |
| | Surfactant (7) | 8 |
| | Hardening agent (25) | 180 |
| The 2nd layer: Base-generating layer | Gelatin | 2500 |
| | Mordant | 2500 |
| | Dextran | 1350 |
| | Surfactant (7) | 25 |
| | Guanidinium picolate | 6000 |
| The 1st layer: Undercoat layer | Gelatin | 190 |
| | Water-soluble polymer (20) | 8 |
| | Surfactant (9) | 9 |
| | Hardening agent (25) | 18 |
| | Support (aluminum-deposited polyethylene terephthalate film (25 μm)) | |

Water-soluble polymer (20):
SUMIKAGEL L-5H, by Sumitomo Chemical Co., Ltd.
Matting agent (22):
Polymethylmethacrylate (grain diameter: 4 μm)
Surfactant (23)

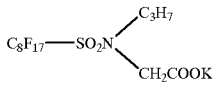

Surfactant (24)

TABLE 4-continued

| Processing Material I-R-1 | | |
|---|---|---|
| Structure of layers | Materials incorporated | Amounts ($mg/m^2$) |

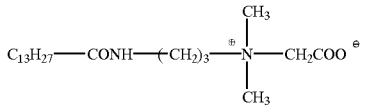

Hardening agent (25)

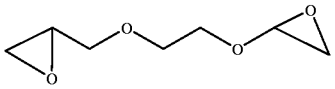

The thus-prepared light-sensitive material I-101, cut to have an ordinary 135 negative film size, perforated, and housed in a camera, was used for photographing a person and a Macbeth chart.

To the light-sensitive layer surface of the light-sensitive material which had been used for photography was applied 40° C. water in an amount of 15 $cc/m^2$ (corresponding to 45% of the volume of maximum swelling), and the water-applied surface was superposed on the film of processing material I-R-1. Heat was applied for 20 seconds from the back surface of the light-sensitive material by use of a 83° C. heat drum. When the processing material I-R-1 was peeled off from the light-sensitive material I-101, there was obtained a negative image on the light-sensitive material. This image was read with a digital image reading device FRONTIER SP-1000 (by Fuji Photo Film Co., Ltd.), image-processed, and output by use of a heat development printer (PICTOGRAPHY 3000, Fuji Photo Film Co., Ltd.). The prints of the person's figure were excellent in respect of sharpness and granularity. When the light sensitive material was similarly processed after being left to stand for three days under humidity of 80%, excellent prints were obtained.

The dye compounds according to the present invention, exhibited excellent decolorizing properties upon processing, and the dyes were completely decolorized when they underwent processing. Also, analysis of the processing material after processing revealed that neither compounds of the present invention nor adducts of guanidinium picolinate (nucleophoic reagent, i.e., decolorizing agent) were present.

Moreover, there was obtained an unexpected effect that addition of the dyes of the preset invention improved stability of the emulsions over time.

Comparative Example 1

Each of the following dyes (yellow, magenta, and cyan; 4 g each) was combined with 25% aqueous solution (4 g) of surfactant (30) and water (92 ml), and the mixture was processed for 24 hours in a DINOMILL by use of glass beads (mean diameter: 0.75 mm). The glass beads were removed, and a dispersion of each solid dye was obtained.

Yellow dye

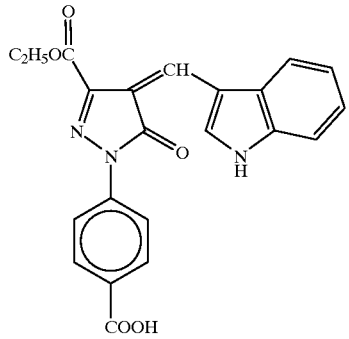

Magenta dye

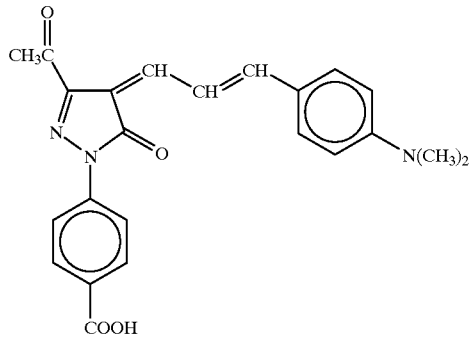

Cyan dye

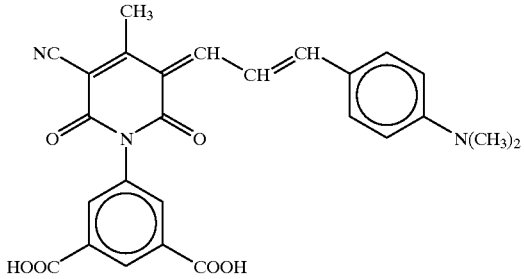

Surfactant (30)

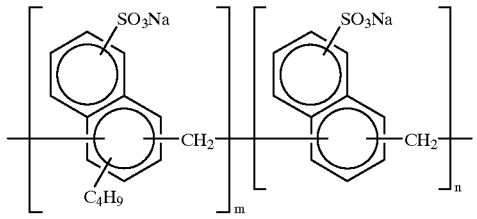

By use of these dye dispersions, a light-sensitive material I-102 was prepared. The light-sensitive material I-102 contained the above-described solid dye dispersions instead of the yellow, magenta, and cyan dyes contained in light-sensitive material I-101 prepared in Example 1.

When similar procedures in Example 1, i.e., photographing, heat development, reading, image processing, and outputting, were performed by use of the light-sensitive material I-102, prints of the person's figure with excellent sharpness and granularity were obtained. However, when the light sensitive material I-102 was similarly processed after being left to stand at 45° C. for three days under humidity of 80%, sensitivity of the light-sensitive material decreased to provide images with poor quality, as the images on the negative did not sufficiently develop color.

Example 2

Light-sensitive materials I-201 through I-205 were similarly prepared, excepting that the magenta dye A-10 used in Example 1 (see Table 2) was replaced by the same molar quantity of dyes shown in Table 6.

When the materials were similarly processed as in Example 1, all the materials were found to provide images of excellent granularity and sharpness.

TABLE 6

| Light-sensitive material | Magenta dye |
|---|---|
| I-201 | A-17 |
| I-202 | A-18 |
| I-203 | A-24 |
| I-204 | A-4 |
| I-205 | A-155 |

Example 3

Light-sensitive materials I-301 through I-305 were similarly prepared, excepting that the cyan dye A-26 used in Example 1 (see Table 2) was replaced by the same molar quantity of dyes shown in Table 7.

TABLE 7

| Light-sensitive material | Cyan dye |
|---|---|
| I-301 | A-74 |
| I-302 | A-27 |
| I-303 | A-53 |
| I-304 | A-134 |
| I-305 | A-144 |

When these materials were similarly processed as in Example 1, all the materials were found to provide images of excellent granularity and sharpness.

Example 4

Light-sensitive materials I-401 through I-406 were similarly prepared, excepting that the developing agent contained in the yellow-developing layer, magenta-developing layer, and the cyan-developing layer, as well as the couplers, used in light-sensitive material I-101 in Example 1 were replaced by those shown in Table 8. The amounts of the respective substances were the same as those in Example 1.

TABLE 8

| Light | Yellow dye forming layer | | Magenta dye forming layer | | Cyan dye forming layer | |
|---|---|---|---|---|---|---|
| sensitive material | Developing agent | Coupler | Developing agent | Coupler | Developing agent | Coupler |
| I-401 | I-16 | C-77 | I-16 | C-133 | I-1 | C-164 |
| I-402 | I-27 | C-95 | I-16 | C-133 | I-43 | C-164 |
| I-403 | I-61 | C-3 | I-83 | C-47 | I-59 | C-66 |
| I-404 | I-61 | C-3 | I-61 | C-56 | I-59 | C-43 |
| I-405 | I-16 | C-77 | I-83 | C-47 | I-59 | C-66 |
| I-406 | I-27 | C-95 | I-61 | C-56 | I-43 | C-164 |

When the light-sensitive materials I-401 through I-406 were similarly processed as in Example 1, it was confirmed that the dye compounds according to the present invention were decolorized as in Example 1 to obtain prints having excellent quality.

Example 5

Preparation of Light-Sensitive Silver Halide Emulsions

A method of preparing blue-sensitive silver halide emulsion I-(1) is described below.

Distilled water (1,191 ml) containing gelatin (Av. MW: 12,000; 0.96 g) and potassium bromide (0.9 g) was added to a reactor and the contents were heated to 40° C. An aqueous solution (A) (10.5 ml) containing silver nitrate (0.5 g) and an aqueous solution (B) (10 ml) containing potassium bromide (0.35 g) were added thereto with vigorous stirring over 150 seconds. Thirty seconds following completion of addition, 10% aqueous potassium bromide solution (12 ml) was added. Thirty seconds thereafter, the temperature of the reaction mixture was elevated to 75° C. Lime-treated gelatin (35.0 g) and distilled water (250 ml) were added, and subsequently, an aqueous solution (C) (39 ml) containing silver nitrate (10.0 g) and an aqueous solution (D) (30 ml) containing potassium bromide (6.7 g) were added for 3 minutes and 15 seconds with the rate of addition being increased. Subsequently, an aqueous solution (E) (302 ml) containing silver nitrate (96.7 g) and an aqueous solution (F) containing potassium iodide and potassium bromide (molar ratio=7:93, the concentration of potassium bromide: 26%) were added over 20 minutes with the rate of addition being increased. During the addition, the silver potential of the reaction mixture was controlled to be −20 mV with respect to the saturated calomel electrode. Furthermore, an aqueous solution (G) (97 ml) containing silver nitrate (24.1 g) and a 21.9% aqueous potassium bromide solution (H) were added over 3 minutes so that the silver potential of the reaction mixture was 25 mV with respect to the saturated calomel electrode. After completion of addition, the reaction mixture was maintained at 75° C. for 1 minute, and then the reaction mixture was cooled to 55° C. Subsequently, 1N sodium hydroxide solution (15 ml) was added. Two minutes thereafter, an aqueous solution (I) (100 ml) containing silver nitrate (5 g) and an aqueous solution (j) (200.5 ml) containing potassium iodide (4.7 g) was added over 5 minutes. After completion of addition, potassium bromide (7.11 g) was added, and the reaction mixture was maintained at 55° C for 1 minute. An aqueous solution (K) (248 ml) containing silver nitrate (62 g) and an aqueous solution (L) (231 ml) containing potassium bromide (48.1 g) were added over 8 minutes. Thirty seconds thereafter, an aqueous solution containing sodium ethylthiosulfonate (0.03 g) was added and the reaction mixture was cooled. Through use of Demol (product of Kao Corporation), the reaction mixture was desalted, allowing emulsion grains to flocculate and precipitate. The grains were dispersed by addition of sodium benzenethiosulfonate, phenoxyethanol, a water-soluble polymer (27), and lime-treated gelatin.

Chemical sensitization was carried out at 60° C. A sensitizing dye (12) was dispersed in gelatin and the dispersion was added prior to chemical sensitization. After addition, a mixture of potassium thiocyanate and chloroauric acid was added. Subsequently, sodium thiosulfate and a selenium sensitizer were added. Chemical sensitization was stopped by the addition of mercapto compounds. The amounts of the sensitizing dye, the chemical sensitizer, and the mercapto compounds were optimized by means of sensitivity and fogging.

The thus-obtained emulsion contained tabular grains in such an amount that they accounted for more than 99% of the total projection area of the entirety of the grains. The mean equivalent spherical diameter of the grains was 1.07 μm, the mean thickness was 0.38 μm, the mean circle-equivalent diameter was 1.47 μm, and the mean aspect ratio was 3.9

Sensitizing dye (12)

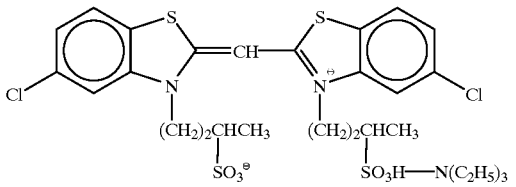

Water-soluble polymer (27)

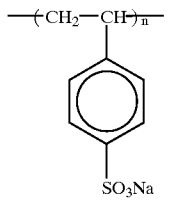

Selenium sensitizer

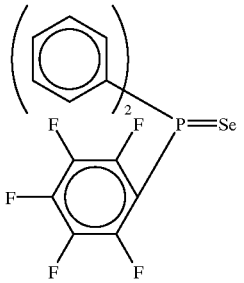

Mercapto compound

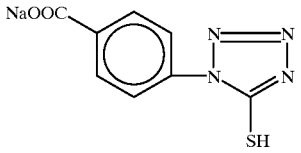

A method of preparing blue-sensitive silver halide emulsion I-(2) is described below.

Distilled water (1,191 ml) containing gelatin (Av. MW: 12,000; 0.96 g) and potassium bromide (0.9 g) was added to a reactor and the contents were heated to 40° C. An aqueous solution (A) (37.5 ml) containing silver nitrate (1.5 g) and an aqueous solution (B) (37.5 ml) containing potassium bromide (1.051 g) were added thereto under vigorous stirring over 90 seconds. Thirty seconds following completion of addition, a 10% aqueous potassium bromide solution (12 ml) was added. Thirty seconds thereafter, the temperature of the reaction mixture was elevated to 75° C. Lime-treated gelatin (35.0 g) and distilled water (250 ml) were added, and subsequently, an aqueous solution (C) (116 ml) containing silver nitrate (29.0 g) and an aqueous solution (D) (91 ml) containing potassium bromide (20 g) were added for 11 minutes and 35 seconds with the rate of addition being increased. Subsequently, an aqueous solution (E) (302 ml) containing silver nitrate (96.7 g) and an aqueous solution (F) containing potassium iodide and potassium bromide (molar ratio=3.3:96.7, the concentration of potassium bromide: 26%) were added over 20 minutes with the rate of addition being increased. During the addition, the silver potential of the reaction mixture was controlled to be 2 mV with respect to the saturated calomel electrode. Furthermore, an aqueous solution (G) (97 ml) containing silver nitrate (24.1 g) and a 21.9% aqueous potassium bromide solution (H) were added over 3 minutes so that the silver potential of the reaction mixture was 0 mV with respect to the saturated calomel electrode. After completion of addition, the reaction mixture was maintained at 75° C. for 1 minute, and then the reaction mixture was cooled to 55° C. Subsequently, 1N sodium hydroxide solution (15 ml) was added. Two minutes thereafter, an aqueous solution (I) (153 ml) containing silver nitrate (10.4 g) and an aqueous solution (J) (414.5 ml) containing potassium iodide (9.35 g) was added over 5 minutes. After completion of addition, potassium bromide (7.11 g) was added, and the reaction mixture was maintained at 55° C for 1 minute. An aqueous solution (K) (228 ml) containing silver nitrate (57.1 g) and an aqueous solution (L) (201 ml) containing potassium bromide (43.9 g) were added over 8 minutes. Thirty seconds thereafter, an aqueous solution containing sodium ethylthiosulfonate (0.04 g) was added and the reaction mixture was cooled. Similar to the case of blue-sensitive sensitive silver halide emulsion I-(1), the reaction mixture was desalted and the resultant grains were dispersed.

Chemical sensitization was also carried out in a similar manner except that the blue-sensitive silver halide emulsion I-(1) and the selenium sensitizer were not used. The amounts of the sensitizing dye and the mercapto compounds for stopping the chemical sensitization were almost proportional to the surface area of the emulsion grains.

The thus-obtained emulsion contained tabular grains in such an amount that they accounted for more than 99% of the total projection area of the entirety of the grains. The mean equivalent spherical diameter of the grains was 0.66 $\mu$m, the mean thickness was 0.17 $\mu$m, the mean circle-equivalent diameter was 1.05 $\mu$m, and the mean aspect ratio was 6.3.

A method of preparing blue-sensitive silver halide emulsion I-(3) is described below.

Distilled water (1,345 ml) containing lime-treated gelatin (17.8 g), potassium bromide (6.2 g), and potassium iodide (0.46 g) was added to a reactor and the contents were heated to 45° C. An aqueous solution (A) (70 ml) containing silver nitrate (11.8 g) and an aqueous solution (B) (70 ml) containing potassium bromide (3.8 g) were added thereto under vigorous stirring over 45 seconds. The reaction mixture was maintained at 45° C. for 4 minutes. Subsequently, the temperature of the reaction mixture was elevated to 630C. Lime-treated gelatin (24 g) and distilled water (185 ml) were added, and subsequently, an aqueous solution (C) (208 ml) containing silver nitrate (73 g) and a 24.8% aqueous potassium bromide solution (D) were added over 13 minutes with the rate of addition being increased. During the addition, the silver potential of the reaction mixture was controlled to be 0 mV with respect to the saturated calomel electrode. After completion of addition, the reaction mixture was maintained at 63° C. for 2 minutes, and then the temperature of the reaction mixture was dropped to 450C. Subsequently, 1N sodium hydroxide solution (15 ml) was added. Two minutes thereafter, an aqueous solution (E) (60 ml) containing silver nitrate (8.4 g) and an aqueous solution (F) (461 ml) containing potassium iodide (8.3 g) were added over 5 minutes. Furthermore, an aqueous solution (G) (496 ml) containing silver nitrate (148.8 g) and a 25% aqueous potassium bromide solution (H) were added over 47 minutes so that the silver potential of the reaction mixture was 90 mV with respect to the saturated calomel electrode. Thirty seconds following completion of addition, an aqueous solution containing potassium bromide (2 g) and sodium ethylthiosulfonate (0.06 g) was added and the reaction mixture was cooled. Similar to the case of the blue-sensitive sensitive silver halide emulsion I-(2), the reaction mixture was dispersed and the resultant grains were chemically sensitized.

The thus-obtained emulsion contained hexagonal tabular grains which have the average grain size represented by the mean equivalent spherical diameter of the grains of 0.44 μm, the mean thickness of 0.2 μm, the mean circle-equivalent diameter of 0.53 μm, and the mean aspect ratio was 2.6.

A method of preparing green-sensitive silver halide emulsion I-(4) is described below.

Distilled water (1,191 ml) containing gelatin (Av. MW: 12,000; 0.96 g) and potassium bromide (0.9 g) was added to a reactor and the contents were heated to 40° C. An aqueous solution (A) (17.5 ml) containing silver nitrate (0.7 g) and an aqueous solution (B) (17.5 ml) containing potassium bromide (1.051 g) were added thereto under vigorous stirring over 120 seconds. Thirty seconds following completion of addition, a 10% aqueous potassium bromide solution (12 ml) was added. Thirty seconds thereafter, the temperature of the reaction mixture was elevated to 75° C. Lime-treated gelatin (35.0 g) and distilled water (250 ml) were added, and subsequently, an aqueous solution (C) (56 ml) containing silver nitrate (19.0 g) and an aqueous solution (D) (461 ml) containing potassium bromide (10 g) were added for 7 minutes and 35 seconds with the rate of addition being increased. Subsequently, an aqueous solution (E) (302 ml) containing silver nitrate (96.7 g) and an aqueous solution (F) containing potassium iodide and potassium bromide (molar ratio=3.3:96.7, the concentration of potassium bromide: 26%) were added over 20 minutes with the rate of addition being increased. During the addition, the silver potential of the reaction mixture was controlled to be 0 mV with respect to the saturated calomel electrode. Furthermore, an aqueous solution (G) (97 ml) containing silver nitrate (24.1 g) and a 21.9% aqueous potassium bromide solution (H) were added over 3 minutes so that the silver potential of the reaction mixture was 0 mv with respect to the saturated calomel electrode. After completion of addition, the reaction mixture was maintained at 75° C. for 1 minute, and then the reaction mixture was cooled to 55° C. Subsequently, an aqueous solution (I) (122 ml) containing silver nitrate (8.3 g) and an aqueous solution (J) (332 ml) containing potassium iodide (7.48 g) was added over 5 minutes. After completion of addition, potassium bromide (7.11 g) was added, and the reaction mixture was maintained at 55° C. for 1 minute. An aqueous solution (K) (228 ml) containing silver nitrate (62.8 g) and an aqueous solution (L) (201 ml) containing potassium bromide (48.3 g) were added over 8 minutes and the reaction mixture was cooled. Similar to the case of blue-sensitive sensitive silver halide emulsion I-(1), reaction mixture was desalted and the resultant grains were dispersed.

Chemical sensitization was also carried out in a similar manner except that a mixture of sensitizing dyes (13), (14), and (15) was used instead of a sensitizing dye (12) used in the blue-sensitive silver halide emulsion (1). The mixing ratio of the sensitizers (13), (14), and (15) was 12:2:1 (mol).

The thus-obtained emulsion contained tabular grains in such an amount that they accounted for more than 99% of the total projection area of the entirety of the grains. The mean equivalent spherical diameter of the grains was 0.85 μm, the mean thickness was 0.26 μm, the mean circle-equivalent diameter was 1.25 μm, and the mean aspect ratio was 4.8.

Sensitizing dye (13) for green-sensitive emulsion

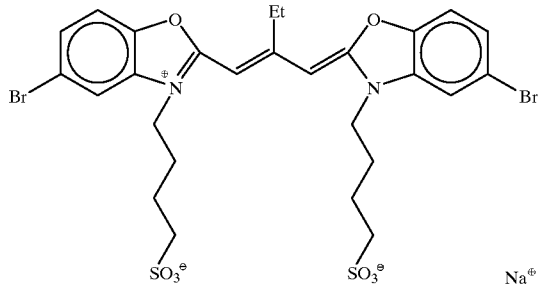

Sensitizing dye (14) for green-sensitive emulsion

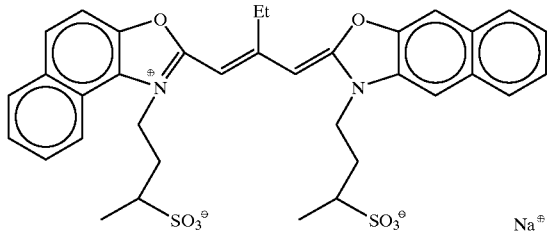

Sensitizing dye (15) for green-sensitive emulsion

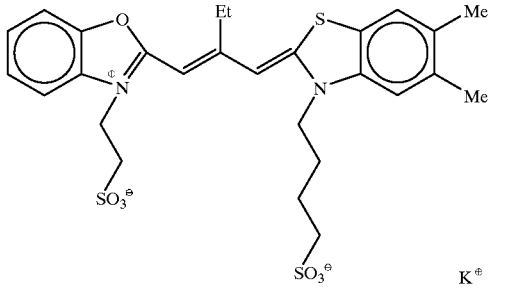

A method of preparing green-sensitive silver halide emulsion I-(5) is described below.

Formation of grains, desalting, and emulsification were performed in a manner similar to that employed for the preparation of the blue-sensitive silver halide emulsion, except that sodium hydroxide and sodium ethylthiosulfonate were not added in the grain forming step.

Chemical sensitization was also carried out similar to the sensitization of the green-sensitive silver halide emulsion I-(4).

The thus-obtained emulsion contained tabular grains in such an amount that they accounted for more than 99% of the total projection area of the entirety of the grains. The mean equivalent spherical diameter of the grains was 0.66 μm, the mean thickness was 0.17 μm, the mean circle-equivalent diameter was 1.05 μm, and the mean aspect ratio was 6.3.

A method of preparing green-sensitive silver halide emulsion I-(6) is described below.

Formation of grains, desalting, and emulsification were performed in a manner similar to that employed for the preparation of the blue-sensitive silver halide emulsion I-(3), except that sodium hydroxide was not added and sodium ethylthiosulfonate (4 mg) was added in the grain forming step.

Chemical sensitization was also carried out similar to the sensitization of the green-sensitive silver halide emulsion I-(4), except that a selenium sensitizer was not added.

The thus-obtained emulsion contained hexagonal tabular grains having the mean grain size represented by the equivalent spherical diameter of the grains of 0.44 μm, the mean thickness of 0.2 μm, the mean circle-equivalent diameter of 0.53 μm, and the mean aspect ratio of 2.6.

A method of preparing red-sensitive silver halide emulsion I-(7) is described below.

Emulsion I-(7) was prepared in a manner similar to that employed for the preparation of the green-sensitive silver halide emulsion I-(4), except that a gelatin dispersion of sensitizing dye (16) and a gelatin dispersion of a mixture of sensitizing dye (17) and sensitizing dye (18) were added in the chemical sensitization. The mixing ratio of the sensitizers (16), (17), and (18) was 40:2:58 (mol).

The thus-obtained emulsion contained tabular grains in such an amount that they accounted for more than 99% of the total projection area of the entirety of the grains. The mean equivalent spherical diameter of the grains was 0.85 μm, the mean thickness was 0.26 μm, the mean circle-equivalent diameter was 1.25 μm, and the mean aspect ratio was 4.8.

Sensitizing dye (16) for red-sensitive emulsion

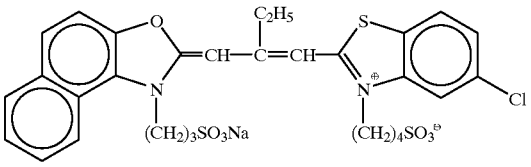

Sensitizing dye (17) for red-sensitive emulsion

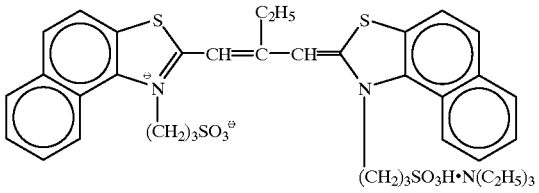

Sensitizing dye (18) for red-sensitive emulsion

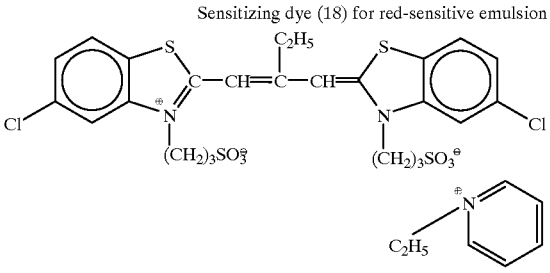

A method of preparing red-sensitive silver halide emulsion I-(8) is described below.

Emulsion I-(8) was prepared in a manner similar to that employed for the preparation of the green-sensitive silver halide emulsion I-(5), except that a gelatin dispersion of sensitizing dye (16) and a gelatin dispersion of a mixture of sensitizing dye (17) and sensitizing dye (18) were added in the chemical sensitization. The mixing ratio of the sensitizers (16), (17), and (18) was 40:2:58 (mol).

The thus-obtained emulsion contained tabular grains in such an amount that they accounted for more than 99% of the total projection area of the entirety of the grains. The mean equivalent spherical diameter of the grains was 0.66 μm, the mean thickness was 0.17 μm, the mean circle-equivalent diameter was 1.05 μMm, and the mean aspect ratio was 6.3.

A method of preparing red-sensitive silver halide emulsion I-(9) is described below.

Emulsion I-(9) was prepared in a manner similar to that employed for the preparation of the green-sensitive silver halide emulsion I-(6), except that a gelatin dispersion of sensitizing dye (16) and a gelatin dispersion of a mixture of sensitizing dye (17) and sensitizing dye (18) were added in the chemical sensitization.

The thus-obtained emulsion contained hexagonal tabular grains having the mean grain size represented by the equivalent spherical diameter of the grains of 0.44 μm, the mean thickness of 0.2 μm, the mean circle-equivalent diameter of 0.53 μm, and the mean aspect ratio of 2.6.

Preparation of Emulsified Dispersions of Color Developing Agents and Couplers

Compositions of a cyan emulsion used in the third layer described in Table 11, a magenta emulsion used in the sixth layer described in Table 11, and a yellow emulsion used in the tenth layer described in Table 11 are shown in the following Table 9.

TABLE 9

| | | Cyan (The 2nd layer) | Magenta (The 6th layer) | Yellow (The 10th layer) |
|---|---|---|---|---|
| Oil phase | Cyan coupler (1) | 5.63 g | — | — |
| | Magenta coupler (2) | — | 6.87 g | — |
| | Yellow coupler (28) | — | — | 7.86 g |
| | Developing agent (4) | 3.57 g | 7.67 g | 5.11 g |
| | Developing agent (29) | 1.53 g | — | 1.53 g |
| | Anti-fogging agent (5) | 3.0 mg | 1.0 mg | 10.0 mg |
| | High b.p. solvent (6) | 8.44 g | 5.27 g | 6.09 g |
| | Ethyl acetate | 24.0 ml | 24.0 ml | 24.0 ml |
| Aqueous phase | Lime-treated gelatin | 12.0 g | 12.0 g | 12.0 g |
| | Surfactant (7) | 0.60 g | 0.60 g | 0.60 g |
| | Water | 138.0 ml | 138.0 ml | 138.0 ml |
| | Subsequent addition of water | 180.0 ml | 180.0 ml | 180.0 ml |

Yellow coupler (28)

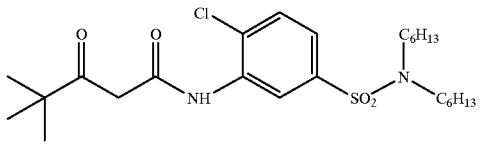

Developing agent (29)

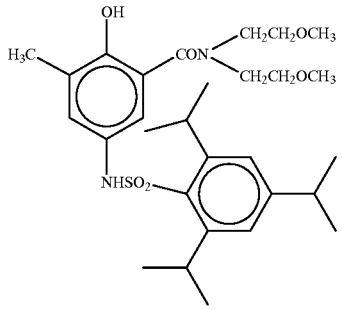

The oil phase components and the aqueous phase components shown in Table 9 were respectively dissolved to obtain homogeneous solutions at 60° C. The oil phase solution and the aqueous phase solution were combined in an 1-liter stainless steel vessel equipped with a dissolver having a disperser (5 cm in diameter) and dispersed at 10,000 rpm for 20 minutes. Subsequently, slightly hot water was added to the resultant mixture for a volume specified in Table 9 and the mixture was allowed to be stirred at 2000 rpm for 10 minutes. Thus, coupler emulsions for three colors; cyan (the third layer), magenta (the sixth layer), and yellow (the tenth layer), were prepared.

Other emulsions were also prepared in a similar manner.

Preparation of dye compositions for a yellow filter layer and an antihalation layer Dye compositions were prepared into emulsions by the following method.

Leuco dyes, a developer, and if necessary, a high-b.p. organic solvent were weighed, and ethyl acetate was added. The resultant mixture was heated to 60° C. to dissolve, so as to make a uniform solution. To this solution (100 cc) were added surfactant (7) (1.0 g) and 6.6.% aqueous solution of lime-treated gelatin heated to about 60° C. (190 cc). The mixture was dispersed with a homogenizer for 10 minutes at 10,000 rpm, to thereby obtain two dye dispersions shown in Table 10.

TABLE 10

| Compounds | Yellow filter dye | Antihalation dye |
|---|---|---|
| Leuco dye Y | 5.32 g | — |
| Leuco dye B | — | 4.5 g |
| Leuco dye M | — | 0.58 g |
| Developing agent | 30.2 g | 15.1 g |
| Oil (1) | — | 10 g |
| Ethyl acetate | 60 ml | 75 ml |

Leuco dye Y

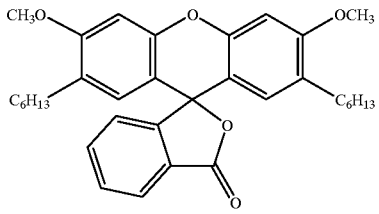

Leuco dye B

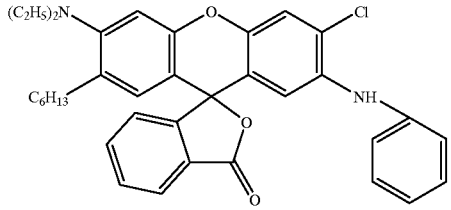

Leuco dye M

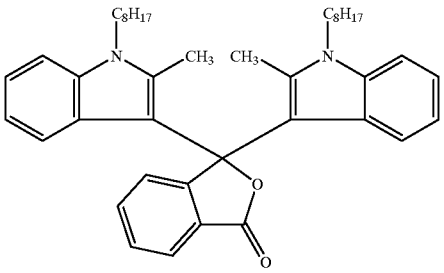

TABLE 10-continued

| Compounds | Yellow filter dye | Antihalation dye |
|---|---|---|

Developer

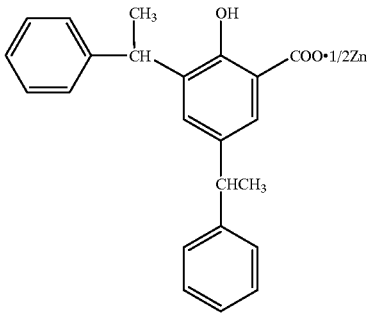

Oil (1)
$C_{26}H_{46.9}Cl_{7.1}$

Preparation of a support

The support used in the present invention was prepared as follows:

Polyethylene-2,6-naphthalate (PEN) polymer (100 parts by weight) was compounded with Tinuvin P.326 (Ciba-Geigy; a UV absorber, 2 parts by weight) and brought to dryness. The compound was melted at 300° C. and extruded through a T-shaped die. The extruded material was subjected to longitudinal stretching (×3.3) at 140° C. and subsequently to transversal stretching (×3.3) at 130° C. The resultant stretched film was thermally set at 250° C. for 6 seconds to thereby obtain a PEN film having a thickness of 92 μm. To the thus-obtained PEN film were added blue dyes, magenta dyes, or yellow dyes (I-1, I-4, I-6, I-24, I-26, I-27, and II-5 described in Technical Disclosure Bulletin No. 94-6023) to obtain a yellow concentration of 0.01, a magenta concentration of 0.08, and a cyan concentration of 0.09. The film was wound on a stainless steel rod having a diameter of 20 cm, and a thermal hysteresis was applied at 113° C. for 30 hours, to thereby obtain a support resistant to curling.

Coating of an undercoating layer

The thus-obtained support was subjected to corona discharge treatment, UV discharge treatment, and glow treatment on both surfaces. To the surface on which a light-sensitive layer was provided, an undercoat liquid (10 cc/$m^2$) containing gelatin (0.1 g/$m^2$), sodium α-sulfo-di-2-ethylhexylsuccinate (0.01 g/$m^2$), salicylic acid (0.025 g/$m^2$), PQ-1 (0.005 g/$m^2$), and PQ-2 (0.006 g/$m^2$) was applied by use of a bar coater so as to provide an undercoat layer, which thereafter was dried at 115° C. for 6 minutes. (The temperature of all the rolls and conveyors in the drying zone was preset to 115° C.)

Coating of a back layer

1) Coating of an antistatic layer

An antistatic layer was formed by the application of a mixture containing a fine powder dispersion (0.027 g/$m^2$; diameter of secondary aggregates: about 0.08 μm, specific resistance: 5 Ω·cm) of stannic oxide-antimony oxide complex particles having an average diameter of 0.005 μm, gelatin (0.03 g/$m^2$), $(CH_2{=}CHSO_2CH_2CH_2NHCO)_2CH_2$ (0.02 g/$m^2$), polyoxyethylene (polymerization degree: 10)-p-nonylphenol (0.005 g/$m^2$), PQ-3 (0.008 g/$m^2$), and resorcin.

2) Coating of a magnetic recording layer

A magnetic recording layer having a thickness of 1.2 μm was formed by the application, through use of a bar coater, of a mixture containing cobalt-γ-iron oxide (0.06 g/m$^2$; specific surface area: 43 m$^2$/g, major axis: 0.14 μm, minor axis: 0.03 μm, saturation magnetization: 89 emu/g, $Fe^{+2}/Fe^{+3}$=6/94, the surfaces are treated with aluminum oxide—silicone oxide (2 wt. % with resect to the weight of the iron oxide)) coated with 3-polyoxyethylene(polymerization degree: 15)-propyloxytrimethoxysilane (15 wt. %), diacetylcellulose (1.15 g/m$^2$; the iron oxide was dispersed through use of an open kneader and a sand mill), PQ-4 (0.075 g/m$^2$) and PQ-5 (0.004 g/m$^2$) as hardening agents, and solvents therefor (acetone, methylethylketone, cyclohexanone, and dibutylphtalate). The magnetic recording layer also contained a lubricant $C_6H_{13}CH(OH)C_{10}H_{20}COOC_{40}H_{81}$ (50 mg/m$^2$), a matting agent of silica particles (5 mg/m$^2$; average particle size: 1.0 μm), and an abrasive of aluminum oxide particles (15 mg/m2; average particle size: 0.44 μm, ERC-DBM, Reynolds Metal). Drying was performed at 115° C. for 6 minutes (the temperature of all the rollers and conveyors in the drying zone was preset to 115° C.). The increment in color density of $D^3$ in the magnetic recording layer when irradiated with light from an X-light (a blue filter) was approximately 0.1. Saturation magnetization moment of the magnetic recording layer was 4.2 emu/g, coercive force was $7.3\times10^4$ A/m, and the square ratio was 65%.

3) Coating of a lubricating layer

A mixture containing hydroxyethylcellulose (25 mg/m$^2$), PQ-6 (7.5 mg/m$^2$), PQ-7 (1.5 mg/M$^2$) and polydimethylsiloxane (1.5 mg/M$^2$) was applied. The mixture was prepared by melting the respective components in xylene/propylene glycol monomethyl ether (1/1) at 105° C., pouring the resultant melt into propylene monomethyl ether (10 times in amount) having ambient temperature to form a dispersion, and further diluting the resultant dispersion in acetone (average particle size: 0.01 μm). Drying was performed at 115° C. for 6 minutes (the rollers and conveyors in the drying zone were all preset to 115° C.). The resultant lubricant layer had excellent characteristics; a dynamic friction coefficient of 0.10 (stainless steel balls having a diameter of 5 mm, load: 100 g, and speed: 6 cm/min), a static friction coefficient of 0.09 (clipping method), and a dynamic friction coefficient of 0.18 against the emulsion layer which will be described below.

The compounds PQ-1 to PQ-7 used in layers of the above support are described below.

PQ-1

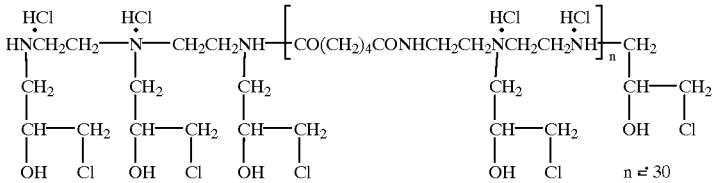

PQ-2

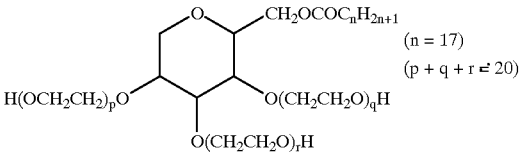

PQ-3

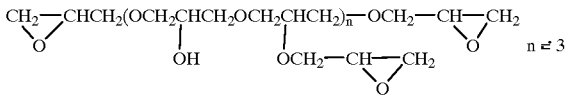

PQ-4

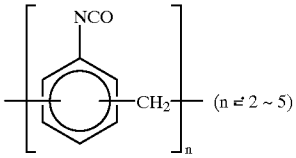

PQ-5

$(CH_3O)_3SiCH_2CH_2CH_2O(CH_2CH_2O)_nCH_3$ (n ≒ 7.3)

PQ-6

$C_{50}H_{101}(CH_2CH_2O)_nH$ (n ≒ 16)

PQ-7

$C_8F_{17}SO_2N(C_3H_7)(CH_2CH_2O)_n(CH_2)_4SO_3Na$ n ≒ 4

Light-sensitive material I-501 having a multi-layered constitution to serve as a color negative film was manufactured by providing through coating simultaneously all the layers shown in Table 11 using the above-described materials and support.

TABLE 11-1

Structure of Light-Sensitive Material I-501

| Structure of layers | Materials incorporated | Amounts (mg/m$^2$) |
|---|---|---|
| The 13th layer: Protective layer | Lime-treated gelatin | 1000 |
| | Matting agent (silica) | 100 |
| | Surfactant (8) | 100 |
| | Surfactant (9) | 300 |
| | Water-soluble polymer (27) | 20 |
| The 12th layer: Intermediate layer | Lime-treated gelatin | 500 |
| | Surfactant (9) | 15 |
| | Zinc hydroxide | 3400 |
| | Water-soluble polymer (27) | 30 |
| The 11th layer: Yellow dye forming layer (High sensitivity layer) | Lime-treated gelatin | 560 |
| | Blue-sensitive silver halide emulsion (1) | 507 |
| | Sensitizing dye (12) | 1.08 |
| | Yellow coupler (28) | 93 |
| | Developing agent (4) | 208 |
| | Anti-fogging agent (5) | 0.8 |
| | High b.p. solvent (6) | 234 |
| | Surfactant (7) | 48 |
| | Water-soluble polymer (27) | 48 |
| The 10th layer: Yellow dye forming layer (Low sensitivity layer) | Lime-treated gelatin | 835 |
| | Blue-sensitive silver halide emulsion (2) | 233 |
| | Blue-sensitive silver halide emulsion (3) | 233 |
| | Sensitizing dye (12) | 2.02 |
| | Yellow coupler (28) | 286 |
| | Developing agent (4) | 186 |
| | Developing agent (29) | 56 |
| | Anti-fogging agent (5) | 0.36 |
| | High b.p. solvent (6) | 222 |
| | Surfactant (7) | 22 |
| | Water-soluble polymer (27) | 48 |
| The 9th layer: Intermediate layer (Yellow filter layer) | Lime-treated gelatin | 1000 |
| | Leuco dye Y | 250 |
| | Surfactant (9) | 8 |
| | Developing agent | 1420 |
| | Water-soluble polymer (27) | 5 |
| | Hardening agent (11) | 65 |

TABLE 11-2

Structure of Light-Sensitive Material I-501

| Structure of layers | Materials incorporated | Amounts (mg/m$^2$) |
|---|---|---|
| The 8th layer: Magenta dye forming layer (High sensitivity layer) | Lime-treated gelatin | 362 |
| | Green-sensitive silver halide emulsion (4) | 286 |
| | Sensitizing dye (13) | 1.02 |
| | Sensitizing dye (14) | 0.21 |
| | Sensitizing dye (15) | 0.08 |
| | Magenta coupler (2) | 32 |
| | Developing agent (4) | 81 |
| | Anti-fogging agent (5) | 0.06 |
| | High b.p. solvent (6) | 78 |
| | Surfactant (7) | 33 |
| | Water-soluble polymer (27) | 14 |
| | Polyethyl acrylate latex | 30 |
| The 7th layer: Magenta dye forming layer (Intermediate sensitivity layer) | Lime-treated gelatin | 158 |
| | Green-sensitive silver halide emulsion (5) | 157 |
| | Sensitizing dye (13) | 0.71 |
| | Sensitizing dye (14) | 0.15 |
| | Sensitizing dye (15) | 0.06 |

TABLE 11-2-continued

Structure of Light-Sensitive Material I-501

| Structure of layers | Materials incorporated | Amounts (mg/m$^2$) |
|---|---|---|
| | Magenta coupler (2) | 32 |
| | Developing agent (4) | 54 |
| | Anti-fogging agent (5) | 0.06 |
| | High b.p. solvent (6) | 75 |
| | Surfactant (7) | 33 |
| | Water-soluble polymer (27) | 14 |
| The 6th layer: Magenta dye forming layer (Low sensitivity layer) | Lime-treated gelatin | 441 |
| | Green-sensitive silver halide emulsion (6) | 241 |
| | Sensitizing dye (13) | 0.90 |
| | Sensitizing dye (14) | 0.19 |
| | Sensitizing dye (15) | 0.07 |
| | Magenta coupler (2) | 185 |
| | Developing agent (4) | 207 |
| | Anti-fogging agent (5) | 0.027 |
| | High b.p. solvent (6) | 142 |
| | Surfactant (7) | 16 |
| | Water-soluble polymer (27) | 14 |

TABLE 11-3

Structure of Light-Sensitive Material I-501

| Structure of layers | Materials incorporated | Amounts (mg/m$^2$) |
|---|---|---|
| The 5th layer: Intermediate layer | Lime-treated gelatin | 1000 |
| | Surfactant (9) | 8 |
| | Zinc hydroxide | 1200 |
| | Water-soluble polymer (27) | 5 |
| | Polyethyl acrylate latex | 15 |
| The 4th layer: Cyan dye forming layer (High sensitivity layer) | Lime-treated gelatin | 778 |
| | Red-sensitive silver halide emulsion (7) | 1000 |
| | Sensitizing dye (16) | 1.44 |
| | Sensitizing dye (17) | 0.07 |
| | Sensitizing dye (18) | 2.09 |
| | Cyan coupler (1) | 49 |
| | Developing agent (4) | 84 |
| | Developing agent (29) | 42 |
| | Anti-fogging agent (5) | 0.12 |
| | High b.p. solvent (6) | 200 |
| | Surfactant (7) | 24 |
| | Water-soluble polymer (27) | 10 |
| The 3rd layer: Cyan dye forming layer (Intermediate sensitivity layer) | Lime-treated gelatin | 345 |
| | Red-sensitive silver halide emulsion (8) | 398 |
| | Sensitizing dye (16) | 1.70 |
| | Sensitizing dye (17) | 0.08 |
| | Sensitizing dye (18) | 2.46 |
| | Cyan coupler (1) | 65 |
| | Developing agent (4) | 41 |
| | Developing agent (29) | 18 |
| | Anti-fogging agent (5) | 0.035 |
| | High b.p. solvent (6) | 97 |
| | Surfactant (7) | 6.9 |
| | Water-soluble polymer (27) | 10 |

TABLE 11-4

| Structure of layers | Materials incorporated | Amounts (mg/m$^2$) |
|---|---|---|
| The 2nd layer: Cyan dye forming layer (Low sensitivity layer) | Lime-treated gelatin | 514 |
| | Red-sensitive silver halide emulsion (9) | 311 |
| | Sensitizing dye (16) | 0.67 |
| | Sensitizing dye (17) | 0.03 |
| | Sensitizing dye (18) | 0.97 |

TABLE 11-4-continued

| Structure of layers | Materials incorporated | Amounts ($mg/m^2$) |
|---|---|---|
| | Cyan coupler (1) | 270 |
| | Developing agent (4) | 113 |
| | Developing agent (29) | 55 |
| | Anti-fogging agent (5) | 0.12 |
| | High b.p. solvent (6) | 208 |
| | Surfactant (7) | 24 |
| | Water-soluble polymer (27) | 10 |
| The 1st layer: Antihalation layer | Lime-treated gelatin | 1000 |
| | Leuco dye B | 221 |
| | Leuco dye M | 28 |
| | Developing agent | 740 |
| | Oil (1) | 491 |
| | Surfactant (7) | 46 |
| | PEN support (92 $\mu$m) | |

The total amount of potassium ions contained in the manufactured light-sensitive material was $2.2\times10^{-4}$ with respect to the amount of silver on a weight basis.

Processing material I-R-2 of which contents are shown in Tables 12 and 13 was also manufactured.

TABLE 12

Structure of Processing Material I-R-2

| Structure of layers | Composition | Amounts ($mg/m^2$) |
|---|---|---|
| The 4th layer: Protective layer | Acid-treated gelatin | 220 |
| | Water-soluble polymer (19) | 60 |
| | Water-soluble polymer (20) | 200 |
| | Additive (21) | 20 |
| | Potassium nitrate | 12 |
| | Matting agent (31) | 10 |
| | Surfactant (9) | 7 |
| | Surfactant (23) | 7 |
| | Surfactant (24) | 10 |
| The 3rd layer: Intermediate layer | Lime-treated gelatin | 240 |
| | Water-soluble polymer (20) | 24 |
| | Hardening agent (25) | 360 |
| | Surfactant (7) | 9 |
| The 2nd layer: Base-generating layer | Lime-treated gelatin | 4800 |
| | Water-soluble polymer (26) | 1400 |
| | Guanidine picolate | 5820 |
| | Potassium quinolate | 450 |
| | Sodium quinolate | 360 |
| | Surfactant (7) | 48 |
| The 1st layer: Undercoat layer | Lime-treated gelatin | 280 |
| | Water-soluble polymer (20) | 12 |
| | Surfactant (9) | 14 |
| | Hardening agent (25) | 370 |
| | Support A (63 $\mu$m) | |

TABLE 13

Structure of Support A

| Layers | Composition | Weight ($mg/m^2$) |
|---|---|---|
| Upper surface undercoat layer | Lime-treated gelatin | 100 |
| Polymer layer | Polyethylene terephthalate | 62500 |
| Backface undercoat layer | Polymer(Methyl methacrylate-styrene-2-ethylhexyl acrylate-methacrylic acid copolymer) | 1000 |
| | PMMA latex | 120 |

TABLE 13-continued

Structure of Support A

| Layers | Composition | Weight ($mg/m^2$) |
|---|---|---|
| Water-soluble polymer (19) | | |
| κ-carageenan | | |
| Additive (21) | | |

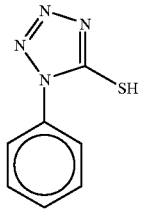

| | | |
|---|---|---|
| Matting agent (31) | | |
| SYLOID79 | (product of Fuji Davison) | |
| Water-soluble polymer (26) | | |
| dextran (molecular weight) 70,000) | | |

Specimens I-502 to I-512 were manufactured by alternating Leuco dye Y in the ninth layer (yellow filter layer) of the manifactured Specimen I-501 to equimol of the dyes (listed in Table 14) of the present invention, with proviso that the developer incorporated in the ninth layer of Specimen I-501 was not used in Specimens I-502 to I-512.

The manufactured Specimens I-502 to I-512 were given image-forming exposure and subjected to the following thermal development processes. Briefly, the light-sensitive materials were dried immediately after processing. The yellow density of each specimen was determined by use of the corresponding fog value at an exposure dose which rendered a yellow density expressed by [(fogging of Specimen I-501)+2.0]. The results are shown in Table 14 as relative values with the yellow density of Specimen I-501 being taken as 100. The computed relative values were used as indication of BL color-developability of BL.

MTF (Modulation Transfer Function) values at the yellow image 20 cycles/mm (sharpness of BL) were measured by a conventional MTF method under similar process conditions. The results are shown in Table 14 wherein the data are shown by relative values with Specimen I-501 being taken as 100.

Method of Development processing

The developing method included the following steps: imparting 40° C. water (15 $cc/m^2$, corresponding to 45% of the maximum swell of a light-sensitive material) to the exposed light-sensitive material; laminating the resultant light-sensitive material with processing material I-R-2; heating the light-sensitive material from its backside with a heat drum at 83° C. for 17 seconds; and peeling the light-sensitive material from processing material I-R-2.

TABLE 14

| Sample No. | Dye in the 9th layer | Color generation of BL | Sharpness of BL | Note |
|---|---|---|---|---|
| I-501 | Leuco dye Y | 100 | 100 | Comparative Ex. |
| I-502 | A-3 | 121 | 112 | Invention |
| I-503 | A-13 | 120 | 110 | Invention |
| I-504 | A-55 | 119 | 112 | Invention |
| I-505 | A-58 | 118 | 113 | Invention |

TABLE 14-continued

| Sample No. | Dye in the 9th layer | Color generation of BL | Sharpness of BL | Note |
|---|---|---|---|---|
| I-506 | A-87 | 121 | 113 | Invention |
| I-507 | A-88 | 120 | 112 | Invention |
| I-508 | A-95 | 120 | 110 | Invention |
| I-509 | A-100 | 122 | 115 | Invention |
| I-510 | A-101 | 123 | 115 | Invention |
| I-511 | A-116 | 121 | 112 | Invention |
| I-512 | A-122 | 119 | 113 | Invention |

Table 14 shows that the light-sensitive material having a yellow filter layer containing the dye of the present invention exhibits excellent sharpness without losing color-developability of BL during heat development.

Example 6

Specimen I-601 was manufactured by alternating the composition of the first layer (anti-halation layer) of Specimen I-501 to the composition shown in Table 15. Moreover, Cyan dye A-26 in Specimen I-601 was substituted for dyes (listed in Table 16) consisting of the present invention to provide Specimens from I-602 to I-609.

TABLE 15

| | | amount (mg/cm$^2$) |
|---|---|---|
| The 1st layer: Antihalation layer | Lime-treated gelatin | 240 |
| | Cyan dye A-26 | 150 |
| | Oil (1) | 130 |
| | Surfactant (7) | 35 |

TABLE 16

| Sample No. | Dye in the 1st layer | Color generation of BL | Sharpness of BL | Note |
|---|---|---|---|---|
| I-501 | Leuco dye B,M | 100 | 100 | Comparative Ex. |
| I-601 | A-26 | 118 | 110 | Invention |
| I-602 | A-25 | 116 | 112 | Invention |
| I-603 | A-57 | 116 | 112 | Invention |
| I-604 | A-60 | 115 | 111 | Invention |
| I-605 | A-76 | 118 | 113 | Invention |
| I-606 | A-78 | 119 | 112 | Invention |
| I-607 | A-74 | 117 | 110 | Invention |
| I-608 | A-134 | 118 | 113 | Invention |
| I-609 | A-144 | 116 | 111 | Invention |

Degree of color formation and shapness of RL of each of manufactured Specimens I-601 to I-609 and Specimen I-501 were evaluated after they were processed in a similar manner to that employed in Example 5. As was found in Example 5, the use of dyes according to the present invention proved to provide a light-sensitive material exhibiting excellent sharpness of RL without losing color-developability of RL.

Example 7

Specimen I-701 was manufactured by alternating the ninth layer of Specimen I-601 in Example 6 in a manner similar to that in Example 5 for Specimen I-502; and modifying the fifth layer as shown in Table 17. Moreover, Dye A-26 in the first layer, Dye A-10 in the fifth layer, and Dye A-3 in the ninth layer of Specimen I-701 were substituted for dyes listed in Table 18 to provide Specimens I-702 to I-716. Degree of color formation and shapness were measured by a method similar to that in Example 5. All specimens proved to exhibit excellent sharpness without decreasing color-developability.

TABLE 17

| | | amount (mg/cm$^2$) |
|---|---|---|
| The 5th layer: (Magenta filter) | Lime-treated gelatin | 1000 |
| | Magenta dye A-10 | 240 |
| | Surfactant (9) | 8 |
| | High b.p. solvent (6) | 270 |
| | Zinc hydroxide | 1200 |
| | Water-soluble polymer (10) | 5 |
| | Polyethyl acrylate latex | 15 |

TABLE 18

| Sample No. | Dye in the 1st layer | Dye in the 5th layer | Dye in the 9th layer | Note |
|---|---|---|---|---|
| I-701 | A-26 | A-10 | A-3 | Invention |
| I-702 | A-26 | A-30 | A-3 | Invention |
| I-703 | A-26 | A-56 | A-3 | Invention |
| I-704 | A-26 | A-93 | A-13 | Invention |
| I-705 | A-26 | A-93 | A-55 | Invention |
| I-706 | A-26 | A-30 | A-100 | Invention |
| I-707 | A-25 | A-30 | A-100 | Invention |
| I-708 | A-57 | A-30 | A-88 | Invention |
| I-709 | A-60 | A-56 | A-88 | Invention |
| I-710 | A-25/A-30 | A-56 | A-116 | Invention |
| I-711 | A-25/A-30 | A-93 | A-100 | Invention |
| I-712 | A-25/A-30 | A-10 | A-122 | Invention |
| I-713 | A-74 | A-155 | A-100 | Invention |
| I-714 | A-134 | A-155 | A-103 | Invention |
| I-715 | A-144 | A-4 | A-100 | Invention |
| I-716 | A-134 | A-4 | A-103 | Invention |

Example 8

A method of preparing tabular silver iodobromide emulsions (for comparison) II-M-1, II-M-2, and II-M-3 is described below.

Distilled water (930 ml) containing gelatin (Av. MW: 15,000; 0.74 g) and potassium bromide (0.7 g) was added to a reactor and the contents were heated to 42° C. An aqueous solution (30 ml) containing silver nitrate (1.2 g) and an aqueous solution (30 ml) containing potassium bromide (0.82 g) were added thereto with vigorous stirring for 30 seconds. After completion of addition, the temperature of the reaction mixture was maintained at 40° C. for 1 minute, and thereafter elevated to 75° C. Gelatin (27.5 g) and distilled water (200 ml) were added, and subsequently, an aqueous solution (100 ml) containing silver nitrate (22.5 g) and an aqueous solution (80 ml) containing potassium bromide (15.43 g) were added over 11 minutes with the rate of addition being increased.

Subsequently, an aqueous solution (250 ml) containing silver nitrate (75.1 g) and an aqueous solution containing potassium iodide and potassium bromide (molar ratio=3:97, the concentration of potassium bromide: 26%) were added for 20 minutes with the rate of addition being increased. During the addition, the silver potential of the reaction mixture was controlled to be 2 mV with respect to the saturated calomel electrode. Furthermore, an aqueous solution (75 ml) containing silver nitrate (18.7 g) and a 21.9% aqueous potassium bromide solution were added over 4 minutes so that the silver potential of the reaction mixture was 0 mV with respect to the saturated calomel electrode.

After completion of addition, the reaction mixture was maintained at 73° C. for 1 minute, and then the reaction mixture was cooled to 55° C. Subsequently, an aqueous solution (120 ml) containing silver nitrate (8.1 g) and an aqueous solution (320 ml) containing potassium iodide (7.26 g) were added over 5 minutes. After completion of addition, potassium bromide (5.5 g) and potassium hexachloroiridate (0.04 mg) were added, and the reaction mixture was maintained at 55° C. for 1 minute. Further, an aqueous solution (180 ml) containing silver nitrate (44.3 g) and an aqueous solution (160 ml) containing potassium bromide (34.0 g) were added over 10 minutes. The reaction mixture was cooled, and desalted by a conventional method.

The obtained emulsion was silver iodobromide emulsion (content of silver iodide: 5.7 mol %) which was formed of tabular hexagonal grains. The mean circle-equivalent diameter of the grains was 1.81 μm, and the mean aspect ratio (obtained by dividing the mean grain diameter by the mean thickness) was 3.8. This emulsion is referred to as Emulsion II-M-1.

Emulsion II-M-2 and Emulsion II-M-3 were prepared from grains having circle-equivalent diameters of 1.21 μm and 0.76 μm, respectively, which grains were prepared by use of different initial amounts of gelatin and potassium bromide from those employed in the preparation of Emulsion II-M-1. Emulsion II-M-2, and Emulsion II-M-3 were used in Example 9.

A method of preparing cubic silver chloride emulsions (for comparison), II-R-1, II-R-2, and II-R-3, is described below.

Distilled water (1,000 ml) containing calcium-removed gelatin (calcium content: not more than 2,000 ppm, 30.0 g), sodium chloride (2.4 g), and sulfuric acid (1 N, 15.0 ml) was added to a reactor and the contents were heated to 59° C. An aqueous solution (concentration 1%, 1.91 ml) of N, N'-dimethylimidazolidine-2-thione, an aqueous solution (2,000 ml) containing silver nitrate (7.1 g), and an aqueous solution (200 ml) containing sodium chloride (2.41 g) were added thereto with vigorous stirring for 24 minutes. Further, an aqueous solution (500 ml) containing silver nitrate (162.8 g), and an aqueous solution (500 ml) containing sodium chloride (59.88 g) were added over 80 minutes with the rate of addition being increased. After 60 minutes from starting addition of this reaction mixture, potassium hexachloroiridate (0.04 mg) was added. After completion of addition, the temperature of the reaction mixture was maintained at 55° C. for 5 minutes. Thereafter, the reaction mixture was cooled, and desalted by a conventional method.

The thus-obtained emulsion was formed of cubic grains having a circle-equivalent mean diameter of 0.73 μm. This emulsion is referred to as Emulsion II-R-1.

Emulsion II-R-2 and Emulsion II-R-3 were prepared in a manner similar to that employed for the preparation of Emulsion II-R-1 except that the temperatures of the reactors were at 45° C. and 40° C., respectively. The mean diameters of the grains in the obtained emulsions II-R-2 and II-R-3 were 0.54 μm and 0.29 μm, respectively. Emulsion II-R-2 and Emulsion II-R-3 were used in Example 9.

Methods for preparing high-AgCl-content tabular silver chloride emulsions (present invention) II-H-1, II-H-2, and II-H-3 having (100) major faces are described below.

Distilled water (1,000 ml) containing gelatin (Av. MW: 15,000; 20.2 g), sodium chloride (0.81 g), and sulfuric acid (1 N, 8.8 ml) were added to a reactor and the contents were heated to 35° C. An aqueous solution (30 ml) containing silver nitrate (6.1 g) and an aqueous solution (30 ml) containing sodium chloride (2.00 g) and potassium bromide (0.21 g) were added to the reaction mixture with vigorous stirring for 45 seconds. An aqueous solution containing polyvinyl alcohol (Av. polymerization degree: 300 to 700, 5.0 g; Kuraray Poval 105; Kuraray Co., Ltd.) was added to the reaction mixture. Subsequently, an aqueous solution (40 ml) containing sodium bromide (0.55 g) was added. Further, an aqueous solution (100 ml) containing silver nitrate (18.3 g), and an aqueous solution (100 ml) containing sodium chloride (6.30 g) were added for 3 minutes. After addition of sodium hydroxide (1N, 6.0 ml), the temperature of the reaction mixture was elevated to 75° C. After gelatin (10.0 g) and distilled water (100 ml) were added thereto, an aqueous solution (750 ml) containing silver nitrate (145.4 g) and an aqueous sodium chloride solution (7.0%) were added over 45 minutes with the rate of addition being increased so that the silver potential of the reaction mixture was controlled to be 100 mv with respect to the saturated calomel electrode. Potassium hexachloroiridate (0.04 mg) was added, and the temperature of the reaction mixture was maintained at 75° C. for 30 minutes. Thereafter, the reaction mixture was cooled, and desalted by a conventional method.

The obtained emulsion was (100) silver chlorobromide emulsion (silver bromide content: 0.64 mol %) formed of tabular grains. The grains had a mean circle-equivalent diameter of 0.67 μm, a mean aspect ratio of 7.1 (obtained by dividing the diameter of a circle equivalent to the mean projected area of the grains by the mean thickness), and a mean ratio of adjacent sides of rectangular projected planes of 1:1.25. This emulsion is referred to as Emulsion II-H-1. By controlling the molecular weight and the amount of gelatin used in the first reaction, emulsions which had the mean equivalent spherical diameters of 0.50 Mm and 0.31 Mm were prepared (II-H-2, and II-H-3). The obtained Emulsion II-H-2 and Emulsion II-H-3 were used in Example 9.

Spectral sensitizations and chemical sensitizations of emulsions, II-M-1, II-M-2, II-M-3, II-R-1, II-R-2, II-R-3, II-H-1, II-H-2, and II-H-3 are described below. To these emulsions, spectral sensitizing dyes (II-I, II-II, and II-III) mentioned thereinafter, Compound II-I, potassium thiocyanate, chloroauric acid, and sodium thiosulfate were incorporated so as to provide spectral sensitization and chemical sensitization. In this case, spectral sensitizing dyes were varied in proportion to the grain surface area of each emulsion. The amounts of pAg and chemical sensitizing agents at the time of chemical sesitization were controlled to achieve an optimum degree of chemical sesitization for each emulsion. Thus-obtained green-sensitive emulsions are represented by II-M-1g, and the like with a small letter g.

Sensitizing dye II-I for green-sensitive emulsion

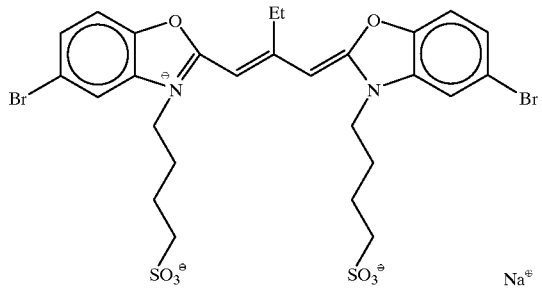

$8.4\times10^{-4}$ mole per mole of silver for each emulsion

Sensitizing dye II-II for green-sensitive emulsion

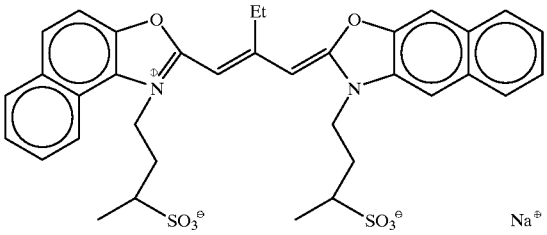

$2.2\times10^{-4}$ mole per mole of silver for each emulsion

Sensitizing dye II-III for green-sensitive emulsion

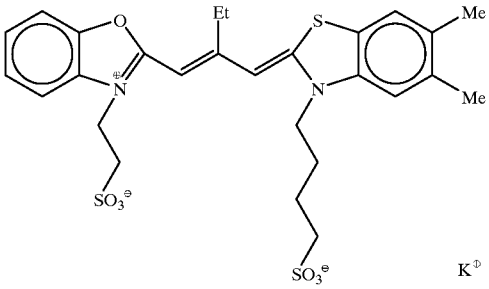

$3.2\times10^{-4}$ mole per mole of silver for each emulsion

Compound II-I

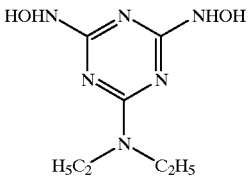

Methods for preparing tabular emulsions (present invention) II-B-1, II-B-2, and II-B-3 having (111) major faces with high AgCl contant are described below.

An aqueous gelatin solution (1,200 ml) containing deionized alkali-treated bone gelatin (2.1 g), and sodium chloride (2 g) was added to a reactor and the temperature was maintained at 35° C. To the reaction mixture, 60 ml of an aqueous solution (A) (1,100 ml) containing silver nitrate (165 g), and 60 ml of an aqueous solution (B) (1,100 ml) containing sodium chloride (59.1 g) were added simultaneously with vigorous stirring over 1 minute. An aqueous solution (C) (50 ml) containing compound (3) (0.285 g) was prepared. One minute after completion of addition of this solution (40 ml), 10% aqueous sodium chloride solution (30 ml) was added. After addition, the temperature of this reaction mixture was elevated to 60° C. over 25 minutes, and 16 minutes thereafter, an aqueous gelatin solution (260 ml) containing phthalic acid-treated gelatin (29 g) was added. Three minutes thereafter, solution (C) (10 ml) was added. One minute thereafter, solution (A) (768 ml), and solution (B) (768 ml) were added simultaneously to the reaction mixture at an initial velocity of 2.85 ml/min and acceleration of 0.818 ml/min$^2$. Ten minutes prior to completion of addition of solution (A) and solution (B), an aqueous solution (D) (270 ml) containing sodium chloride (3.9 g) and yellow prussiate of potash (0.1 g) was added over 10 minutes. Two minutes prior to completion of addition of solution (A) and solution (B), 10% aqueous potassium bromide solution (34 ml) was added for 3 seconds. Three minutes after completion of addition of solution (A) and solution (B), 1% aqueous sodium thiosulfate solution (27 ml) was added and solution (45 ml) of a gelatin dispersion (gelatin content: 100 g) containing the aforementioned sensitizing dyes for a green-sensitive emulsion, i.e., II-I (570 mg), II-II (60 mg), and II-III (120 mg), were added to the reaction mixture. After 1 minute of addition the temperature of the mixture was elevated to 75° C., and the mixture was maintained at this temperature for 10 minutes. Subsequently, the mixture was cooled to 40° C, and desalted by a conventional method by use of precipitating agent (1). Deionized alkali-treated bone gelatin (67 g), zinc nitrite, and phenoxy ethanol were used to obtain a dispersion of the mixture. The pH and pAg were adjusted to 6.3 and 7.7. respectively.

The grains contained in the obtained emulsion were tabular (111) silver chlorobromide grains (silver bromide content: 5 mol %) and had a equivalent spherical mean diameter of 0.74 $\mu$m, a mean aspect ratio of 8.7, and a mean ratio of adjacent sides of projected planes of 1:1.6. This emulsion is referred to as Emulsion II-B-1. The chemical sensitization of this Emulsion II-B-1 was conducted at 60 ° C. and by sequential addition of 4-hydroxy-6-methyl-1,3,3a,7-tetrazaindene, sodium thiosulfate, selenium sensitizer, chloroauric acid, and sodium benzenthiosulfonate to achieve a maximum degree of chemical sensitization. Compound (4) was used to stop chemical sensitization. Thus-obtained green-sensitive emulsions are represented by II-B-1g, and the like with a small letter g.

Compound (3)

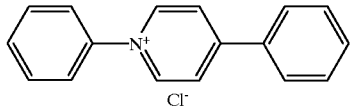

Precipitating agent (1)

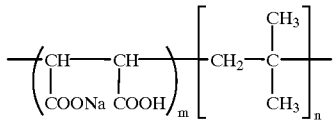

Compound (4)

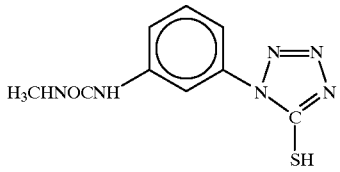

Selenium sensitizer

Mixture of

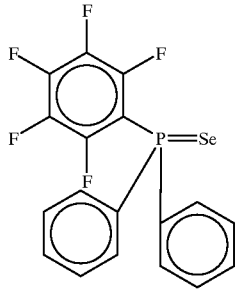

and

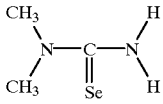

(molar ratio = 3:1)

Further, the initial amount of gelatin, silver nitrate content of solution (A), and sodium chloride content of solution (B) were adjusted to thereby prepare Emulsions II-B-2g and II-B-3g which had (111) major faces and which had grain sizes different from the grain size of Emulsion II-B-1g. The grains of Emulsions II-B-2g and II-B-3g were 0.51 μm and 0.37 μm, respectively. These Emulsions II-B-2g and II-B-3g were used in Example 9.

A dispersion of zinc hydroxide to be used as a base precursor was prepared.

Zinc hydroxide powder (31 g) with a primary grain size of 0.2 μm was mixed with dispersing agents, namely, carboxymethylcellulose (1.6 g) and sodium polyacrylate (0.4 g), lime-treated ossein gelatin (8.5 g), and water (158.5 ml). The mixture was dispersed for 1 hour in a mill employing glass beads. After the powder was dispersed, the glass beads were removed by filtration, whereby a dispersion (188 g) of zinc hydroxide was obtained.

An emulsion of a magenta coupler was prepared as follows.

Magenta coupler (a) (7.80 g), developing agent (b) (5.45 g), antifogging agent (c) (2 mg), high-b.p. organic solvent (d) (8.21 g), and ethyl acetate (24.0 ml) were mixed and dissolved at 60° C. The resultant solution was added to an aqueous solution (150 g) containing lime-treated gelatin (12.0 g) and sodium dodecylbenzene sulfonate (0.6 g). The mixture was emulsified by used of a dissolver stirrer at 10,000 for 20 minutes with the temperature being maintained at 50° C. After completely emulsified, distilled water was added so as to make the total amount 300 g. The mixture was stirred at 2,000 rpm for 10 minutes.

A dye dispersion for a magenta layer (invention) was prepared by use of the following emulsification process. Briefly, an oil phase containing the aforementioned magenta dye A10 (2.0 g), tricresyl phosphate (2.0 g), and cyclohexane (22 cc) and an aqueous phase containing lime-treated gelatin (3.5 g), surfactant (e) (0.26 g), and water (37 cc) were mixed. The mixture was dispersed with a homogenizer at 10,000 for 3 minutes at 40° C. Water (44 cc) was further added and the mixture was stirred at 2,000 rpm for 10 minutes so as to obtain a uniform dispersion.

The obtained dispersion contained grains having a mean grain size of 0.18 μm.

For comparison, there was prepared a colored dispersion product to be incorporated in a layer that constituted a colored layer capable of being decolorized during a heat development process. In this coloring agent dispersion, a magenta leuco dye and zinc were incorporated in combination.

These dispersions and the previously prepared silver halide emulsions were used in combination to thereby prepare six heat developable, color photographic light-sensitive materials of Samples II-101 through II-106 shown in Table 19.

Similarly, processing materials II-P-1 and II-P-2 shown in Tables 20 through 22 were prepared.

TABLE 19

(mg/m²)

| | | Sample I II-101 | Sample I II-102 | Sample I II-103 | Sample I II-104 | Sample I II-105 | Sample I II-106 |
|---|---|---|---|---|---|---|---|
| Protective layer | Lime-treated gelatin | 1000 | 1000 | 1000 | 1000 | 1000 | 1000 |
| | Matting agent (silica) | 50 | 50 | 50 | 50 | 50 | 50 |
| | Surfactant (f) | 120 | 120 | 120 | 120 | 120 | 120 |
| | Surfactant (g) | 270 | 270 | 270 | 270 | 270 | 270 |
| | Water-soluble polymer (h) | 10 | 10 | 10 | 10 | 10 | 10 |
| | Hardening agent (i) | 40 | 40 | 40 | 40 | 40 | 40 |
| Intermediate layer | Lime-treated gelatin | 375 | 375 | 375 | 375 | 375 | 375 |
| | Surfactant (g) | 15 | 15 | 15 | 15 | 15 | 15 |
| | Zinc hydroxide | 1100 | 1100 | 1100 | 1100 | 1100 | 1100 |
| | Water-soluble polymer (h) | 15 | 15 | 15 | 15 | 15 | 15 |
| Magenta dye forming layer | Lime-treated gelatin | 2000 | 2000 | 2000 | 2000 | 2000 | 2000 |
| | Emulsion (silver) | M-1g 2700 | R-1g 2700 | H-1g 2700 | B-1g 2700 | H-1g 2700 | B-1g 2700 |
| | Magenta coupler (a) | 637 | 637 | 637 | 637 | 637 | 637 |
| | Developing agent (b) | 444 | 444 | 444 | 444 | 444 | 444 |
| | Anti-fogging agent (c) | 0.20 | 0.20 | 0.20 | 0.20 | 0.20 | 0.20 |
| | High b.p. organic solvent (d) | 670 | 670 | 670 | 670 | 670 | 670 |
| | Surfactant (e) | 33 | 33 | 33 | 33 | 33 | 33 |
| | Water-soluble polymer (h) | 14 | 14 | 14 | 14 | 14 | 14 |
| Antihalation layer | Magenta leuco dye (z) | 490 | 490 | 490 | 490 | — | — |
| | Lime-treated gelatin | 720 | 720 | 720 | 720 | 720 | 720 |
| | Surfactant (e) | 15 | 15 | 15 | 15 | 36 | 36 |
| | High b.p. organic solvent (d) | — | — | — | — | 280 | 280 |
| | Magenta dye A10 | — | — | — | — | 280 | 280 |
| | Developing agent (y) | 640 | 640 | 640 | 640 | — | — |
| | | Transparent PET base (120 μm) | | | | | |

TABLE 19-continued
| | | | | | | | | (mg/m$^2$) |
|---|---|---|---|---|---|---|---|---|
| | | | Sample I II-101 | Sample I II-102 | Sample I II-103 | Sample I II-104 | Sample I II-105 | Sample I II-106 |
| Table 19 Note | | | | | | | | |
| Emulsion | Mg-1g AgBrI plate | R-1g AgCl cube | H-1g AgCl (100) plate | B-1g AgCl (111) plate | | | | |
Magenta coupler (a)
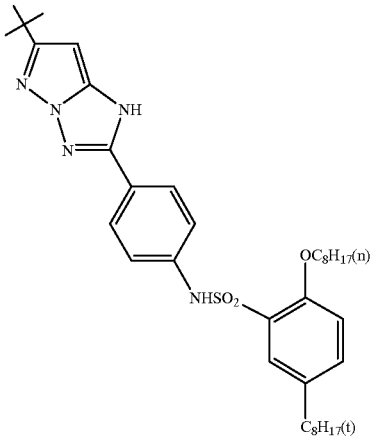
Developing agent (b)
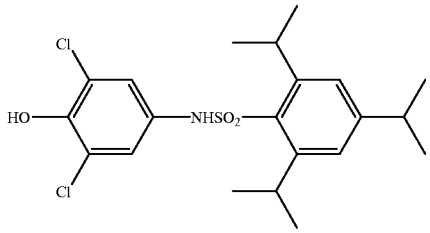
High.b.p. organic agent (d)
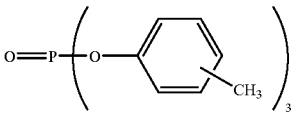
Magenta leuco dye (z)
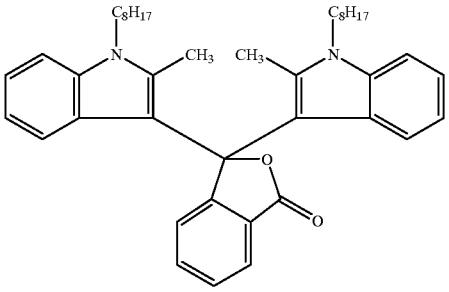
Antifogging agent (c)

TABLE 19-continued

| | Sample I II-101 | Sample I II-102 | Sample I II-103 | Sample I II-104 | Sample I II-105 | (mg/m$^2$) Sample I II-106 |
|---|---|---|---|---|---|---|

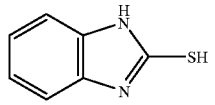

Surfactant (e)

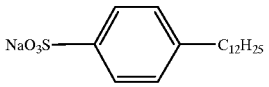

Developing agent (y)

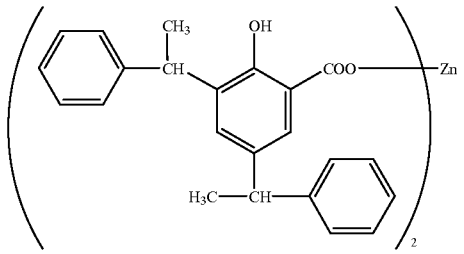

Surfactant (f)

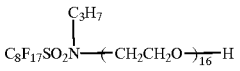

Surfactant (g)

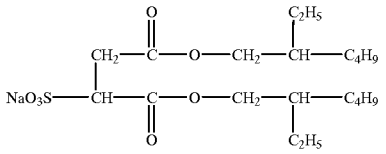

Water-soluble polymer (h)

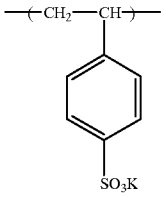

Hardening agent (i)
$CH_2{=}CH{-}SO_2{-}CH_2{-}SO_2{-}CH{=}CH_2$

TABLE 20

Structure of Processing Material II-P-1

| Structure of layers | Composition | Amounts (mg/m$^2$) |
|---|---|---|
| The 4th layer: Protective layer | Acid-treated gelatin | 180 |
| | Water-soluble polymer (j) | 60 |
| | Water-soluble polymer (k) | 200 |
| | Additive (1) | 80 |

TABLE 20-continued

Structure of Processing Material II-P-1

| Structure of layers | Composition | Amounts (mg/m$^2$) |
|---|---|---|
| | Potassium nitrate | 12 |
| | Matting agent (m) | 10 |
| | Surfactant (g) | 7 |
| | Surfactant (n) | 7 |

TABLE 20-continued

Structure of Processing Material II-P-1

| Structure of layers | Composition | Amounts (mg/m$^2$) |
|---|---|---|
| | Surfactant (o) | 10 |
| The 3rd layer: Intermediate layer | Lime-treated gelatin | 240 |
| | Water-soluble polymer (k) | 24 |
| | Hardening agent (p) | 180 |
| | Surfactant (e) | |
| The 2nd layer: Base-generating layer | Lime-treated gelatin | 2400 |
| | Water-soluble polymer (k) | 360 |
| | Water-soluble polymer (g) | 700 |
| | Water-soluble polymer (r) | 600 |
| | High b.p. solvent (s) | 2000 |
| | Additive (t) | 20 |
| | Guanidine picolate | 2630 |
| | Potassium quinolate | 225 |
| | Sodium quinolate | 180 |
| | Surfactant (e) | 24 |
| The 1st layer: Undercoat layer | Lime-treated gelatin | 190 |
| | Water-soluble polymer (j) | 12 |
| | Surfactant (g) | 14 |
| | Hardening agent (p) | 185 |
| | Transparent support A (63 $\mu$m) | |

TABLE 21

Structure of Processing Material II-P-2

| Structure of layers | Composition | Amounts (mg/m$^2$) |
|---|---|---|
| The 4th layer | Acid-treated gelatin | 180 |
| | Water-soluble polymer (j) | 60 |
| | Water-soluble polymer (k) | 200 |
| | Potassium nitrate | 12 |
| | Matting agent (m) | 10 |
| | Surfactant (g) | 7 |
| | Surfactant (n) | 7 |
| | Surfactant (o) | 10 |
| The 3rd layer | Lime-treated gelatin | 240 |
| | Water-soluble polymer (k) | 24 |
| | Hardening agent (p) | 180 |
| | Surfactant (e) | 9 |
| The 2nd layer | Lime-treated gelatin | 2400 |
| | Water-soluble polymer (k) | 120 |
| | Water-soluble polymer (q) | 700 |
| | Water-soluble polymer (r) | 600 |
| | High b.p. solvent (s) | 2000 |
| | Additive A | 1270 |
| | Additive B | 683 |
| | Surfactant (e) | 20 |
| The 1st layer | Lime-treated gelatin | 190 |
| | Water-soluble polymer (j) | 12 |
| | Surfactant (g) | 14 |
| | Hardening agent (p) | 185 |
| | Transparent support A (63 $\mu$m) | |

TABLE 22

Structure of Support A

| Layers | Composition | Weight (mg/m$^2$) |
|---|---|---|
| Upper surface undercoat layer | Gelatin | 100 |
| Polymer layer | Polyethylene terephthalate | 62500 |
| Backface undercoat layer | Methyl methacrylate-styrene-2-ethylhexyl acrylate-methacrylic acid copolymer | 1000 |
| | PMMA latex | 120 |

TABLE 22-continued

Structure of Support A

| Layers | Composition | Weight (mg/m$^2$) |
|---|---|---|
| | (av. particle size: 12$\mu$) | |
| | | 63720 |

Water-soluble polymer (j): κ-carageenan

Water-soluble polymer (k): SUMIKAGEL L-5H (Sumitomo Chemical Co., Ltd.)

Additive (1)

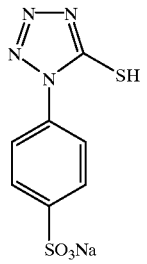

Matting agent (m): SYLOID 79 (Fuji Devison)

Surfactant (n)

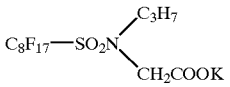

Surfactant (o)

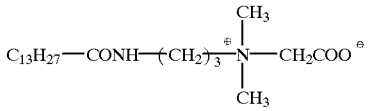

Hardening agent (p)

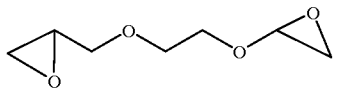

Water-soluble polymer (q): Dextran (M.W. 70,000)

Water-soluble polymer (r): MP POLYMER MP102 (Kuraray Co., Ltd.)

High.b.p. solvent (s): ENPARA (Ajinomoto K.K.)

Additive (t)

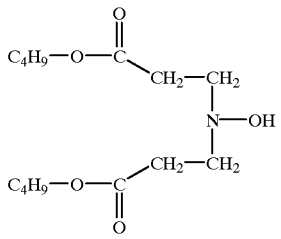

TABLE 22-continued

| Layers | Structure of Support A<br>Composition | Weight ($mg/m^2$) |
|---|---|---|
| Additive A | 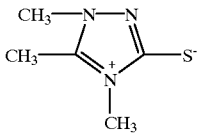 | |
| Additive B | 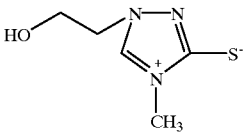 | |

These light-sensitive materials were exposed to light through a green filter by use of an optical wedge (1,000 lux for 1/100 sec.).

Warm water (40° C., 18 $ml/m^2$) was applied to the surface of the exposed light-sensitive material, and this surface was attached to the surface of processing material II-P-1 in a face-to-face manner. Heat was applied thereto by use of a heat drum at 83° C. for 15 seconds. Subsequently, a light-sensitive material was peeled off to confirm that a wedge-like image which developed magenta color was obtained.

For fixing purposes, a second step was performed by use of processing material II-P-2. Briefly, in the second step, water (12 $cc/m^2$) was applied to processing material II-P-2, the surface of the wet material was bonded in a face-to-face manner to the previously processed (first step) light-sensitive material, and the integrated body was heated at 70° C. for 20 seconds.

When the unexposed portions of the obtained samples were visually checked, all colored layers were found to be completely decolorized. The transmission density of each of the colored samples was measured, and sensitivity of each light-sensitive material was determined by use of a so-called characteristic curve. When the relative sensitivity was expressed by an inverse number of the amount of exposure corrsponding to the density 0.15 higher than the fogging density, light-sensitive materials II-101 through II-106 were all fall within the same range with variation within ±0.1. Therefore, these light-sensitive materials were found to have almost identical sensitivities.

The maximum density of these samples were measured. In all cases, bleaching of silver halide was not performed. In both cases of presence and absence of fixing procedure, almost the same results were obtained. The results obtained in the case of absence of fixing procedure are shown in Table 23.

TABLE 23

| Light-sensitive material No. | Emulsion | Characteristics of emulsion | Dye of the Invention | Maximum density of Magenta | Note |
|---|---|---|---|---|---|
| II-101 | II-M-1g | AgBrI plate (111) | Not contained | 2.72 | Comparative Ex. |
| II-102 | II-R-1g | AgCl Cube (100) | Not contained | 2.81 | Comparative Ex. |
| II-103 | II-H-1g | AgCl plate (100) | Not contained | 2.97 | Comparative Ex. |
| II-104 | II-B-1g | AgCl plate (111) | Not contained | 2.89 | Comparative Ex. |
| II-105 | II-H-1g | AgCl plate (100) | Contained | 3.51 | Invention |
| II-106 | II-B-1g | AgCl plate (111) | Contained | 3.40 | Invention |

Table 23 shows that the light-sensitive materials of the present invention exhibits an elevated maximum density, and thus are excellent light-sensitive materials. When the light-sensitive material and the processing material were respectively extracted by liquid chromatography, the dyes that had been decolorized remained in the light-sensitive material, and were not transferred onto the processed material.

Example 9

By changing the spectral sensitizing dyes used in Example 8 for spectrally sensitizing the silver halide emulsions to those shown below, blue-sensitive and red-sensitive emulsions were prepared. The blue sensitive emulsions and red sensitive emulsions were respectively expressed by, for example, II-M-1b and II-M-1r, by use of "b" or "r" at the end.

Blue-sensitive dye IV for blue-sensitive emulsion

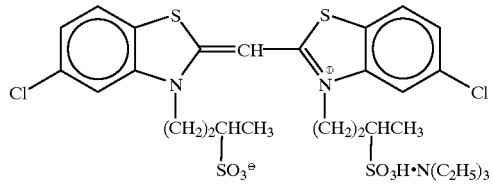

$6.0\times10^{-4}$ mol per mol of silver for each (-b) emulsion

Red-sensitive dye V for red-sensitive emulsion

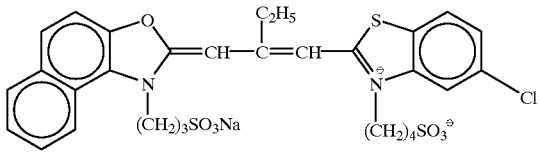

$3.5\times10^{-4}$ mol per mol of silver for each (-r) emulsion

Red-sensitive dye VI for red-sensitive emulsion

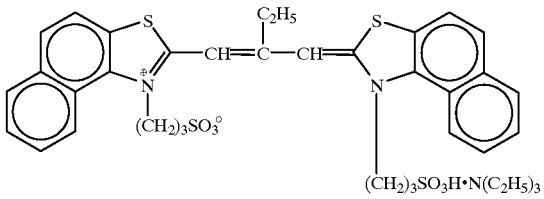

$1.6\times10^{-5}$ mol per mol of silver for each (-r) emulsion

Red-sensitive dye VII for red-sensitive emulsion

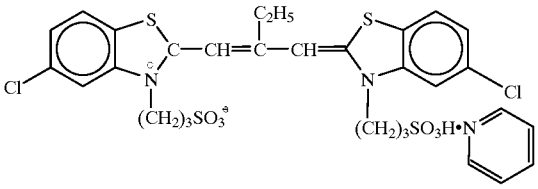

$5.1\times10^{-4}$ mol per mol of silver for each (-r) emulsion

Cyan and yellow coupler dispersions were prepared in accordance with the method for preparing the coupler dispersion in Example 8.

Cyan and yellow dye dispersions were also prepared in accordance with the method for preparing the coupler dispersion of the present invention described in Example 8. For comparison, there was prepared a colored dispersion product to be incorporated in a layer that constituted a colored layer capable of being decolorized during a heat development process. In this comparative coloring agent dispersion, the following yellow, magenta, and cyan leuco dues as wellas zinc complex were incorporated.

The obtained silver halide emulsions, coupler dispersions, and coloring agent dispersion were used to construct multilayerd, heat-developable color photographic light-sensitive materials II-211, II-213, II-214, II-223, and II-224.

The emulsions used in layers are shown in Table 25.

TABLE 24

| | | (Unit: mg/m$^2$) Samples (common) |
|---|---|---|
| Protective layer | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardening agent (i) | 91 |
| Intermediate layer | Lime-treated gelatin | 375 |
| | Surfactant (g) | 15 |
| | Zinc hydroxide | 1100 |
| | Water-soluble polymer (h) | 15 |
| Yellow dye forming layer | Lime-treated gelatin | 150 |
| | Emulsion (based on the amount | EM-1Y |
| | of coated silver) | 647 |
| | Yellow coupler (u) | 57 |
| | Developing agent (v) | 41 |
| | Ariti-fogging agent (w) | 4 |
| | High b.p. organic solvent (d) | 50 |
| | Surfactant (e) | 3 |
| | Water-soluble polymer (h) | 1 |
| Yellow dye forming layer | Lime-treated gelatin | 220 |
| | Emulsion (based on the amount | EM-2Y |
| | of coated silver) | 475 |
| | Yellow coupler (u) | 84 |
| | Developing agent (v) | 60 |
| | Anti-fogging agent (w) | 6 |
| | High b.p. organic solvent (d) | 74 |
| | Surfactant (e) | 4 |
| | Water-soluble polymer (h) | 2 |

| | | Samples II-211, II-213, II-214 | (Unit: mg/m$^2$) Samples II-223, II-224 |
|---|---|---|---|
| Yellow dye forming layer | Lime-treated gelatin | 1400 | 1400 |
| | Emulsion (based on the amount | EM-3Y | EM-3Y |
| | of coated silver) | 604 | 604 |
| | Yellow coupler (u) | 532 | 532 |
| | Developing agent (v) | 382 | 382 |
| | Anti-fogging agent (w) | 40 | 40 |
| | High b.p. organic solvent (d) | 469 | 469 |
| | Surfactant (e) | 23 | 23 |
| | Water-soluble polymer (h) | 10 | 10 |

TABLE 24-continued

| | | | |
|---|---|---|---|
| Intermediate layer | Lime-treated gelatin | 750 | 750 |
| | Surfactant (e) | 15 | 36 |
| | Leuco dye (x) | 303 | — |
| | Developing agent (y) | 433 | — |
| | Water-soluble polymer (h) | 15 | — |
| | High b.p. organic solvent (d) | — | 240 |
| | Yellow dye (A13) | — | 240 |
| Magenta dye forming layer | Lime-treated gelatin | 150 | 150 |
| | Emulsion (based on the amount of coated silver) | EM-1M 647 | EM-1M 647 |
| | Magenta coupler (a) | 48 | 48 |
| | Developing agent (b) | 33 | 33 |
| | Anti-fogging agent (c) | 0.02 | 0.02 |
| | High b.p. organic solvent (d) | 50 | 50 |
| | Surfactant (e) | 3 | 3 |
| | Water-soluble polymer (h) | 1 | 1 |
| Magenta dye forming layer | Lime-treated gelatin | 220 | 220 |
| | Emulsion (based on the amount of coated silver) | EM-2M 475 | EM-2M 475 |
| | Magenta coupler (a) | 70 | 70 |
| | Developing agent (b) | 49 | 49 |
| | Anti-fogging agent (c) | 0.02 | 0.02 |
| | High b.p. organic solvent (d) | 74 | 74 |
| | Surfactant (e) | 4 | 4 |
| | Water-soluble polymer (h) | 2 | 2 |
| Magenta dye forming layer | Lime-treated gelatin | 1400 | 1400 |
| | Emulsion (based on the amount of coated silver) | EM-3M 604 | EM-3M 604 |
| | Magenta coupler (a) | 446 | 446 |
| | Developing agent (b) | 311 | 311 |
| | Anti-fogging agent (c) | 0.14 | 0.14 |
| | High b.p. organic solvent (d) | 469 | 469 |
| | Surfactant (e) | 23 | 23 |
| | Water-soluble polymer (h) | 10 | 10 |
| Intermediate layer | Lime-treated gelatin | 900 | 900 |
| | Surfactant (e) | 15 | 36 |
| | Leuco dye (z) | 345 | — |
| | Developing agent (y) | 636 | — |
| | Zinc hydroxide | 1100 | — |
| | Water-soluble polymer (h) | 15 | — |
| | High b.p. organic solvent (d) | — | 280 |
| | Magenta dye (A10) | — | 280 |
| Cyan dye forming layer | Lime-treated gelatin | 150 | 150 |
| | Emulsion (based on the amount of coated silver) | EM-1C 647 | EM-1C 647 |
| | Cyan coupler (aa) | 65 | 65 |
| | Developing agent (b) | 33 | 33 |
| | Anti-fogging agent (c) | 0.03 | 0.03 |
| | High b.p. organic solvent (d) | 50 | 50 |
| | Surfactant (e) | 3 | 3 |
| | Water-soluble polymer (h) | 1 | 1 |
| Cyan dye forming layer | Lime-treated gelatin | 220 | 220 |
| | Emulsion (based on the amount of coated silver) | EM-2C 475 | EM-2C 475 |
| | Cyan coupler (aa) | 96 | 96 |
| | Developing agent (b) | 49 | 49 |
| | Anti-fogging agent (c) | 0.05 | 0.05 |
| | High b.p. organic solvent (d) | 74 | 74 |
| | Surfactant (e) | 4 | 4 |
| | Water-soluble polymer (h) | 2 | 2 |
| Cyan dye forming layer | Lime-treated gelatin | 1400 | 1400 |
| | Emulsion (based on the amount of coated silver) | EM-3C 604 | EM-3C 604 |
| | Cyan coupler (aa) | 610 | 610 |
| | Developing agent (b) | 311 | 311 |
| | Anti-fogging agent (c) | 0.32 | 0.32 |
| | High b.p. organic solvent (d) | 469 | 469 |
| | Surfactant (e) | 23 | 23 |
| | Water-soluble polymer (h) | 10 | 10 |
| Antihalation layer | Lime-treated gelatin | 750 | 750 |
| | Surfactant (e) | 15 | 30 |
| | Leuco dye (ab) | 243 | — |
| | Developing agent (y) | 425 | — |
| | Water-soluble polymer (h) | 15 | — |
| | High b.p. organic solvent (d) | — | 300 |
| | Cyan dye (A26) | — | 320 |
| | Transparent PET base (120 μm) | | |

Yellow coupler (u)

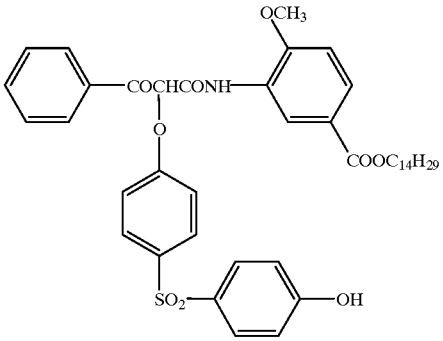

Developing agent (v)

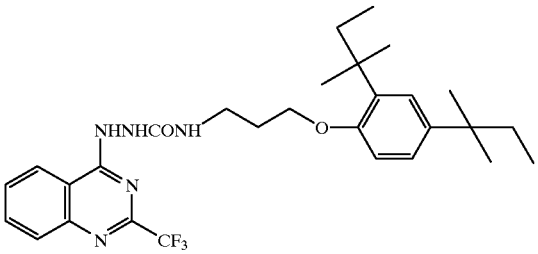

Antifogging agent (w)

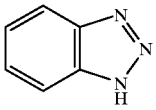

Cyan coupler (aa)

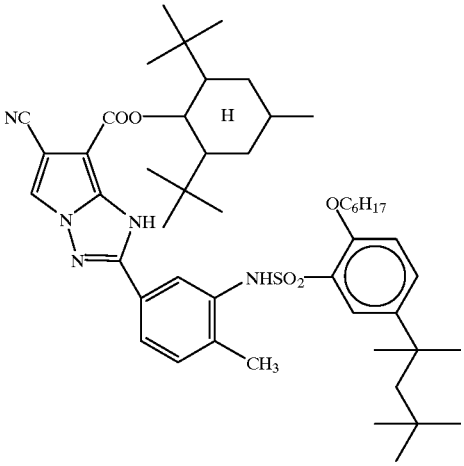

Leuco dye (ab)

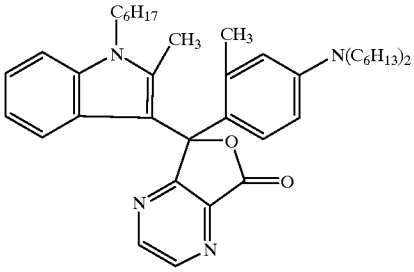

-continued

Yellow leuco dye (x)

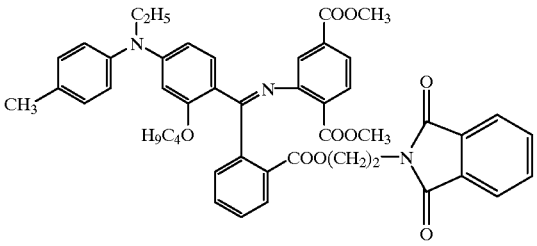

TABLE 25

| | Sample No. | | |
|---|---|---|---|
| Emulsion | II-211 | II-213, II-223 | II-214, II-224 |
| EM-1Y | II-M-1b | II-H-1b | II-B-1b |
| EM-2Y | II-M-2b | II-H-2b | II-B-2b |
| EM-3Y | II-M-3b | II-H-3b | II-B-3b |
| EM-1M | II-M-1g | II-H-1g | II-B-1g |
| EM-2M | II-M-2g | II-H-2g | II-B-2g |
| EM-3M | II-M-3g | II-H-3g | II-B-3g |
| EM-1C | II-M-1r | II-H-1r | II-B-1r |
| EM-2C | II-M-2r | II-H-2r | II-B-2r |
| EM-3C | II-M-3r | II-H-3r | II-B-3r |

The photographic characteristics of these light-sensitive materials were investigated as in Example 8. First, each of the light-sensitive materials were exposed to light through a blue, green, or red filter by use of an optical wedge (1,000 lux for 1/100 sec.).

Warm water (40° C., 16 ml/m$^2$) was applied to the surface of the exposed light-sensitive material, and this surface was attached to the surface of processing material II-P-1 in a face-to-face manner. Heat was applied thereto by use of a heat drum at 80° C. for 25 seconds (this period of time was from attaching to peeloing) for heat development. No fixing operation was performed. When the light-sensitive materials were peeled off after the heat developing step, samples exposed to light through blue filter, samples exposed to light through green filter, and samples exposed to light through red filter respectively afforded yellow-colored wedge-like images, magenta-colored wedge-like images, and cyan-colored wedge-like images. Color separation properties of green-sensitive layers and red-sensitive layers with respect to blue light were visually evaluated.

In addition, the maximum density of each of these samples was determined. No fixation procedure was performed. The results are shown in Table 26.

TABLE 26

| Sample No. | Emulsion | Characteristics of emulsions | Maximum density (not fixed) | Note |
|---|---|---|---|---|
| II-211 | II-M-1 | AgBrI plate | B2.72 | Comparative |
| | II-M-2 | (111) | G2.33 | Ex. |
| | II-M-3 | | R1.92 | |
| II-213 | II-H-1 | AgCl plate | B2.91 | Comparative |
| | II-H-2 | (100) | G2.47 | Ex. |
| | II-H-3 | | R2.07 | |
| II-214 | II-B-1 | AgCl plate | B2.87 | Comparative |
| | II-B-2 | (111) | G2.39 | Ex. |
| | II-B-3 | | R2.01 | |
| II-223 | II-H-1 | AgCl plate | B3.37 | Invention |
| | II-H-2 | (100) | G3.01 | |

TABLE 26-continued

| Sample No. | Emulsion | Characteristics of emulsions | Maximum density (not fixed) | Note |
|---|---|---|---|---|
| | II-H-3 | | R2.67 | |
| II-224 | II-B-1 | AgCl plate | B3.28 | Invention |
| | II-B-2 | (111) | G2.94 | |
| | II-B-3 | | R2.60 | |

Table 26 shows that the present invention provides excellent effects. That is, even when the color photographic light-sensitive material of the present invention is embodied to have a structure having three 0 layers, three M layers, and three U layers (in which 0, M, and U correspond to B light, G light, and R light, which in turn correspond to yellow, magenta, and cyan, respectively), a high maximum density was obtained as in Example 8. Also, when a color photographic material prepared as in the present Example using a blue-sensitive, green-sensitive, and red-sensitive layers was tested for color separation, excellent color separation was obtained with respect to blue light, confirming high quality of the product.

What is claimed is:

1. A heat-developable light-sensitive material comprising a support and having thereon a light-sensitive layer comprising silver halide grains and a binder wherein the heat-developable light-sensitive material further contains a decolorizable dye layer formed from a dispersion in which oil droplets formed by dissolving the dye in oil and/or oil soluble-polymer arc dispersed into a hydrophilic binder, wherein the dye is decolorized by the reaction with a decolorizing agent or a precursor thereof that is incorporated into the light-sensitive material in advance or incorporated into the light-sensitive material from a processing material in a heat development processing stage, and wherein the dye is non-diffusible and at least a part of the decolorized dye resulting from the heat development process is non-diffusible.

2. The heat-developable light-sensitive material according to claim 1, wherein the dyes have neither a carboxyl group nor a sulfo group in molecules thereof.

3. The heat-developable light-sensitive material according to any one of claims 1 to 2, wherein the dyes are represented by the following formulas (I) to (IV): Formula (I):

$$A51{=}L51{-}(L52{=}L53)_{m51}{-}Q51;$$

Formula (II):

$$A51{=}L51{-}(L52{=}L53)_{n51}{-}A52;$$

Formula (III):

$$A51({=}L51{-}L52)_{p51}{=}B51;$$

$$(NC)_2C{=}C(CN){-}Q51;$$

wherein "═" represents a double bond, and "—" represents a single bond; each of A51 and A52 represents an acidic nucleus, and B51 represents a basic nucleus; Q51 represents an aryl group or a heterocyclic group; each of L51, L52, and L53 represents a methine group; m51 represents 0, 1, or 2; each of n51 and p51 represents 0, 1, 2, or 3; when a plurality of L51, a plurality of L52, or a plurality of L53 are present in the molecule, members of each of L51, L52, and L53 may be identical to or different from one another; provided that compounds represented by formulas (I) to (IV) have no carboxyl group or no sulfo group, that compounds represented by formulas (I) to (IV) have a non-diffusion group, that resultant products after a development process (decolorization) are also non-diffusible and are substantially not eluted from a light-sensitive material, and that compounds represented by formulas (I) to (IV) do not have a group that initiates a redox reaction during the development process and subsequently undergoes bond cleavage to separate into a plurality of molecules.

4. The heat-developable light-sensitive material according to claim 3, wherein each of the acidic nuclei A51 and A52 is a cyclic ketomethylene compound or a compound having a methylene group interposed between electrophilic groups.

5. The heat-developable light-sensitive material according to claim 4, wherein the cyclic ketomethylene compound is 2-pyrazolin-5-one, rhodanine, hydantoin, thiohydantoin, 2,4-oxazolidinedione, isoxazolone, barbituric acid, thiobarbituric acid, indanedione, dioxopyrazolopyridine, hydroxypyridine, pyrazolidinedione, 2,5-dihydrofuran-2-one, or pyrrolin-2-one; and wherein the compound having a methylene group interposed between electrophilic groups is a group represented by $Z51{-}CH_2{-}Z52$, wherein each of Z51 and Z52 independently represents —CN, $-SO_2R51$, —COR51, —COOR51, $-CON(R52)_2$, $-SO_2N(R52)_2$, $C[{=}C(CN)_2]R51$, or $-C[C(CN)_2]N(R51)_2$; R51 represents an alkyl group, a cycloalkyl group, an arkyl group, or a heterocyclic group; R52 represents a hydrogen atom or groups listed for R51; each of R51 and R52 may have a substituent, and when there exist a plurality of R51 or a plurality of R52, they may be identical to or different from each other.

6. The heat-developable light-sensitive material according to claim 3, wherein the basic nucleus B51 is pyridine, quinoline, indolenine, oxazole, imidazole, thiazole, benzoxazole, benzoimidazole, benzothiazole, oxazoline, naphthoxazole, or pyrrole;

7. The heat-developable light-sensitive material according to claim 3, wherein the dye is represented by formula (I):

$$A51{=}L51{-}(L52{=}L53)_{m51}{-}Q51 \qquad (I)$$

wherein "═" represents a double bond and "—" represents a single bond; A51 represents an acidic nucleus, Q51 represents an aryl group or a heterocyclic group; each of L51, L52, and L53 represents a methine group; and m51 represents 0, 1, or 2; when a plurality of L52 or a plurality of L53 are present in the molecule, members of each of L52 and L53 may be identical to or different from one another; provided that the compound represented by formula (I) has neither a carboxyl group nor a sulfo group, that the compound represented by formula (I) has a non-diffusion group, and that the resultant product after the development process (decolorization) is also non-diffusible and is substantially not eluted from the light-sensitive material.

8. A heat-developable light-sensitive material according to claim 3, wherein each of the acidic nuclei A51 and A52 is a cyclic ketomethylene compound.

9. The heat-developable light-sensitive material according to claim 1, wherein at least one light-sensitive layer contains a binder, and a compound which undergo a coupling reaction with light-sensitive silver halide grains and an oxidation product of a developing agent to thereby form a dye; and wherein after exposure, the light-sensitive layer surface of the heat-developable light-sensitive material is adhered to the processing layer surface of a processing material containing a decolorizing agent or a precursor thereof, followed by heat development to form color images, wherein at least one light-sensitive layer contains:

i) an emulsion containing silver halide grains comprised of at least 50 mol % silver chloride, wherein tabular grains having (100) major faces account for at least 50% of the projected area, each grain having a rectangular projected area of an adjacent edge ratio of 1:1 to 1:2 and an aspect ratio of at least 2, or ii) an emulsion containing silver halide grains comprised of at least 50 mol % silver chloride, wherein tabular grains having (111) major faces account for at least 50% of the projected area, each grain having a hexagonal projected area of an adjacent edge ratio of 1:1 to 1:10 and an aspect ratio of at least 2.

10. The heat-developable light-sensitive material according to claim 9, wherein the dye decolorizes during a development process and is represented by the following formulas (I) to (IV):

Formula (I):

$$A51{=}L51{-}(L52{=}L53)_{m51}{-}Q51;$$

Formula (II):

$$A51{=}L51{-}(L52{=}L53)_{n51}{-}A52;$$

Formula (III):

$$AS1({=}L51{-}L52)_{p51}{=}B51;$$

Formula (IV):

$$(NC)_2C{=}C(CN){-}Q51;$$

wherein "=" represents a double bond, and "—" represents a single bond; each of A51 and A52 represents an acidic nucleus, and B51 represents a basic nucleus; Q51 represents an aryl group or a heterocyclic group; each of L51, L52, and L53 represents a methine group; m51 represents 0, 1, or 2; each of n51 and p51 represents 0, 1, 2, or 3; when a plurality of L51, a plurality of L52, or a plurality of L53 are present in the molecule, members of each of L51, L52, and L53 may be identical to or different from one another; provided that compounds represented by formulas (I) to (IV) have neither a carboxyl group nor a sulfo group, that compounds represented by formulas (I) to (IV) have a non-diffusion group, and that resultant products after the development process (decolorization) are also non-diffusible and are substantially not eluted from the light-sensitive material.

11. The heat-developable light-sensitive material according to claim 1, wherein the light-sensitive layer of the heat-developable light-sensitive material contains a developing agent, and the processing layer of a processing material contains a base and/or base precursor (may be identical to or different from a decolorizing agent or a precursor thereof), and wherein the light-sensitive layer surface of the heat-developable light-sensitive material is adhered to the processing layer surface of the processing material with water being applied to the light-sensitive layer surface and/or the processing layer surface, followed by heat development.

12. The heat-developable light-sensitive material according to claim 1, wherein the light-sensitive layer contains a developing agent and a coupler.

13. The heat-developable light-sensitive material according to claim 1, wherein the dyes are contained in an amount of 0.005 to 2 mmol per square meter of the heat-developable light-sensitive material.

14. The heat-developable light-sensitive material according to claim 1, wherein a decolorizing agent or a precursor thereof is contained at 0.1 to 200 times the amount of the dyes contained.

15. A method of forming images, comprising the steps of: allowing face-to-face adhesion to occur between the heat-developable light-sensitive material as described in claim 1 and a processing material containing a decolorizing agent or a precursor thereof in the presence of water after or at the same time that the heat-developable light-sensitive material is given an image-forming exposure; applying heat to the adhered heat-developable light-sensitive material and processing material; and subsequently separating the heat-developable light-sensitive material from the processing material, thereby obtaining images on the heat-developable light-sensitive material and effecting decolorization of dyes.

* * * * *

UNITED STATES PATENT AND TRADEMARK OFFICE

CERTIFICATE OF CORRECTION

PATENT NO. : 6,051,359 
DATED : April 18, 2000
INVENTOR(S) : Atsuhiro Ohkawa, Takaizawa, Hiroo, Ishikawa, Shun-ichi, Yokokawa, Takuya It is certified that error appears in the above-identified patent and that said Letters Patent is hereby corrected as shown below:

Title page,
Item [56] References Cited, under U.S. PATENT DOCUMENTS, insert the following U.S. patents:

| | | | |
|---|---|---|---|
| 5,558,973 | 9/1996 | Yamada..... | 430/203 |
| 5,834,173 | 11/1998 | Helber et al..... | 430/522 |
| 5,441,859 | 8/1995 | Yabuki et al..... | 430/522 |

Signed and Sealed this

Ninth Day of October, 2001

*Attest:*

Nicholas P. Godici

*Attesting Officer*

NICHOLAS P. GODICI
*Acting Director of the United States Patent and Trademark Office*